US009786995B2

(12) United States Patent
Kirino et al.

(10) Patent No.: US 9,786,995 B2
(45) Date of Patent: Oct. 10, 2017

(54) SLOT ARRAY ANTENNA

(71) Applicants: NIDEC ELESYS CORPORATION, Kawasaki-shi, Kanagawa (JP); WGR Co., Ltd., Shimogyo-ku, Kyoto (JP)

(72) Inventors: Hideki Kirino, Kyoto (JP); Hiroyuki Kamo, Kawasaki (JP)

(73) Assignees: NIDEC ELESYS CORPORATION, Kanagawa (JP); WGR CO., LTD., Kyoto (JP)

( * ) Notice: Subject to any disclaimer, the term of this patent is extended or adjusted under 35 U.S.C. 154(b) by 0 days.

(21) Appl. No.: 15/461,552

(22) Filed: Mar. 17, 2017

(65) Prior Publication Data

US 2017/0187124 A1 Jun. 29, 2017

Related U.S. Application Data

(63) Continuation of application No. PCT/JP2016/083622, filed on Nov. 4, 2016.

(30) Foreign Application Priority Data

Nov. 5, 2015 (JP) ..... 2015-217657
Sep. 7, 2016 (JP) ..... 2016-174841

(51) Int. Cl.
*H01Q 13/10* (2006.01)
*H01Q 21/06* (2006.01)
(Continued)

(52) U.S. Cl.
CPC ..... *H01Q 21/064* (2013.01); *H01Q 1/3266* (2013.01); *H01Q 13/06* (2013.01); *H01Q 13/10* (2013.01)

(58) Field of Classification Search
CPC .... H01C 21/064; H01C 1/3266; H01C 13/06; H01C 13/10
See application file for complete search history.

(56) References Cited

U.S. PATENT DOCUMENTS 6,191,704 B1 2/2001 Takenaga et al.
6,339,395 B1 1/2002 Hazumi et al.
(Continued)

FOREIGN PATENT DOCUMENTS

EP 1 331 688 A1 7/2003
JP 2001-267838 A 9/2001
(Continued)

OTHER PUBLICATIONS

Kirino et al., "A 76 GHz Multi-Layered Phased Array Antenna Using a Non-Metal Contact Metamaterial Waveguide", IEEE Transactions on Antennas and Propagation, vol. 60, No. 2, Feb. 2012, pp. 840-853.
(Continued)

*Primary Examiner* — Dameon E Levi
*Assistant Examiner* — David Lotter
(74) *Attorney, Agent, or Firm* — Keating & Bennett, LLP

(57) ABSTRACT

A slot array antenna includes: an electrically conductive member having an electrically conductive surface and slots therein, the slots being arrayed in a first direction which extends along the conductive surface; a waveguide member having an electrically conductive waveguide face which opposes the slots and extends along the first direction; and an artificial magnetic conductor extending on both sides of the waveguide member. At least one of the conductive member and the waveguide member includes dents on the conductive surface and/or the waveguide face, the dents each serving to broaden a spacing between the conductive surface and the waveguide face relative to any adjacent site. The dents include a first, second, and third dents which are adjacent to one another and consecutively follow along the first direction. A distance between centers of the first and second dents is different from a distance between centers of the second and third dents.

19 Claims, 55 Drawing Sheets

(51) Int. Cl.
*H01Q 13/06* (2006.01)
*H01Q 1/32* (2006.01)

(56) References Cited

U.S. PATENT DOCUMENTS

| | | | | |
|---|---|---|---|---|
| 6,403,942 | B1 | 6/2002 | Stam | |
| 6,611,610 | B1 | 8/2003 | Stam et al. | |
| 6,628,299 | B2 | 9/2003 | Kitayama | |
| 6,661,367 | B2 | 12/2003 | Sugiyama et al. | |
| 6,703,967 | B1 | 3/2004 | Kuroda et al. | |
| 6,903,677 | B2 | 6/2005 | Takashima et al. | |
| 6,943,726 | B2 | 9/2005 | Schneider | |
| 7,161,561 | B2 | 1/2007 | Kitayama | |
| 7,355,524 | B2 | 4/2008 | Schofield | |
| 7,358,889 | B2 | 4/2008 | Abe et al. | |
| 7,417,580 | B2 | 8/2008 | Abe et al. | |
| 7,420,159 | B2 | 9/2008 | Heslin et al. | |
| 7,425,983 | B2 | 9/2008 | Izumi et al. | |
| 7,570,198 | B2 | 8/2009 | Tokoro | |
| 7,978,122 | B2 | 7/2011 | Schmidlin | |
| 8,068,134 | B2 | 11/2011 | Yoshizawa | |
| 8,446,312 | B2 | 5/2013 | Kanamoto et al. | |
| 8,543,277 | B2 | 9/2013 | Higgins-Luthman | |
| 8,593,521 | B2 | 11/2013 | Schofield et al. | |
| 8,604,968 | B2 | 12/2013 | Alland et al. | |
| 8,610,620 | B2 | 12/2013 | Katoh | |
| 8,614,640 | B2 | 12/2013 | Lynam | |
| 8,636,393 | B2 | 1/2014 | Schofield | |
| 8,730,096 | B2 | 5/2014 | Kanamoto et al. | |
| 8,730,099 | B2 | 5/2014 | Kanamoto et al. | |
| 8,803,638 | B2 | 8/2014 | Kildal | |
| 8,861,842 | B2 | 10/2014 | Jung et al. | |
| 9,286,524 | B1 | 3/2016 | Mei et al. | |
| 2011/0187614 | A1 | 8/2011 | Kirino et al. | |
| 2012/0092224 | A1 | 4/2012 | Sauleau et al. | |
| 2013/0033404 | A1 | 2/2013 | Abe | |
| 2014/0097995 | A1* | 4/2014 | McKinzie, III | H01Q 9/0407 343/793 |
| 2015/0222021 | A1* | 8/2015 | Stevenson | H01Q 13/18 343/771 |
| 2015/0264230 | A1 | 9/2015 | Takeda | |
| 2016/0126637 | A1* | 5/2016 | Uemichi | H01Q 21/0043 343/771 |
| 2016/0140424 | A1 | 5/2016 | Wang et al. | |
| 2016/0264065 | A1 | 9/2016 | Takeda | |

FOREIGN PATENT DOCUMENTS

| | | | |
|---|---|---|---|
| JP | 2004-257848 | A | 9/2004 |
| JP | 2007-259047 | A | 10/2007 |
| JP | 2010-021828 | A | 1/2010 |
| JP | 2012-004700 | A | 1/2012 |
| JP | 2012-523149 | A | 9/2012 |
| JP | 2013-032979 | A | 2/2013 |
| WO | 01/67540 | A1 | 9/2001 |
| WO | 2008/081807 | A1 | 7/2008 |
| WO | 2010/003808 | A2 | 1/2010 |
| WO | 2010/050122 | A1 | 5/2010 |
| WO | 2015/172948 | A2 | 11/2015 |

OTHER PUBLICATIONS

Zaman et al., "Ku Band Linear Slot-Array in Ridge Gapwaveguide Technolgy", 7th European Conference on Antennas and Propagation (EUCAP 2013)—Convened Sessions, 2013, pp. 2968-2971.

Kildal et al., "Local Metamaterial-Based Waveguides in Gaps Between Parallel Metal Plates", IEEE Antennas and Wireless Propagation Letters, vol. 8, 2009, pp. 84-87.

Pucci et al., "Design of a Dual-Mode Horn Element for Microstrip Gap Waveguide Fed Array", 7th European Conference on Antennas and Propagation (EUCAP 2013)—Convened Sessions, 2013, pp. 2976-2979.

Kildal, "Metasurting Since 1987—A Personal Story Involving Soft and Hard Surfaces, EBG Surfaces, Cloaking, Gap Waveguides and Mass Production", 2014 IEEE Antennas and Propagation Society International Symposium, 2014, pp. 529-530.

Sehm et al., "A High-Gain 58-GHz Box-Horn Array Antenna with Suppressed Grating Lobes", IEEE Transactions on Antennas and Propagation, vol. 47, No. 7, Jul. 1999, pp. 1125-1130.

Official Communication issued in International Patent Application No. PCT/JP2016/083622, mailed on Dec. 6, 2016.

* cited by examiner $$\frac{Rs}{Zo}=2,\quad \omega CZo=0.05\pi,\quad \frac{\omega L}{Zo}=1.2\pi,\quad d=\frac{\lambda_g}{9}$$

$$\frac{Rs}{Zo}=2,\quad \frac{\omega L_1}{Zo}=0.5\pi,\quad \frac{\omega L_2}{Zo}=0.12\pi,\quad d_1=\frac{\lambda_g}{2.25},\quad d_2=\frac{\lambda_g}{9}$$

$$\frac{Rs}{Zo} = 2, \quad \omega C_1 Zo = 0.085\pi, \quad \omega C_2 Zo = 0.1785\pi, \quad d_3 = \frac{\lambda_g}{0.53}$$

SLOT ARRAY ANTENNA

This is a continuation of International Application No. PCT/JP2016/083622, with an international filing date of Nov. 4, 2016, which claims priority of Japanese Patent Application No. 2015-217657 filed Nov. 5, 2015, and Japanese Patent Application No. 2016-174841 filed Sep. 7, 2016, the entire contents of which are hereby incorporated by reference.

BACKGROUND

1. Technical Field

The present disclosure relates to a slot array antenna.

2. Description of the Related Art

An array antenna including a plurality of antenna elements (hereinafter also referred to "radiating elements") that are arrayed on a line or a plane finds its use in various applications, e.g., radar and communication systems. In order to radiate electromagnetic waves from an array antenna, it is necessary to supply electromagnetic waves (e.g., radio-frequency signal waves) to each antenna element, from a circuit which generates electromagnetic waves ("feed"). Such feed is performed via a waveguide. A waveguide is also used to send electromagnetic waves that are received at the antenna elements to a reception circuit.

Conventionally, feed to an array antenna has often been achieved by using a microstrip line(s). However, in the case where the frequency of an electromagnetic wave to be transmitted or received by an array antenna is a high frequency, e.g., above 30 gigahertz (GHz), a microstrip line will incur a large dielectric loss, thus detracting from the efficiency of the antenna. Therefore, in such a radio frequency region, an alternative waveguide to replace a microstrip line is needed.

It is known that using a hollow waveguide, instead of a microstrip line, to feed each antenna element allows the loss to be reduced even in frequency regions exceeding 30 GHz. A hollow waveguide, also known as a hollow metallic waveguide, is a metal body having a circular or rectangular cross section. In the interior of a hollow waveguide, an electromagnetic field mode which is adapted to the shape and size of the body is created. For this reason, an electromagnetic wave is able to propagate within the body in a certain electromagnetic field mode. Since the body interior is hollow, no dielectric loss problem occurs even if the frequency of the electromagnetic wave to propagate increases. However, by using a hollow waveguide, it is difficult to dispose antenna elements with a high density, because the hollow portion of a hollow waveguide needs to have a width which is equal to or greater than a half wavelength of the electromagnetic wave to be propagated, and the body (metal wall) of the hollow waveguide itself also needs to be thick enough.

Patent Documents 1 to 3, and Non-Patent Documents 1 and 2 disclose waveguiding structures which guide electromagnetic waves by utilizing an artificial magnetic conductor (AMC) extending on both sides of a ridge-type waveguide.

[Patent Document 1] International Publication No. 2010/050122

[Patent Document 2] the specification of U.S. Pat. No. 8,803,638

[Patent Document 3] European Patent Application Publication No. 1331688

[Non-Patent Document 1] Kirino et al., "A 76 GHz Multi-Layered Phased Array Antenna Using a Non-Metal Contact Metamaterial Waveguide", IEEE Transaction on Antennas and Propagation, Vol. 60, No. 2, February 2012, pp 840-853

[Non-Patent Document 2] Kildal et al., "Local Metamaterial-Based Waveguides in Gaps Between Parallel Metal Plates", IEEE Antennas and Wireless Propagation Letters, Vol. 8, 2009, pp 84-87

SUMMARY

One of the inventors of the present application has arrived at the concept of constructing an antenna array by using a ridge-type waveguide which utilizes an artificial magnetic conductor, which was then disclosed in Patent Document 1. However, this slot array antenna was not able to allow a plurality of antenna elements to perform a proper radiation that is adapted to the purpose. An embodiment of the present disclosure provides a slot array antenna which includes a waveguide structure to replace a conventional microstrip line or hollow waveguide, and which allows a plurality of antenna elements to perform a proper radiation that is adapted to the purpose.

A slot array antenna according to one aspect of the present disclosure includes: an electrically conductive member having an electrically conductive surface and a plurality of slots therein, the plurality of slots being arrayed in a first direction which extends along the electrically conductive surface; a waveguide member having an electrically conductive waveguide face which opposes the plurality of slots and extends along the first direction; and an artificial magnetic conductor extending on both sides of the waveguide member. At least one of the electrically conductive member and the waveguide member includes a plurality of bumps on the electrically conductive surface and/or the waveguide face, the plurality of bumps each serving to narrow a spacing between the electrically conductive surface and the waveguide face relative to any adjacent site. The plurality of bumps include a first bump, a second bump, and a third bump which are adjacent to one another and consecutively follow along the first direction. A distance between centers of the first bump and the second bump is different from a distance between centers of the second bump and the third bump.

A slot array antenna according to another aspect of the present disclosure includes: an electrically conductive member having an electrically conductive surface and a plurality of slots therein, the plurality of slots being arrayed in a first direction which extends along the electrically conductive surface; a waveguide member having an electrically conductive waveguide face which opposes the plurality of slots and extends along the first direction; and an artificial magnetic conductor extending on both sides of the waveguide member. At least one of the electrically conductive member and the waveguide member includes a plurality of dents on the electrically conductive surface and/or the waveguide face, the plurality of dents each serving to broaden a spacing between the electrically conductive surface and the waveguide face relative to any adjacent site. The plurality of dents include a first dent, a second dent, and a third dent which are adjacent to one another and consecutively follow along the first direction. A distance between centers of the first dent and the second dent is different from a distance between centers of the second dent and the third dent.

A slot array antenna according to still another aspect of the present disclosure includes: an electrically conductive member having an electrically conductive surface and a plurality of slots therein, the plurality of slots being arrayed in a first direction which extends along the electrically conductive surface; a waveguide member having an electrically conductive waveguide face which opposes the plurality of slots and extends along the first direction; and an artificial magnetic conductor extending on both sides of the waveguide member. The waveguide member includes a plurality of broad portions on the waveguide face, the plurality of broad portions each serving to broaden width of the waveguide face relative to any adjacent site. The plurality of broad portions include a first broad portion, a second broad portion, and a third broad portion which are adjacent to one another and consecutively follow along the first direction. A distance between centers of the first broad portion and the second broad portion is different from a distance between centers of the second broad portion and the third broad portion.

A slot array antenna according to still another aspect of the present disclosure includes: an electrically conductive member having an electrically conductive surface and a plurality of slots therein, the plurality of slots being arrayed in a first direction which extends along the electrically conductive surface; a waveguide member having an electrically conductive waveguide face which opposes the plurality of slots and extends along the first direction; and an artificial magnetic conductor extending on both sides of the waveguide member. The waveguide member includes a plurality of narrow portions on the waveguide face, the plurality of narrow portions each serving to narrow width of the waveguide face relative to any adjacent site. The plurality of narrow portions include a first narrow portion, a second narrow portion, and a third narrow portion which are adjacent to one another and consecutively follow along the first direction. A distance between centers of the first narrow portion and the second narrow portion is different from a distance between centers of the second narrow portion and the third narrow portion.

A slot array antenna according to still another aspect of the present disclosure includes: an electrically conductive member having an electrically conductive surface and a plurality of slots therein, the plurality of slots being arrayed in a first direction which extends along the electrically conductive surface; a waveguide member having an electrically conductive waveguide face which opposes the plurality of slots and extends along the first direction; and an artificial magnetic conductor extending on both sides of the waveguide member. A waveguide extending between the electrically conductive surface and the waveguide face includes a plurality of positions at which capacitance of the waveguide exhibits a local maximum or a local minimum. The plurality of positions include a first position, a second position, and a third position which are adjacent to one another and consecutively follow along the first direction. A distance between centers of the first position and the second position is different from a distance between centers of the second position and the third position.

A slot array antenna according to still another aspect of the present disclosure includes: an electrically conductive member having an electrically conductive surface and a plurality of slots therein, the plurality of slots being arrayed in a first direction which extends along the electrically conductive surface; a waveguide member having an electrically conductive waveguide face which opposes the plurality of slots and extends along the first direction; and an artificial magnetic conductor extending on both sides of the waveguide member. A waveguide extending between the electrically conductive surface and the waveguide face includes a plurality of positions at which inductance of the waveguide exhibits a local maximum or a local minimum. The plurality of positions include a first position, a second position, and a third position which are adjacent to one another and consecutively follow along the first direction. A distance between centers of the first position and the second position is different from a distance between centers of the second position and the third position.

A slot array antenna according to still another aspect of the present disclosure is for use in at least one of transmission and reception of an electromagnetic wave of a band having a central wavelength $\lambda o$ in free space. The slot array antenna includes: an electrically conductive member having an electrically conductive surface and a slot row including a plurality of slots, the plurality of slots being arrayed in a first direction which extends along the electrically conductive surface; a waveguide member having an electrically conductive waveguide face which opposes the plurality of slots and extends along the first direction; and an artificial magnetic conductor extending on both sides of the waveguide member. A width of the waveguide face is less than $\lambda o/2$. A waveguide extending between the electrically conductive surface and the waveguide face includes at least one minimal position at which at least one of inductance and capacitance of the waveguide exhibits a local minimum and at least one maximal position at which at least one of inductance and capacitance of the waveguide exhibits a local maximum, the at least one minimal position and the at least one maximal position being arrayed along the first direction. The at least one minimal position includes a first type of minimal position which is adjacent to the maximal position while being more distant therefrom than $1.15\lambda o/8$.

A slot array antenna according to still another aspect of the present disclosure is for use in at least one of transmission and reception of an electromagnetic wave of a band having a central wavelength $\lambda o$ in free space. The slot array antenna includes: an electrically conductive member having an electrically conductive surface and a slot row including a plurality of slots, the plurality of slots being arrayed in a first direction which extends along the electrically conductive surface; a waveguide member having an electrically conductive waveguide face which opposes the plurality of slots and extends along the first direction; and an artificial magnetic conductor extending on both sides of the waveguide member. A width of the waveguide face is less than $\lambda o/2$. At least one of the electrically conductive member and the waveguide member includes a plurality of additional elements on at least one of the electrically conductive surface and the waveguide face. The plurality of additional elements include at least one first type of additional element and/or at least one second type of additional element. The at least one first type of additional element is a bump being provided on either the electrically conductive surface or the waveguide face and serving to narrow a spacing between the electrically conductive surface and the waveguide face relative to any adjacent site, or a broad portion serving to broaden the width of the waveguide face relative to any adjacent site. The at least one second type of additional element is a dent being provided on either the electrically conductive surface or the waveguide face and serving to broaden the spacing between the electrically conductive surface and the waveguide face relative to any adjacent site, or a narrow portion serving to narrow the width of the waveguide face relative to any adjacent site. (a) The at least one first type of additional element is adjacent along the first direction to the at least one second type of additional element or at least one neutral portion lacking the at least one additional element, and a central position of the at least one first type of additional element is more distant than $1.15\lambda o/8$ along the first direction from a central position of the at least one second type of additional element or the at least one neutral portion; or (b) the at least one second type of additional element is adjacent along the first direction to the at least one first type of additional element or at least one neutral portion lacking the at least one additional element, and a central position of the at least one first type of additional element is more distant than 1.15λo/8 along the first direction from a central position of the at least one second type of additional element or the at least one neutral portion.

A slot array antenna according to still another aspect of the present disclosure is for use in at least one of transmission and reception of an electromagnetic wave of a band having a central wavelength λo in free space. The slot array antenna includes: an electrically conductive member having an electrically conductive surface and a slot row including a plurality of slots, the plurality of slots being arrayed in a first direction which extends along the electrically conductive surface; a waveguide member having an electrically conductive waveguide face which opposes the plurality of slots and extends along the first direction; and an artificial magnetic conductor extending on both sides of the waveguide member. A width of the waveguide face is less than λo/2. At least one of the electrically conductive member and the waveguide member includes a plurality of additional elements on at least one of the electrically conductive surface and the waveguide face. The plurality of additional elements include at least one third type of additional element and/or at least one fourth type of additional element. The at least one third type of additional element is a bump being provided on either the electrically conductive surface or the waveguide face and serving to narrow a spacing between the electrically conductive surface and the waveguide face relative to any adjacent site, the width of the waveguide being narrowed at the bump relative to any adjacent site. The at least one fourth type of additional element is a dent being provided on either the electrically conductive surface or the waveguide face and serving to broaden the spacing between the electrically conductive surface and the waveguide face relative to any adjacent site, the width of the waveguide being broadened at the bump relative to any adjacent site. (c) The at least one third type of additional element is adjacent along the first direction to the at least one fourth type of additional element or at least one neutral portion lacking the at least one additional element, and a central position of the at least one third type of additional element is more distant than 1.15λo/8 along the first direction from a central position of the at least one fourth type of additional element or the at least one neutral portion; or (d) the at least one fourth type of additional element is adjacent along the first direction to the at least one third type of additional element or at least one neutral portion lacking the at least one additional element, and a central position of the at least one fourth type of additional element is more distant than 1.15λo/8 along the first direction from a central position of the at least one third type of additional element or the at least one neutral portion.

A slot array antenna according to still another aspect of the present disclosure includes: an electrically conductive member having an electrically conductive surface and a plurality of slots therein, the plurality of slots being arrayed in a first direction which extends along the electrically conductive surface; a waveguide member having an electrically conductive waveguide face which opposes the plurality of slots and extends along the first direction; and an artificial magnetic conductor extending on both sides of the waveguide member. At least one of a spacing between the electrically conductive surface and the waveguide face and a width of the waveguide face fluctuates along the first direction with a period which is equal to or greater than ½ of a distance between centers of two adjacent slots among the plurality of slots.

A slot array antenna according to still another aspect of the present disclosure is for use in at least one of transmission and reception of an electromagnetic wave of a band having a central wavelength λo in free space. The slot array antenna includes: an electrically conductive member having an electrically conductive surface and a plurality of slots therein, the plurality of slots being arrayed in a first direction which extends along the electrically conductive surface; a waveguide member having an electrically conductive waveguide face which opposes the plurality of slots and extends along the first direction; and an artificial magnetic conductor extending on both sides of the waveguide member. A width of the waveguide face is less than λo. At least one of a spacing between the electrically conductive surface and the waveguide face and the width of the waveguide face fluctuates along the first direction with a period which is longer than 1.15λo/4.

A slot array antenna according to still another aspect of the present disclosure is for use in at least one of transmission and reception of an electromagnetic wave of a band having a central wavelength λo in free space. The slot array antenna includes: an electrically conductive member having an electrically conductive surface and a plurality of slots therein, the plurality of slots being arrayed in a first direction which extends along the electrically conductive surface; a waveguide member having an electrically conductive waveguide face which opposes the plurality of slots and extends along the first direction; and an artificial magnetic conductor extending on both sides of the waveguide member. A width of the waveguide face is less than λo. At least one of the electrically conductive member and the waveguide member includes a plurality of additional elements on the waveguide face or the electrically conductive surface, the plurality of additional elements changing at least one of a spacing between the electrically conductive surface and the waveguide face and the width of the waveguide face relative to any adjacent site. At least one of the spacing between the electrically conductive surface and the waveguide face and the width of the waveguide face fluctuates along the first directions with a period which is longer than $\lambda_R/4$, where $\lambda_R$ is a wavelength of an electromagnetic wave of the wavelength λo when propagating in a waveguide lacking the plurality of additional elements, the waveguide extending between the electrically conductive member and the waveguide member.

A slot array antenna according to still another aspect of the present disclosure includes: an electrically conductive member having an electrically conductive surface and a plurality of slots therein, the plurality of slots being arrayed in a first direction which extends along the electrically conductive surface; a waveguide member having an electrically conductive waveguide face which opposes the plurality of slots and extends along the first direction; and an artificial magnetic conductor extending on both sides of the waveguide member. At least one of capacitance and inductance of a waveguide extending between the electrically conductive surface and the waveguide face fluctuates along the first direction with a period which is equal to or greater than ½ of a distance between centers of two adjacent slots among the plurality of slots.

A slot array antenna according to still another aspect of the present disclosure includes: an electrically conductive member having an electrically conductive surface and a plurality of slots therein, the plurality of slots being arrayed in a first direction which extends along the electrically conductive surface; a waveguide member having an electrically conductive waveguide face which opposes the plurality of slots and extends along the first direction; and an artificial magnetic conductor extending on both sides of the waveguide member. A spacing between the electrically conductive surface and the waveguide face fluctuates along the first direction. A waveguide extending between the electrically conductive member and the waveguide member has at least three places with mutually varying spacing between the electrically conductive surface and the waveguide face.

A slot array antenna according to still another aspect of the present disclosure includes: an electrically conductive member having an electrically conductive surface and a plurality of slots therein, the plurality of slots being arrayed in a first direction which extends along the electrically conductive surface; a waveguide member having an electrically conductive waveguide face which opposes the plurality of slots and extends along the first direction; and an artificial magnetic conductor extending on both sides of the waveguide member. A width of the waveguide face fluctuates along the first direction. The waveguide face has at least three places with mutually varying width of the waveguide face.

These general and specific aspects may be implemented using a system, a method, and a computer program, and any combination of systems, methods, and computer programs.

Additional benefits and advantages of the disclosed embodiments will be apparent from the specification and Figures. The benefits and/or advantages may be individually provided by the various embodiments and features of the specification and drawings disclosure, and need not all be provided in order to obtain one or more of the same.

In accordance with an embodiment of the present disclosure, the phase of an electromagnetic wave propagating in a waveguide can be adjusted, whereby a desired excitation state can be realized at the position of each antenna element. This allows a plurality of antenna elements to perform a proper radiation that is adapted to the purpose.

DETAILED DESCRIPTION

<Findings Forming the Basis of the Present Disclosure>

Prior to describing embodiments of the present disclosure, findings that form the basis of the present disclosure will be described.

For applications in which thinness is required of an antenna and a waveguide (e.g., onboard millimeter wave radar applications), those array antennas which allow themselves to be thin are broadly adopted. Gain and directivity characteristics are the performance factors that are required of an array antenna. Gain determines a detection range of a radar. Directivity characteristics determines a region of detection, angular resolution, and degree of image suppression. To each antenna element (radiating element) of an array antenna, a signal wave (e.g., a signal wave of a radio frequency) is supplied via a feeding network. The method of supplying a signal wave differs depending on the performance that is required of the array antenna. For example, when maximization of gain is desired, an approach (hereinafter referred to as "standing-wave series feed") may be taken in which a standing wave is created on a feeding network, and a radio frequency signal is supplied to antenna elements which are inserted in series to the feeding network.

A ridge waveguide which is disclosed in the aforementioned Patent Document 1 and Non-Patent Document 1 is provided in a waffle iron structure which is capable of functioning as an artificial magnetic conductor. A ridge waveguide in which such an artificial magnetic conductor is utilized based on the present disclosure (which hereinafter may be referred to as a WRG: Waffle-iron Ridge wave-Guide) is able to realize an antenna feeding network with low losses in the microwave or the millimeter wave band. Moreover, use of such a ridge waveguide allows antenna elements to be disposed with a high density.

Figure 1:
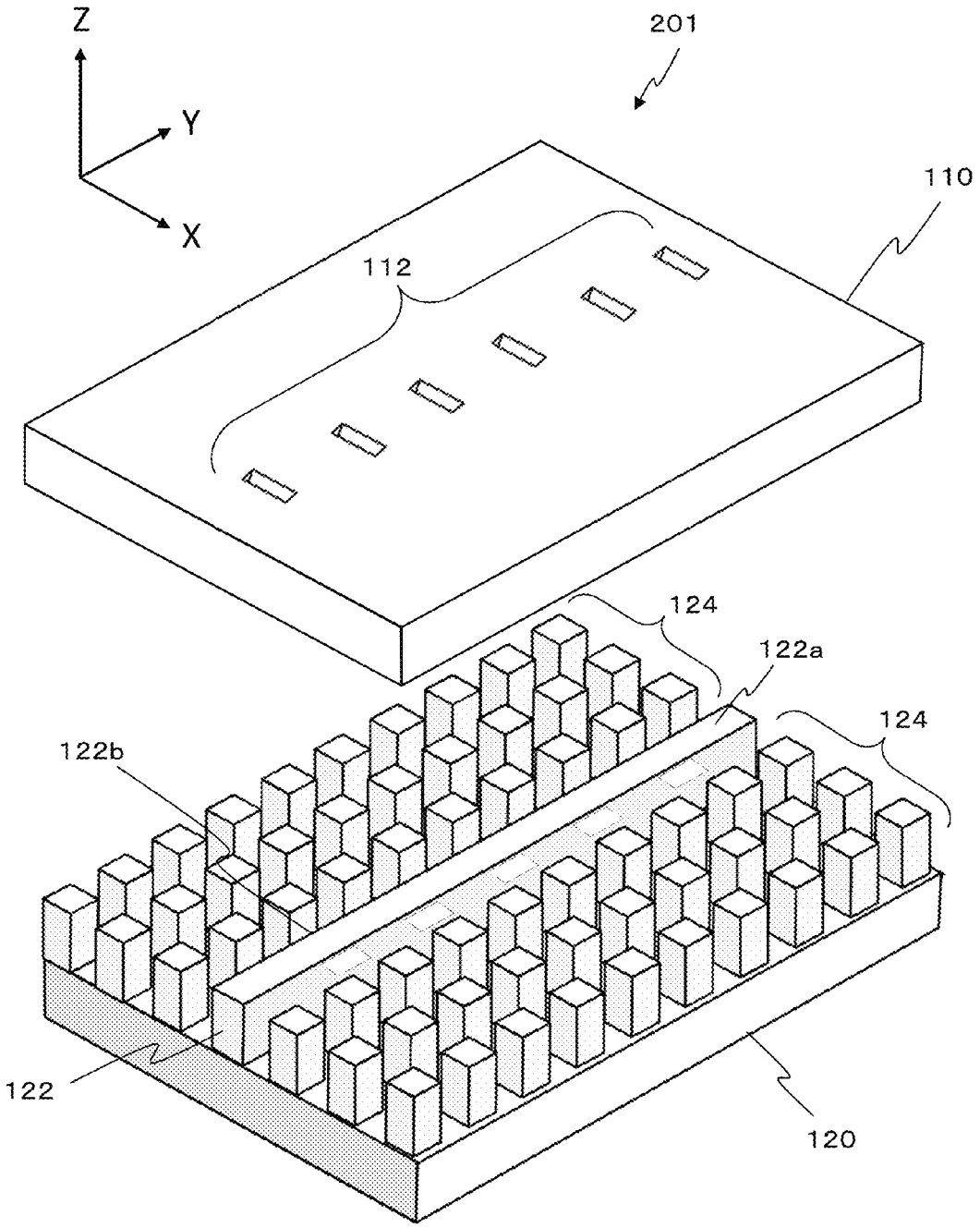
FIG. 1 is a perspective view schematically showing an exemplary construction for a slot array antenna 201 including a ridge waveguide.

FIG. 1 is a perspective view schematically showing an exemplary construction for a slot array antenna 201 including a ridge waveguide. The slot array antenna 201 shown in the figure includes a first conductive member 110 and a second conductive member 120 opposing the first conductive member 110. The surface of the first conductive member 110 is composed of an electrically conductive material. The first conductive member 110 includes a plurality of slots 112 as radiating elements. On the second conductive member 120, a waveguide member (ridge) 122 having an electrically-conductive waveguide face 122*a* opposing a slot row consisting of a plurality of slots 112, and a plurality of conductive rods 124 are provided. The plurality of conductive rods 124 are disposed on both sides of the waveguide member 122, constituting an artificial magnetic conductor together with the conductive surface of the second conductive member 120. Electromagnetic waves are unable to propagate in the space existing between the artificial magnetic conductor and the conductive surface of the first conductive member 110. Therefore, while propagating in a waveguide which is created between the waveguide face 122*a* and the conductive surface of the first conductive member 110, an electromagnetic wave (signal wave) excites each slot 112. As a result, an electromagnetic wave is radiated from each slot 112. The following description will be based on an orthogonal coordinate system in which the width direction of the ridge 122 defines the X axis direction, the direction that the ridge 122 extends defines the Y axis direction, and a direction which is perpendicular to the waveguide face 122*a*, i.e., the upper face of the ridge 122, defines the Z axis direction.

In the construction shown in FIG. 1, the waveguide member 122 has a flat waveguide face 122*a*. In connection with this construction, Patent Document 1 discloses a construction in which the height or width of the waveguide face 122*a* is varied along the direction that the ridge 122 extends, with a period which is sufficiently short relative to the wavelength. It is disclosed that such a construction changes the characteristic impedance of a feeding network, thus allowing the wavelength of a signal wave within the waveguide to be shortened.

However, the inventors have found that such a conventional ridge waveguide has difficulty in providing desired antenna characteristics. This problem will be described first. In the following description, the term "antenna element" or "radiating element" is used to describe a generic array antenna. On the other hand, the term "radiating slot" (which may abbreviated to "slot") is used to describe a slot array antenna according to the present disclosure, or any embodiment thereof. Moreover, a "slot array antenna" means an array antenna which includes a plurality of slots as radiating elements. A slot array antenna may be referred to as a "slot antenna array".

Depending on the purpose, an array antenna may employ different methods of exciting each radiating element. For example, in a radar device in which a WRG waveguide is used, a different method of exciting each radiating element will be employed depending on the target radar characteristics, e.g., maximizing the radar efficiency, or reducing side lobes while sacrificing radar efficiency. Herein, a design method that maximizes the gain of an array antenna in order to maximize its radar efficiency will be described as an example. In order to maximize the gain of an array antenna, it is known that the density with which the radiating elements composing an array are disposed may be maximized, and all of the radiating elements may be excited with an equiamplitude and equiphase. In order to realize this, the aforementioned standing-wave series feed may be used, for example. Standing-wave series feed is a feed method which excites all radiating elements in an array antenna with an equiamplitude and equiphase, by utilizing its nature that "identical voltages and currents exist at positions which are distant by one wavelength on a path upon which a standing wave is created".

Herein, a common design procedure for achieving standing-wave series feed will be described. First, a waveguide is constructed so that an electromagnetic wave (signal wave) is allowed to undergo total reflection in at least one of the two ends of a feeding path, such that a standing wave is created on the feeding path. Next, at a plurality of positions which are distant by one wavelength on the feeding path, a plurality of radiating elements having an identical impedance which is small enough not to substantially affect the standing wave are inserted in series to the path, such that the standing wave current has the largest amplitude at these positions. As a result, excitation with an equiamplitude and equiphase based on standing-wave series feed is realized.

Thus, the principle of standing-wave series feed is easy to understand. However, it has been found that merely applying such a construction to a WRG-based array antenna will not achieve excitation with an equiamplitude and equiphase. It has been found through the inventors' study that, in order to excite all radiating elements with an equiamplitude and equiphase, a portion(s) having a different capacitance or inductance from that of any other portion (e.g., portions different in height or width from other portions) needs to be provided on the WRG, thereby adjusting the phase of a signal wave to propagate through the WRG. Such phase adjustments are needed not only in the case of exciting all radiating elements with an equiamplitude and equiphase, but also in attaining other purposes, such as reducing side lobes while sacrificing efficiency. For example, differences in phase and amplitude may be introduced between adjacent radiating elements so that desired excitation states are realized at the respective slot positions, or some other adjustments may be made. Moreover, similar phase adjustments are needed not only when adopting standing-wave feed, but also when adopting traveling-wave feed.

However, in a conventional WRG-based array antenna which is disclosed in the aforementioned Patent Document 1, identical dents (notches) or broad portions are merely disposed over the entire path with a certain short period, and no structure is provided for adjusting the signal wave phase. More specifically, in the construction disclosed in Patent Document 1, given a wavelength $\lambda_R$ of a signal wave in a waveguide where no dents or broad portions are provided, dents or broad portions are periodically disposed with a period which is smaller than $\lambda_R/4$. Such a structure affects the characteristic impedance on the transmission line as a distributed constant circuit, and consequently shortens the wavelength of the signal wave within the waveguide. However, it is unable to adjust the excitation state of each slot in accordance with the desired antenna characteristics.

The reason is that, when constructing a slot array antenna by disposing a plurality of slots on the ridge waveguide which is disclosed in Patent Document 1, the slot impedance is large enough to significantly distort the waveform of a signal wave propagating through the waveguide. Therefore, when adopting the minute periodic structure disclosed in Patent Document 1, the intensity and phase of an electromagnetic wave which is radiated from each of the plurality of slots cannot be adjusted depending on the purpose. This means that, in a WRG-based radar device, in order to attain the target radar characteristics (e.g., maximizing efficiency, reducing side lobes while sacrificing efficiency, or other characteristics), one cannot design the waveguide and the slots independently of each other (in other words, these need to be simultaneously optimized). When one of the inventors filed an application for the invention of Patent Document 1, such influences of slot impedance had not been recognized at all.

In making the present invention, the inventors have considered, between two adjacent slots, locally introducing regions in which a plurality of additional elements such as dents or bumps are disposed at an interval which is longer than $\lambda_R/4$, rather than uniformly distributing additional elements along the transmission line with a short period which is smaller than $\lambda_R/4$. The inventors have further studied disposing additional elements such as dents or bumps between two adjacent slots, in an aperiodic manner along the transmission line. The inventors have also studied a structure in which the spacing between the conductive member and the waveguide member and/or the width of the waveguide face of the waveguide member varies (i.e., inductance and/or capacitance varies) in three or more steps along the waveguide face. As a result, they have succeeded in adjusting the wavelength of the signal wave within the waveguide, and also adjusting the intensity and the phase of the propagating signal wave at the slots. $\lambda_R$ is longer than a wavelength $\lambda o$ in free space, but less than $1.15\lambda o$. Therefore, the aforementioned "interval which is longer than $\lambda_R/4$" can also be read as an "interval which is longer than $1.15\lambda o/4$". If the aforementioned interval is greater than $\lambda_R/4$ but only by a small difference, a sufficient amount of phase adjustment may not be obtained in the propagating signal wave. In such a case, a site in which additional elements are disposed at an interval which is equal to or greater than $1.5\lambda o/4$ may be introduced.

In the present specification, an "additional element" means a structure on a transmission line which locally changes at least one of inductance and capacitance. In the present specification, "inductance" and "capacitance" refer to inductance and capacitance values per unit length in a direction along the transmission line (i.e., the direction in which the row of slots are arrayed), where the unit length is equal to or less than 1/10 of the free-space wavelength $\lambda o$. Without being limited to a dent or a bump, an additional element may be a "broad portion" at which the waveguide face has a greater width than at the other adjacent portions, or a "narrow portion" at which the waveguide face has a smaller width than at the other adjacent portions, for example. Alternatively, it may be a portion that is composed of a material whose dielectric constant is different from that of any other portion. Such an additional element(s) is typically to be provided on an electrically-conductive waveguide face of a waveguide member (e.g., a ridge on a conductive member), but may also be provided on a conductive surface of a conductive member opposing the waveguide face.

Now, with reference to FIGS. 2A through 2E, constructions according to illustrative embodiments of the present disclosure will be described in comparison with the construction of Patent Document 1.

Figure 2A:
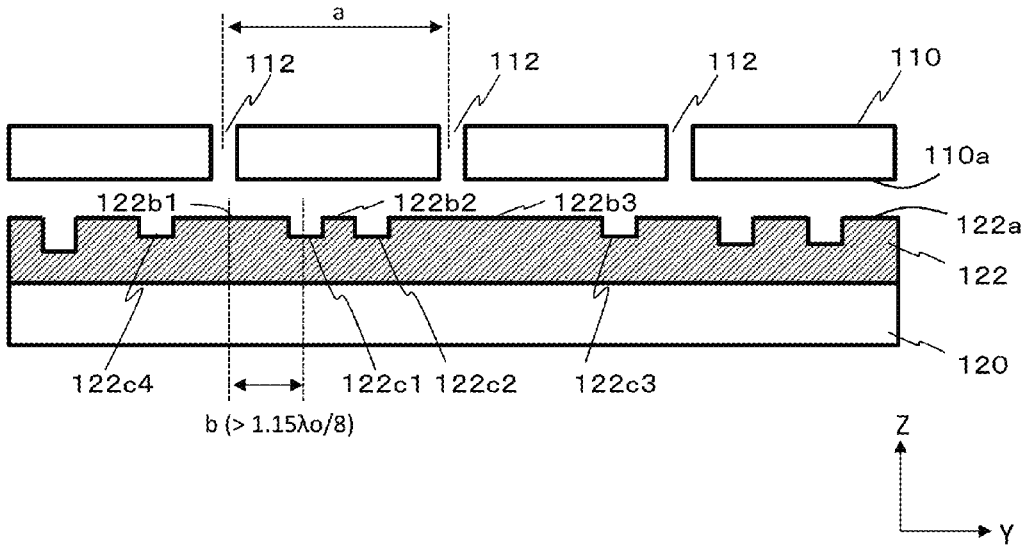
FIG. 2A is a cross-sectional view schematically showing the structure of a slot array antenna according to an illustrative embodiment of the present disclosure.

FIG. 2A is a cross-sectional view schematically showing the structure of a slot array antenna according to an illustrative embodiment of the present disclosure. This slot array antenna has a similar construction to the construction shown in FIG. 1, except for a different structure of the waveguide member 122. FIG. 2A corresponds to a cross-sectional view when the slot array antenna is cut along a plane which is parallel to the YZ plane and which extends through the center of the plurality of slots 112 in FIG. 1. This slot array antenna includes a first conductive member 110 having the plurality of slots 112 (slot row) that are arrayed along a first direction (referred to as the Y direction), a second conductive member 120 opposing the first conductive member 110, and a waveguide member (ridge) 122 on the second conductive member 120. Unlike in the example shown in FIG. 1, a plurality of dents are provided on the ridge 122. Positions of the dents were selected so that changes were introduced in the signal wave phase at the plurality of slots 112 so as to provide characteristics as desired. In this example, the dents 122*c*1 and 122*c*2 are at two positions which are symmetric with respect to a position opposing the midpoint between two adjacent slots 112, but may also be at other positions as will be described later.

In the construction shown in FIG. 2A, the dent 122*c*1 adjoins bumps 122*b*1 and 122*b*2. The distance b between the central portion of the dent 122*c*1 and the central portion of the bump 122*b*1 along the Y direction is longer than 1.15/8 of a free-space wavelength $\lambda o$ corresponding to the center frequency of electromagnetic waves (radio waves) in the frequency band to be transmitted or received by this slot array antenna. More preferably, it is equal to or greater than 1.5/8 of λo. Stated otherwise, among the plurality of dents, the distance between the centers of the two adjacent dents 122*c*1 and 122*c*4 on both sides of the bump 122*b*1 is longer than 1.15λo/4. Now, let the distance between the centers of two adjacent slots 112 be a. The distance a may be, for example, designed to be approximately equal to the wavelength λg of an electromagnetic wave propagating in the waveguide. The wavelength λg is a wavelength which has varied from the wavelength $\lambda_R$ due to the additional elements being provided. Although it may depend on the design, λg may be shorter than $\lambda_R$, for example. In that case, $a<\lambda_R$, and therefore the distance ($>\lambda_R/4$) between the centers of the two adjacent dents 122*c*1 and 122*c*4 on both sides of the bump 122*b*1 is longer than ¼ of the distance a. In the construction of FIG. 2A, the distance between the centers of the dent 122*c*1 and the other bump 122*b*2 may be equal to or less than 1.15λo/8.

In the construction of FIG. 2A, each dent functions as an element to locally increase the inductance of the transmission line. In this example, the bottom of each dent and the top of each bump are flat. Therefore, the position of the center of each dent along the Y direction is designated as a "maximal position" at which inductance exhibits a local maximum, whereas the position of the center of each bump along the Y direction is designated as a "minimal position" at which inductance exhibits a local minimum. Then, the aforementioned distance b is the distance between one maximal position and a minimal position which is adjacent thereto, such that b>1.15λo/8. More preferably, b>1.5λo/80.

In the construction of FIG. 2A, the plurality of bumps on the waveguide member 122 include a first bump 122*b*1, a second bump 122*b*2, and a third bump 122*b*3, which are adjacent to one another and consecutively follow along the Y direction (first direction). The distance between the centers of the first bump 122*b*1 and the second bump 122*b*2 is different from the distance between the centers of the second bump 122*b*2 and the third bump 122*b*3. Similarly, the plurality of dents on the waveguide member 122 include a first dent 122*c*1, a second dent 122*c*2, and a third dent 122*c*3, which are adjacent to one another and consecutively follow along the Y direction. The distance between the centers of the first dent 122*c*1 and the second dent 122*c*2 is different from the distance between the centers of the second dent 122*c*2 and the third dent 122*c*3. Thus, in the construction shown in FIG. 2A, at least within the illustrated region, the spacing between the conductive surface 110*a* and the waveguide face 122*a* aperiodically fluctuates along the Y direction. The aforementioned first to third bumps (or the first to third dents) may be in any positions so long as they are provided between the two endmost slots among the plurality of slots 112. The bumps or dents may be provided on the conductive surface 110*a* of the conductive member 110.

In the construction of FIG. 2A, the first bump 122*b*1 is in a position opposing a slot 112 (first slot), while the third bump 122*b*3 is in a position opposing another slot 112 (second slot) adjacent to that slot 112, with the second bump 122*b*2 being interposed between the two positions opposing these two slots 112. The second bump 122*b*2 is in a position overlapping the midpoint between the two slots 112, as viewed from the normal direction of the conductive surface 110*a*. Moreover, as viewed from the normal direction of the conductive surface 110*a* of the conductive member 110, the first dent 122*c*1 and the second dent 122*c*2 are located between two adjacent slots 112, while the third dent 122*c*3 is located outside of these two slots 112. Furthermore, as viewed from the normal direction of the conductive surface 110*a*, the midpoint between these two slots 112 is located between the first dent 122*c*1 and the second dent 122*c*2 (i.e., at the second bump 122*b*2). Other than this construction, for example, all of the first to third dents 122*c*1, 122*c*2 and 122*c*3 may be located between the two adjacent slots 112, as viewed from the normal direction of the conductive surface 110*a*. In these constructions, as viewed from the normal direction of the conductive surface 110*a*, at least two of the first to third dents 122*c*1, 122*c*2 and 122*c*3 are located between two adjacent slots 112. At least one of the distance between the centers of the first dent 122*c*1 and the second dent 122*c*2, and the distance between the centers of the second dent 122*c*2 and the third dent 122*c*3, may be designed to be greater than 1.15λo/4. Moreover, at least one of the distance between the centers of the first bump 122*b*1 and the second bump 122*b*2, and the distance between the centers of the second bump 122*b*1 and the third bump 122*b*3, may be designed to be greater than 1.15λo/4.

A similar aperiodic construction can also be realized by, instead of providing dents or bumps, providing broad portions or narrow portions. For example, consider a case where the waveguide member 122 includes a plurality of broad portions on the waveguide face 122*a*, the plurality of broad portions expanding the width of the waveguide face 122*a* relative to any adjacent site. In this case, the plurality of broad portions include a first broad portion, a second broad portion, and a third broad portion, which are adjacent to one another and consecutively follow along the Y direction, and they may be disposed so that the distance between the centers of the first broad portion and the second broad portion is different from the distance between the centers of the second broad portion and the third broad portion. Similarly, consider a case where the waveguide member 122 includes a plurality of narrow portions narrowing the width of the waveguide face 122*a* relative to any adjacent site on the waveguide face 122*a*. In this case, the plurality of narrow portions include a first narrow portion, a second narrow portion, and a third narrow portion which are adjacent to one another and consecutively follow along the Y direction, and they may be disposed so that the distance between the centers of the first narrow portion and the second narrow portion is different from the distance between the centers of the second narrow portion and the third narrow portion. The first to third broad portions (or the first to third narrow portions) may be in any positions so long as they are provided between the two endmost slots among the plurality of slots 112.

In the construction of FIG. 2A, the waveguide existing between the conductive surface 110*a* and the waveguide face 122*a* includes a plurality of positions at which the inductance (or capacitance) of the waveguide exhibits local maximums or local minimums. The plurality of positions include a first position (bump 122*b*1), a second position (dent 122*c*1), and a third position (bump 122*b*2) which are adjacent to one another and consecutively follow along the Y direction. The distance between the centers of the first position and the second position is different from the distance between the centers of the second position and the third position. Thus, within a region where a plurality of slots are provided, a structure where aperiodic fluctuations in inductance or capacitance are at least locally introduced allows the phase of an electromagnetic wave propagating in the waveguide to be adjusted in accordance with the desired characteristics. The aforementioned first to third positions may be in any positions so long as they are provided between the two endmost slots.

Figure 2B:
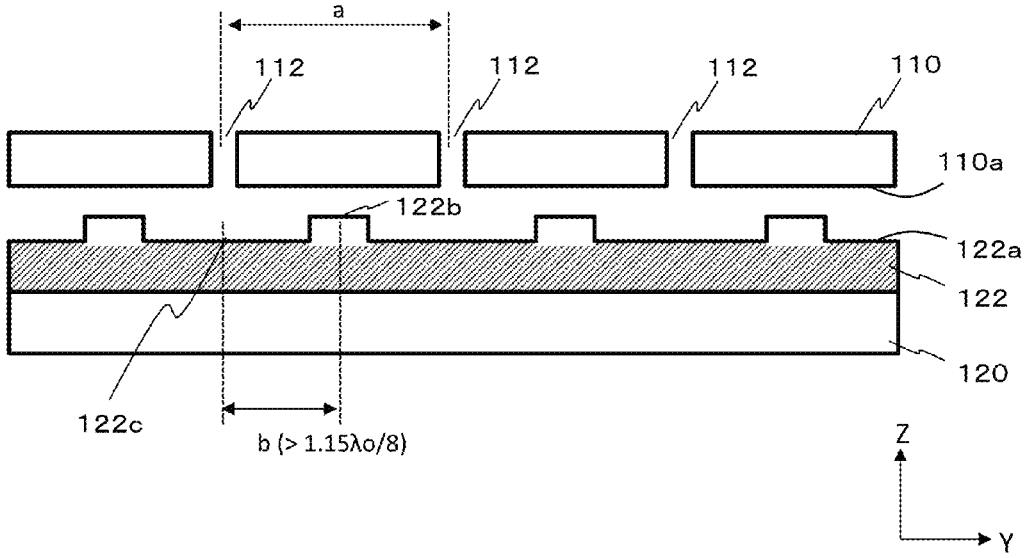
FIG. 2B is a cross-sectional view schematically showing the structure of a slot array antenna according to another embodiment of the present disclosure.

FIG. 2B is a cross-sectional view schematically showing the structure of a slot array antenna according to another embodiment of the present disclosure. In this slot array antenna, bumps 122*b* are provided at positions each opposing a midpoint between two adjacent slots 112. Without being limited to the positions shown in the figure, the bumps 122*b* may be in other positions. In such a construction, each bump 122*b* functions as an element to locally increase the capacitance of the transmission line. In this example, too, the top of each bump 122*b* and the bottom of each dent 122*c* are flat. Therefore, the position of the center of each bump 122*b* along the Y direction is designated as a "maximal position" at which capacitance exhibits a local maximum, whereas the position of the center of each dent 122*c* along the Y direction is designated as a "minimal position" at which inductance exhibits a local minimum. Then, also in this example, the distance b between a maximal position and a minimal position which is adjacent thereto satisfies $b>1.15\lambda o/8$. More preferably, $b>1.5\lambda o/8$. Similar characteristics can also be obtained with a construction in which broad portions are provided instead of bumps 122*b*, or bumps are provided on the conductive surface 110*a* rather than on the waveguide face 122*a*.

In the construction of FIG. 2B, the spacing between the conductive surface 110*a* and the waveguide face 122*a* periodically fluctuates along the Y direction. However, it is distinct from the construction of Patent Document 1 in that the period of fluctuation is longer than $1.15\lambda o/4$ or $\lambda_R/4$. In the example shown in FIG. 2B, the period is equal to the distance (slot interval) between the centers of two adjacent slots 112. When such a periodic construction is adopted, the period may be set to a value which is equal to or greater than ½ of the slot interval. In other words, at least one of the spacing between the conductive surface 110*a* and the waveguide face 122*a* and the width of the waveguide face 122*a* (or at least one of inductance and capacitance of the waveguide) may fluctuate along the Y direction with a period which is equal to or greater than ½ of the distance between the centers of two adjacent slots 112.

Figure 2C:
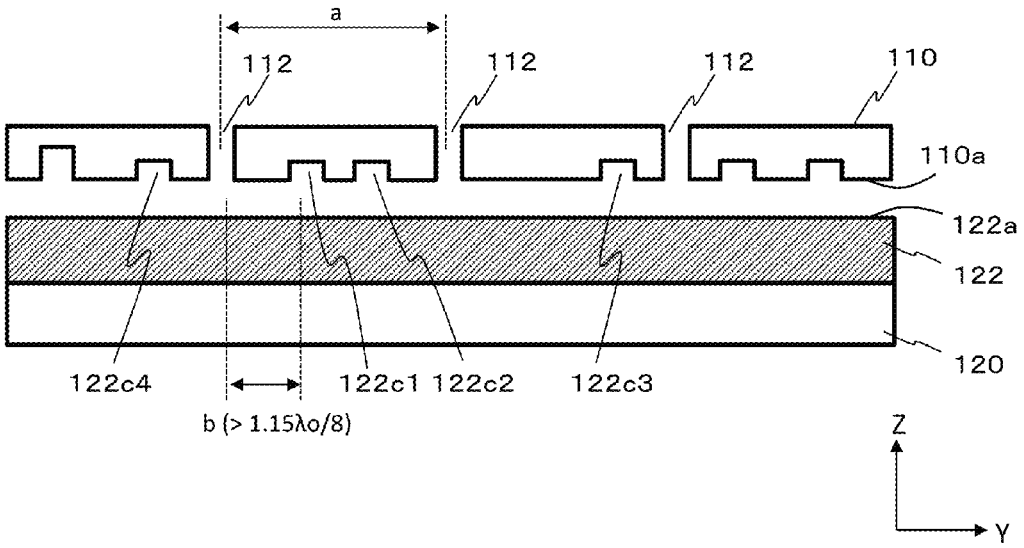
FIG. 2C is a cross-sectional view schematically showing the structure of a slot array antenna according to still another embodiment of the present disclosure.

FIG. 2C is a cross-sectional view schematically showing the structure of a slot array antenna according to still another embodiment of the present disclosure. In this slot array antenna, a plurality of dents are provided on the conductive surface 110*a* of the first conductive member 110. The positions along the Y direction of the plurality of dents are identical to the positions along the Y direction of the plurality of dents in FIG. 2A. The waveguide face 122*a* of the waveguide member 122 has no bumps or dents, and is flat.

Figure 2D:
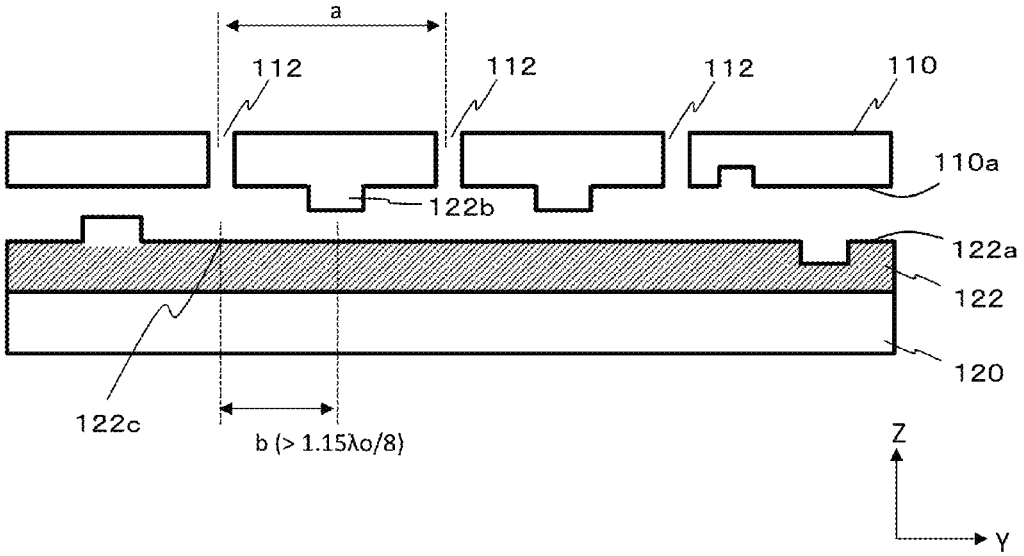
FIG. 2D is a cross-sectional view schematically showing the structure of a slot array antenna according to still another embodiment of the present disclosure.

FIG. 2D is a cross-sectional view schematically showing the structure of a slot array antenna according to still another embodiment of the present disclosure. In this slot array antenna, each of the conductive surface 110*a* and the waveguide face 122*a* has both dents and bumps.

As shown in FIGS. 2C and 2D, the conductive surface 110*a* of the first conductive member 110 may have at least one of the bumps and the dents. In that case, in terms of fabrication, the width of any dent or bump along the X direction, i.e., the direction which is orthogonal to the direction that the waveguide member 122 extends is preferably broader than the width of the waveguide member 122. The accuracy of alignment along the X direction that is required between the dents or bumps on the conductive member 110 and the waveguide member 122 may be relaxed. However, without limitation, the width of any dent or bump on the conductive member 110 along the X direction may be equal to or narrower than the width of the waveguide face 122*a* of the waveguide member 122.

In the slot array antennas according to the embodiments shown in FIGS. 2A to 2D, a waveguide which is constituted by the conductive surface 110*a* and the waveguide face 122*a* includes: at least one minimal position at which at least one of inductance and capacitance of the waveguide exhibits a local minimum; and at least one maximal position at which at least one of inductance and capacitance of the waveguide exhibits a local maximum. A "minimal position" is a position in the neighborhood of a position along the Y direction at which a function concerning coordinates along the Y direction indicating inductance or capacitance of the waveguide (or the transmission line) takes a local minimum value. On the other hand, a "maximal position" is a position in the neighborhood of a position along the Y direction at which the aforementioned function takes a local maximum value. As in the examples shown in FIGS. 2A to 2D, when a local maximum or a local minimum of inductance or capacitance is ascribable to a dent with a flat bottom or a bump with a flat top, the central portion of the dent or bump is regarded as a "maximal position" or a "minimal position". In the exemplary constructions shown in FIGS. 2A and 2C, the center of each dent is a "maximal position" at which inductance takes a local maximum, and the center of each bump is a "minimal position" at which inductance takes a local minimum. On the other hand, in the exemplary construction shown in FIG. 2B, the center of each bump 122*b* is a "maximal position" at which capacitance takes a local maximum, and the center of each dent 122*c* is a "minimal position" at which capacitance takes a local minimum. Similarly in the example shown in FIG. 2D, there are a plurality of maximal positions and a plurality of minimal positions.

Minimal positions include a first type of minimal position(s) which is adjacent to a maximal position while being more distant therefrom than $1.15\lambda o/8$. In the exemplary construction shown in FIG. 2A, the position of the center of the bump 122*b*1 corresponds to a first type of minimal position. In the exemplary construction shown in FIG. 2B, the position of the center of the dent 122*c* corresponds to a first type of minimal position. In either example, the distance b along the Y direction between the first type of minimal position and an adjacent maximal position is longer than $1.15\lambda o/8$. More preferably, $b>1.5\lambda o/8$.

Figure 2E:
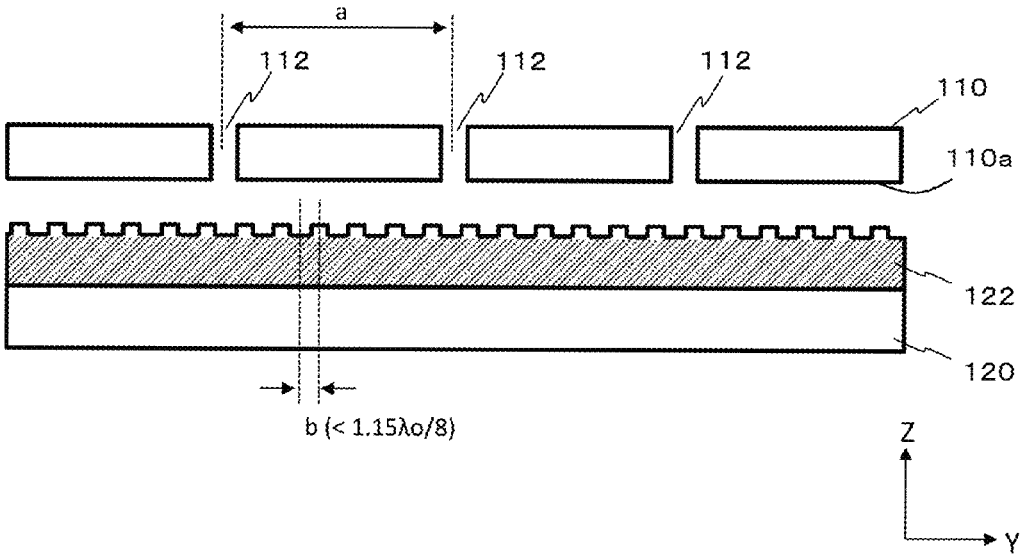
FIG. 2E is a cross-sectional view schematically showing a slot array antenna having a similar structure to that of a slot array antenna disclosed in Patent Document 1.

FIG. 2E is a cross-sectional view schematically showing a slot array antenna (Comparative Example) having a similar structure to that of the slot array antenna disclosed in Patent Document 1. In this slot array antenna, a plurality of minute dents 122*c* are periodically arrayed on the ridge 122. The period of this array is smaller than $\lambda_R/4$, where $\lambda$ is the wavelength of a signal wave in the waveguide with no plurality of dents 122*c* being provided. Since the wavelength $\lambda$ is less than 1.15 times the free-space wavelength $\lambda o$, the period of the array of dents 122*c* is less than $1.15\lambda o/4$. Therefore, in the construction shown in FIG. 2E, the distance b between the center of a dent and the center of an adjacent bump along the Y direction is shorter than $1.15\lambda o/8$.

Figure 3A:
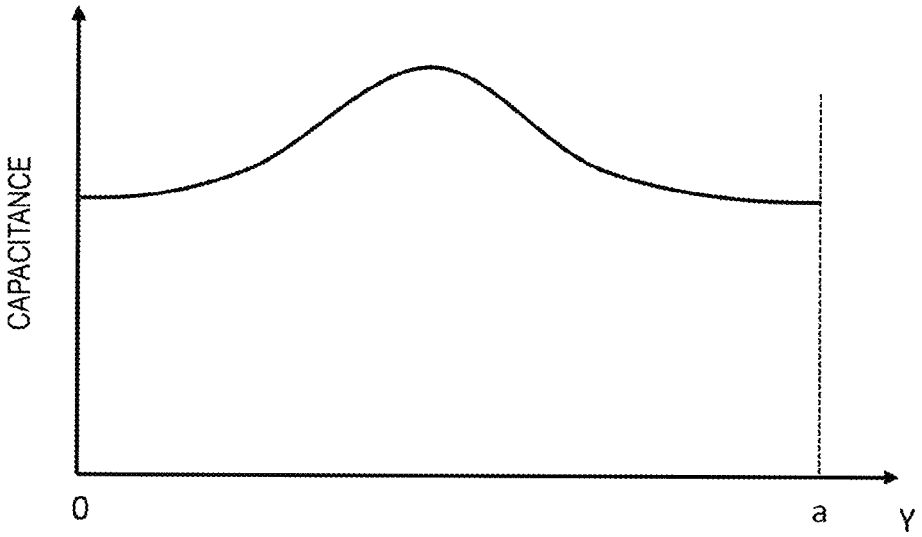
FIG. 3A is a diagram showing a Y direction dependence of capacitance between two adjacent slots 112 in the construction shown in FIG. 2B.
Figure 3B:
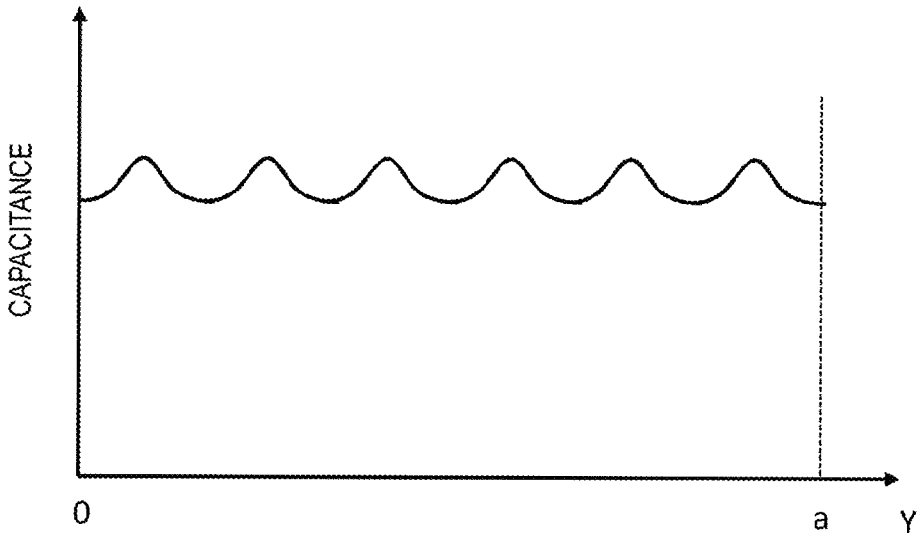
FIG. 3B is a diagram showing a Y direction dependence of capacitance between two adjacent slots 112 in the construction shown in FIG. 2E.

Now, with reference to FIG. 3A and FIG. 3B, the construction shown in FIG. 2B and the construction shown in FIG. 2E will be compared.

FIG. 3A is a graph schematically showing a Y direction dependence of capacitance of the waveguide in the construction shown in FIG. 2B. FIG. 3B is a graph schematically showing a Y direction dependence of capacitance of the waveguide in the construction shown in FIG. 2E. These graphs illustrate change in capacitance within a range of Y=0 to a, where the origin of Y coordinates is defined at the position of one slot 112. Note that FIG. 3A and FIG. 3B illustrate tendencies of change in capacitance along the Y direction, rather than being exact. As shown in FIG. 3A and FIG. 3B, capacitance changes along the Y direction in both of the construction of FIG. 2B and the construction of FIG. 2E, but with different periods. In the construction of FIG. 2B, after exhibiting a local minimum near a slot, capacitance exhibits a local maximum in the neighborhood of a bump 122*b*. The minimal position exhibiting a local minimum and the maximal position adjacent thereto along the Y direction and exhibiting a local maximum are distant from each other by about ½ of the slot interval a. On the other hand, the construction of FIG. 2E is oscillating with a fine period which is less than ¼ of the wavelength $\lambda_R$ of an electromagnetic wave on a ridge waveguide lacking the dents.

In the case where the slot array is designed so that electromagnetic waves with an identical phase are radiated from the respective slots, the interval between adjacent slots along the Y direction is substantially equal to the wavelength λg of a transmission wave on the transmission line. Therefore, in that case, capacitance fluctuates with a long period which is about the same as the wavelength λg in the construction of FIG. 2B, whereas capacitance oscillates with a short period which is less than ¼ of the wavelength $\lambda_R$ in the construction of FIG. 2E. In a short modulation structure measuring less than ¼ of the wavelength $\lambda_R$, a transmission wave will hardly be reflected by each individual modulation, and the transmission wave will behave as if propagating in a medium which is near uniform. On the other hand, in a long modulation structure measuring equal to or greater than ¼ of the wavelength $\lambda_R$, a transmission wave can be reflected by each individual modulation.

Although the term "wavelength" is used in the description of the constructions of FIG. 2A and FIG. 2B, this is for convenience of explanation. When capacitance or inductance fluctuates at long intervals, a transmission wave will undergo complex reflections, and the wavelength of an actual transmission wave has yet been directly confirmed. However, by imparting fluctuations with a long period to capacitance or inductance, in a WRG-based slot antenna, the excitation state of each slot can be appropriately adjusted so as to achieve desired antenna characteristics. In such a state, the wavelength λg of a transmission wave is presumed to be substantially equal to the interval between two adjacent slots 112. The following description will assume that, even when capacitance or inductance fluctuates with a long period, a wavelength λg can still be adaptively defined for each situation.

Figure 4:
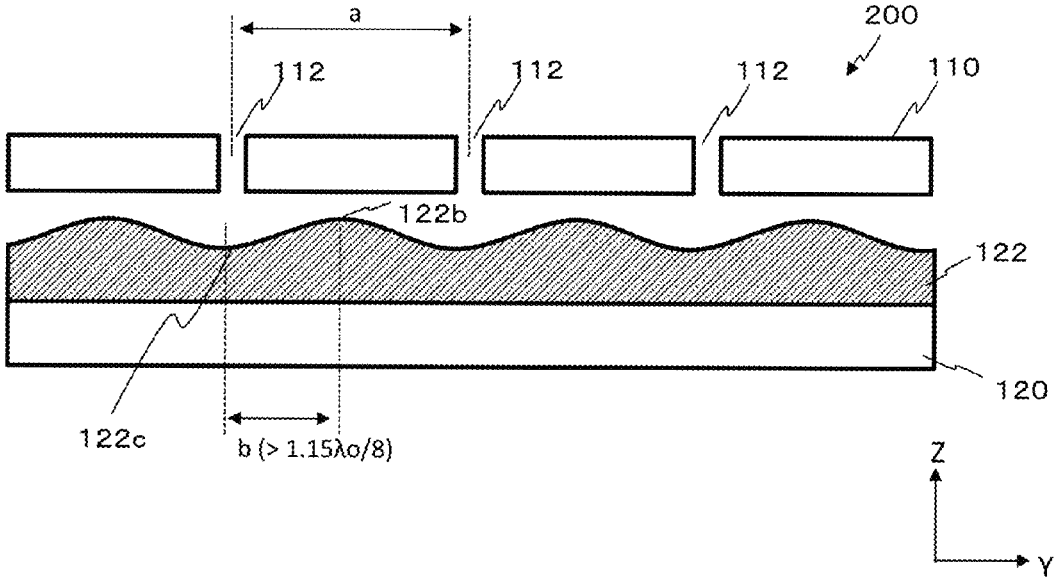
FIG. 4 is a diagram showing an exemplary construction in which an upper face (waveguide face) of a ridge 122 has smoothly varying height.

As described above, unlike in the construction disclosed in Patent Document 1, at least one of inductance and capacitance changes between two adjacent slots in a direction along the waveguide member in the embodiments shown in FIG. 2A and FIG. 2B, on the basis of a modulation structure which is longer than ¼ of the wavelength $\lambda_R$. The actual manner of such change can be arbitrarily altered by adjusting the positions of additional elements such as bumps, dents, broad portions, and narrow portions. Moreover, similar effects can also be obtained by ensuring that the upper face (waveguide face) of the ridge 122 has smoothly varying height, as is illustrated in FIG. 4, for example. Similar effects can also be obtained by ensuring that the waveguide face has smoothly varying width. Thus, embodiments of the present disclosure encompass a construction which has smoothly varying distance between the conductive surface of the first conductive member 110 and the waveguide face of the waveguide member 122, and also a construction where the waveguide face has smoothly varying width. Embodiments of the present disclosure are not limited to constructions where additional elements are clearly defined (e.g., a construction where bumps or dents are arrayed).

In the present specification, bumps that serve to narrow the spacing between the conductive surface of the first electrically conductive member and the waveguide face of the waveguide member relative to any adjacent site, and broad portions that serve to broaden the width of the waveguide face relative to any adjacent site, may be referred to as "first type of additional elements". A first type of additional element has the function of increasing the capacitance of the transmission line. Moreover, dents that serve to broaden the spacing between the conductive surface of the first electrically conductive member and the waveguide face of the waveguide member relative to any adjacent site, and narrow portions that serve to narrow the width of the waveguide face relative to any adjacent site, may be referred to as "second type of additional elements". A second type of additional element has the function of increasing the inductance of the transmission line. In one implementation, the additional elements include a first type of additional element(s) and/or a second type of additional element(s). A first type of additional element may be adjacent to a second type of additional element, or to a site where no additional element is provided (which may be referred to as a "neutral portion" in the present specification). Similarly, a second type of additional element may be adjacent to a first type of additional element or a neutral portion. The distance between the centers of such two adjacent elements is longer than ⅛ of the wavelength $\lambda_R$ within the waveguide, or 1.15/8 of the central wavelength λo in free space. More preferably, it is equal to or greater than 1.5/8 of λo.

In an embodiment of the present disclosure, a special structure which can be regarded as a bump and yet a narrow portion, or a special structure which can be regarded as a dent and yet a broad portion, may be used as an additional element. In the present specification, a structure which is a bump that narrows the spacing between the conductive surface and the waveguide face relative to any adjacent site and yet is a narrow portion that narrows the width of the waveguide face relative to any adjacent site may be referred to as a "third type of additional element". Moreover, a structure which is a dent that broadens the spacing between the conductive surface and the waveguide face relative to any adjacent site and yet is a broad portion that broadens the width of the waveguide face relative to any adjacent site may be referred to as a "fourth type of additional element". Depending on its structure, a third type of additional element and a fourth type of additional element may each function as a capacitance component or as an inductance component. The additional elements may include a third type of additional element(s) and/or a fourth type of additional element(s) as such. A third type of additional element may be adjacent to a fourth type of additional element, or a neutral portion where no additional element is provided. Similarly, a fourth type of additional element may be adjacent to a third type of additional element or a neutral portion. The distance between the centers of such two adjacent elements is longer than ⅛ of $\lambda_R$, or 1.15/8 of λo. This distance between centers is, more preferably, equal to or greater than 1.5/8 of λo.

Figure 5A:
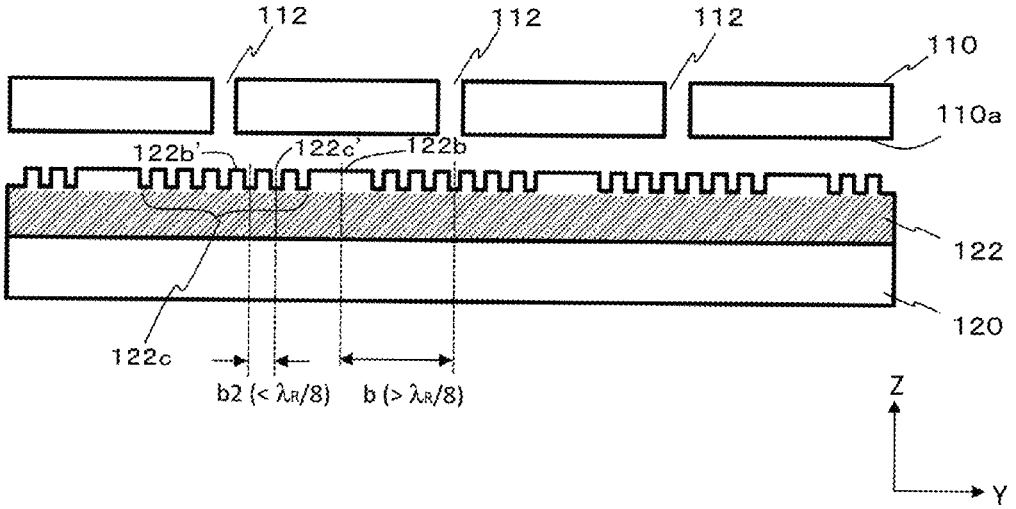
FIG. 5A is a cross-sectional view schematically showing another embodiment of the present disclosure.

An embodiment of the present disclosure may also include any structure having a period which is less than ¼ of the wavelength $\lambda_R$ in a waveguide lacking bumps or dents, etc., in a manner disclosed in Patent Document 1. FIG. 5A is a cross-sectional view schematically showing an example of such construction. In this example, a plurality of minute additional elements are provided within a minimal position 122*c*, these minute additional elements having a length along the waveguide direction of less than $\lambda_R/8$ or less than 1.15λo/8. In this example, the minute additional elements are dents 122*c*'. The interspaces between two adjacent dents 122*c*' may also be regarded as bumps 122*b*'. The distance b2 between the centers of two adjacent dents 122*c*' is less than $\lambda_R/8$ or less than 1.15λo/8. In each dent 122*c*', local capacitance exhibits a local minimum. Therefore, in this structure, minimal positions are arrayed so as to be less than $\lambda_R/8$ or less than 1.15λo/8 apart. Minimal positions which are arrayed so as to be apart by a distance which is less than $\lambda_R/8$ may be referred to as "clustering minimal positions" in the present specification. The plurality of clustering minimal positions 122*c*', as a whole, constitute a site 122*c* which acts similarly to one large dent. The distance b between the center of such a dent 122*c* including plural clustering minimal positions and the center of an adjacent bump 122*b* is longer than $\lambda_R/8$. Thus, an embodiment of the present disclosure may include any structure that locally has a period which is smaller than $\lambda_R/4$.

Figure 5B:
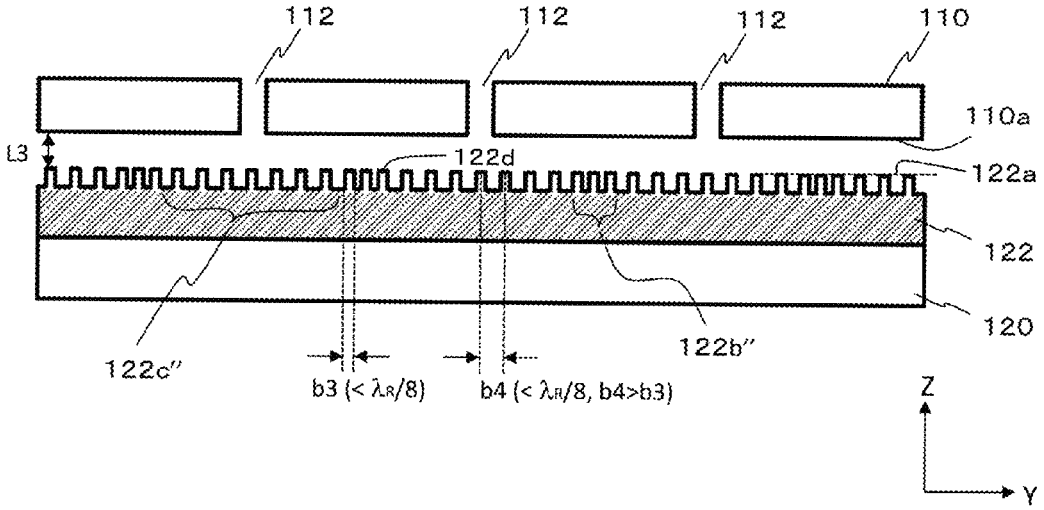
FIG. 5B is a cross-sectional view schematically showing still another embodiment of the present disclosure.

FIG. 5B is a cross-sectional view schematically showing still another embodiment of the present disclosure. In this example, the additional elements include bumps 122*d*, which are a plurality of minute additional elements each of whose length b3 along the Y direction is less than $\lambda_R/8$ or less than 1.15λo/8. The plurality of bumps 122*d* are arrayed so as to be adjacent along the Y direction, spanning a range including minimal positions and maximal positions. Among these bumps 122*d*, the distance between the centers of two adjacent bumps is less than a half of the spacing L3 between the conductive surface 110*a* and the waveguide face 122*a*, and yet less than $\lambda_R/8$ or less than 1.15λo/8. At the positions of these bumps 122*d*, local capacitance exhibits local maximums. Therefore, in this structure, maximal positions are arrayed so as to be apart by less than $\lambda_R/8$ or less than 1.15λo/8. In the present specification, maximal positions which are arrayed so as to be apart by less than $\lambda_R/8$ are referred to as "clustering maximal positions", thus being distinguished from the aforementioned "maximal positions". In FIG. 5B, there is a distance of less than $\lambda_R/8$ or less than 1.15λo/8 between the centers of clustering maximal positions at any site. However, the distance between the centers of clustering maximal positions is smaller at a midpoint between two adjacent slots 112, and greater at any other place. In the example of FIG. 5B, a plurality of clustering maximal positions are arrayed at an interval of b3 near a midpoint between slots 112, thus constituting a site 122*b*" to function as one maximal position (or maximal portion). Between two adjacent maximal portions 122*b*", a plurality of clustering maximal positions are arrayed at an interval of b4 which is greater than b3, thus constituting a site 122*c*" to function as one minimal position (or minimal portion). As in this example, based on how dense or sparse the minute additional elements are (i.e., differences in density), fluctuations in average inductance or capacitance may be caused, each spanning a distance of $\lambda_R/8$ or more. In such an implementation, a "maximal position" and a "minimal position" each refer to a region with some expanse that contains a plurality of minute additional elements.

Figure 5C:
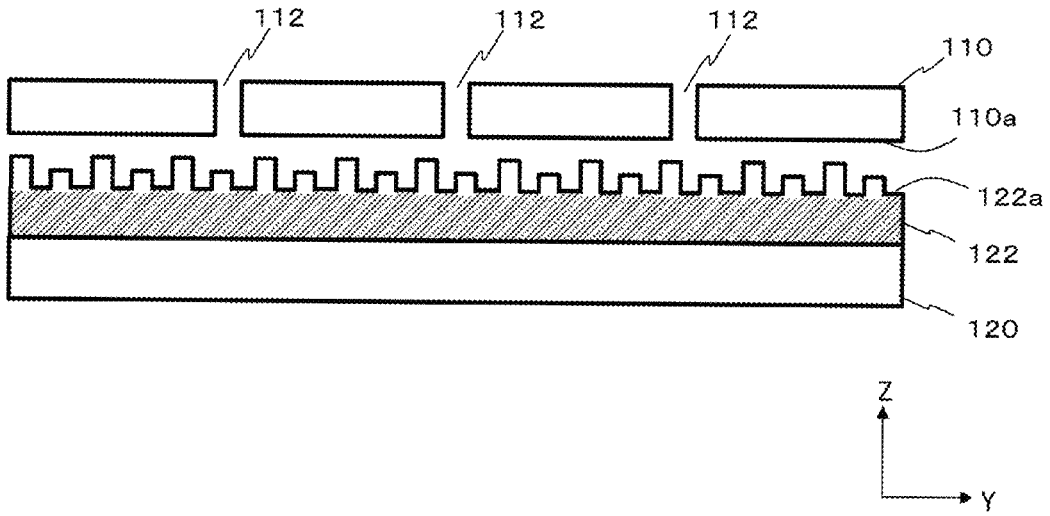
FIG. 5C is a cross-sectional view schematically showing still another embodiment of the present disclosure.

FIG. 5C is a cross-sectional view schematically showing still another embodiment of the present disclosure. In this embodiment, the waveguide member 122 includes two types of bumps with different heights. The two types of bumps alternate at equal intervals. The spacing between the waveguide face 122*a* of the waveguide member 122 and the conductive surface 110*a* of the conductive member 110 periodically fluctuates along the Y direction. In other words, inductance and/or capacitance of the waveguide periodically fluctuates along the Y direction. The period of this fluctuation is shorter than ½ of the slot interval. In this example, three kinds of positions with mutually varying spacing between the conductive surface 110*a* and the waveguide face 122*a* occur so as to be adjacent along the Y direction. Thus, the waveguide member 122 may be structured so that a plurality of bumps with different heights are provided thereon. By appropriately setting the bump heights in accordance with the desired characteristics, it becomes possible to adjust the phase of an electromagnetic wave propagating in the waveguide and adjust the excitation state of each slot 112. Without being limited to a plurality of bumps with different heights, similar adjustments may also be made by providing a plurality of dents with different depths, or a plurality of broad portions or narrow portions with different widths. Instead of the waveguide member 122, a plurality of bumps or a plurality of dents may be provided on the conductive member 110. Between the two endmost slots among the plurality of slots 112, the spacing between the conductive surface 110*a* and the waveguide face 122*a* or the width of the waveguide face 122*a* may vary in four or more steps.

Figure 5D:
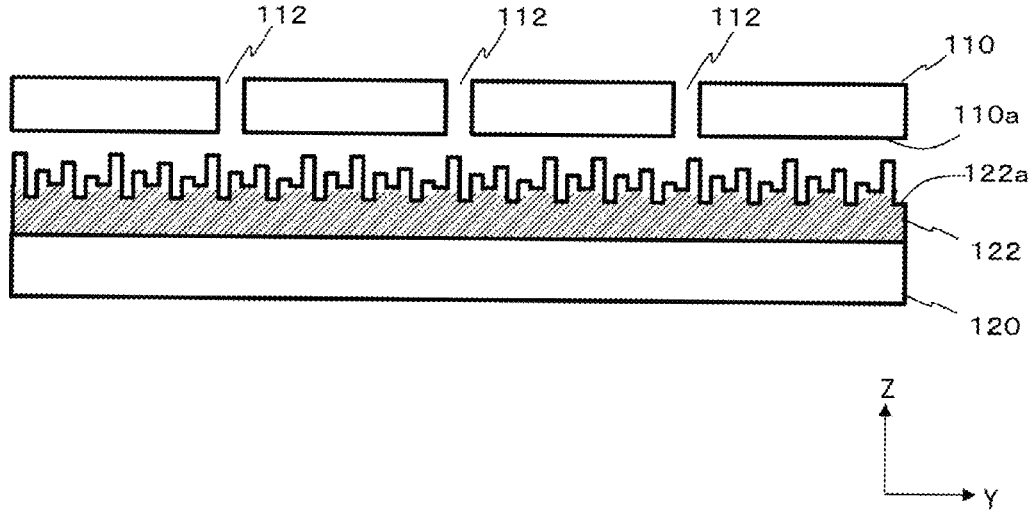
FIG. 5D is a cross-sectional view schematically showing still another embodiment of the present disclosure.

FIG. 5D is a diagram showing an exemplary construction in which the spacing (gap) between the conductive surface 110*a* and the waveguide face 122*a* is allowed to vary at more positions than in the example of FIG. 5C, so that the gap fluctuates over a shorter distance. In this example, there exist six kinds of positions with mutually varying spacing between the conductive surface 110*a* and the waveguide face 122*a*. Although the gap varies over a distance which is shorter than $\lambda_R/4$ or 1.15λo/4, with respect to each repetition unit consisting of bumps and dents, the repetition period is longer than $\lambda_R/4$ or 1.15λo/4.

As in the examples shown in FIG. 5C and FIG. 5D, the waveguide existing between the conductive member 110 and the waveguide member 122 may include at least three kinds of places with mutually varying spacing between the conductive surface 110*a* and the waveguide face 122*a*. Similarly, the waveguide member 122 may include at least three kinds of places with mutually varying width of the waveguide face 122*a*. It is not necessary that all of the at least three places are provided between every two adjacent slots among the plurality of slots 112; rather, it suffices if the at least three places are provided between the two endmost slots. In these implementations, the spacing between the conductive surface 110*a* and the waveguide face 122*a* or the width of the waveguide face 122*a* may vary along the waveguide face 122*a* either periodically or aperiodically. In the case where it varies periodically, its period may be equal to or less than $\lambda_R/4$ or 1.15λo/4 as described above.

Additional elements according to an embodiment of the present disclosure may be regarded as elements which are, as if lumped-parameter elements, locally added to a distributed constant circuit that has a certain characteristic impedance. Disposing such additional elements at appropriate positions allows flexible adjustments as are adapted to the application or purpose. For example, gain may be maximized by: adjusting the wavelength of a signal wave within the waveguide to a desired length; and applying standing-wave series feed or traveling-wave feed to effect excitation with an equiamplitude and equiphase. Alternatively, it is possible to adjust directivity characteristics through intentionally introducing a desired phase difference between the slots, or to radiate electromagnetic waves with a desired intensity from a plurality of slots by applying traveling-wave feed. Thus, the technique of the present disclosure is applicable to a broad range of purposes or applications.

Hereinafter, more specific exemplary constructions for slot array antennas according to embodiments of the present disclosure will be described. Note however that unnecessarily detailed descriptions may be omitted. For example, detailed descriptions on what is well known in the art or redundant descriptions on what is substantially the same constitution may be omitted. This is to avoid lengthy description, and facilitate the understanding of those skilled in the art. The accompanying drawings and the following description, which are provided by the present inventors so that those skilled in the art can sufficiently understand the present disclosure, are not intended to limit the scope of claims.

<Exemplary Fundamental Construction>

First, an exemplary fundamental construction for a slot array antenna according to an embodiment of the present disclosure will be described.

In the slot array antenna according to an embodiment of the present disclosure, electromagnetic waves can be guided by utilizing stretches of artificial magnetic conductor that are provided on both sides of a waveguide member; thus, electromagnetic waves can be radiated from or allowed to impinge on a plurality of slots that are made in the conductive member. The use of artificial magnetic conductor restrains radio frequency signals from leaking on both sides of the waveguide member (e.g., a ridge having an electrically-conductive waveguide face).

An artificial magnetic conductor is a structure which artificially realizes the properties of a perfect magnetic conductor (PMC), which does not exist in nature. One property of a perfect magnetic conductor is that "a magnetic field on its surface has zero tangential component". This property is the opposite of the property of a perfect electric conductor (PEC), i.e., "an electric field on its surface has zero tangential component". Although no perfect magnetic conductor exists in nature, it can be embodied by an artificial structure, e.g., an array of conductive rods. An artificial magnetic conductor functions as a perfect magnetic conductor in a specific frequency band which is defined by its structure. An artificial magnetic conductor restrains or prevents an electromagnetic wave of any frequency that is contained in the specific frequency band (propagation-restricted band or prohibited band) from propagating along the surface of the artificial magnetic conductor. For this reason, the surface of an artificial magnetic conductor may be referred to as a high impedance surface.

As disclosed in Patent Documents 1 and 2 and Non-Patent Documents 1 and 2, an artificial magnetic conductor can be realized by a plurality of electrically conductive rods which are arrayed along row and column directions. The electrically conductive rods do not need to be disposed with a specific period in clearly defined rows and columns, so long as they have a one-dimensional or two-dimensional distribution. Such rods are portions (projections) that protrude from an electrically conductive member, and may also be referred to as posts or pins. A slot array antenna according to one embodiment of the present disclosure includes a pair of opposing electrically conductive members (electrically conductive plates). One conductive plate has a ridge protruding toward the other conductive plate, and stretches of an artificial magnetic conductor extending on both sides of the ridge. An upper face (i.e., its electrically conductive face) of the ridge opposes, via a gap, a conductive surface of the other conductive plate. An electromagnetic wave of a frequency which is contained in the propagation-restricted band of the artificial magnetic conductor propagates along the ridge, in the space (gap) between this conductive surface and the upper face of the ridge.

Figure 6:
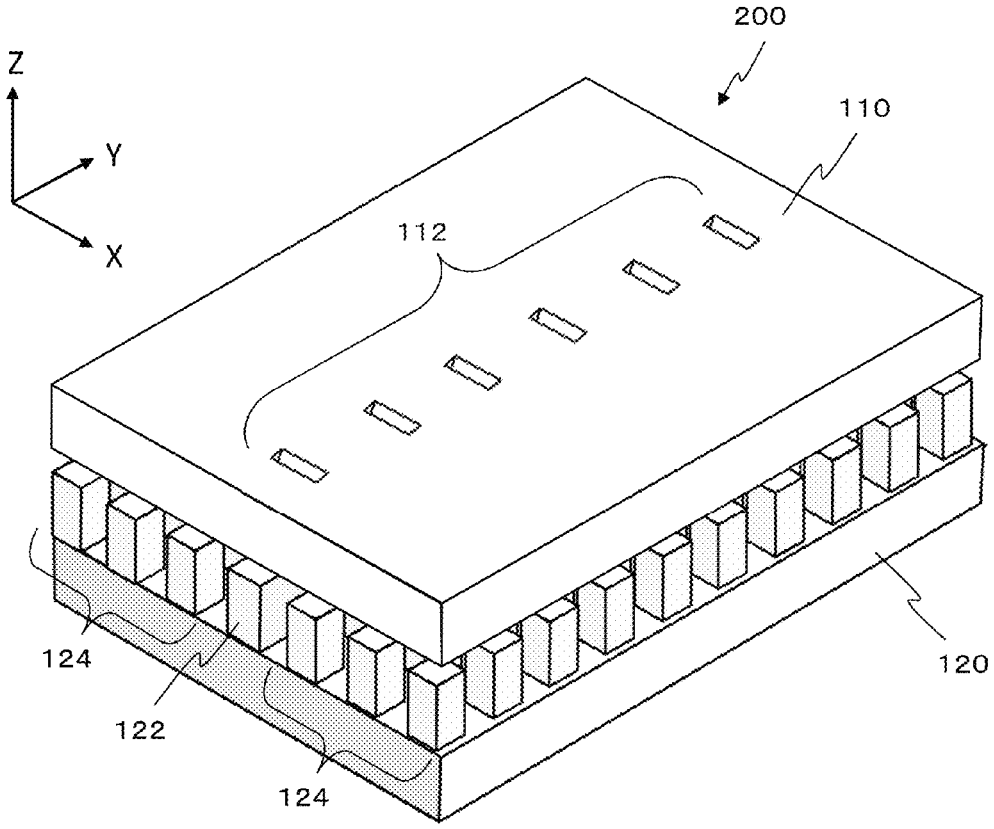
FIG. 6 is a perspective view schematically showing the construction of a slot array antenna 200 according to an illustrative embodiment of the present disclosure.

FIG. 6 is a perspective view schematically showing the construction of a slot array antenna 200 (which hereinafter may also be referred to as a "slot antenna 200") according to an illustrative embodiment of the present disclosure. FIG. 6 shows XYZ coordinates along X, Y and Z directions which are orthogonal to one another. The slot array antenna 200 shown in the figure includes a plate-like first conductive member 110 and a plate-like second conductive member 120, which are in opposing and parallel positions to each other. The first conductive member 110 has a plurality of slots 112 which are arrayed along a first direction (the Y direction). A plurality of conductive rods 124 are arrayed on the second conductive member 120.

Note that any structure appearing in a figure of the present application is shown in an orientation that is selected for ease of explanation, which in no way should limit its orientation when an embodiment of the present disclosure is actually practiced. Moreover, the shape and size of a whole or a part of any structure that is shown in a figure should not limit its actual shape and size.

Figure 7A:
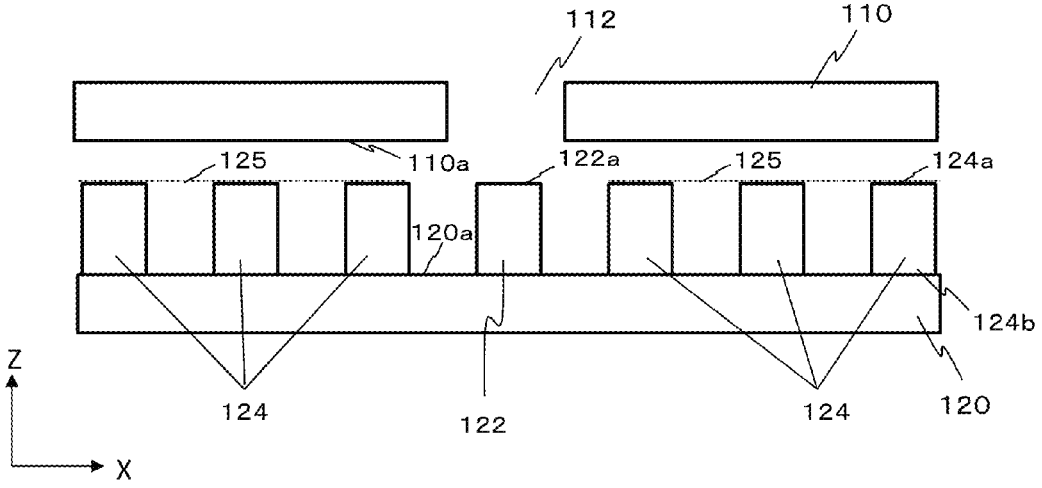
FIG. 7A is a diagram schematically showing a construction of a cross section through the center of a slot 112, taken parallel to the XZ plane.

FIG. 7A is a diagram schematically showing the construction of a cross section through the center of a slot 112, taken parallel to the XZ plane. As shown in FIG. 7A, the first conductive member 110 has a conductive surface 110*a* on the side facing the second conductive member 120. The conductive surface 110*a* has a two-dimensional expanse along a plane which is orthogonal to the axial direction (Z direction) of the conductive rods 124 (i.e., a plane which is parallel to the XY plane). Although the conductive surface 110*a* is shown to be a smooth plane in this example, the conductive surface 110*a* does not need to be a smooth plane, but may be curved or include minute rises and falls, as will be described later.

Figure 8:
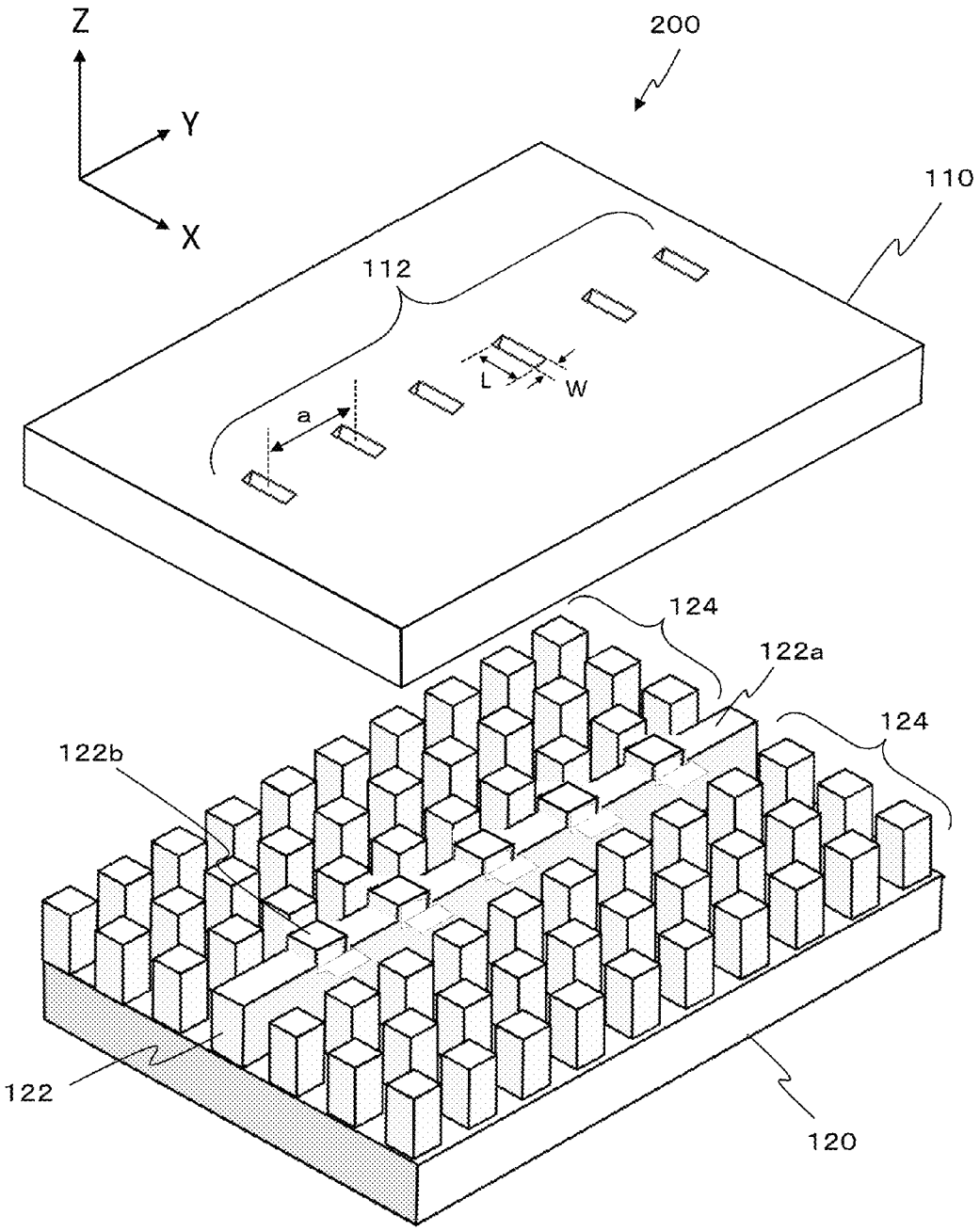
FIG. 8 is a perspective view schematically showing a slot array antenna 200, illustrated so that the spacing between a first conductive member 110 and a second conductive member 120 is exaggerated.

FIG. 8 is a perspective view schematically showing the slot array antenna 200, illustrated so that the spacing between the first conductive member 110 and the second conductive member 120 is exaggerated for ease of understanding. In an actual slot array antenna 200, as shown in FIG. 6 and FIG. 7A, the spacing between the first conductive member 110 and the second conductive member 120 is narrow, with the first conductive member 110 covering over the conductive rods 124 on the second conductive member 120.

As shown in FIG. 8, the waveguide face 122*a* of the waveguide member 122 according to the present embodiment includes a plurality of bumps 122*b* as additional elements. These bumps 122*b* are distributed with an interval which is longer than ¼ of $\lambda_R$ in the region between two endmost slots. In the example shown in FIG. 8, each bump 122*b* is provided at a position opposing a midpoint between two adjacent slots, similarly to the construction of FIG. 2B; however, they may be provided at other positions. Disposing the bumps 122*b* at appropriate positions enables amplitude and phase adjustments each slot's excitation. As in the subsequently-described embodiments, it is also possible to excite each slot with an equiamplitude and equiphase, or attain other effects. Without being limited to bumps, the additional elements may include at least one of dents, broad portions, and narrow portions. In the case where bumps or dents are included, the waveguide face 122*a* may include a flat portion between two adjacent dents or two adjacent bumps, the flat portion being equal to or greater than ¼ of $\lambda_R$. Although the additional elements are provided on the waveguide member 122 in the example of FIG. 8, they may alternatively be provided on the first conductive member 110.

See FIG. 7A again. The plurality of conductive rods 124 arrayed on the second conductive member 120 each have a leading end 124*a* opposing the conductive surface 110*a*. In the example shown in the figure, the leading ends 124*a* of the plurality of conductive rods 124 are on the same plane. This plane defines the surface 125 of an artificial magnetic conductor. Each conductive rod 124 does not need to be entirely electrically conductive, so long as it at least includes an electrically conductive layer that extends along the upper face and the side face of the rod-like structure. Although this electrically conductive layer may be located at the surface layer of the rod-like structure, the surface layer may be composed of an insulation coating or a resin layer with no electrically conductive layer existing on the surface of the rod-like structure. Moreover, each second conductive member 120 does not need to be entirely electrically conductive, so long as it can support the plurality of conductive rods 124 to constitute an artificial magnetic conductor. Of the surfaces of the second conductive member 120, a face 120*a* carrying the plurality of conductive rods 124 may be electrically conductive, such that the electrical conductor interconnects the surfaces of adjacent ones of the plurality of conductive rods 124. Moreover, the electrically conductive layer of the second conductive member 120 may be covered with an insulation coating or a resin layer. In other words, the entire combination of the second conductive member 120 and the plurality of conductive rods 124 may at least include an electrically conductive layer with rises and falls opposing the conductive surface 110*a* of the first conductive member 110.

On the second conductive member 120, a ridge-like waveguide member 122 is provided among the plurality of conductive rods 124. More specifically, stretches of an artificial magnetic conductor are present on both sides of the waveguide member 122, such that the waveguide member 122 is sandwiched between the stretches of artificial magnetic conductor on both sides. As can be seen from FIG. 8, the waveguide member 122 in this example is supported on the second conductive member 120, and extends linearly along the Y direction. In the example shown in the figure, the waveguide member 122 has the same height and width as those of the conductive rods 124. As will be described later, however, the height and width of the waveguide member 122 may be different from those of the conductive rod 124. Unlike the conductive rods 124, the waveguide member 122 extends along a direction (which in this example is the Y direction) in which to guide electromagnetic waves along the conductive surface 110*a*. Similarly, the waveguide member 122 does not need to be entirely electrically conductive, but may at least include an electrically conductive waveguide face 122*a* opposing the conductive surface 110*a* of the first conductive member 110. The second conductive member 120, the plurality of conductive rods 124, and the waveguide member 122 may be parts of a continuous single-piece body. Furthermore, the first conductive member 110 may also be a part of such a single-piece body.

The waveguide face 122*a* of the waveguide member 122 has a stripe shape extending along the Y direction. In the present specification, a "stripe shape" means a shape which is defined by a single stripe, rather than a shape constituted by stripes. Not only shapes that extend linearly in one direction, but also any shape that bends or branches along the way is also encompassed by a "stripe shape". In the case where any portion that undergoes a change in height or width is provided on the waveguide face 122*a*, it still falls under the meaning of "stripe shape" so long as the shape includes a portion that extends in one direction as viewed from the normal direction of the waveguide face 122*a*. A "stripe shape" may also be referred to a "strip shape". The waveguide face 122*a* does not need to extend linearly along the Y direction in regions opposing the plurality of slots 112, but may be bending or branching along the way.

On both sides of the waveguide member 122, the space between the surface 125 of each stretch of artificial magnetic conductor and the conductive surface 110*a* of the first conductive member 110 does not allow an electromagnetic wave of any frequency that is within a specific frequency band to propagate. This frequency band is called a "prohibited band". The artificial magnetic conductor is designed so that the frequency of a signal wave to propagate in the slot array antenna 200 (which may hereinafter be referred to as the "operating frequency") is contained in the prohibited band. The prohibited band may be adjusted based on the following: the height of the conductive rods 124, i.e., the depth of each groove formed between adjacent conductive rods 124; the width of each conductive rod 124; the interval between conductive rods 124; and the size of the gap between the leading end 124*a* and the conductive surface 110*a* of each conductive rod 124.

In the present embodiment, the entire first conductive member 110 is composed of an electrically conductive material, and each slot 112 is an aperture which is made in the first conductive member 110. However, the slots 112 are not limited to such a structure. For example, in a construction where the first conductive member 110 includes an internal dielectric layer and an outermost electrically conductive layer, apertures which are made only in the electrically conductive layer and not in the dielectric layer would also function as slots.

The waveguide between the first conductive member 110 and the waveguide member 122 is open at both ends. The slot interval is set to an integer multiple (typically ×1) of the wavelength λg of an electromagnetic wave in the waveguide, for example. Herein, λg means the wavelength of an electromagnetic wave in a ridge waveguide in which bumps or dents, or some other structures are added to the ridge. When the technique of the present disclosure is applied, λg can be made greater or smaller than the wavelength $\lambda_R$ of an electromagnetic wave in a ridge waveguide lacking any such structures; in the present embodiment, however, λg is smaller than $\lambda_R$. Although not shown in FIG. 8, choke structures may be provided near both ends of the waveguide member 122 along the Y direction. A choke structure may typically be composed of: an additional transmission line having a length of approximately λg/4; and a row of plural grooves having a depth of about λo/4, or plural rods having a height of about λo/4, that are disposed at an end of that additional transmission line. The choke structures confer a phase difference of about 180° (π) between an incident wave and a reflected wave, thereby restraining electromagnetic waves from leaking at both ends of the waveguide member 122. Instead of the second conductive member 120, such choke structures may be provided on the first conductive member 110.

Although not shown, the waveguiding structure in the slot antenna 200 has a port (opening) that is connected to a transmission circuit or reception circuit (i.e., an electronic circuit) not shown. The port may be provided at one end or an intermediate position (e.g., a central portion) of the waveguide member 122 shown in FIG. 8, for example. A signal wave which is sent from the transmission circuit via the port propagates through the waveguide extending upon the ridge 122, and is radiated through each slot 112. On the other hand, an electromagnetic wave which is led into the waveguide through each slot 112 propagates to the reception circuit via the port. At the rear side of the second conductive member 120, a structure including another waveguide that is connected to the transmission circuit or reception circuit (which in the present specification may also be referred to as a "distribution layer") may be provided. In that case, the port serves to couple between the waveguide in the distribution layer and the waveguide on the waveguide member 122.

Note that the interval between the centers of two adjacent slots may have a different value from that of the wavelength λg. This will allow a phase difference to occur at the positions of the plurality of slots 112, so that the azimuth at which the radiated electromagnetic waves will strengthen one another can be shifted from the frontal direction to another azimuth in the YZ plane. Thus, with the slot antenna 200 shown in FIG. 8, directivity within the YZ plane can be adjusted.

In the present embodiment, as described above, gain and directivity adjustments of the antenna can be achieved through adjustments of the shape, position, and number of additional elements, e.g., bumps 122*b*, on the waveguide face 122*a*. The structure and positioning of additional elements may vary depending on the desired performance, and are not limited by the implementation shown in the figures.

A plurality of such antennas, each including a waveguide which has a plurality of slots made therein, may be arrayed along a second direction (e.g., the X direction perpendicular to the first direction) that intersects the first direction, i.e., the direction in which the slots are arrayed. An array antenna including a two-dimensional array of such plural slots on a plate-like conductive member may also be called a flat panel array antenna. Such an array antenna includes: a plurality of slot rows which are parallel to one another; and a plurality of waveguide members. The plurality of waveguide members each have a waveguide face, these waveguide faces respectively facing the plurality of slot rows. In accordance with desired antenna performance, the aforementioned additional elements may be formed as appropriate on the plurality of waveguide faces. Depending on the purpose, the plurality of slot rows which are parallel to one another may vary in length (i.e., in terms of length between the slots at both ends of each slot row). A staggered array may be adopted such that, between two adjacent rows along the X direction, the positions of the slots are shifted along the Y direction. Depending on the purpose, the plurality of slot rows and the plurality of waveguide members may not be parallel, but may be angled.

<Example Dimensions, Etc. Of Each Member>

Next, with reference to FIG. 9, the dimensions, shape, positioning, and the like of each member will be described.

Figure 9:
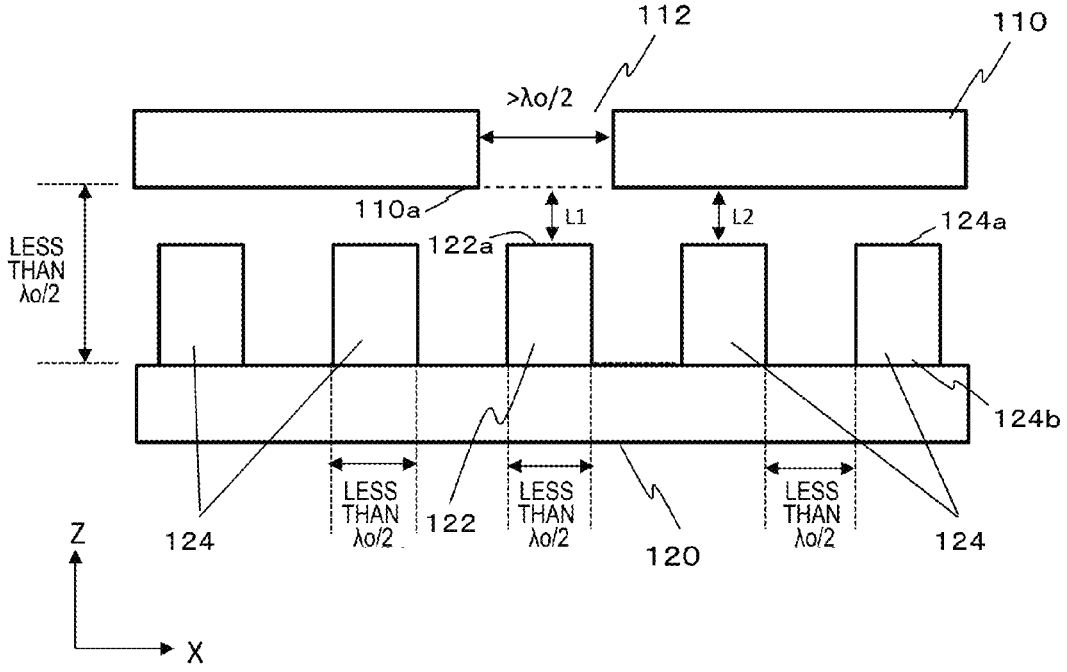
FIG. 9 is a diagram showing an exemplary range of dimension of each member in the structure shown in FIG. 7A.

FIG. 9 is a diagram showing an exemplary range of dimension of each member in the structure shown in FIG. 7A. The slot array antenna is used for at least one of the transmission and the reception of an electromagnetic wave of a predetermined band (referred to as the operating frequency band). In the following description, Ao denotes a wavelength (or, in the case where the operating frequency band has some expanse, a central wavelength corresponding to the center frequency) in free space of an electromagnetic wave (signal wave) propagating in a waveguide extending between the conductive surface 110*a* of the first conductive member 110 and the waveguide face 122*a* of the waveguide member 122. Moreover, λm denotes a wavelength (shortest wavelength), in free space, of an electromagnetic wave of the highest frequency in the operating frequency band. The end of each conductive rod 124 that is in contact with the second conductive member 120 is referred to as the "root". As shown in FIG. 9, each conductive rod 124 has the leading end 124*a* and the root 124*b*. Examples of dimensions, shapes, positioning, and the like of the respective members are as follows.

(1) Width of the Conductive Rod

The width (i.e., the size along the X direction and the Y direction) of the conductive rod 124 may be set to less than λo/2 (preferably less than λm/2). Within this range, for any signal wave with a free-space wavelength of λo or more, resonance of the lowest order can be prevented from occurring along the X direction and the Y direction. Since resonance may possibly occur not only in the X and Y directions but also in any diagonal direction in an X-Y cross section, the diagonal length of an X-Y cross section of the conductive rod 124 is also preferably less than λo/2 (and more preferably less than λm/2). The lower limit values for the rod width and diagonal length will conform to the minimum lengths that are producible under the given manufacturing method, but is not particularly limited.

(2) Distance from the Root of the Conductive Rod to the Conductive Surface of the First Conductive Member The distance from the root 124*b* of each conductive rod 124 to the conductive surface 110*a* of the first conductive member 110 may be longer than the height of the conductive rods 124, while also being less than λo/2 (preferably less than λm/2). When the distance is λo/2 or more, for any signal wave with a free-space wavelength of λo, resonance may occur between the root 124*b* of each conductive rod 124 and the conductive surface 110*a*, thus reducing the effect of signal wave containment.

The distance from the root 124*b* of each conductive rod 124 to the conductive surface 110*a* of the first conductive members 110 corresponds to the spacing between the first conductive member 110 and the second conductive member 120. For example, when a signal wave of 76.5±0.5 GHz (which belongs to the millimeter band or the extremely high frequency band) propagates in the waveguide, the wavelength of the signal wave is in the range from 3.8934 mm to 3.9446 mm. Therefore, λm equals 3.8934 mm in this case, so that the spacing between the first conductive member 110 and the second conductive member 120 can be set to less than a half of 3.8934 mm. So long as the first conductive member 110 and the second conductive member 120 realize such a narrow spacing while being disposed opposite from each other, the first conductive member 110 and the second conductive member 120 do not need to be strictly parallel. Moreover, when the spacing between the first conductive member 110 and the second conductive member 120 is less than λo/2 (preferably less than λm/2), a whole or a part of the first conductive member 110 and/or the second conductive member 120 may be shaped as a curved surface. On the other hand, the first and second conductive members 110 and 120 each have a planar shape (i.e., the shape of their region as perpendicularly projected onto the XY plane) and a planar size (i.e., the size of their region as perpendicularly projected onto the XY plane) which may be arbitrarily designed depending on the purpose.

Figure 7B:
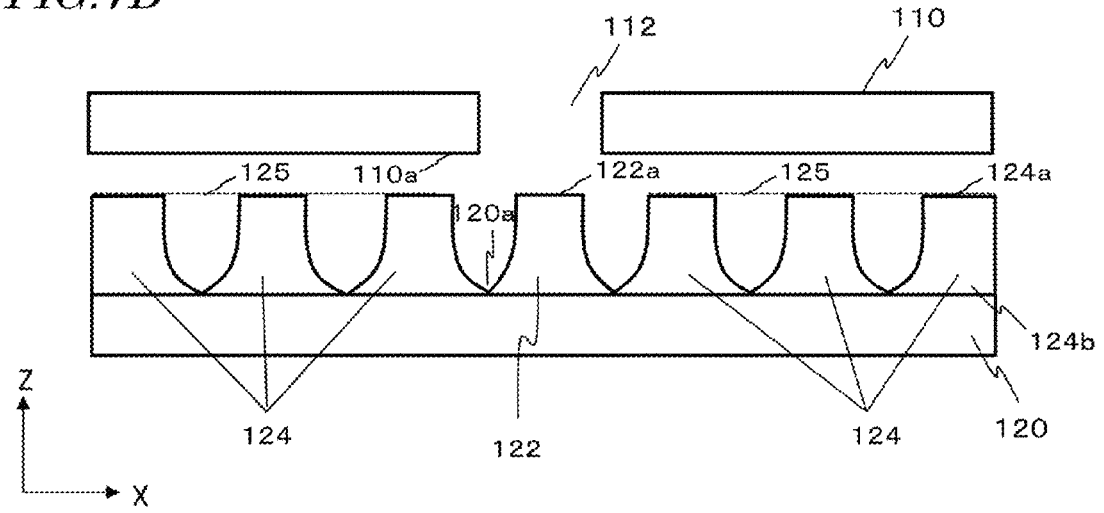
FIG. 7B is a diagram schematically showing another exemplary construction of a cross section through the center of a slot 112, taken parallel to the XZ plane.

Although the conductive surface 120*a* is illustrated as a plane in the example shown in FIG. 7A, embodiments of the present disclosure are not limited thereto. For example, as shown in FIG. 7B, the conductive surface 120*a* may be the bottom parts of faces each of which has a cross section similar to a U-shape or a V-shape. The conductive surface 120*a* will have such a structure when each conductive rod 124 or the waveguide member 122 is shaped with a width which increases toward the root. Even with such a structure, the device shown in FIG. 7B can function as the slot antenna according to an embodiment of the present disclosure so long as the distance between the conductive surface 110*a* and the conductive surface 120*a* is less than a half of the wavelength λo or λm.

(3) Distance L2 from the Leading End of the Conductive Rod to the Conductive Surface The distance L2 from the leading end 124*a* of each conductive rod 124 to the conductive surface 110*a* is set to less than λo/2 (preferably less than λm/2). When the distance is λo/2 or more, for any electromagnetic wave with a free-space wavelength of λo, a propagation mode that reciprocates between the leading end 124*a* of each conductive rod 124 and the conductive surface 110*a* may occur, thus no longer being able to contain an electromagnetic wave. Note that, among the plurality of conductive rods 124, at least those which are adjacent to the waveguide member 122 (described later) do not have their leading ends in electrical contact with the conductive surface 110*a*. As used herein, the leading end of a conductive rod not being in electrical contact with the conductive surface means either of the following states: there being an air gap between the leading end and the conductive surface; or the leading end of the conductive rod and the conductive surface adjoining each other via an insulating layer which may exist in the leading end of the conductive rod or in the conductive surface.

(4) Arrangement and Shape of Conductive Rods

The interspace between two adjacent conductive rods 124 among the plurality of conductive rods 124 has a width of less than λo/2 (preferably less than λm/2), for example. The width of the interspace between any two adjacent conductive rods 124 is defined by the shortest distance from the surface (side face) of one of the two conductive rods 124 to the surface (side face) of the other. This width of the interspace between rods is to be determined so that resonance of the lowest order will not occur in the regions between rods. The conditions under which resonance will occur are determined based by a combination of: the height of the conductive rods 124; the distance between any two adjacent conductive rods; and the capacitance of the air gap between the leading end 124*a* of each conductive rod 124 and the conductive surface 110*a*. Therefore, the width of the interspace between rods may be appropriately determined depending on other design parameters. Although there is no clear lower limit to the width of the interspace between rods, for manufacturing ease, it may be e.g. λo/16 or more when an electromagnetic wave in the extremely high frequency band is to be propagated. Note that the interspace does not need to have a constant width. So long as it remains less than λo/2, the interspace between conductive rods 124 may vary.

The arrangement of the plurality of conductive rods 124 is not limited to the illustrated example, so long as it exhibits a function of an artificial magnetic conductor. The plurality of conductive rods 124 do not need to be arranged in orthogonal rows and columns; the rows and columns may be intersecting at angles other than 90 degrees. The plurality of conductive rods 124 do not need to form a linear array along rows or columns, but may be in a dispersed arrangement which does not present any straightforward regularity. The conductive rods 124 may also vary in shape and size depending on the position on the second conductive member 120.

The surface 125 of the artificial magnetic conductor that are constituted by the leading ends 124*a* of the plurality of conductive rods 124 does not need to be a strict plane, but may be a plane with minute rises and falls, or even a curved surface. In other words, the conductive rods 124 do not need to be of uniform height, but rather the conductive rods 124 may be diverse so long as the array of conductive rods 124 is able to function as an artificial magnetic conductor.

Furthermore, each conductive rod 124 does not need to have a prismatic shape as shown in the figure, but may have a cylindrical shape, for example. Furthermore, each conductive rod 124 does not need to have a simple columnar shape, but may have a mushroom shape, for example. The artificial magnetic conductor may also be realized by any structure other than an array of conductive rods 124, and various artificial magnetic conductors are applicable to the waveguide structure according to the present disclosure. Note that, when the leading end 124*a* of each conductive rod 124 has a prismatic shape, its diagonal length is preferably less than λo/2. When the leading end 124*a* of each conductive rod 124 is shaped as an ellipse, the length of its major axis is preferably less than λo/2 (and more preferably less than λm/2). Even when the leading end 124*a* has any other shape, the dimension across it is preferably less than λo/2 (and more preferably less than λm/2) even at the longest position.

(5) Width of the Waveguide Face

The width of the waveguide face 122*a* of the waveguide member 122, i.e., the size of the waveguide face 122*a* along a direction which is orthogonal to the direction that the waveguide member 122 extends, may be set to less than λo/2 (preferably less than λm/2, e.g., λo/8). If the width of the waveguide face 122*a* is λo/2 or more, for any electromagnetic wave with a free-space wavelength of λo, resonance will occur along the width direction, which will prevent any WRG from operating as a simple transmission line.

(6) Height of the Waveguide Member

The height (i.e., the size along the Z direction in the example shown in the figure) of the waveguide member 122 is set to less than λo/2 (preferably less than λm/2). The reason is that, if the distance is λo/2 or more, the distance between the root 124*b* of each conductive rod 124 and the conductive surface 110*a* will be λo/2 or more. Similarly, the height of the conductive rods 124 (especially those conductive rods 124 which are adjacent to the waveguide member 122) is set to less than λo/2 or less than λm/2.

(7) Distance L1 Between the Waveguide Face and the Conductive Surface

The distance L1 between the waveguide face 122*a* of the waveguide member 122 and the conductive surface 110*a* is set to less than λo/2 (preferably less than λm/2). If the distance is λo/2 or more, for any electromagnetic wave with a free-space wavelength of λo, resonance will occur between the waveguide face 122*a* and the conductive surface 110*a*, which will prevent functionality as a waveguide. In one example, the distance is λo/4 or less. In order to ensure manufacturing ease, when an electromagnetic wave in the extremely high frequency band is to propagate, the distance L1 is preferably λo/16 or more, for example.

The lower limit of the distance L1 between the conductive surface 110*a* and the waveguide face 122*a* and the lower limit of the distance L2 between the conductive surface 110*a* and the leading end 124*a* of each rod 124 depends on the machining precision, and also on the precision when assembling the two upper/lower conductive members 110 and 120 so as to be apart by a constant distance. When a pressing technique or an injection technique is used, the practical lower limit of the aforementioned distance is about 50 micrometers (μm). In the case of using an MEMS (Micro-Electro-Mechanical System) technique to make a product in e.g. the terahertz range, the lower limit of the aforementioned distance is about 2 to about 3 μm.

(8) Arraying Interval and Size of Slots

The distance (slot interval) a between the centers of two adjacent slots 112 in the slot antenna 200 may be set to, for example, an integer multiple of λg (typically the same value as λg), where λg is the intra-waveguide wavelength of a signal wave propagating in the waveguide (or, in the case where the operating frequency band has some expanse, a central wavelength corresponding to the center frequency). As a result of this, when standing-wave series feed is applied, an equiamplitude and equiphase state can be realized at the position of each slot. Note that the interval a between the centers of two adjacent slots is determined by the required directivity characteristics, and therefore may not be equal to λg in some cases. Although the number of slots 112 is six in the present embodiment, the number of slots 112 may be any number which is equal to or greater than two.

In the examples shown in FIG. 8 and FIG. 9, each slot has a planar shape which is nearly rectangular, measuring longer along the X direction and shorter along the Y direction. Assuming that each slot has a size (length) L along the X direction and a size (width) W along the Y direction, L and W are set to values at which higher-order mode oscillation does not occur and at which the slot impedance is not too small. For example, L may be set to a range of $\lambda o/2<L<\lambda o$. W may be less than λo/2. In order to actively utilize higher-order modes, L may possibly be larger than λo.

Next, more specific embodiments of the slot array antenna having the above construction will be described.

Embodiment 1

Embodiment 1 relates to a slot array antenna (which hereinafter may simply be referred to as an "array antenna") to which standing-wave series feed is applied in order to excite a plurality of slots with an equiamplitude and equiphase and achieve a high gain. The slot array antenna according to the present disclosure is not limited to a construction where the plurality of slots are excited with an equiamplitude and equiphase; however, for ease of understanding the invention, the present embodiment will illustrate a slot array antenna which achieves equiamplitude-equiphase excitation to maximize the gain, this being the simplest example.

First, the principle of standing-wave series feed will be described.

Figure 10:
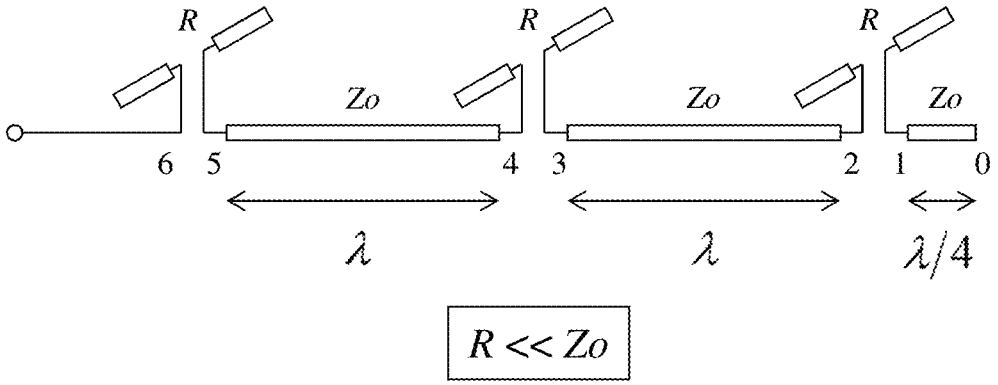
FIG. 10 is a principle diagram showing an exemplary array antenna under ideal standing-wave series feed.
Figure 11:
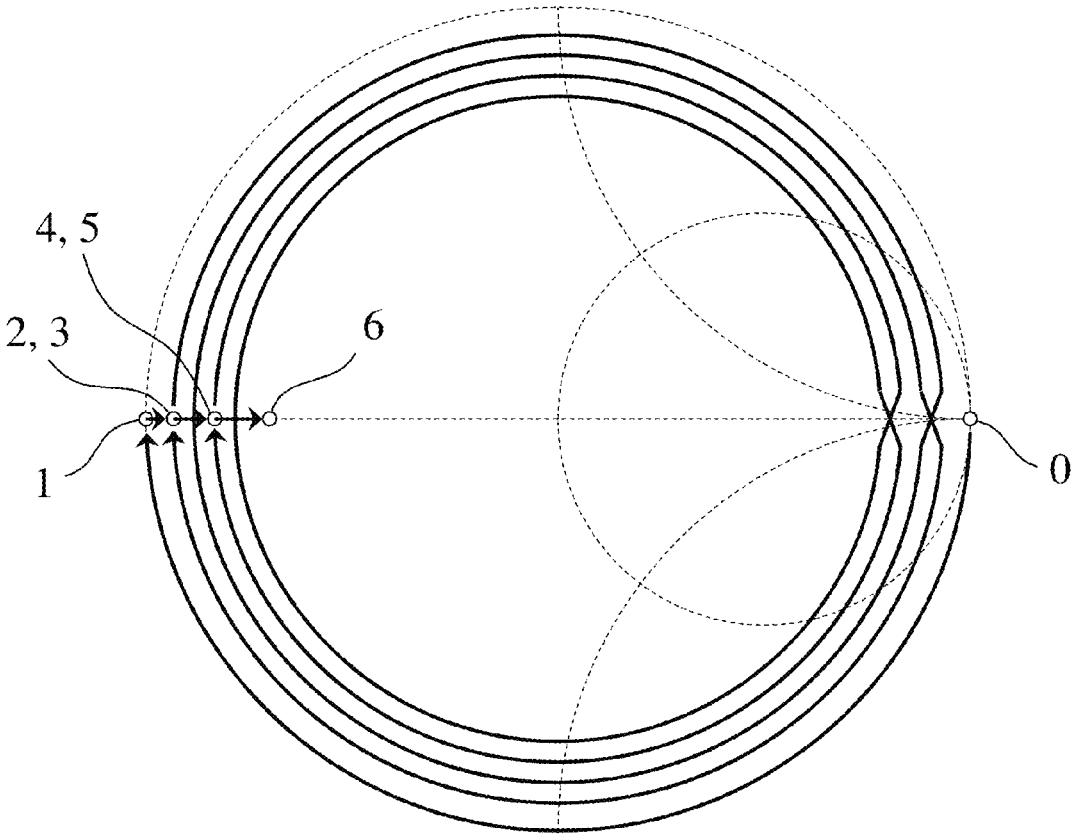
FIG. 11 is a Smith chart representation of an impedance locus at different points in the array antenna shown in FIG. 10, as viewed from the antenna input terminal side (the left side in FIG. 10).
Figure 12:
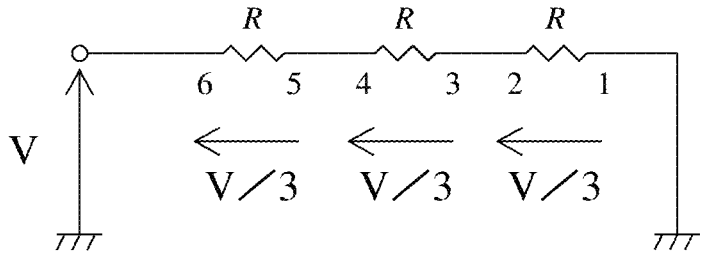
FIG. 12 is a diagram showing an equivalent circuit of the array antenna of FIG. 10, where attention is paid to voltages at both ends of radiating elements.

FIG. 10 is a principle diagram showing an exemplary array antenna under ideal standing-wave series feed. FIG. 11 is a Smith chart representation of an impedance locus at different points in the array antenna shown in FIG. 10, as viewed from the antenna input terminal side (the left side in FIG. 10). FIG. 12 shows an equivalent circuit of the array antenna of FIG. 10, where attention is paid to voltages at both ends of radiating elements.

In the array antenna under ideal standing-wave series feed as shown in FIG. 10, the impedance of each radiating element is sufficiently small relative to the characteristic impedance Zo of the feeding network, and only has a pure resistance component R. Moreover, each radiating element is inserted in series at a position that maximizes the amplitude of a standing wave current. Therefore, as shown in FIG. 11, the impedance locus (1→2, 3→4, and 5→6) at both ends of each radiating element is within a region approximating a short-circuit impedance on the real axis of the Smith chart. Furthermore, since the length between both ends of the path connecting any two adjacent radiating elements is equal to the wavelength λ, the impedance locus therebetween (2→3 and 4→5) makes two turns clockwise around the center of the Smith chart before returning to the original point. In other words, when only paying attention to the amplitude and phase of the voltage of each radiating element, an input signal (voltage V) is aliquoted over all radiating elements as indicated by the equivalent circuit of FIG. 12. As a result, all radiating elements are excited with an equiamplitude and equiphase.

Next, effects that are provided by the array antenna of the present embodiment will be described, by way of comparison between the construction disclosed in Patent Document 1 and the construction according to the present embodiment, in a scenario where standing-wave series feed is to be applied to an array antenna in which a WRG and radiating slots are used.

Figure 13A:
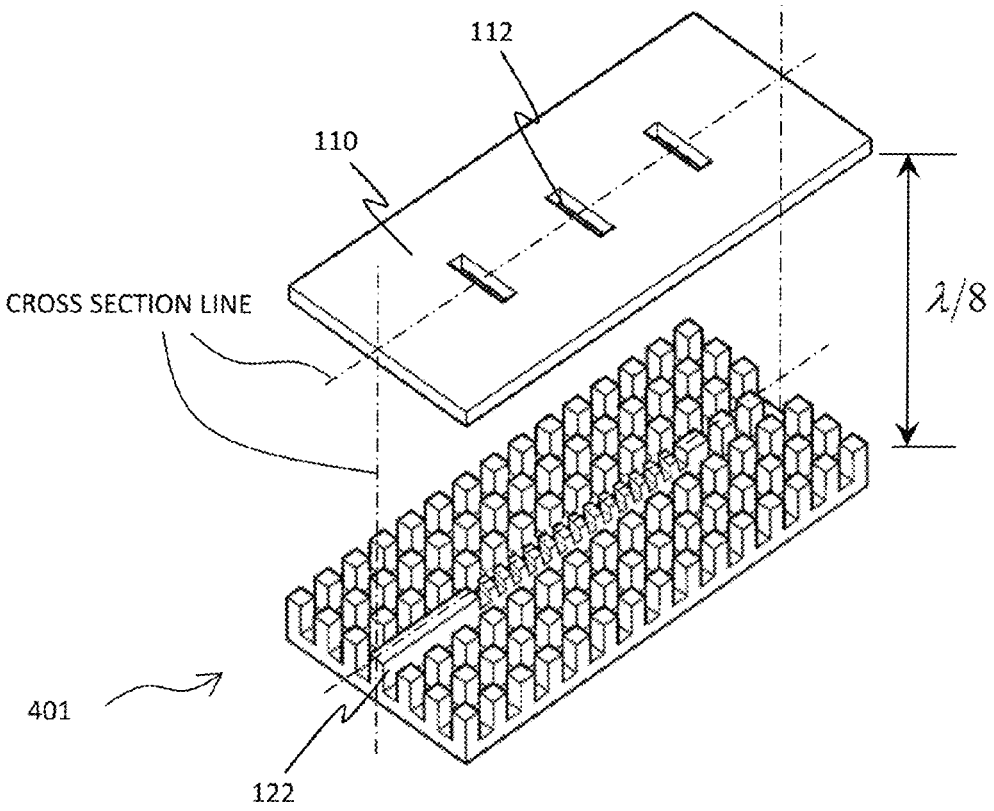
FIG. 13A is a perspective view showing an exemplary array antenna 401 (Comparative Example) having a similar structure to a structure which is disclosed in Patent Document 1.
Figure 13B:
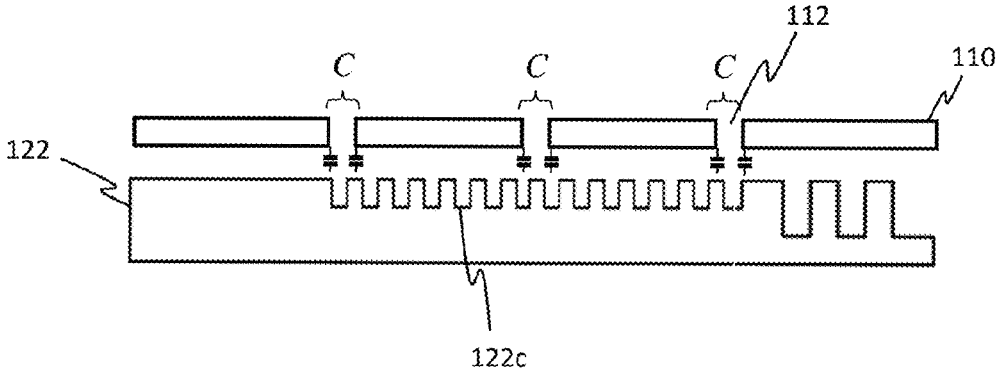
FIG. 13B is a cross-sectional view showing an exemplary array antenna 401 (Comparative Example) having a similar structure to a structure which is disclosed in Patent Document 1.

FIG. 13A and FIG. 13B show an exemplary array antenna 401 (Comparative Example) having a structure to which the structure disclosed in Patent Document 1 is partly applied. FIG. 13A is a perspective view showing the structure of the array antenna 401, and FIG. 13B is a cross-sectional view of the array antenna 401, taken along a plane which extends through the centers of a plurality of slots 112 and the center of a ridge 122.

Figure 14A:
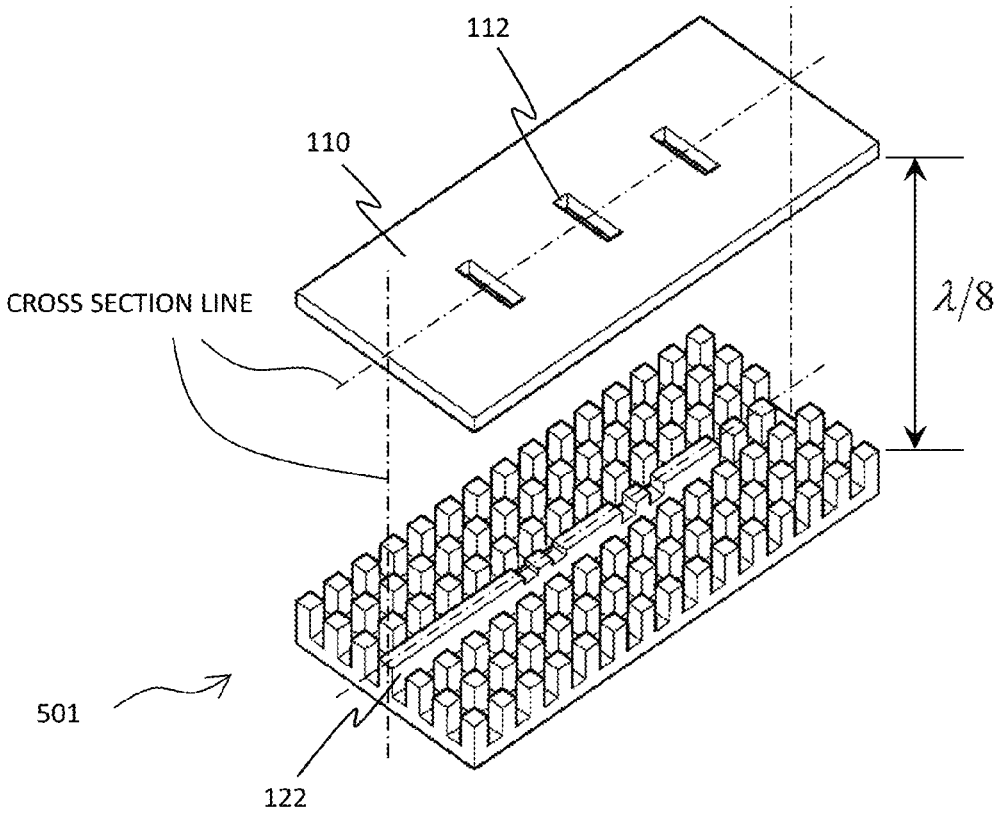
FIG. 14A is a perspective view showing an array antenna 501 according to Embodiment 1.
Figure 14B:
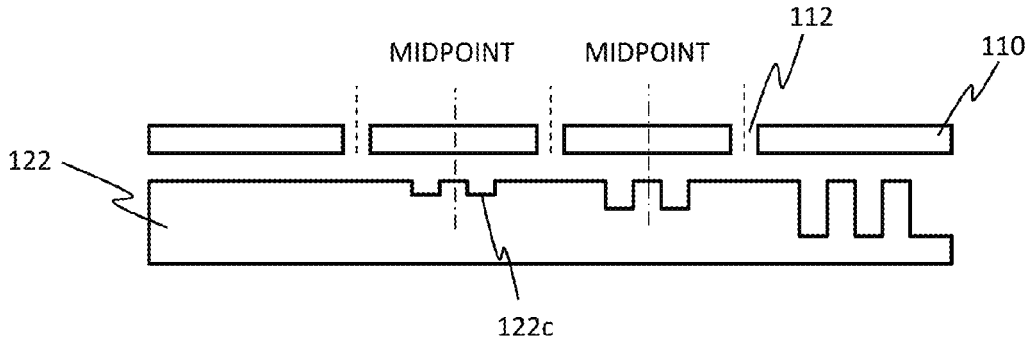
FIG. 14B is a cross-sectional view showing an array antenna 501 according to Embodiment 1.

FIG. 14A and FIG. 14B show an array antenna 501 according to the present embodiment. FIG. 14A is a perspective view showing the structure of the array antenna 501, and FIG. 14B is a cross-sectional view of the array antenna 501, taken along a plane which extends through the centers of a plurality of slots 112 and the center of a ridge 122.

As described earlier, under ideal standing-wave series feed, the impedance of each radiating element only has a pure resistance component which is sufficiently small relative to the characteristic impedance of the feeding network. However, it has been found through a study by the inventors that the impedance of each radiating slot 112 becomes about equal to or greater than the characteristic impedance of the feeding network in the case where radiating slots 112 are used for a WRG, as in the example shown in FIG. 13A and FIG. 13B and the example shown in FIG. 14A and FIG. 14B. In other words, in actuality, there exists a non-negligible change (relative to the wavelength λ) before and after insertion of the radiating slots 112, in the position(s) at which the voltage amplitude becomes maximum and the position(s) at which the current amplitude becomes maximum. This means that, in order to achieve desired radiation characteristics, the waveguide and the slots cannot be independently designed (i.e., both need to be optimized simultaneously). Such a problem has hitherto not been recognized at all. Since the impedance of the slots, which are radiowave excitation openings, is non-negligible as compared to the impedance of the feeding network, an alternative design method to replace the aforementioned standing wave method is needed for a WRG-based slot array antenna.

In order to solve the above problem, the inventors have invented a novel method (which hereinafter may be referred to as an "enhanced standing wave method") to replace the conventional standing wave method. This enhanced standing wave method extends the notion of standing-wave feed so that, within the aforementioned detection method under ideal standing-wave series feed, a method is established that detects equiamplitude-equiphase excitation on the basis of an impedance locus through various points of the array antenna. Specifically, the following two criteria are adopted as a method of detecting whether equiamplitude-equiphase excitation is being achieved:

(1) the impedance locus at both ends of every radiating slot is located on the real axis; and (2) the impedance locus at both ends of a region connecting any two adjacent radiating elements matches after making two turns around the center of the Smith chart.

In the present embodiment, additional elements that change at least one of inductance and capacitance of the path are disposed at appropriate positions so as to satisfy conditions (1) and (2). As a result of this, equiamplitude-equiphase excitation is achieved.

Hereinafter, a construction according to the present embodiment will be described in comparison with the construction of Comparative Example.

In Comparative Example illustrated in FIG. 13A and FIG. 13B, the dents 122*c* are periodically arrayed at short constant intervals. In the construction of Patent Document 1, the period of the array of dents 122*c* is less than ¼ of the wavelength $\lambda_R$ of a signal wave in a waveguide lacking the dents 122*c*. The wavelength $\lambda_R$ is a length which is close to the distance between the centers of two adjacent slots. A transmission line on which a plurality of dents 122*c* are formed with such a short period can usually be regarded as a distributed constant circuit having a constant characteristic impedance, and is in fact explained as such in Patent Document 1. However, the inventors have arrived at the concept of regarding the additional elements such as dents 122*c* as if lumped-parameter elements, thus accomplishing the claimed invention based on this concept.

In the present embodiment, as shown in FIG. 14B, dents 122*c* are formed in regions other than the regions opposing the radiating slots 112. Furthermore, the dents 122*c* are disposed so that, in each region between two adjacent radiating slots 112, a combination of identical dents 122*c* are provided symmetrically on both sides of a midpoint between the two radiating slots 112. As shown in FIG. 14B, the dents 122*c* may vary in depth from place to place. Moreover, as necessary, an alternative construction may be adopted where dents are disposed in the regions opposing the radiating slots 112.

Figure 15:
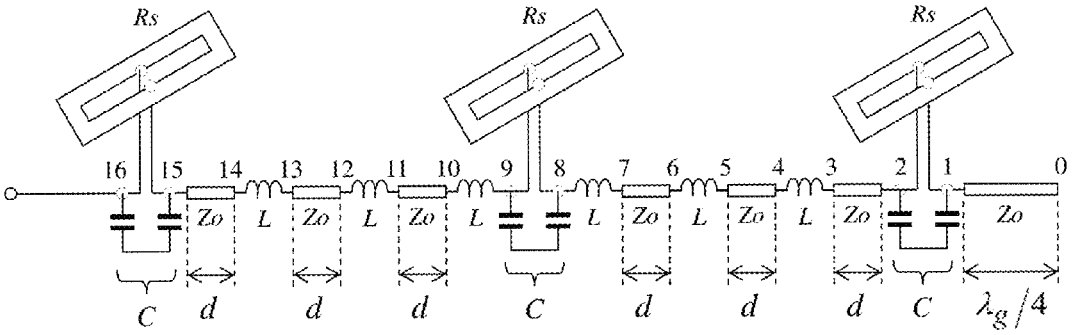
FIG. 15 shows an equivalent circuit of the series-feed array antenna shown in FIG. 13A and FIG. 13B.

FIG. 15 shows an equivalent circuit of the series-feed array antenna of Comparative Example shown in FIG. 13A and FIG. 13B. In FIG. 15, a radiation impedance (pure resistance) of any radiating slot is denoted as Rs; a characteristic impedance of any partial path lacking a dent is denoted as Z0; the length of any partial path lacking a dent is denoted as d; an equivalent series inductance component ascribable to any dent is denoted as L; and a parasitic capacitance that is created between any radiating slot and the WRG is denoted as C.

Figure 16:
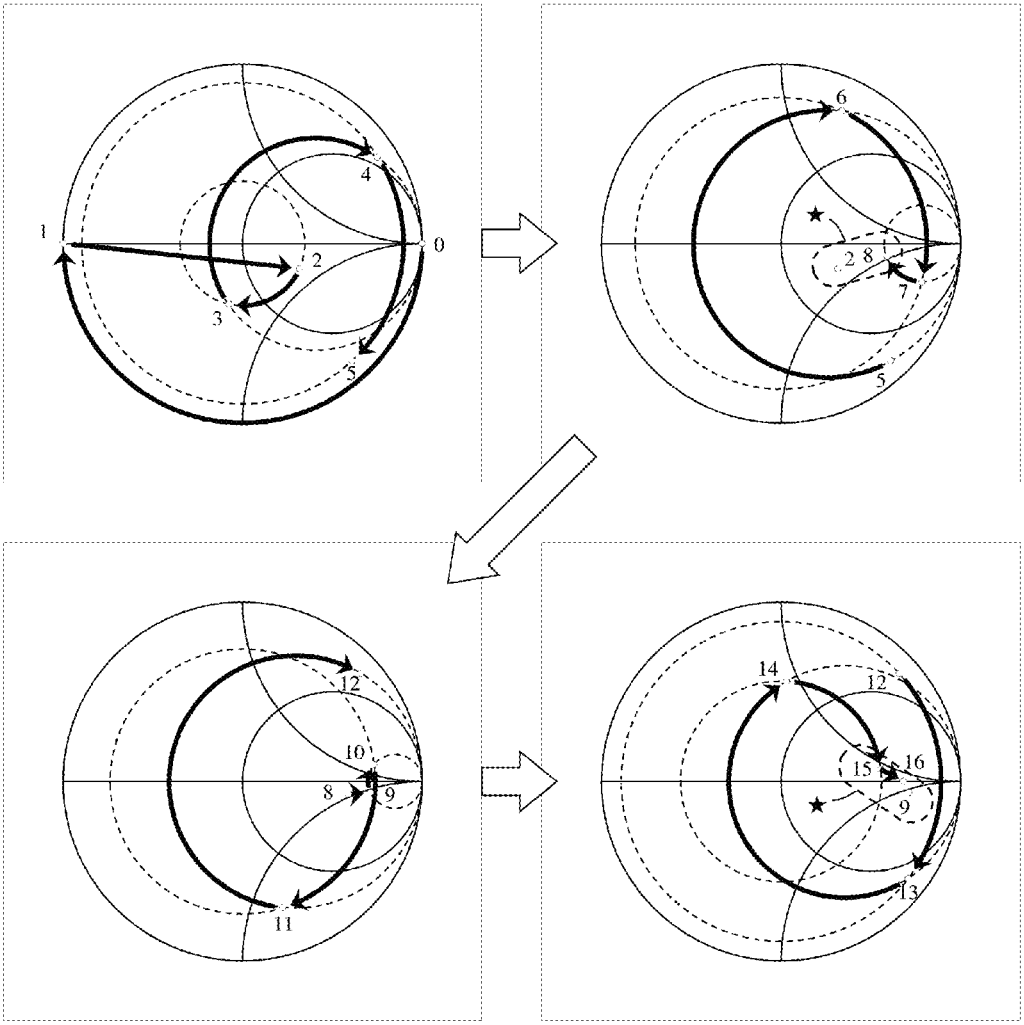
FIG. 16 is a Smith chart representation of an impedance locus in the equivalent circuit shown in FIG. 15 at points 0 to 16.

FIG. 16 is a Smith chart representation of an impedance locus in the equivalent circuit shown in FIG. 15 at points 0 to 16. In FIG. 16, any arrow connecting between points represents a locus of: a synthetic impedance of a resistance Rs of a radiating slot and its parasitic capacitance C; a characteristic impedance Zo of a partial path; and an impedance due to a series inductance component L.

By taking corresponding looks at FIG. 15 and FIG. 16, one would be able to see the impedance locus in the equivalent circuit of the array antenna of Comparative Example and why there would be such a locus. As shown in FIG. 15 and FIG. 16, the impedance locus begins at the open end 0. When partial paths (impedance Zo) are inserted in the equivalent circuit (0→1, 2→3, 4→5, 6→7, 10→11, 12→13, 14→15), the reflection phase will rotate along a circle of a constant radius, in a manner of lagging, around the center of the Smith chart. When parallel synthetic impedances of radiation impedance (resistance Rs) and parasitic capacitance C are inserted (1→2, 8→9, 15→16) and when equivalent series inductances L are inserted (3→4, 5→6, 7→8, 9→10, 11→12, 13→14), movements on the Smith chart will occur via a locus that is specific to each inserted impedance.

Note that the impedance locus shown in FIG. 16 was obtained by setting the values of Zo, Rs, w, C, L and d so as to satisfy the four equations shown in FIG. 15. ω represents an angular frequency of a signal wave; and λg as indicated in FIG. 15 represents the wavelength of a signal wave in the waveguide. These values have been determined so that the aforementioned criteria for detecting equiamplitude-equiphase excitation are satisfied to the best extent under the constraints of the conventional technique: identical bump/dent shapes are deployed over the entire path with a constant period in order to control the wavelength of the WRG before any radiating elements are provided thereon. In other words, these values are a result of selecting the path lengths between dents and the dent depths so that the impedance locus, through points 2 to 8 and through points 9 to 15, will come as close to the original point as possible after making two turns around the center of the Smith chart. Stated otherwise, the impedance locus shown in FIG. 16 represents an optimum state that most closely approximates an equiamplitude-equiphase excitation state in the conventional array antenna.

However, the consequence is that, as is indicated by FIG. 16, with respect to none of the radiating slots is the impedance locus at their both ends (1→2, 8→9, 15→16) located on the real axis. Furthermore, the impedance locus at both ends of each region connecting between two adjacent radiating elements (2→8, 9→15; shown within each broken-lined region indicated with a ★ in FIG. 16) does not match, although making two turns around the center of the Smith chart. This means that the conventional array antenna cannot achieve an equiamplitude-equiphase excitation even though its design may be targeted at equiamplitude and equiphase, thus being unable to maximize the gain. The reason behind this is its structure, which merely involves deploying identical bump/dent shapes over the entire path with a constant period in order to control the wavelength of the WRG before any radiating elements are provided thereon. This situation is unaffected even if the relative positioning of the radiating slots and dents is specifically correlated and the parasitic capacitance C is made constant across all slots. In fact, as shown in FIG. 15, the impedance locus shown in FIG. 16 was obtained under conditions such that the parasitic capacitance C was equal in every slot.

One conceivable method of eliminating the parasitic capacitance C may be to adopt a structure in which dents are not provided in any region overlapping a slot. It might also be possible to differentiate the parasitic capacitance C from slot to slot, so as to adjust the excitation condition in each slot. However, neither of these will provide a solution as it is. Conventionally, in order to control the wavelength of an electromagnetic wave propagating in a WRG, it was desired that dents or the like be uniformly disposed with a period which is smaller than $\lambda_R/4$, given a wavelength $\lambda_R$ of an electromagnetic wave in a WRG with no dents or the like being provided. The reason is that it was considered necessary to uniformly vary the characteristic impedance of a feeding network (as a distributed constant circuit) in order to ensure that each interval among the plurality of slots is equal to the wavelength λg of an electromagnetic wave in the WRG. In the aforementioned structure where dents are not provided in any region overlapping a slot, or the aforementioned structure where the parasitic capacitance C is made different in each slot position, the WRG will have a structure with a period of $\lambda_R/4$ or more. No method was conventionally known to construct a WRG-based slot array antenna in such an aperiodic or non-uniform structure.

Next, an operation of the array antenna of the present embodiment will be described.

Figure 17:
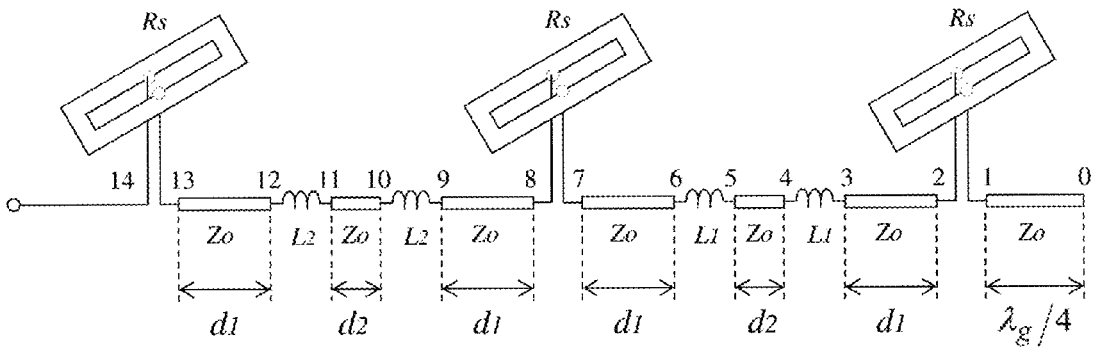
FIG. 17 is a diagram showing an equivalent circuit of an array antenna shown in FIG. 14A and FIG. 14B, which is based on series feed.

FIG. 17 shows an equivalent circuit of the array antenna shown in FIG. 14A and FIG. 14B, which is based on standing-wave series feed. In FIG. 17, a radiation impedance (pure resistance) of any radiating slot is denoted as Rs; a characteristic impedance of any partial path lacking a dent is denoted as Zo; the length of any continuous partial path that lacks a dent is denoted as d1 or d2; and an equivalent series inductance component ascribable to any dent is denoted as L1 or L2.

Figure 18:
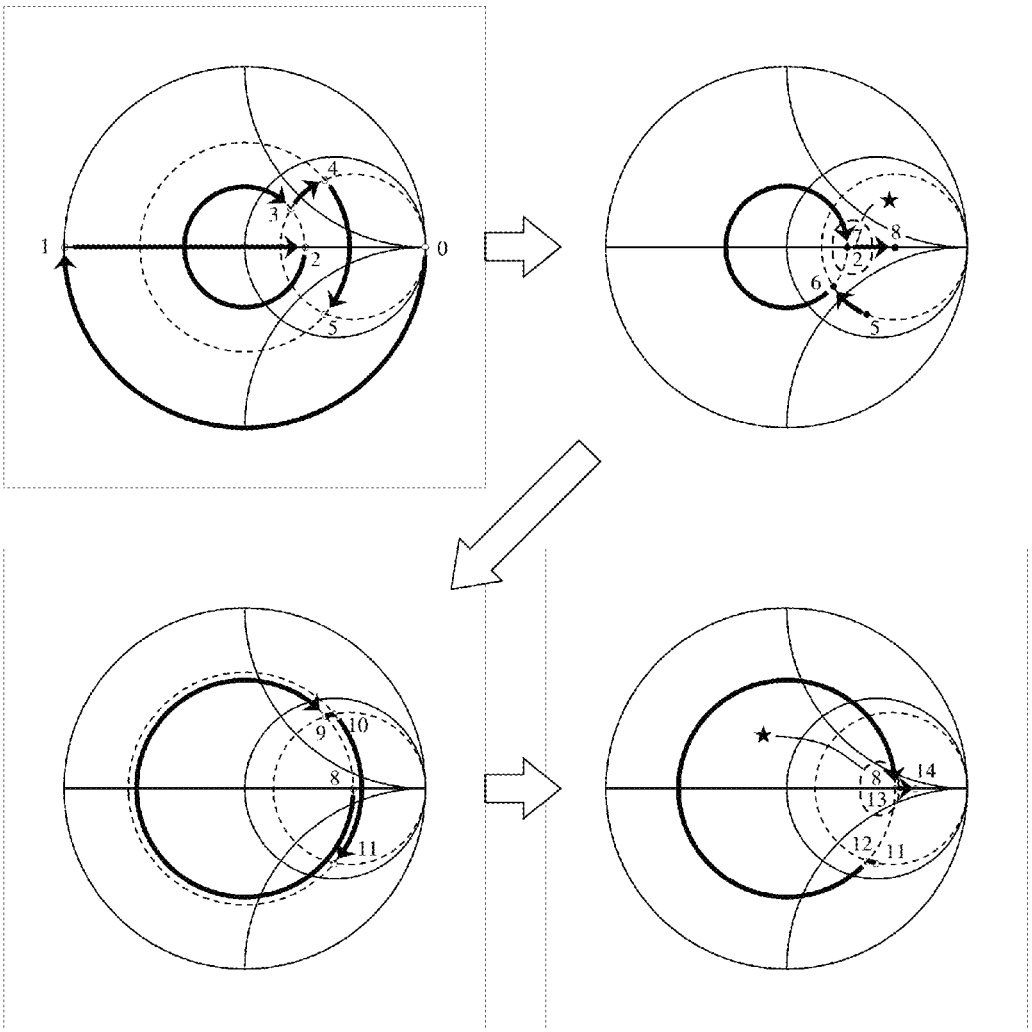
FIG. 18 is a Smith chart representation of an impedance locus in the equivalent circuit shown in FIG. 17 at points 0 to 14.

FIG. 18 is a Smith chart representation of an impedance locus in the equivalent circuit shown in FIG. 17 at points 0 to 14. In FIG. 18, any arrow connecting between points represents an impedance locus of: a characteristic impedance Zo of a partial path; a resistance Rs of a radiating slot; and a series inductance component L.

By taking corresponding looks at FIG. 17 and FIG. 18, one would be able to see the impedance locus in the equivalent circuit of the array antenna of the present embodiment and why there would be such a locus. As shown in FIG. 17 and FIG. 18, the impedance locus begins at the open end 0. When partial paths (impedance Zo) are inserted in the equivalent circuit (0→1, 2→3, 4→5, 6→7, 8→9, 10→11, 12→13), the reflection phase will rotate along a circle of a constant radius, in a manner of lagging, around the center of the Smith chart. When radiation impedances (resistance Rs) are inserted (1→2, 7→8, 13→14) and equivalent series inductances L are inserted (3→4, 5→6, 9→10, 11→12), movements on the Smith chart will occur via a locus that is specific to each inserted impedance.

Note that the impedance locus shown in FIG. 18 was obtained by setting the values of Zo, Rs, ω, L1, L2, d1 and d2 so as to satisfy the five equations shown in FIG. 17. These values are a result of selecting the positions of the dents 122*c* and the depths of the dents 122*c* so that the aforementioned criteria for detecting equiamplitude-equiphase excitation are satisfied to the best extent possible by the array antenna of the present embodiment shown in FIG. 14A and FIG. 14B. Stated otherwise, the impedance locus shown in FIG. 18 represents an optimum state that most closely approximates an equiamplitude-equiphase excitation state in the array antenna of the present embodiment. Therefore, the impedance locus in an actual device may differ from the ideal impedance locus shown in FIG. 18.

In the array antenna of the present embodiment, in an optimum state, the impedance locus at both ends of every radiating slot (1→2, 7→8, 13→14) is located on the real axis. Furthermore, the impedance locus at both ends of each region connecting between two adjacent radiating elements (2→7, 8→13; shown within each broken-lined region indicated with a ★ in FIG. 18) matches the original point after making two turns around the center of the Smith chart. This means that the array antenna of the present embodiment is able to achieve equiamplitude-equiphase excitation, thus maximizing the gain.

Thus, in accordance with the present embodiment, by using an enhanced standing wave method in disposing a plurality of dents at appropriate positions on the waveguide face, an ideal standing wave excitation is achieved to maximize the gain of the array antenna.

Embodiment 2

Figure 19A:
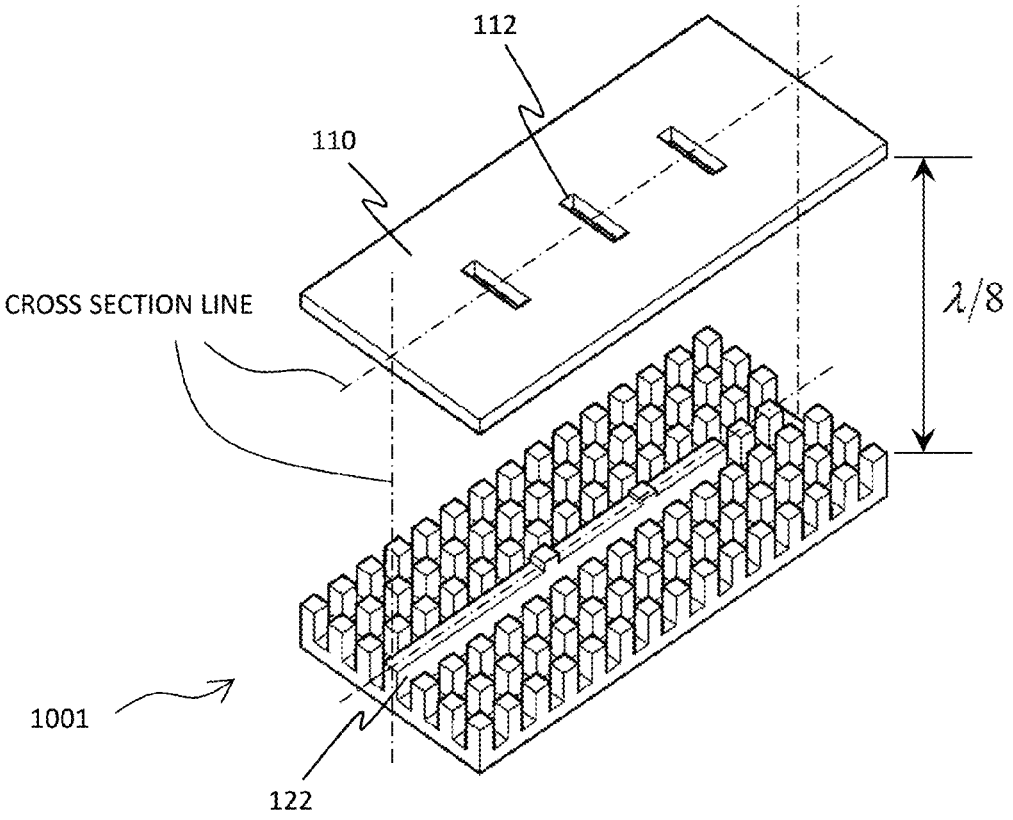
FIG. 19A is a perspective view showing the structure of an array antenna 1001 according to Embodiment 2.
Figure 19B:
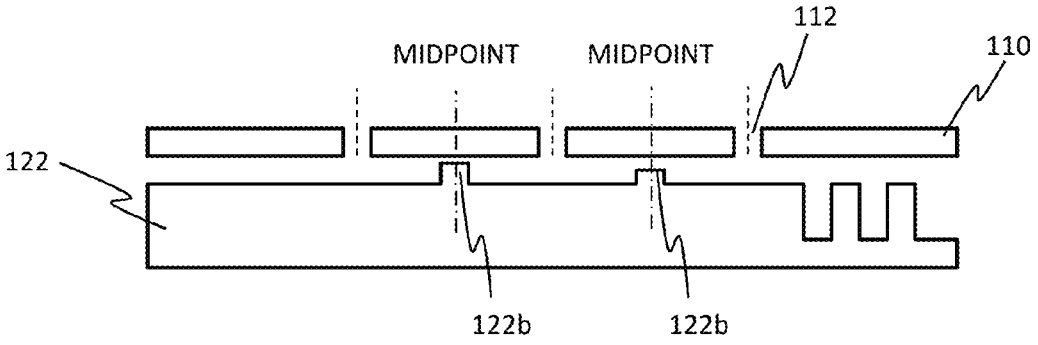
FIG. 19B is a cross-sectional view of the array antenna shown in FIG. 19A, taken along a plane which extends through the centers of a plurality of radiating slots 112 and the center of a ridge 122.

FIG. 19A is a perspective view showing the structure of an array antenna 1001 according to a second embodiment of the present disclosure. FIG. 19B is a cross-sectional view of the array antenna shown in FIG. 19A, taken along a plane which extends through the centers of a plurality of radiating slots 112 and the center of a ridge 122. In the present embodiment, too, according to the principle of standing-wave series feed, every radiating slot 112 is designed in a resonant state so that its radiation impedance equals its pure resistance component. Moreover, all radiating slots 112 are of an identical shape.

In the present embodiment, in order to control the wavelength and phase of a standing wave, structures that are distinct from other partial paths, i.e., bumps 122*b*, are provided as additional elements on the WRG. The bumps 122*b* are disposed so that, in each region between two adjacent radiating slots 112, a combination of identical bumps 122*b* are provided symmetrically on both sides of a midpoint between the two radiating slots 112. In particular, in the embodiment illustrated in FIG. 19A and FIG. 19B, two symmetrically-disposed bumps meet at each midpoint to form a single merged bump 122*b*.

Figure 20:
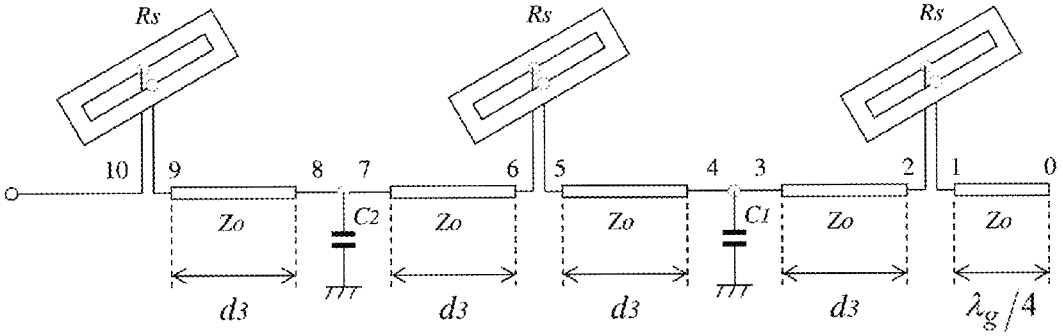
FIG. 20 is a diagram showing an equivalent circuit of an array antenna according to Embodiment 2 to which standing-wave series feed is applied.

FIG. 20 shows an equivalent circuit of the array antenna according of the present embodiment to which standing-wave series feed is applied. In FIG. 20, a radiation impedance (pure resistance) of any radiating slot is denoted as Rs; a characteristic impedance of any partial path lacking a bump is denoted as Zo; the length of any continuous partial path that lacks a bump is denoted as d3; and a parallel capacitance component ascribable to any bump is denoted as C1 or C2.

Figure 21:
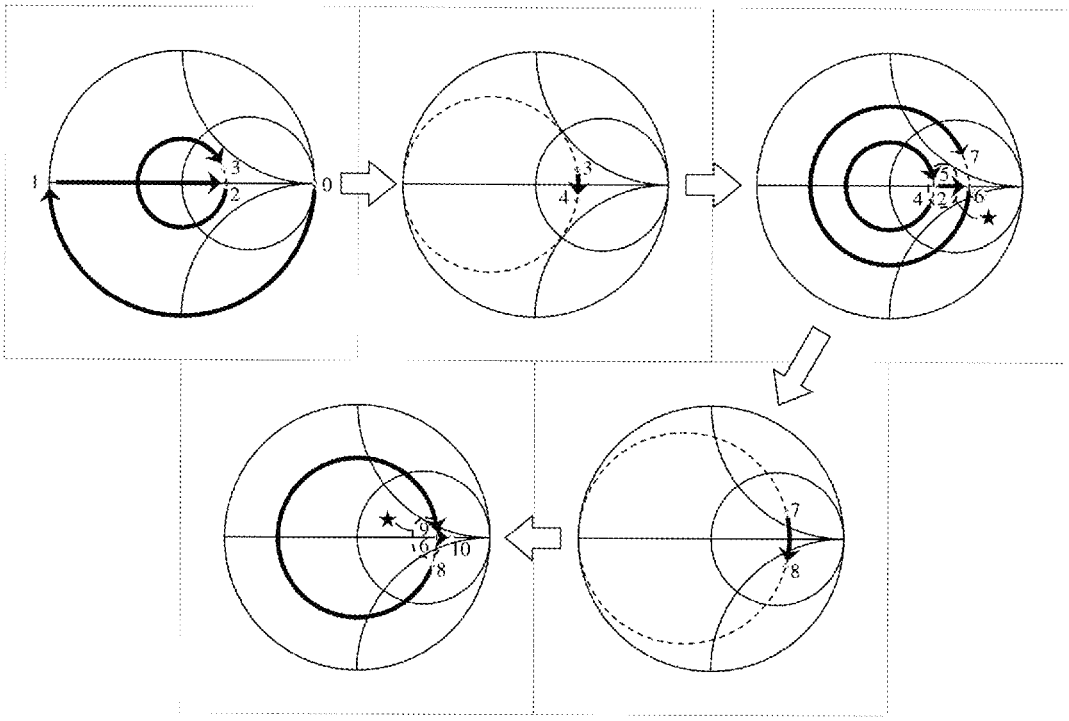
FIG. 21 is a Smith chart representation of an impedance locus of the equivalent circuit shown in FIG. 20 at points 0 to 10.

FIG. 21 is a Smith chart representation of an impedance locus in the equivalent circuit shown in FIG. 20 at points 0 to 10. In FIG. 21, any arrow connecting between points represents an impedance locus of: a characteristic impedance Zo of a partial path; a resistance Rs of a radiating slot; and a parallel capacitance component C1, C2.

By taking corresponding looks at FIG. 20 and FIG. 21, one would be able to see the impedance locus in the equivalent circuit of the array antenna of the present embodiment and why there would be such a locus. As shown in FIG. 20 and FIG. 21, the impedance locus begins at the open end 0. When partial paths (impedance Zo) are inserted in the equivalent circuit (0→1, 2→3, 4→5, 6→7, 8→9), the reflection phase will rotate along a circle of a constant radius, in a manner of lagging, around the center of the Smith chart. When radiation impedances (resistance Rs) are inserted (1→2, 5→6, 9→10) and when equivalent parallel capacitances C1 and C2 are inserted (3→4, 7→8), movements on the Smith chart will occur via a locus that is specific to each inserted impedance.

Note that the impedance locus shown in FIG. 21 was obtained by setting the values of Zo, Rs, w, C1, C2 and d3 so as to satisfy the four equations shown in FIG. 20. These values are a result of selecting the bump positions and the bump heights so that the aforementioned criteria for detecting equiamplitude-equiphase excitation are satisfied to the best extent possible by the array antenna of the present embodiment shown in FIG. 19A and FIG. 19B. Stated otherwise, the impedance locus show in FIG. 21 represents an optimum state that most closely approximates an equiamplitude-equiphase excitation state in the array antenna of the present embodiment.

As a result of this, in the array antenna of the present embodiment, the impedance locus at both ends of every radiating slot (1→2, 5→6, 9→10) is located on the real axis. Furthermore, the impedance locus at both ends of each region connecting between two adjacent radiating elements (2→5, 6→9; shown within each broken-lined region indicated with a ★ in FIG. 21) matches the original point after making two turns around the center of the Smith chart. This means that the array antenna of the present embodiment is also able to achieve equiamplitude-equiphase excitation, thus maximizing the gain. The reasons behind this consequence are that no parasitic capacitance is additionally introduced at the position of any radiating slot because bumps are only disposed in regions not overlapping any apertures of the radiating slots on the WRG; and that, in each region between two adjacent radiating slots, a combination of identical bumps are provided symmetrically on both sides of a midpoint between the two radiating slots.

Thus, in the present embodiment, too, by using an enhanced standing wave method in disposing a plurality of bumps at appropriate positions on the waveguide face, an ideal standing wave excitation is achieved to maximize the gain of the array antenna.

Thus, in Embodiments 1 and 2, the excitation state of each slot is adjusted by introducing in the WRG some structures which are sized $\lambda_R/4$ or larger, i.e., structures which cause changes in impedance or inductance, over a distance of $\lambda_R/8$ or more from every minimal position to an adjacent maximal position. Although this technique is used in Embodiments 1 and 2 to achieve equiamplitude-equiphase excitation, structures which are sized $\lambda_R/4$ or larger may also be introduced with a purpose of achieving an excitation state other than equiamplitude-equiphase.

Other Embodiments

Hereinafter, other embodiments will be illustrated by way of example.

While either one of the dents or the bumps are provided on the WRG in Embodiments 1 and 2 above, both dents and bumps may be provided.

Figure 22A:
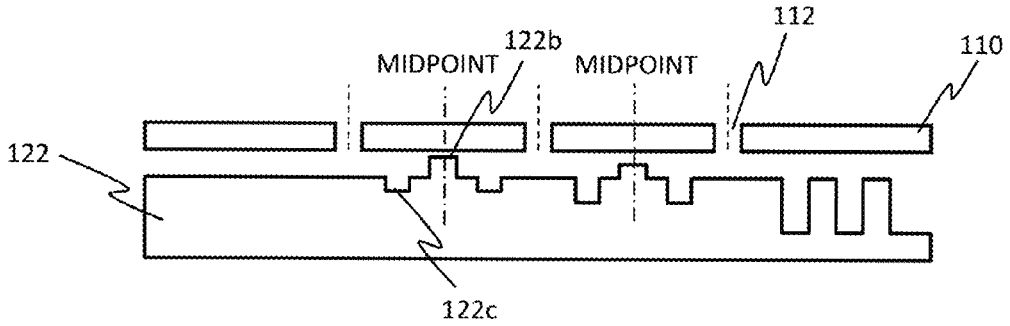
FIG. 22A is a schematic cross-sectional view showing another embodiment of the present disclosure.
Figure 22B:
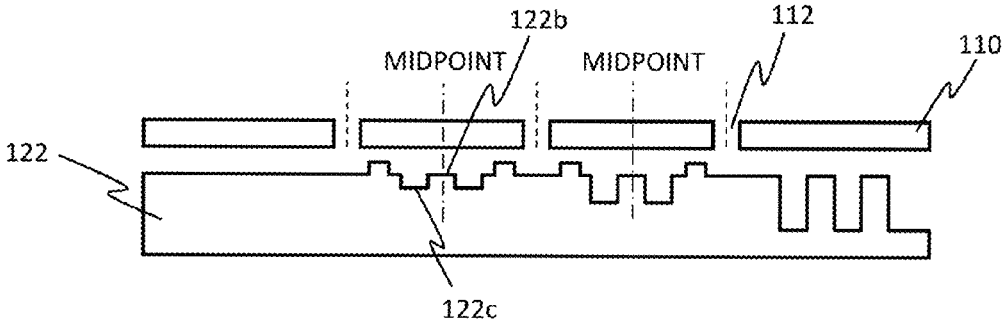
FIG. 22B is a schematic cross-sectional view showing still another embodiment of the present disclosure.

For example, as shown in FIG. 22A, a bump 122*b* may be provided in each region opposing a midpoint between two adjacent slots 112, with dents 122*c* being provided on both sides thereof. Alternatively, as shown in FIG. 22B, two dents 122*c* may be symmetrically provided in a position opposing a midpoint between two adjacent slots 112, and two bumps 122*b* may be provided further outside thereof. In these constructions, the impedance locus will be different from the loci that have been described with reference to FIG. 18 and FIG. 21. Also with these constructions, however, a desired excitation state can be achieved by appropriately adjusting the bump positions and heights and the dent positions and depths so as to satisfy the aforementioned conditions (1) and (2). Furthermore, in order to attain a purpose other than the purpose of maximizing the gain (e.g., reducing side lobes while sacrificing efficiency), a design may be intentionally adopted that does not satisfy conditions (1) and (2). In that case, additional elements of appropriate shapes may be placed in appropriate positions, and the shape and intervals of the slots may be further adjusted, so that a desired excitation state is achieved at the position of each radiating slot.

For example, starting from the equiamplitude-equiphase state that is achieved in Embodiments 1 and 2 above, the phase of a radio wave to be radiated from each slot can be shifted by as much as necessary by introducing slight changes in the slot intervals therefrom. By slightly changing the slot shapes, it can be ensured that the radio waves to be radiated from the respective slots have different amplitudes. The shapes and positions of the additional elements and the slots, and also the dimensions of various sections of the WRG waveguide, can be determined by using an electromagnetic field simulation or an evolutionary algorithm, etc., for example.

In Embodiments 1 and 2 above, between two adjacent slots, additional elements such as dents or bumps are symmetrically distributed with respect to a midpoint position between the two slots, or a position on the waveguide face opposing the midpoint position, this being in order to achieve equiamplitude-equiphase excitation. However, instead of such symmetric distribution, a similar performance can be attained through an appropriate design of structure and positioning of the additional elements.

Figure 23A:
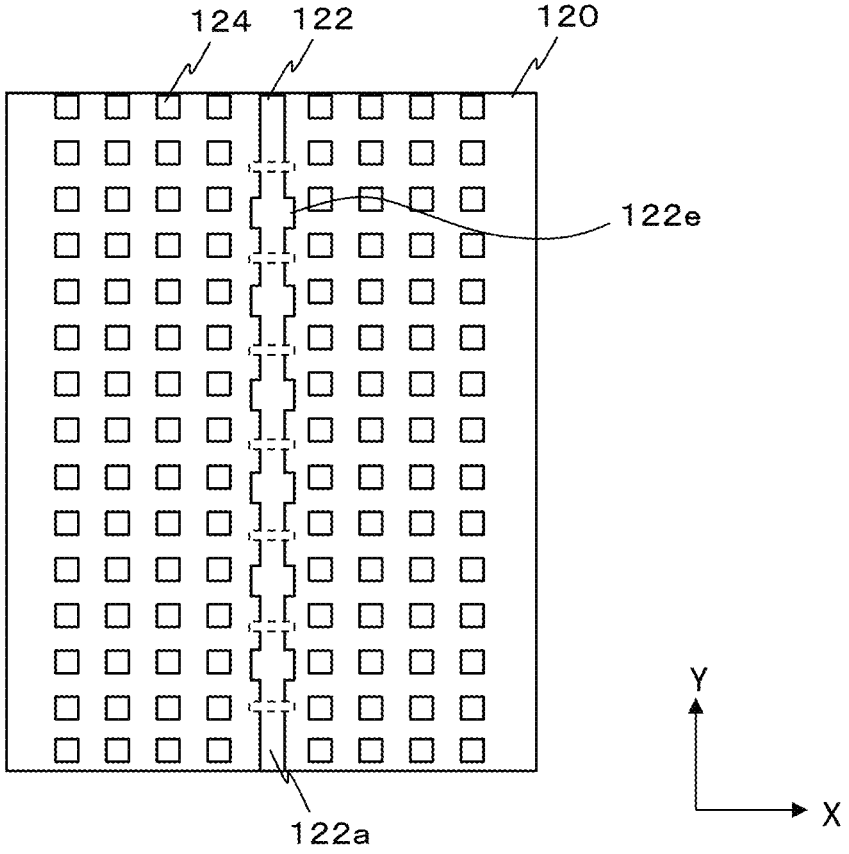
FIG. 23A is a diagram showing still another embodiment of the present disclosure.

FIG. 23A is a diagram showing still another exemplary structure for the waveguide member 122. FIG. 23A is an upper plan view of a second conductive member 120, a waveguide member 122, and a plurality of rods 124 as viewed from the +Z direction. In FIG. 23A, portions of the waveguide face 122*a* that oppose the plurality of slots are indicated by broken lines. In this example, rather than fluctuating the distance between the conductive surface 110*a* and the waveguide face 122*a*, the width of the waveguide face 122*a* is fluctuated. In such a construction, too, capacitance is increased near each midpoint between two adjacent slots, whereby similar effects to that provided by the construction shown in FIG. 19A and FIG. 19B is obtained. Although broad portions 122*e* are used instead of the aforementioned bump in this example, narrow portions may be used instead of the aforementioned dents. Furthermore, structures which are modified in terms of both height and width from the portions where no additional elements are provided (neutral portions) may be used as additional elements. Moreover, instead of bumps, dents, broad portions, or narrow portions, portions having a different dielectric constant from the dielectric constant in the surroundings may be disposed as additional elements, at appropriate positions between the conductive surface 110*a* and the waveguide face 122*a*.

Figure 23B:
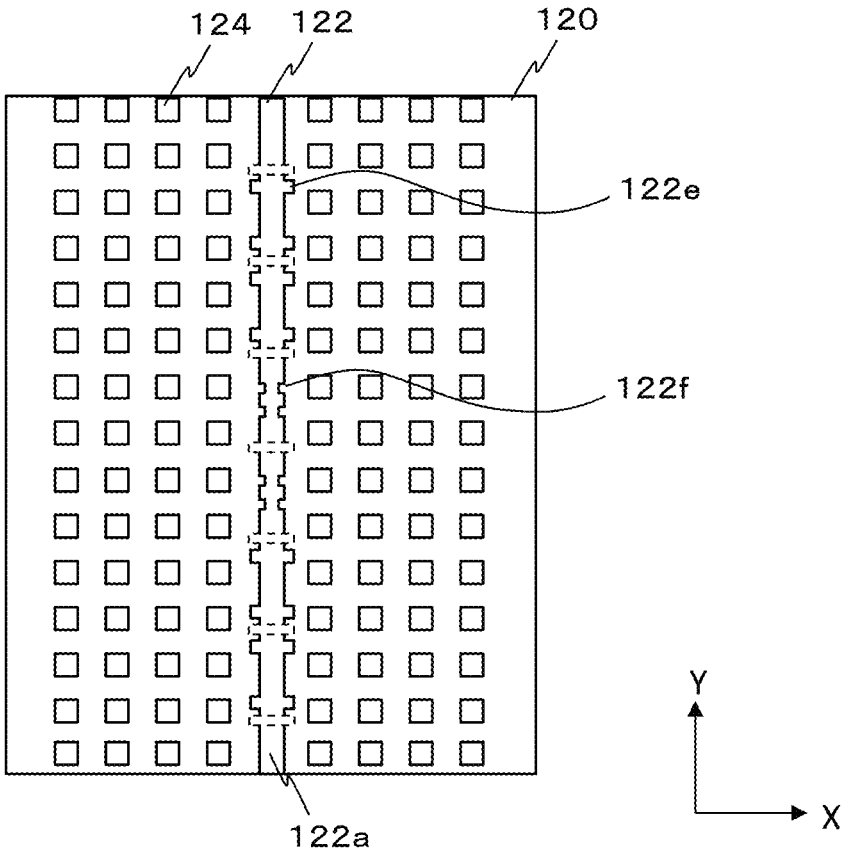
FIG. 23B is a diagram showing still another embodiment of the present disclosure.

FIG. 23B is a diagram showing still another exemplary structure for the waveguide member 122. This figure is drawn in the same manner as FIG. 23A. While the broad portions 122*e* in FIG. 23A are placed at equal intervals along the direction that the waveguide member 122 extends, they are not placed at equal intervals in this example. In FIG. 23B, the interval between the first broad portion 122*e* and the second broad portion 122*e* along the Y direction (from top to bottom) is smaller than the interval between the second broad portion 122*e* and the third broad portion 122*e*. Also, the waveguide member 122 includes narrow portions 122*f*. The fourth broad portion 122*e* is followed by four narrow portions 122*f* in a row. Among them, the interval between the first narrow portion 122*f* and the second narrow portion 122*f* along the Y direction (from top to bottom) is smaller than the interval between the second narrow portion 122*f* and the third narrow portion 122*f*.

Thus, by locally varying the interval between broad portions and/or narrow portions, or placing both of broad portions and narrow portions, it becomes possible to confer necessary characteristics to the slot array antenna.

Next, other exemplary constructions for embodiments of the present disclosure will be described.

Horned Structure

Figure 24A:
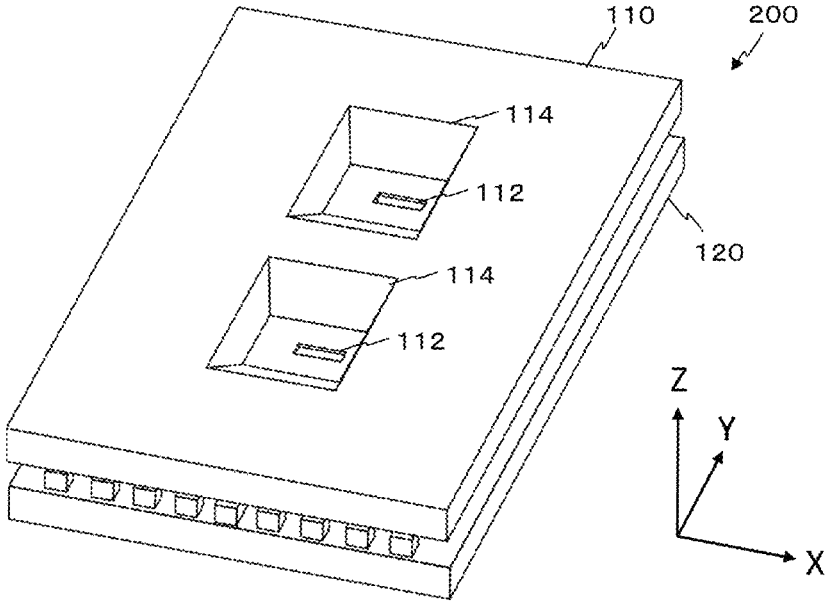
FIG. 24A is a perspective view showing an exemplary construction of a slot antenna 200 including horns.
Figure 24B:
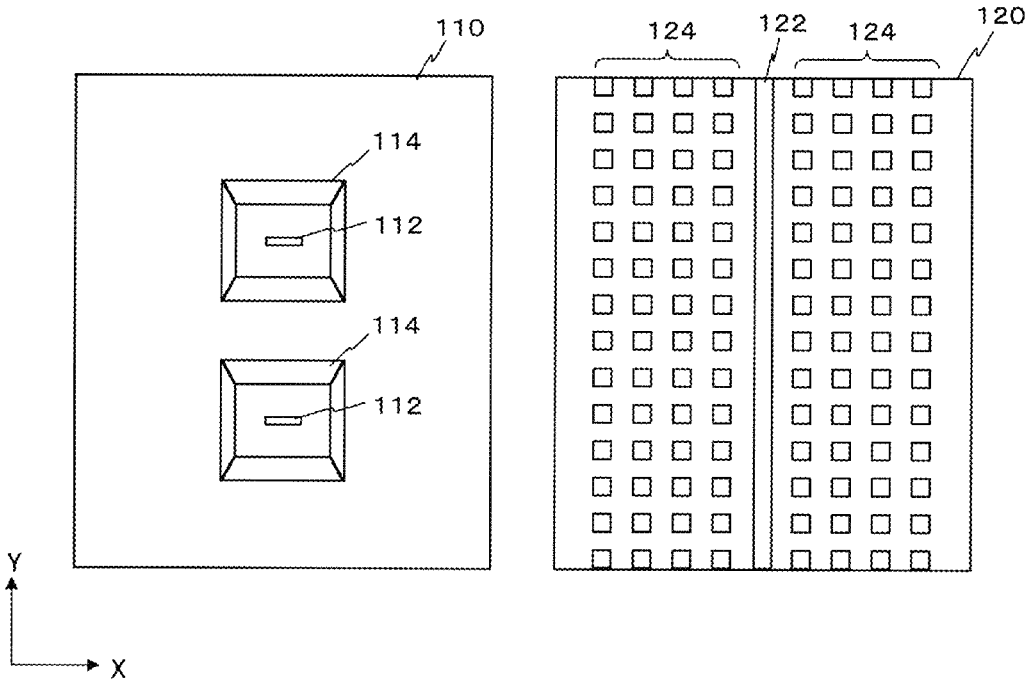
FIG. 24B is an upper plan view showing a first conductive member 110 and a second conductive member 120 shown in FIG. 24A, each viewed from the +Z direction.

FIG. 24A is a perspective view showing an exemplary construction of a slot antenna 200 including horns. FIG. 24B is an upper plan view showing a first conductive member 110 and a second conductive member 120 shown in FIG. 24A, each viewed from the +Z direction. For simplicity, FIG. 24A and FIG. 24B illustrate an example where the first conductive member 110 has two slots 112 and two horns 114 respectively surrounding them. The number of slots 112 and the number of horns 114 may be three or more.

Each horn 114 four side walls (i.e., two pairs of electrically conductive walls) at least the surface of which is composed of an electrically-conductive material. Each side wall is inclined with respect to direction that is perpendicular to the surface of the first conductive member 110. By providing the horns 114, the directivity of an electromagnetic wave to be radiated from each slot 112 can be improved. The shape of the horn 114 is not limited to what is shown in the figure. For example, each side wall may have a portion that is perpendicular to the surface of the first conductive member 110.

Variants of Waveguide Member, Conductive Members, and Conductive Rods

Next, variants of the waveguide member 122, the conductive members 110 and 120, and the conductive rods 124 will be described.

Figure 25A:
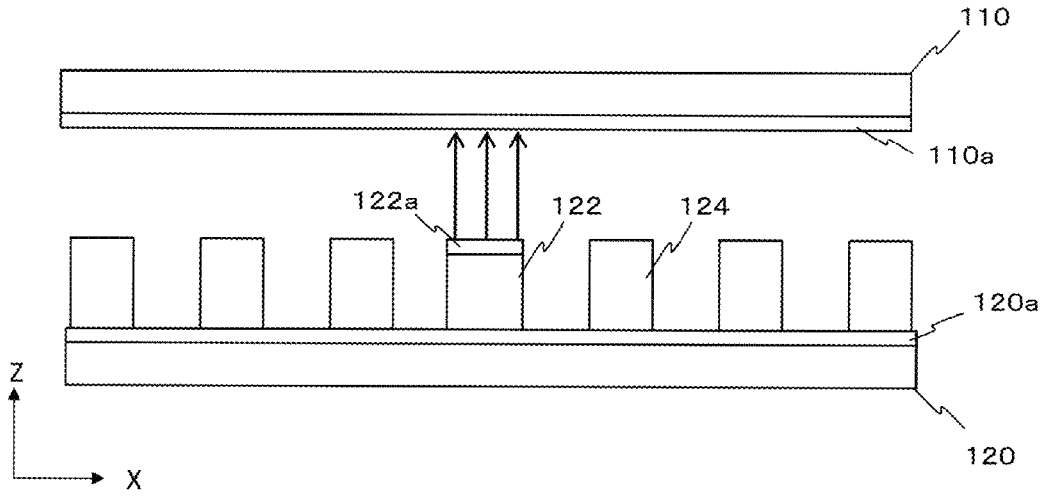
FIG. 25A is a cross-sectional view showing an exemplary structure in which only a waveguide face 122*a*, defining an upper face of the waveguide member 122, is electrically conductive, while any portion of the waveguide member 122 other than the waveguide face 122*a* is not electrically conductive.

FIG. 25A is a cross-sectional view showing an exemplary structure in which only a waveguide face 122*a*, defining an upper face of the waveguide member 122, is electrically conductive, while any portion of the waveguide member 122 other than the waveguide face 122*a* is not electrically conductive. Both of the first conductive member 110 and the second conductive member 120 alike are only electrically conductive at their surface that has the waveguide member 122 provided thereon (i.e., the conductive surface 110*a*, 120*a*), while not being electrically conductive in any other portions. Thus, each of the waveguide member 122, the first conductive member 110, and the second conductive member 120 does not need to be entirely electrically conductive.

Figure 25B:
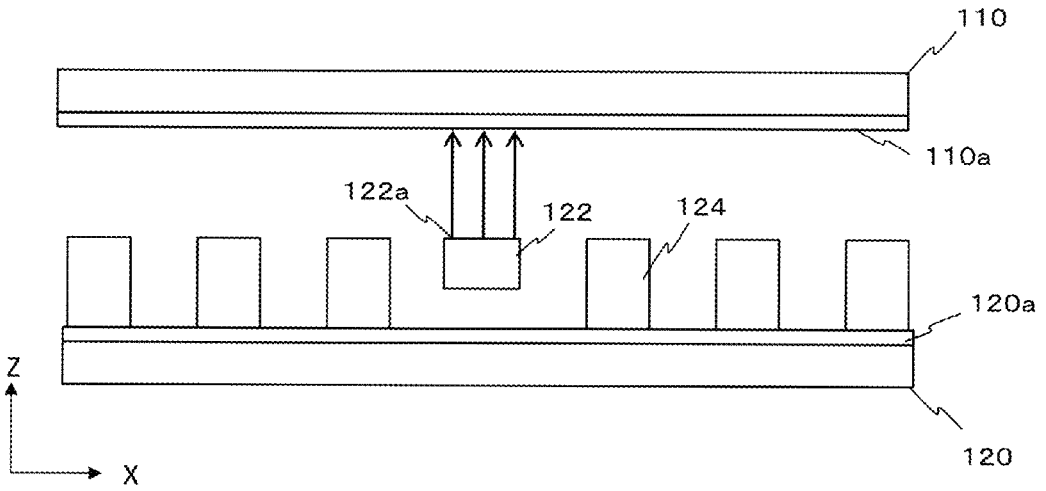
FIG. 25B is a diagram showing a variant in which the waveguide member 122 is not formed on the second conductive member 120.

FIG. 25B is a diagram showing a variant in which the waveguide member 122 is not formed on the second conductive member 120. In this example, the waveguide member 122 is fixed to a supporting member (e.g., an inner wall of the housing) that supports the first conductive member 110 and the second conductive member 120. A gap exists between the waveguide member 122 and the second conductive member 120. Thus, the waveguide member 122 does not need to be connected to the second conductive member 120.

Figure 25C:
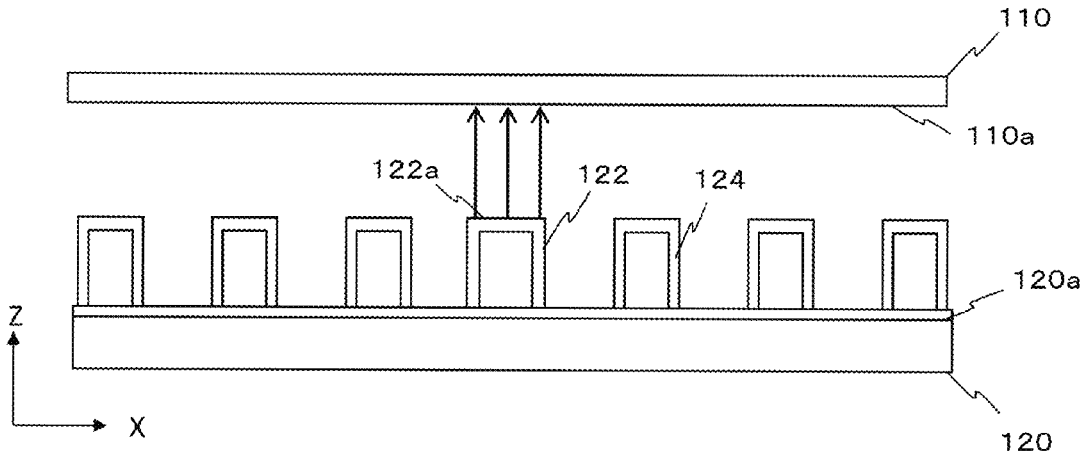
FIG. 25C is a diagram showing an exemplary structure where the second conductive member 120, the waveguide member 122, and each of the plurality of conductive rods 124 are composed of a dielectric surface that is coated with an electrically conductive material such as a metal.

FIG. 25C is a diagram showing an exemplary structure where the second conductive member 120, the waveguide member 122, and each of the plurality of conductive rods 124 are composed of a dielectric surface that is coated with an electrically conductive material such as a metal. The second conductive member 120, the waveguide member 122, and the plurality of conductive rods 124 are connected to one another via the electrical conductor. On the other hand, the first conductive member 110 is made of an electrically conductive material such as a metal.

Figure 25D:
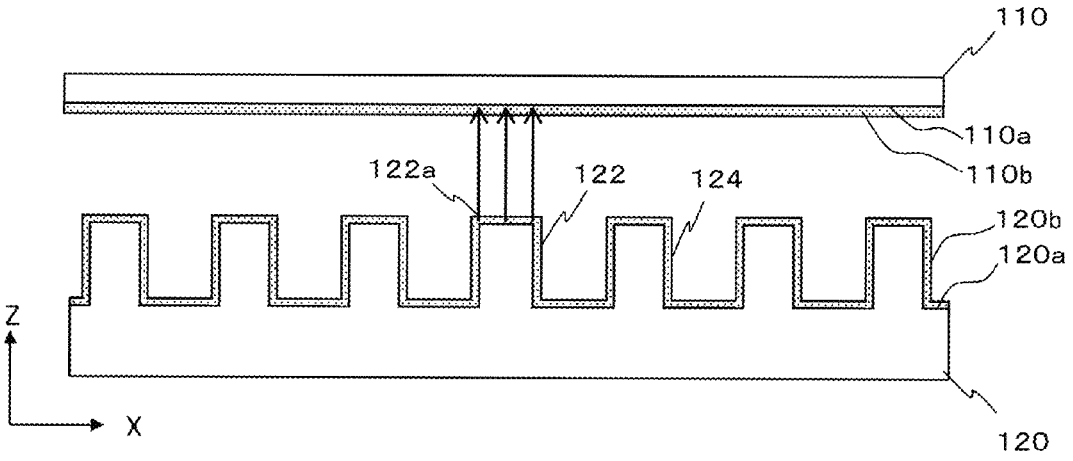
FIG. 25D is a diagram showing an exemplary structure in which dielectric layers 110*b* and 120*b* are respectively provided on the outermost surfaces of conductive members 110 and 120, a waveguide member 122, and conductive rods 124.
Figure 25E:
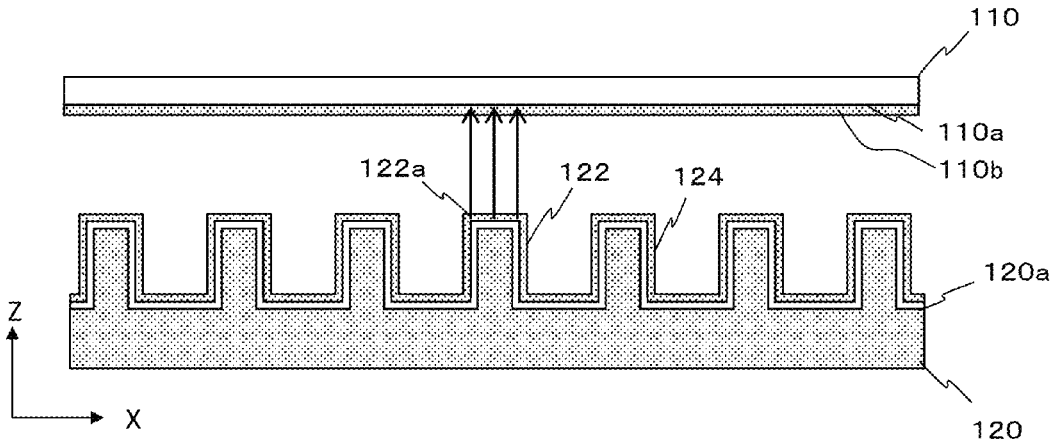
FIG. 25E is a diagram showing another exemplary structure in which dielectric layers 110*b* and 120*b* are respectively provided on the outermost surfaces of conductive members 110 and 120, a waveguide member 122, and conductive rods 124.

FIG. 25D and FIG. 25E are diagrams each showing an exemplary structure in which dielectric layers 110*b* and 120*b* are respectively provided on the outermost surfaces of conductive members 110 and 120, a waveguide member 122, and conductive rods 124. FIG. 25D shows an exemplary structure in which the surface of metal conductive members, which are conductors, are covered with a dielectric layer. FIG. 25E shows an example where the conductive member 120 is structured so that the surface of members which are composed of a dielectric, e.g., resin, is covered with a conductor such as a metal, this metal layer being further coated with a dielectric layer. The dielectric layer that covers the metal surface may be a coating of resin or the like, or an oxide film of passivation coating or the like which is generated as the metal becomes oxidized.

The dielectric layer on the outermost surface will allow losses to be increased in the electromagnetic wave propagating through the WRG waveguide, but is able to protect the conductive surfaces 110*a* and 120*a* (which are electrically conductive) from corrosion. Moreover, short-circuiting can be prevented even if a conductor line to carry a DC voltage, or an AC voltage of such a low frequency that it is not capable of propagation on certain WRG waveguides, exists in places that may come in contact with the conductive rods 124.

Figure 25F:
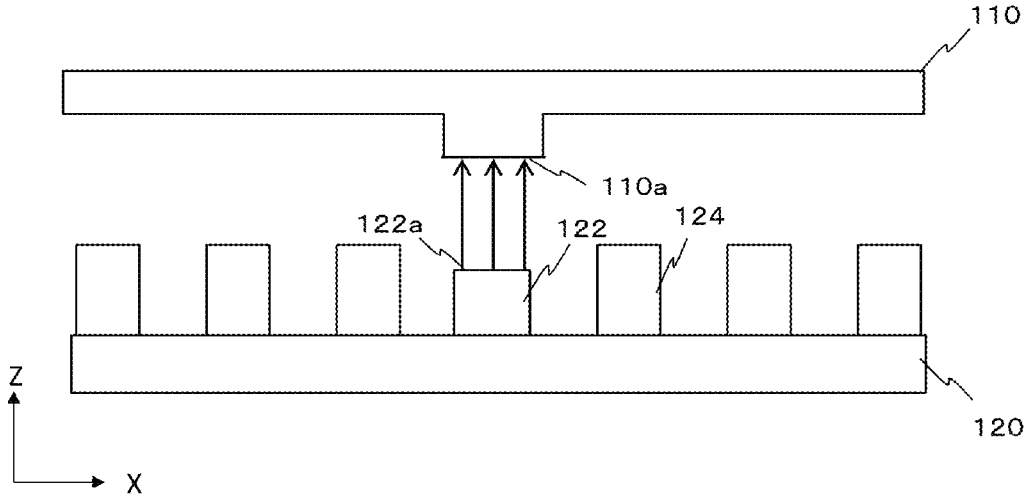
FIG. 25F is a diagram showing an example where the height of the waveguide member 122 is lower than the height of the conductive rods 124, and a portion of a conductive surface 110*a* of the first conductive member 110 that opposes the waveguide face 122*a* protrudes toward the waveguide member 122.

FIG. 25F is a diagram showing an example where the height of the waveguide member 122 is lower than the height of the conductive rods 124, and a portion of a conductive surface 110*a* of the first conductive member 110 that opposes the waveguide face 122*a* protrudes toward the waveguide member 122. Even such a structure will operate in a similar manner to the above-described embodiment, so long as the ranges of dimensions depicted in FIG. 9 are satisfied.

Figure 25G:
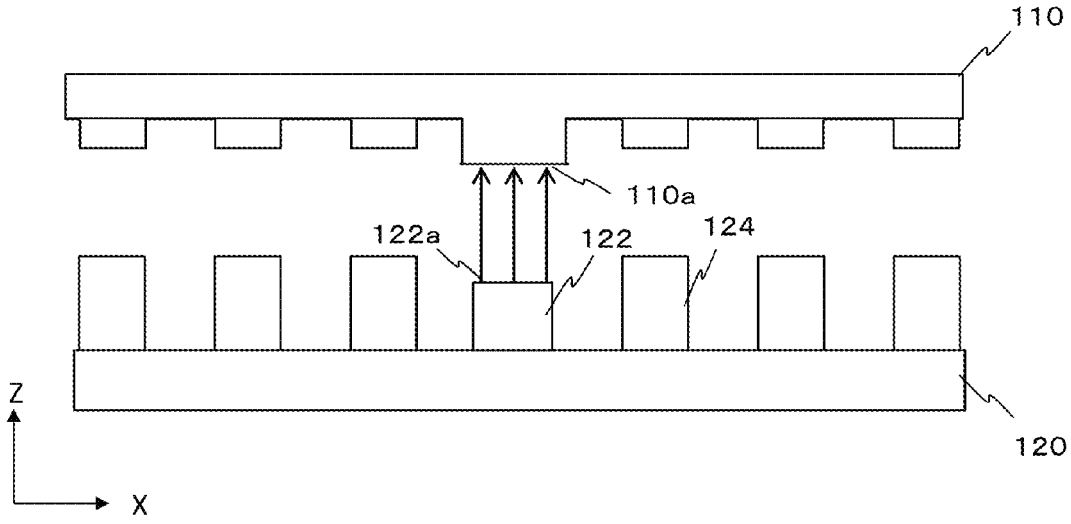
FIG. 25G is a diagram showing an example where, further in the structure of FIG. 25F, portions of the conductive surface 110*a* that oppose the conductive rods 124 protrude toward the conductive rods 124.

FIG. 25G is a diagram showing an example where, further in the structure of FIG. 25F, portions of the conductive surface 110*a* that oppose the conductive rods 124 protrude toward the conductive rods 124. Even such a structure will operate in a similar manner to the above-described embodiment, so long as the ranges of dimensions depicted in FIG. 9 are satisfied. Instead of a structure in which the conductive surface 110*a* partially protrudes, a structure in which the conductive surface 110*a* is partially dented may be adopted.

Figure 26A:
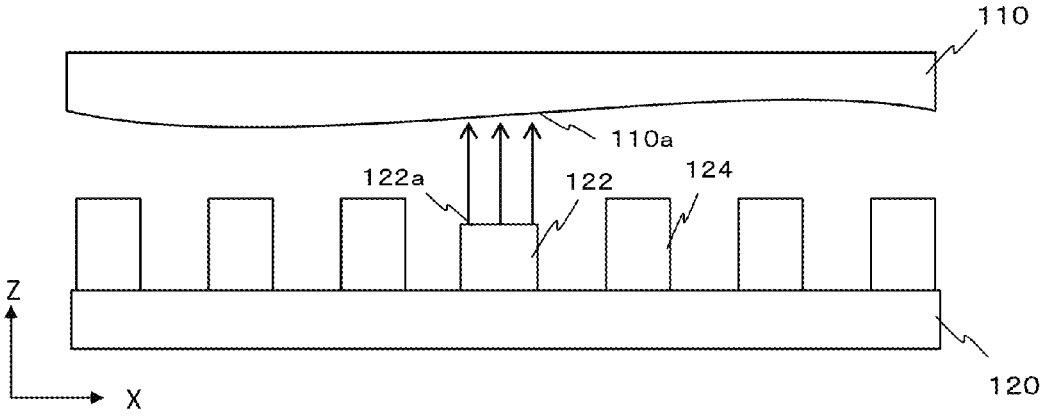
FIG. 26A is a diagram showing an example where a conductive surface 110*a* of the first conductive member 110 is shaped as a curved surface.
Figure 26B:
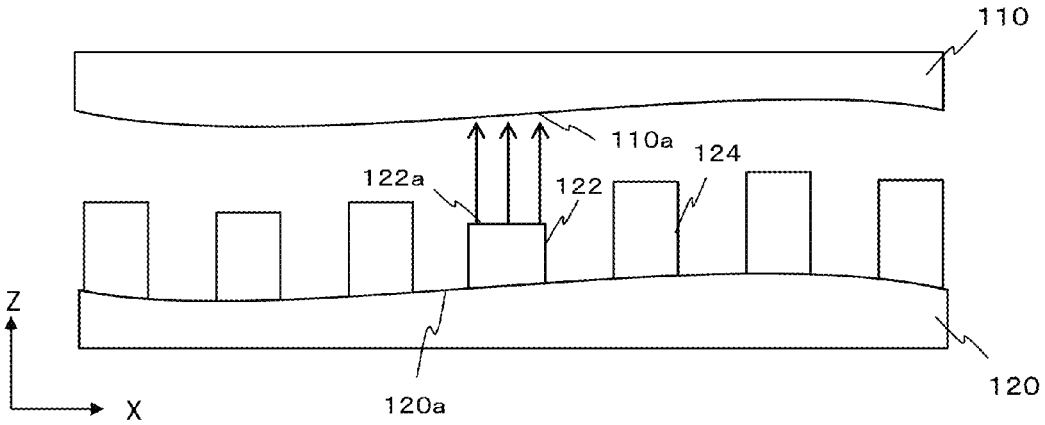
FIG. 26B is a diagram showing an example where also a conductive surface 120*a* of the second conductive member 120 is shaped as a curved surface.

FIG. 26A is a diagram showing an example where a conductive surface 110*a* of the first conductive member 110 is shaped as a curved surface. FIG. 26B is a diagram showing an example where also a conductive surface 120*a* of the second conductive member 120 is shaped as a curved surface. As demonstrated by these examples, the conductive surface(s) 110*a*, 120*a* may not be shaped as a plane(s), but may be shaped as a curved surface(s).

Figure 27:
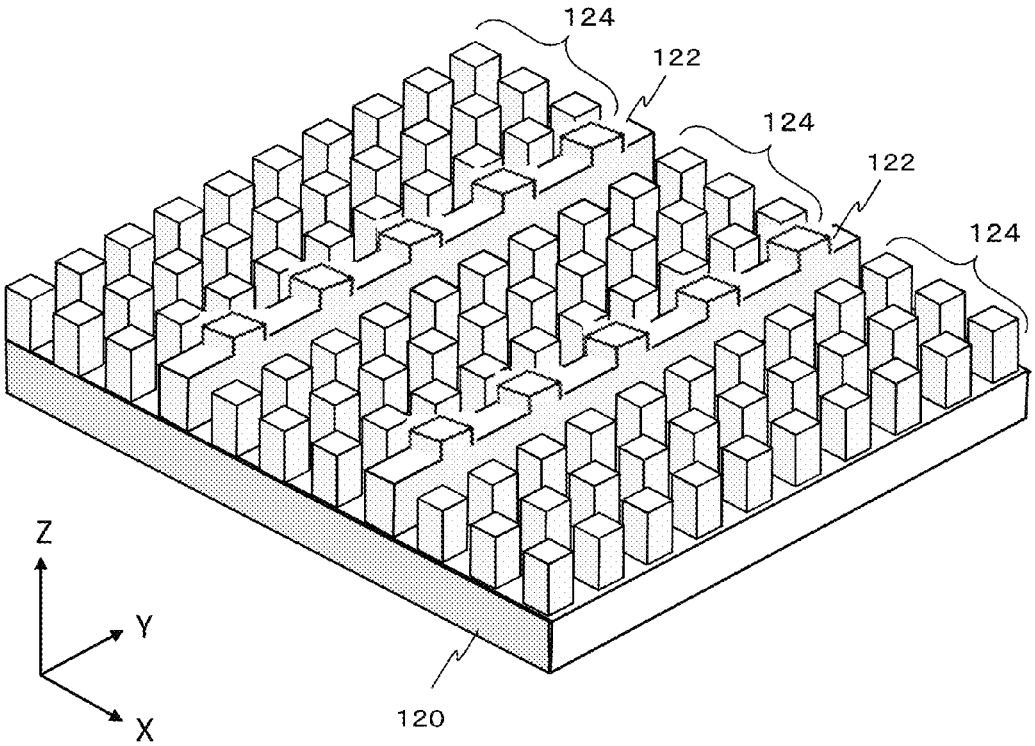
FIG. 27 is a perspective view showing an implementation where two waveguide members 122 extend in parallel upon the second conductive member 120.

A plurality of waveguide members 122 may be provided on the second conductive member 120. FIG. 27 is a perspective view showing an implementation where two waveguide members 122 extend in parallel upon the second conductive member 120. By providing a plurality of waveguide members 122 within a single waveguiding structure, it becomes possible to realize an array antenna in which a plurality of slots are placed in a two-dimensional array at short intervals. In the construction of FIG. 27, an artificial magnetic conductor that includes three rows of conductive rods 124 exists between the two waveguide members 122. Stretches of artificial magnetic conductor also exist on both far sides of the continuous region that accommodates the plurality of waveguide members 122.

Figure 28A:
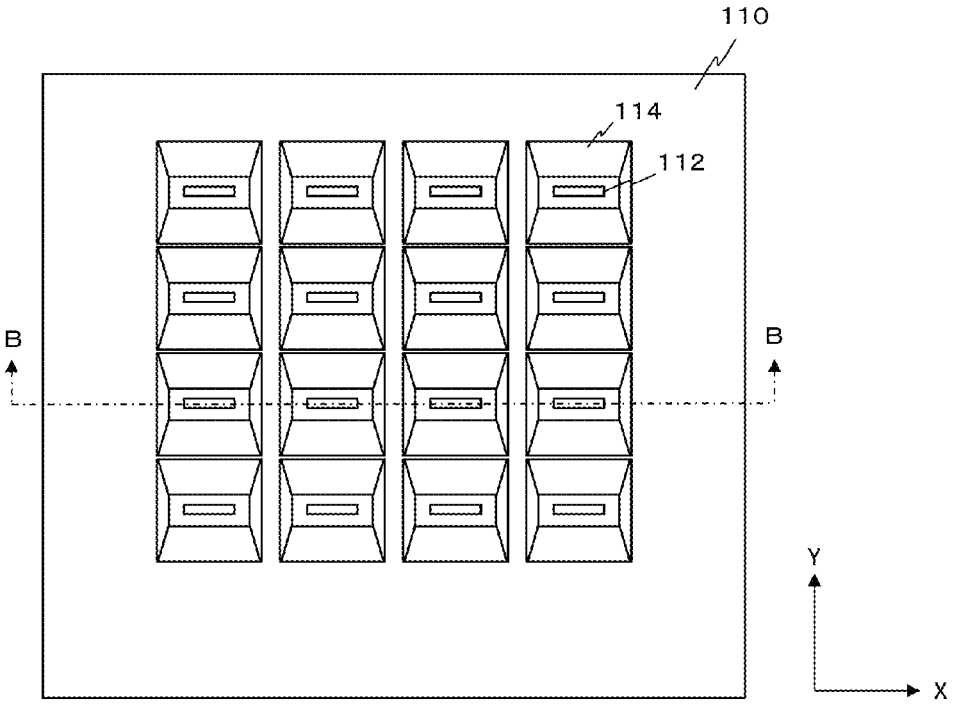
FIG. 28A is an upper plan view of an array antenna including 16 slots in an array of 4 rows and 4 columns, as viewed in the Z direction.
Figure 28B:
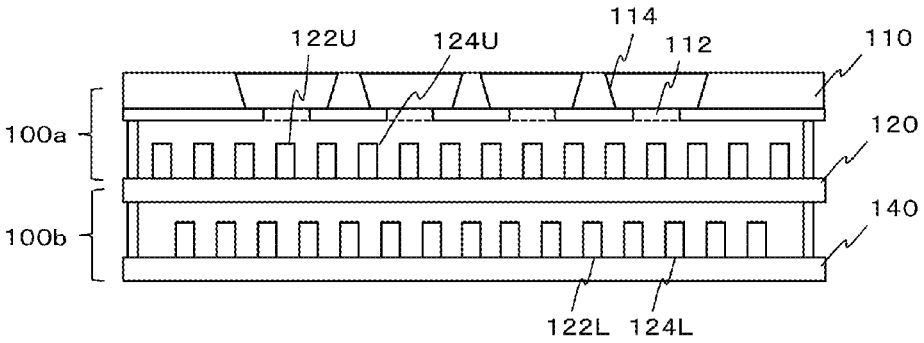
FIG. 28B is a cross-sectional view taken along line B-B in FIG. 28A.

FIG. 28A is an upper plan view of an array antenna including 16 slots 112 in an array of 4 rows and 4 columns, as viewed in the Z direction. FIG. 28B is a cross-sectional view taken along line B-B in FIG. 28A. The first conductive member 110 in this array antenna includes a plurality of horns 114, which are placed so as to respectively correspond to the plurality of slots 112. In the antenna shown in the figures, a first waveguide device 100*a* and a second waveguide device 100*b* are layered. The first waveguide device 100*a* includes waveguide members 122U that directly couple to slots 112. The second waveguide device 100*b* includes further waveguide members 122L that couple to the waveguide members 122U of the first waveguide device 100*a*. The waveguide members 122L and the conductive rods 124L of the second waveguide device 100*b* are arranged on a third conductive member 140. The second waveguide device 100*b* is basically similar in construction to the first waveguide device 100*a*.

As shown in FIG. 28A, the conductive member 110 has a plurality of slots 112 which are arrayed along the first direction (the Y direction) and a second direction (the X direction) orthogonal to the first direction. The waveguide face 122*a* of each waveguide member 122U extends along the Y direction, and opposes four slots that are disposed along the Y direction among the plurality of slots 112. Although the conductive member 110 has 16 slots 112 in an array of 4 rows and 4 columns in this example, the number of slots 112 is not limited to this example. Without being limited to the example where each waveguide member 122U opposes all slots that are disposed along the Y direction among the plurality of slots 112, each waveguide member 122U may oppose at least two adjacent slots along the Y direction. The interval between the centers of the waveguide faces 122*a* of any two adjacent waveguide member 122U is set to be shorter than the wavelength λo, for example.

Figure 29A:
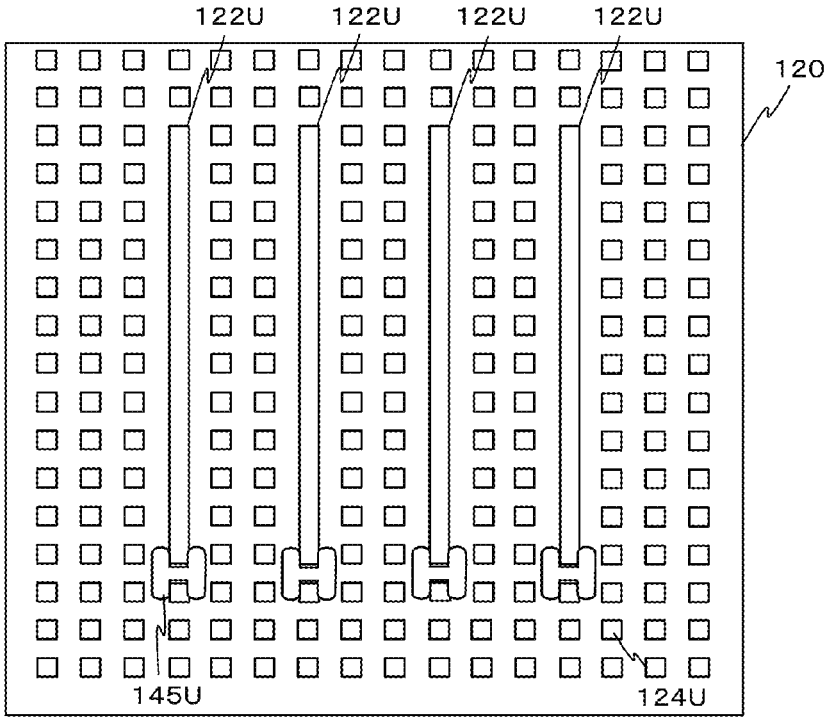
FIG. 29A is a diagram showing a planar layout of waveguide members 122U in a first waveguide device 100*a*.
Figure 30:
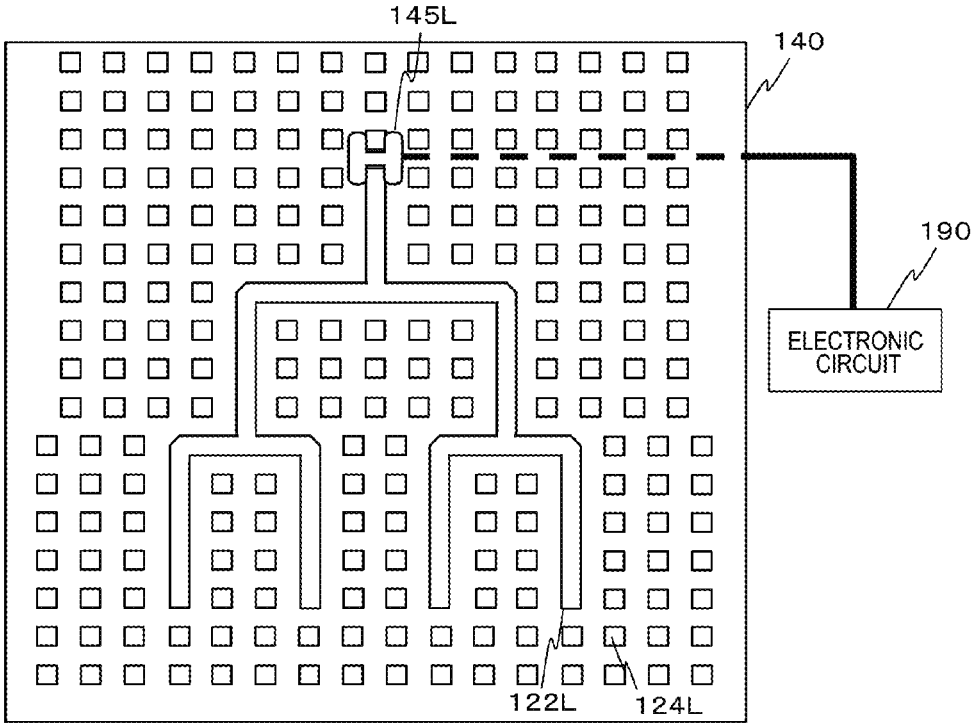
FIG. 30 is a diagram showing a planar layout of a waveguide member 122L in a second waveguide device 100*b*.

FIG. 29A is a diagram showing a planar layout of waveguide members 122U in the first waveguide device 100*a*. FIG. 30 is a diagram showing a planar layout of a waveguide member 122L in the second waveguide device 100*b*. As is clear from these figures, the waveguide members 122U of the first waveguide device 100*a* extend linearly, and include no branching portions or bends; on the other hand, the waveguide members 122L of the second waveguide device 100*b* include both branching portions and bends. The combination of the "second conductive member 120" and the "third conductive member 140" in the second waveguide device 100*b* corresponds to the combination in the first waveguide device 100*a* of the "first conductive member 110" and the "second conductive member 120".

The waveguide members 122U of the first waveguide device 100*a* couple to the waveguide member 122L of the second waveguide device 100*b*, through ports (openings) 145U that are provided in the second conductive member 120. Stated otherwise, an electromagnetic wave which has propagated through the waveguide member 122L of the second waveguide device 100*b* passes through a port 145U to reach a waveguide member 122U of the first waveguide device 100*a*, and propagates through the waveguide member 122U of the first waveguide device 100*a*. In this case, each slot 112 functions as an antenna element to allow an electromagnetic wave which has propagated through the waveguide to be radiated into space. Conversely, when an electromagnetic wave which has propagated in space impinges on a slot 112, the electromagnetic wave couples to the waveguide member 122U of the first waveguide device 100*a* that lies directly under that slot 112, and propagates through the waveguide member 122U of the first waveguide device 100*a*. An electromagnetic wave which has propagated through a waveguide member 122U of the first waveguide device 100*a* may also pass through a port 145U to reach the waveguide member 122L of the second waveguide device 100*b*, and propagates through the waveguide member 122L of the second waveguide device 100*b*. Via a port 145L of the third conductive member 140, the waveguide member 122L of the second waveguide device 100*b* may couple to an external waveguide device or radio frequency circuit (electronic circuit). As one example, FIG. 30 illustrates an electronic circuit 190 which is connected to the port 145L. Without being limited to a specific position, the electronic circuit 190 may be provided at any arbitrary position. The electronic circuit 190 may be provided on a circuit board which is on the rear surface side (i.e., the lower side in FIG. 28B) of the third conductive member 140, for example. Such an electronic circuit is a microwave integrated circuit, and may be an MMIC (Monolithic Microwave Integrated Circuit) that generates or receives millimeter waves, for example.

The first conductive member 110 shown in FIG. 28A may be called a "radiation layer". Moreover, the entirety of the second conductive member 120, the waveguide members 122U, and the conductive rods 124U shown in FIG. 29A may be called an "excitation layer", whereas the entirety of the third conductive member 140, the waveguide member 122L, and the conductive rods 124L shown in FIG. 30 may be called a "distribution layer". Moreover, the "excitation layer" and the "distribution layer" may be collectively called a "feeding layer". Each of the "radiation layer", the "excitation layer", and the "distribution layer" can be mass-produced by processing a single metal plate. The radiation layer, the excitation layer, the distribution layer, and any electronic circuitry to be provided on the rear face side of the distribution layer may be produced as a single-module product.

In the array antenna of this example, as can be seen from FIG. 28B, a radiation layer, an excitation layer, and a distribution layer are layered, which are in plate form; therefore, a flat and low-profile flat panel antenna is realized as a whole. For example, the height (thickness) of a multilayer structure having a cross-sectional construction as shown in FIG. 28B can be 10 mm or less.

With the waveguide member 122L shown in FIG. 30, the distances from the port 145L of the third conductive member 140 to the respective ports 145U (see FIG. 29A) of the second conductive member 120 measured along the waveguide member 122L are all set to an identical value. Therefore, a signal wave which is input to the waveguide member 122L reaches the four ports 145U of the second conductive member 120 all in the same phase, from the port 145L of the third conductive member 140. As a result, the four waveguide members 122U on the second conductive member 120 can be excited in the same phase.

It is not necessary for all slots 112 functioning as antenna elements to radiate electromagnetic waves in the same phase. The network patterns of the waveguide members 122U and 122L in the excitation layer and the distribution layer may be arbitrary, and they may be arranged so that the respective waveguide members 122U and 122L independently propagate different signals.

In the construction of FIG. 29A, a stretch of artificial magnetic conductor including the plurality of conductive rods 124 is provided between two adjacent waveguide members 122. However, this artificial magnetic conductor does not need to be provided.

Figure 29B:
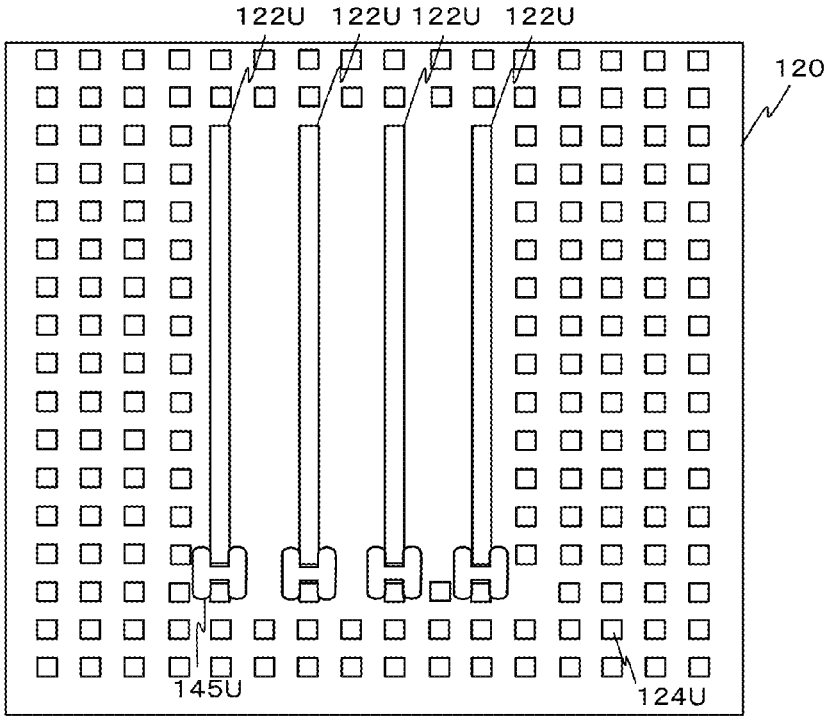
FIG. 29B is a diagram showing another exemplary planar layout of waveguide members 122U in the first waveguide device 100*a*.

FIG. 29B is a diagram showing an example where no artificial magnetic conductor is provided between two adjacent waveguide members 122 among the plurality of waveguide members 122. In the case where the plurality of slots 112 are to be excited in the same phase, it is not problematic if electromagnetic waves propagating along two adjacent waveguide members 122 become mixed with each other. Therefore, no artificial magnetic conductor such as conductive rods 124 need to be provided between two adjacent waveguide members 122. In that case, too, stretches of artificial magnetic conductor are provided on both far sides of the continuous region that accommodates the plurality of waveguide members 122. In the present disclosure, any structure where stretches of artificial magnetic conductor are provided on both far sides of the continuous region that accommodates the plurality of waveguide members 122, as exemplified by FIG. 29B, is still regarded as each waveguide member 122 separating between the stretches of artificial magnetic conductor that are on both its sides. In such an example, the length of the gap between two adjacent waveguide members 122U along the X direction is set to less than $\lambda m/2$.

The present specification employs the term "artificial magnetic conductor" in describing the technique according to the present disclosure, this being in line with what is set forth in a paper by one of the inventors Kirino (Non-Patent Document 1) as well as a paper by Kildal et al., who published a study directed to related subject matter around the same time. However, it has been found through a study by the inventors that the invention according to the present disclosure does not necessarily require an "artificial magnetic conductor" under its conventional definition. That is, while a periodic structure has been believed to be a requirement for an artificial magnetic conductor, the invention according to the present disclosure does not necessary require a periodic structure in order to be practiced.

The artificial magnetic conductor that is described in the present disclosure consists of rows of conductive rods. Therefore, in order to prevent electromagnetic waves from leaking away from the waveguide face, it has been believed essential that there exist at least two rows of conductive rods on one side of the waveguide member(s), such rows of conductive rods extending along the waveguide member(s) (ridge(s)). The reason is that it takes at least two rows of conductive rods for them to have a "period". However, according to a study by the inventors, even when only one row of conductive rods exists between two waveguide members that extend in parallel to each other, the intensity of a signal that leaks from one waveguide member to the other waveguide member can be suppressed to −10 dB or less, which is a practically sufficient value in many applications. The reason why such a sufficient level of separation is achieved with only an imperfect periodic structure is so far unclear. However, in view of this fact, in the present disclosure, the notion of "artificial magnetic conductor" is extended so that the term also encompasses a structure including only one row of conductive rods.

Slot Variants

Next, variant shapes for the slots 112 will be described. Although the above examples illustrate that each slot 112 has a rectangular planar shape, the slots 112 may also have other shapes. Hereinafter, examples of other slot shapes will be described with reference to FIGS. 31A through 31D.

Figure 31A:
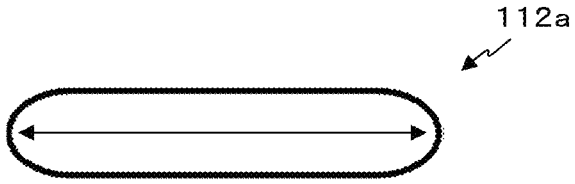
FIG. 31A is a diagram showing another exemplary shape of a slot.

FIG. 31A shows an example of a slot 112*a* having a shape, both of whose ends resemble portions of an ellipse. The length, i.e., its size along the longitudinal direction (the length indicated by arrowheads in the figure) L, of this slot 112*a* is set so that $\lambda o/2<L<\lambda o$, e.g., about $\lambda o/2$, where $\lambda o$ denotes a wavelength in free space that corresponds to a center frequency of the operating frequency, thus ensuring that higher-order resonance will not occur and that the slot impedance will not be too small.

Figure 31B:
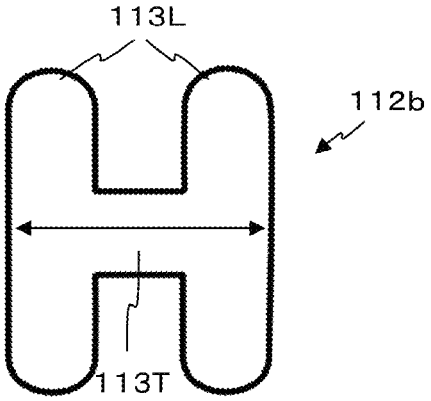
FIG. 31B is a diagram showing another exemplary shape of a slot.

FIG. 31B shows an example of a slot 112*b* having a shape including a pair of vertical portions 113L and a lateral portion 113T interconnecting the pair of vertical portions 113L (referred to as an "H shape" in the present specification). The lateral portion 113T is substantially perpendicular to the pair of vertical portions 113L, connecting substantially central portions of the pair of vertical portions 113L together. With such an H-shaped slot 112*b*, too, its shape and size are to be determined so that higher-order resonance will not occur and that the slot impedance will not be too small. In order to satisfy these conditions, a dimension L is defined which is twice the length along the lateral portion 113T and two halves of the vertical portions 113L that extends from the center point (i.e., the center point of the lateral portion 113T) to an end (i.e., either end of a vertical portion 113L) of the H shape, such that $\lambda o/2<L<\lambda o$, (for example, L=about $\lambda o/2$). On this basis, the length (the length indicated by arrowheads in the figure) of the lateral portion 113T can be made e.g. less than $\lambda o/2$, thus reducing the slot interval along the length direction of the lateral portion 113T.

Figure 31C:
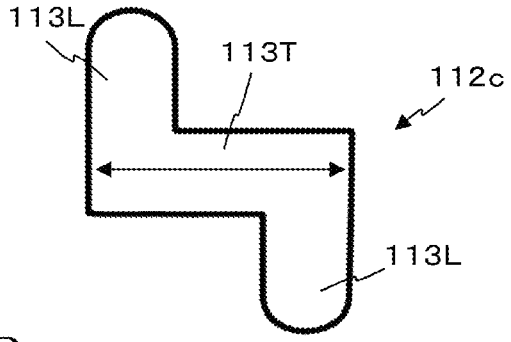
FIG. 31C is a diagram showing another exemplary shape of a slot.

FIG. 31C shows an example of a slot 112*c* which includes a lateral portion 113T and a pair of vertical portions 113L extending from both ends of the lateral portion 113T. The directions that the pair of vertical portions 113L extend from the lateral portion 113T, which are opposite to each other, are substantially perpendicular to the lateral portion 113T. In this example, too, the length (the length indicated by arrowheads in the figure) of the lateral portion 113T can be made e.g. less than $\lambda o/2$, whereby the slot interval along the length direction of the lateral portion 113T can be reduced.

Figure 31D:
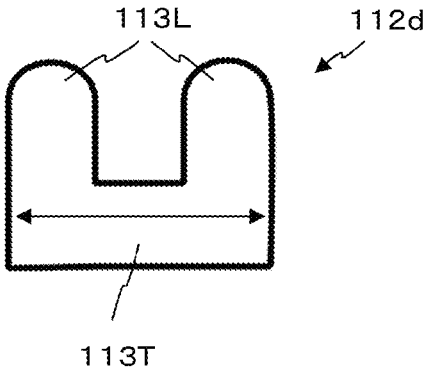
FIG. 31D is a diagram showing another exemplary shape of a slot.

FIG. 31D shows an example of a slot 112*d* which includes a lateral portion 113T and a pair of vertical portions 113L extending from both ends of the lateral portion 113T in the same direction perpendicular to the lateral portion 113T. In this example, too, the length (the length indicated by arrowheads in the figure) of the lateral portion 113T can be made e.g. less than $\lambda o/2$, whereby the slot interval along the length direction of the lateral portion 113T can be reduced.

Figure 32:
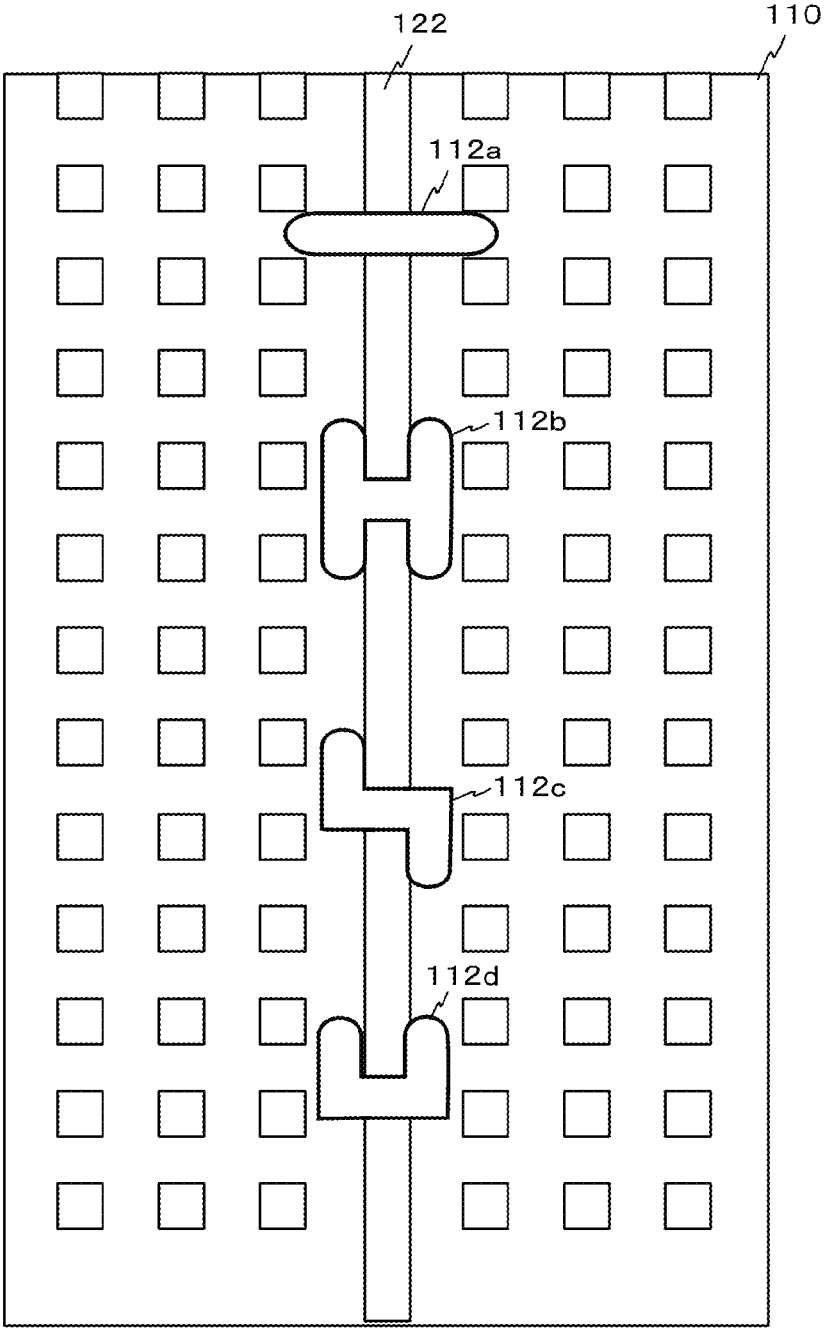
FIG. 32 is a diagram showing a planar layout where the four kinds of slots 112*a* through 112*d* shown in FIGS. 31A through 31D are disposed on a waveguide member 122.

FIG. 32 is a diagram showing a planar layout where the four kinds of slots 112*a* through 112*d* shown in FIGS. 31A through 31D are disposed on a waveguide member 122. As shown in the figure, using the slots 112*b* through 112*d* allows the size of the lateral portion 113T along its length direction (referred to as the "lateral direction") to be reduced as compared to the case of using the slot 112*a*. Therefore, in a structure where a plurality of waveguide members 122 are arranged in parallel, the interval of slots along the lateral direction can be reduced.

The above example illustrates that the longitudinal direction, or the direction that the lateral portion of a slot extends, coincides with the width direction of the waveguide member 122; however, these two directions may intersect each other. In such constructions, the plane of polarization of the electromagnetic wave to be radiated can be tilted. As a result, when used for an onboard radar, for example, an electromagnetic wave which has been radiated from the driver's vehicle can be distinguished from an electromagnetic wave which has been radiated from an oncoming car.

Thus, in accordance with an embodiment of the present disclosure, for example, the interval between a plurality of slots on a conductive member can be narrowed, while also achieving excitation with an equiamplitude and equiphase. As a result, a small-sized and high-gain radar device, radar system, wireless communication system, or the like can be realized. Embodiments of the present disclosure are not limited to implementations where excitation with an equiamplitude and equiphase is to be achieved. For example, other purposes, such as reducing side lobes while sacrificing the output efficiency of a radar, can also be attained. Since the amplitude and phase at each slot position can be individually adjusted, it is possible to radiate electromagnetic wave with an arbitrary radiation pattern. Without being limited to standing-wave feed, traveling-wave feed may also be applied. Thus, the technique of the present disclosure is applicable to a broad range of purposes and applications.

The waveguide device and slot array antenna (antenna device) according to the present disclosure can be suitably used in a radar device or a radar system to be incorporated in moving entities such as vehicles, marine vessels, aircraft, robots, or the like, for example. A radar device would include a slot array antenna according to any of the above-described embodiments and a microwave integrated circuit that is connected to the slot array antenna. A radar system would include the radar device and a signal processing circuit that is connected to the microwave integrated circuit of the radar device. A slot array antenna according to an embodiment of the present disclosure includes a WRG structure which permits downsizing, and thus allows the area of the face on which antenna elements are arrayed to be remarkably reduced, as compared to a construction in which a conventional hollow waveguide is used. Therefore, a radar system incorporating the antenna device can be easily mounted in a narrow place such as a face of a rearview mirror in a vehicle that is opposite to its specular surface, or a small-sized moving entity such as a UAV (an Unmanned Aerial Vehicle, a so-called drone). Note that, without being limited to the implementation where it is mounted in a vehicle, a radar system may be used while being fixed on the road or a building, for example.

A slot array antenna according to an embodiment of the present disclosure can also be used in a wireless communication system. Such a wireless communication system would include a slot array antenna according to any of the above embodiments and a communication circuit (a transmission circuit or a reception circuit). Details of exemplary applications to wireless communication systems will be described later.

A slot array antenna according to an embodiment of the present disclosure can further be used as an antenna in an indoor positioning system (IPS). An indoor positioning system is able to identify the position of a moving entity, such as a person or an automated guided vehicle (AGV), that is in a building. An array antenna can also be used as a radio wave transmitter (beacon) for use in a system which provides information to an information terminal device (e.g., a smartphone) that is carried by a person who has visited a store or any other facility. In such a system, once every several seconds, a beacon may radiate an electromagnetic wave carrying an ID or other information superposed thereon, for example. When the information terminal device receives this electromagnetic wave, the information terminal device transmits the received information to a remote server computer via telecommunication lines. Based on the information that has been received from the information terminal device, the server computer identifies the position of that information terminal device, and provides information which is associated with that position (e.g., product information or a coupon) to the information terminal device.

Application Example 1: Onboard Radar System

Next, as an Application Example of utilizing the above-described slot array antenna, an instance of an onboard radar system including a slot array antenna will be described. A transmission wave used in an onboard radar system may have a frequency of e.g. 76 gigahertz (GHz) band, which will have a wavelength $\lambda o$ of about 4 mm in free space.

In safety technology of automobiles, e.g., collision avoidance systems or automated driving, it is particularly essential to identify one or more vehicles (targets) that are traveling ahead of the driver's vehicle. As a method of identifying vehicles, techniques of estimating the directions of arriving waves by using a radar system have been under development.

Figure 33:
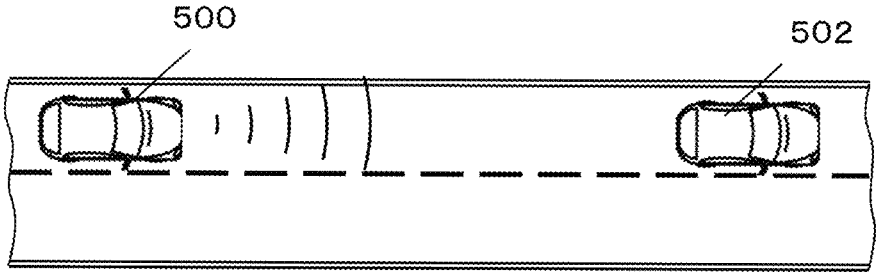
FIG. 33 is a diagram showing a driver's vehicle 500, and a preceding vehicle 502 that is traveling in the same lane as the driver's vehicle 500.

FIG. 33 shows a driver's vehicle 500, and a preceding vehicle 502 that is traveling in the same lane as the driver's vehicle 500. The driver's vehicle 500 includes an onboard radar system which incorporates a slot array antenna according to any of the above-described embodiments. When the onboard radar system of the driver's vehicle 500 radiates a radio frequency transmission signal, the transmission signal reaches the preceding vehicle 502 and is reflected therefrom, so that a part of the signal returns to the driver's vehicle 500. The onboard radar system receives this signal to calculate a position of the preceding vehicle 502, a distance ("range") to the preceding vehicle 502, velocity, etc.

Figure 34:
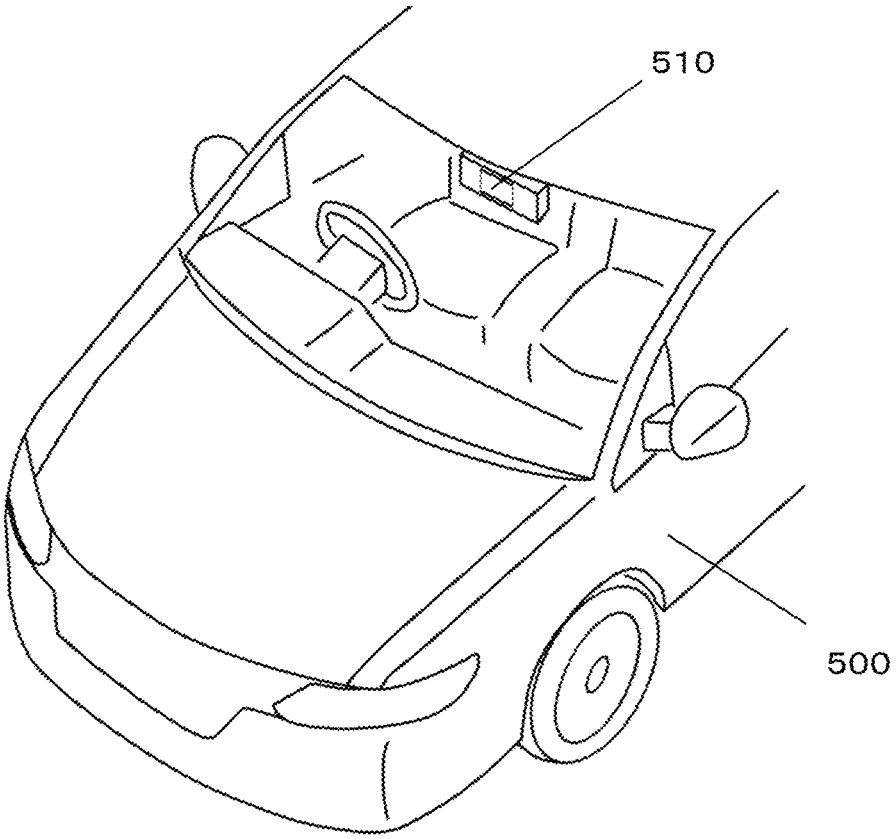
FIG. 34 is a diagram showing an onboard radar system 510 of the driver's vehicle 500.

FIG. 34 shows the onboard radar system 510 of the driver's vehicle 500. The onboard radar system 510 is provided within the vehicle. More specifically, the onboard radar system 510 is disposed on a face of the rearview mirror that is opposite to its specular surface. From within the vehicle, the onboard radar system 510 radiates a radio frequency transmission signal in the direction of travel of the vehicle 500, and receives a signal(s) which arrives from the direction of travel.

The onboard radar system 510 of this Application Example includes a slot array antenna according to the above embodiment of the present disclosure. The slot array antenna may include a plurality of waveguide members which are parallel to one another. It is arranged so that the direction that each of the plurality of waveguide members extends coincides with the vertical direction, and that the direction in which the plurality of waveguide members are arrayed coincides with the horizontal direction. As a result, the lateral dimension and the vertical dimension of the plurality of slots as viewed from the front can be reduced.

Exemplary dimensions of an antenna device including the above array antenna may be 60 mm (wide)×30 mm (long)× 10 mm (deep). It will be appreciated that this is a very small size for a millimeter wave radar system of the 76 GHz band.

Note that many a conventional onboard radar system is provided outside the vehicle, e.g., at the tip of the front nose. The reason is that the onboard radar system is relatively large in size, and thus is difficult to be provided within the vehicle as in the present disclosure. The onboard radar system 510 of this Application Example may be installed within the vehicle as described above, but may instead be mounted at the tip of the front nose. Since the footprint of the onboard radar system on the front nose is reduced, other parts can be more easily placed.

The Application Example allows the interval between a plurality of waveguide members (ridges) that are used in the transmission antenna to be narrow, which also narrows the interval between a plurality of slots to be provided opposite from a number of adjacent waveguide members. This reduces the influences of grating lobes. For example, when the interval between the centers of two laterally adjacent slots is shorter than the free-space wavelength $\lambda o$ of the transmission wave (i.e., less than about 4 mm), no grating lobes will occur frontward. As a result, influences of grating lobes are reduced. Note that grating lobes will occur when the interval at which the antenna elements are arrayed is greater than a half of the wavelength of an electromagnetic wave. If the interval at which the antenna elements are arrayed is less than the wavelength, no grating lobes will occur frontward. Therefore, in the case where each antenna element composing an array antenna is only frontward-sensitive, as in the Application Example, grating lobes will exert substantially no influences so long as the interval at which the antenna elements are arrayed is smaller than the wavelength. By adjusting the array factor of the transmission antenna, the directivity of the transmission antenna can be adjusted. A phase shifter may be provided so as to be able to individually adjust the phases of electromagnetic waves that are transmitted on plural waveguide members. By providing a phase shifter, the directivity of the transmission antenna can be changed in any desired direction. Since the construction of a phase shifter is well-known, description thereof will be omitted.

A reception antenna according to the Application Example is able to reduce reception of reflected waves associated with grating lobes, thereby being able to improve the precision of the below-described processing. Hereinafter, an example of a reception process will be described.

Figure 35A:
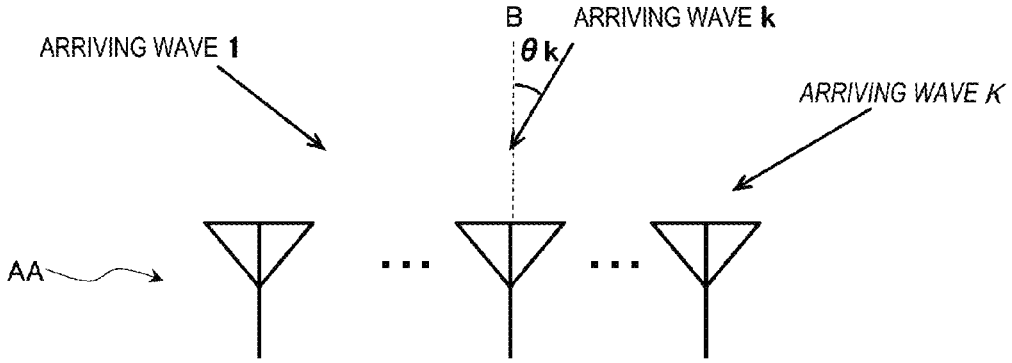
FIG. 35A is a diagram showing a relationship between an array antenna AA of the onboard radar system 510 and plural arriving waves k.

FIG. 35A shows a relationship between an array antenna AA of the onboard radar system 510 and plural arriving waves k (k: an integer from 1 to K; the same will always apply below. K is the number of targets that are present in different azimuths). The array antenna AA includes M antenna elements in a linear array. Principlewise, an antenna can be used for both transmission and reception, and therefore the array antenna AA can be used for both a transmission antenna and a reception antenna. Hereinafter, an example method of processing an arriving wave which is received by the reception antenna will be described.

The array antenna AA receives plural arriving waves that simultaneously impinge at various angles. Some of the plural arriving waves may be arriving waves which have been radiated from the transmission antenna of the same onboard radar system 510 and reflected by a target(s). Furthermore, some of the plural arriving waves may be direct or indirect arriving waves that have been radiated from other vehicles.

The incident angle of each arriving wave (i.e., an angle representing its direction of arrival) is an angle with respect to the broadside B of the array antenna AA. The incident angle of an arriving wave represents an angle with respect to a direction which is perpendicular to the direction of the line along which antenna elements are arrayed.

Now, consider a $k^{th}$ arriving wave. Where K arriving waves are impinging on the array antenna from K targets existing at different azimuths, a "$k^{th}$ arriving wave" means an arriving wave which is identified by an incident angle $\theta_k$.

Figure 35B:
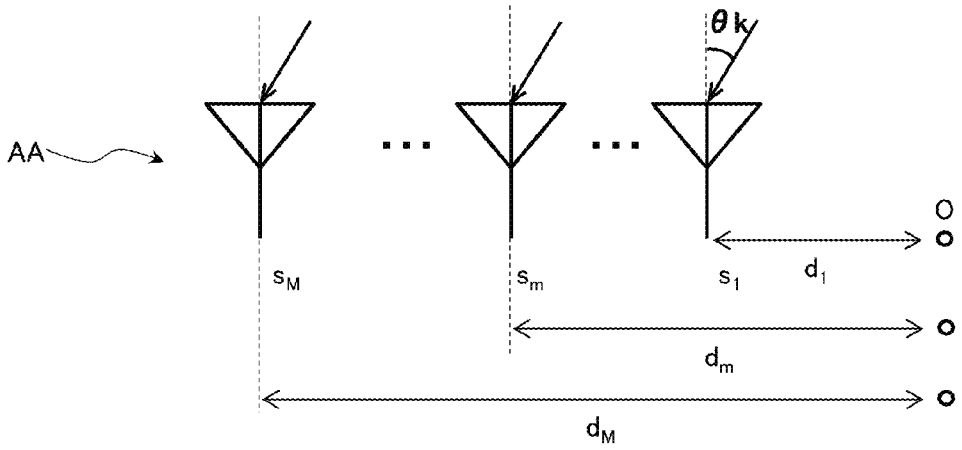
FIG. 35B is a diagram showing the array antenna AA receiving the $k^{th}$ arriving wave.

FIG. 35B shows the array antenna AA receiving the $k^{th}$ arriving wave. The signals received by the array antenna AA can be expressed as a "vector" having M elements, by Math. 1.

$$S=[s_1,s_2,\ldots,s_m]^T \quad \text{(Math. 1)}$$

In the above, $s_m$ (where m is an integer from 1 to M; the same will also be true hereinbelow) is the value of a signal which is received by an $m^{th}$ antenna element. The superscript $^T$ means transposition. S is a column vector. The column vector S is defined by a product of multiplication between a direction vector (referred to as a steering vector or a mode vector) as determined by the construction of the array antenna and a complex vector representing a signal from each target (also referred to as a wave source or a signal source). When the number of wave sources is K, the waves of signals arriving at each individual antenna element from the respective K wave sources are linearly superposed. In this state, $s_m$ can be expressed by Math. 2.

$$s_m=\sum_{k=1}^{K} a_k \exp\left\{j\left(\frac{2\pi}{\lambda}d_m\sin\theta_k+\varphi_k\right)\right\} \quad \text{[Math. 2]}$$

In Math. 2, $a_k$, $\theta_k$ and $\phi_k$ respectively denote the amplitude, incident angle, and initial phase of the $k^{th}$ arriving wave. Moreover, $\lambda$ denotes the wavelength of an arriving wave, and j is an imaginary unit.

As will be understood from Math. 2, $s_m$ is expressed as a complex number consisting of a real part (Re) and an imaginary part (Im).

When this is further generalized by taking noise (internal noise or thermal noise) into consideration, the array reception signal X can be expressed as Math. 3.

$$X=S+N \quad \text{(Math. 3)}$$

N is a vector expression of noise.

The signal processing circuit generates a spatial covariance matrix Rxx (Math. 4) of arriving waves by using the array reception signal X expressed by Math. 3, and further determines eigenvalues of the spatial covariance matrix Rxx.

$$R_{xx}=XX^H=\begin{bmatrix} Rxx_{11} & \ldots & Rxx_{1M} \\ \vdots & \ddots & \vdots \\ Rxx_{M1} & \ldots & Rxx_{MM} \end{bmatrix} \quad \text{[Math. 4]}$$

In the above, the superscript $^H$ means complex conjugate transposition (Hermitian conjugate).

Among the eigenvalues, the number of eigenvalues which have values equal to or greater than a predetermined value that is defined based on thermal noise (signal space eigenvalues) corresponds to the number of arriving waves. Then, angles that produce the highest likelihood as to the directions of arrival of reflected waves (i.e. maximum likelihood) are calculated, whereby the number of targets and the angles at which the respective targets are present can be identified. This process is known as a maximum likelihood estimation technique.

Figure 36:
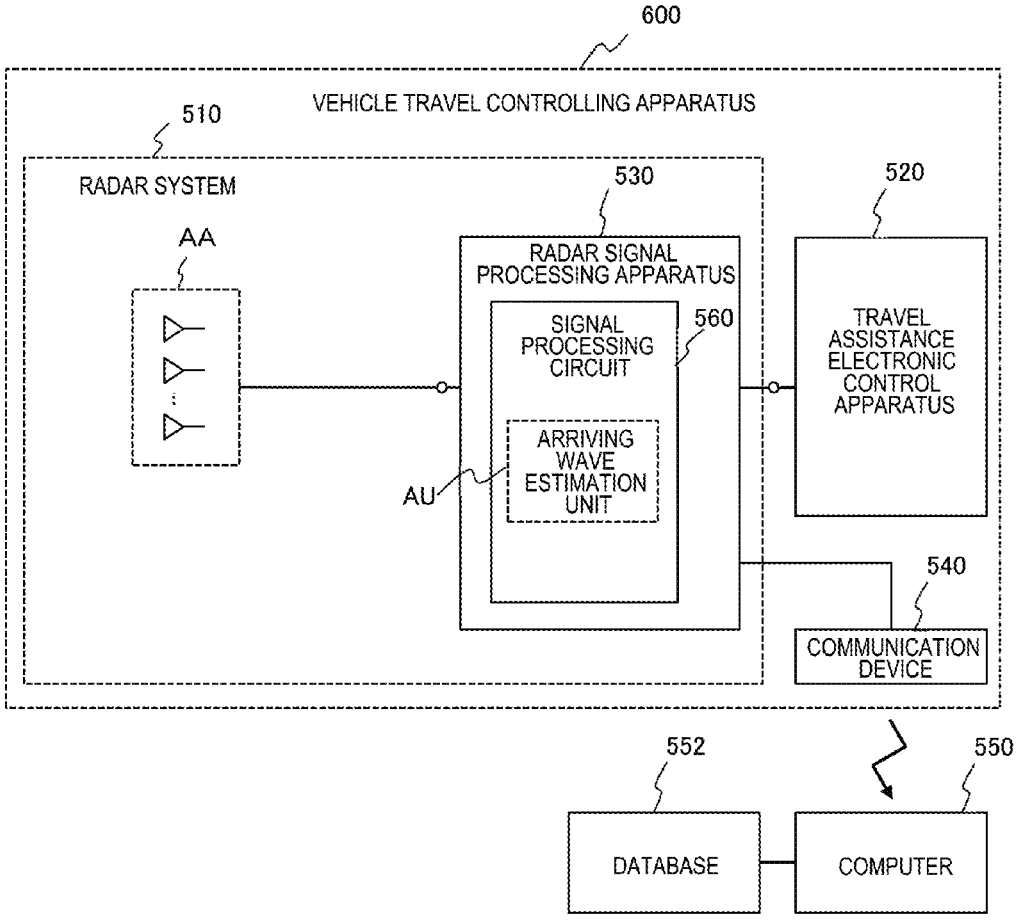
FIG. 36 is a block diagram showing an exemplary fundamental construction of a vehicle travel controlling apparatus 600 according to the present disclosure.

Next, see FIG. 36. FIG. 36 is a block diagram showing an exemplary fundamental construction of a vehicle travel controlling apparatus 600 according to the present disclosure. The vehicle travel controlling apparatus 600 shown in FIG. 36 includes a radar system 510 which is mounted in a vehicle, and a travel assistance electronic control apparatus 520 which is connected to the radar system 510. The radar system 510 includes an array antenna AA and a radar signal processing apparatus 530.

The array antenna AA includes a plurality of antenna elements, each of which outputs a reception signal in response to one or plural arriving waves. As mentioned earlier, the array antenna AA is capable of radiating a millimeter wave of a high frequency.

In the radar system 510, the array antenna AA needs to be attached to the vehicle, while at least some of the functions of the radar signal processing apparatus 530 may be implemented by a computer 550 and a database 552 which are provided externally to the vehicle travel controlling apparatus 600 (e.g., outside of the driver's vehicle). In that case, the portions of the radar signal processing apparatus 530 that are located within the vehicle may be perpetually or occasionally connected to the computer 550 and database 552 external to the vehicle so that bidirectional communications of signal or data are possible. The communications are to be performed via a communication device 540 of the vehicle and a commonly-available communications network.

The database 552 may store a program which defines various signal processing algorithms. The content of the data and program needed for the operation of the radar system 510 may be externally updated via the communication device 540. Thus, at least some of the functions of the radar system 510 can be realized externally to the driver's vehicle (which is inclusive of the interior of another vehicle), by a cloud computing technique. Therefore, an "onboard" radar system in the meaning of the present disclosure does not require that all of its constituent elements be mounted within the (driver's) vehicle. However, for simplicity, the present application will describe an implementation in which all constituent elements according to the present disclosure are mounted in a single vehicle (i.e., the driver's vehicle), unless otherwise specified.

The radar signal processing apparatus 530 includes a signal processing circuit 560. The signal processing circuit 560 directly or indirectly receives reception signals from the array antenna AA, and inputs the reception signals, or a secondary signal(s) which has been generated from the reception signals, to an arriving wave estimation unit AU. A part or a whole of the circuit (not shown) which generates a secondary signal(s) from the reception signals does not need to be provided inside of the signal processing circuit 560. A part or a whole of such a circuit (preprocessing circuit) may be provided between the array antenna AA and the radar signal processing apparatus 530.

The signal processing circuit 560 is configured to perform computation by using the reception signals or secondary signal(s), and output a signal indicating the number of arriving waves. As used herein, a "signal indicating the number of arriving waves" can be said to be a signal indicating the number of preceding vehicles (which may be one preceding vehicle or plural preceding vehicles) ahead of the driver's vehicle.

The signal processing circuit 560 may be configured to execute various signal processing which is executable by known radar signal processing apparatuses. For example, the signal processing circuit 560 may be configured to execute "super-resolution algorithms" such as the MUSIC method, the ESPRIT method, or the SAGE method, or other algorithms for direction-of-arrival estimation of relatively low resolution.

The arriving wave estimation unit AU shown in FIG. 36 estimates an angle representing the azimuth of each arriving wave by an arbitrary algorithm for direction-of-arrival estimation, and outputs a signal indicating the estimation result. The signal processing circuit 560 estimates the distance to each target as a wave source of an arriving wave, the relative velocity of the target, and the azimuth of the target by using a known algorithm which is executed by the arriving wave estimation unit AU, and output a signal indicating the estimation result.

In the present disclosure, the term "signal processing circuit" is not limited to a single circuit, but encompasses any implementation in which a combination of plural circuits is conceptually regarded as a single functional part. The signal processing circuit 560 may be realized by one or more System-on-Chips (SoCs). For example, a part or a whole of the signal processing circuit 560 may be an FPGA (Field-Programmable Gate Array), which is a programmable logic device (PLD). In that case, the signal processing circuit 560 includes a plurality of computation elements (e.g., general-purpose logics and multipliers) and a plurality of memory elements (e.g., look-up tables or memory blocks). Alternatively, the signal processing circuit 560 may be a set of a general-purpose processor(s) and a main memory device(s). The signal processing circuit 560 may be a circuit which includes a processor core(s) and a memory device(s). These may function as the signal processing circuit 560.

The travel assistance electronic control apparatus 520 is configured to provide travel assistance for the vehicle based on various signals which are output from the radar signal processing apparatus 530. The travel assistance electronic control apparatus 520 instructs various electronic control units to fulfill predetermined functions, e.g., a function of issuing an alarm to prompt the driver to make a braking operation when the distance to a preceding vehicle (vehicular gap) has become shorter than a predefined value; a function of controlling the brakes; and a function of controlling the accelerator. For example, in the case of an operation mode which performs adaptive cruise control of the driver's vehicle, the travel assistance electronic control apparatus 520 sends predetermined signals to various electronic control units (not shown) and actuators, to maintain the distance of the driver's vehicle to a preceding vehicle at a predefined value, or maintain the traveling velocity of the driver's vehicle at a predefined value.

In the case of the MUSIC method, the signal processing circuit 560 determines eigenvalues of the spatial covariance matrix, and, as a signal indicating the number of arriving waves, outputs a signal indicating the number of those eigenvalues ("signal space eigenvalues") which are greater than a predetermined value (thermal noise power) that is defined based on thermal noise.

Figure 37:
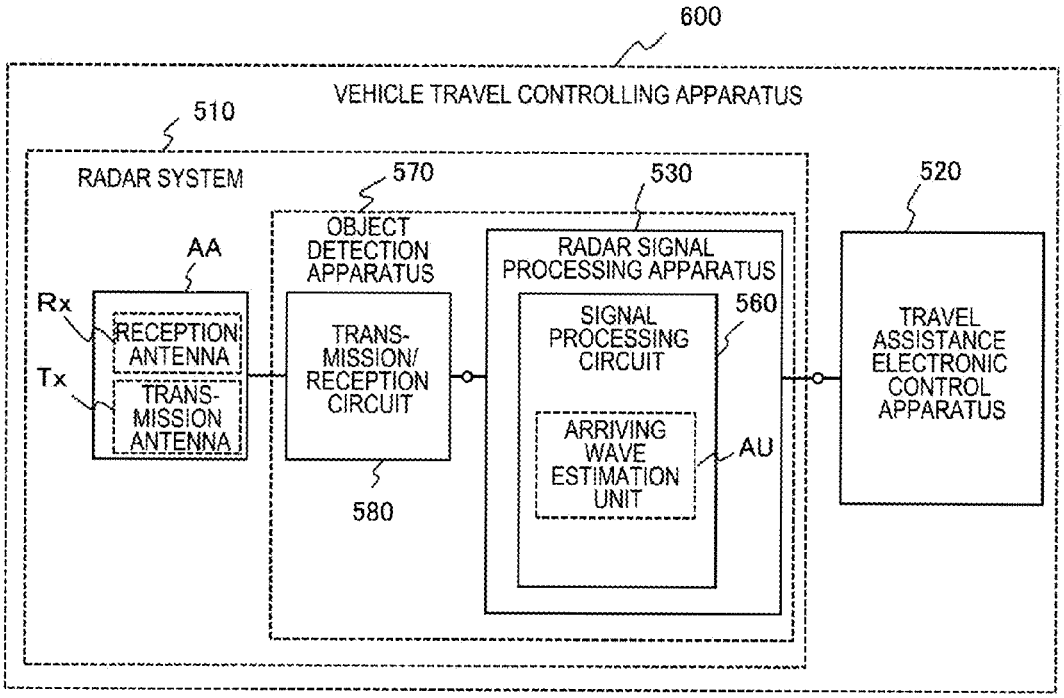
FIG. 37 is a block diagram showing another exemplary construction for the vehicle travel controlling apparatus 600.

Next, see FIG. 37. FIG. 37 is a block diagram showing another exemplary construction for the vehicle travel controlling apparatus 600. The radar system 510 in the vehicle travel controlling apparatus 600 of FIG. 37 includes an array antenna AA, which includes an array antenna that is dedicated to reception only (also referred to as a reception antenna) Rx and an array antenna that is dedicated to transmission only (also referred to as a transmission antenna) Tx; and an object detection apparatus 570.

At least one of the transmission antenna Tx and the reception antenna Rx has the aforementioned waveguide structure. The transmission antenna Tx radiates a transmission wave, which may be a millimeter wave, for example. The reception antenna Rx that is dedicated to reception only outputs a reception signal in response to one or plural arriving waves (e.g., a millimeter wave(s)).

A transmission/reception circuit 580 sends a transmission signal for a transmission wave to the transmission antenna Tx, and performs "preprocessing" for reception signals of reception waves received at the reception antenna Rx. A part or a whole of the preprocessing may be performed by the signal processing circuit 560 in the radar signal processing apparatus 530. A typical example of preprocessing to be performed by the transmission/reception circuit 580 may be generating a beat signal from a reception signal, and converting a reception signal of analog format into a reception signal of digital format.

Note that the radar system according to the present disclosure may, without being limited to the implementation where it is mounted in the driver's vehicle, be used while being fixed on the road or a building.

Next, an example of a more specific construction of the vehicle travel controlling apparatus 600 will be described.

Figure 38:
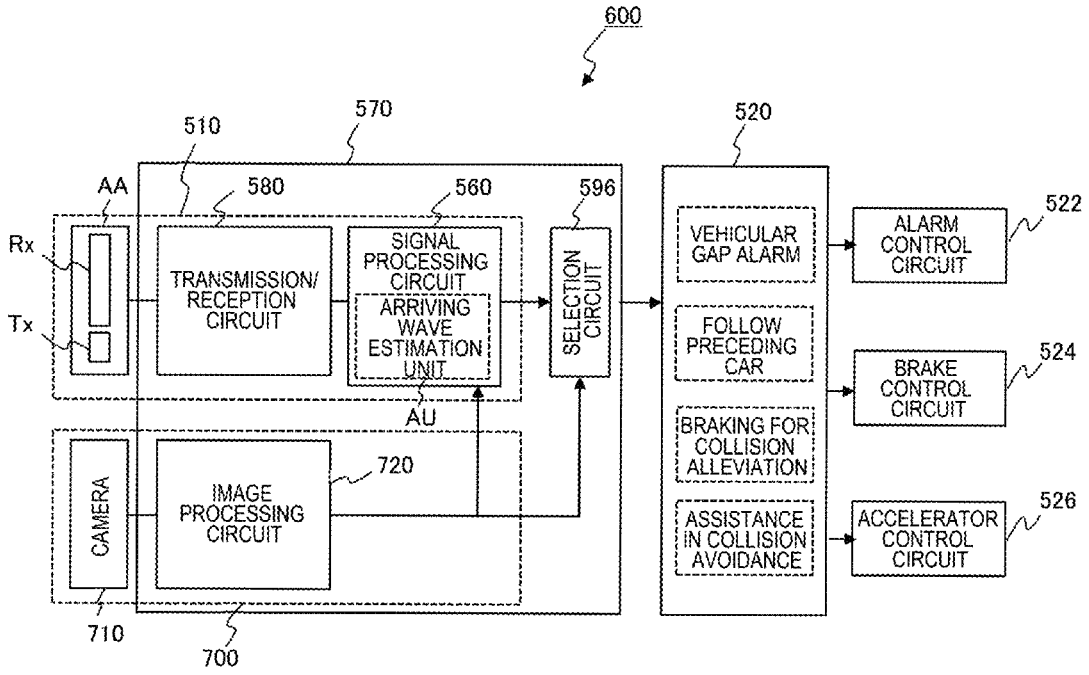
FIG. 38 is a block diagram showing an example of a more specific construction of the vehicle travel controlling apparatus 600.

FIG. 38 is a block diagram showing an example of a more specific construction of the vehicle travel controlling apparatus 600. The vehicle travel controlling apparatus 600 shown in FIG. 38 includes a radar system 510 and an onboard camera system 700. The radar system 510 includes an array antenna AA, a transmission/reception circuit 580 which is connected to the array antenna AA, and a signal processing circuit 560.

The onboard camera system 700 includes an onboard camera 710 which is mounted in a vehicle, and an image processing circuit 720 which processes an image or video that is acquired by the onboard camera 710.

The vehicle travel controlling apparatus 600 of this Application Example includes an object detection apparatus 570 which is connected to the array antenna AA and the onboard camera 710, and a travel assistance electronic control apparatus 520 which is connected to the object detection apparatus 570. The object detection apparatus 570 includes a transmission/reception circuit 580 and an image processing circuit 720, in addition to the above-described radar signal processing apparatus 530 (including the signal processing circuit 560). The object detection apparatus 570 detects a target on the road or near the road, by using not only the information which is obtained by the radar system 510 but also the information which is obtained by the image processing circuit 720. For example, while the driver's vehicle is traveling in one of two or more lanes of the same direction, the image processing circuit 720 can distinguish which lane the driver's vehicle is traveling in, and supply that result of distinction to the signal processing circuit 560. When the number and azimuth(s) of preceding vehicles are to be recognized by using a predetermined algorithm for direction-of-arrival estimation (e.g., the MUSIC method), the signal processing circuit 560 is able to provide more reliable information concerning a spatial distribution of preceding vehicles by referring to the information from the image processing circuit 720.

Note that the onboard camera system 700 is an example of a means for identifying which lane the driver's vehicle is traveling in. The lane position of the driver's vehicle may be identified by any other means. For example, by utilizing an ultra-wide band (UWB) technique, it is possible to identify which one of a plurality of lanes the driver's vehicle is traveling in. It is widely known that the ultra-wide band technique is applicable to position measurement and/or radar. Using the ultra-wide band technique enhances the range resolution of the radar, so that, even when a large number of vehicles exist ahead, each individual target can be detected with distinction, based on differences in distance. This makes it possible to identify distance from a guardrail on the road shoulder, or from the median strip, with good precision. The width of each lane is predefined based on each country's law or the like. By using such information, it becomes possible to identify where the lane in which the driver's vehicle is currently traveling is. Note that the ultra-wide band technique is an example. A radio wave based on any other wireless technique may be used. Moreover, LIDAR (Light Detection and Ranging) may be used together with a radar. LIDAR is sometimes called "laser radar".

The array antenna AA may be a generic millimeter wave array antenna for onboard use. The transmission antenna Tx in this Application Example radiates a millimeter wave as a transmission wave ahead of the vehicle. A portion of the transmission wave is reflected off a target which is typically a preceding vehicle, whereby a reflected wave occurs from the target being a wave source. A portion of the reflected wave reaches the array antenna (reception antenna) AA as an arriving wave. Each of the plurality of antenna elements of the array antenna AA outputs a reception signal in response to one or plural arriving waves. In the case where the number of targets functioning as wave sources of reflected waves is K (where K is an integer of one or more), the number of arriving waves is K, but this number K of arriving waves is not known beforehand.

The example of FIG. 36 assumes that the radar system 510 is provided as an integral piece, including the array antenna AA, on the rearview mirror. However, the number and positions of array antennas AA are not limited to any specific number or specific positions. An array antenna AA may be disposed on the rear surface of the vehicle so as to be able to detect targets that are behind the vehicle. Moreover, a plurality of array antennas AA may be disposed on the front surface and the rear surface of the vehicle. The array antenna(s) AA may be disposed inside the vehicle. Even in the case where a horn antenna whose respective antenna elements include horns as mentioned above is to be adopted as the array antenna(s) AA, the array antenna(s) with such antenna elements may be situated inside the vehicle.

The signal processing circuit 560 receives and processes the reception signals which have been received by the reception antenna Rx and subjected to preprocessing by the transmission/reception circuit 580. This process encompasses inputting the reception signals to the arriving wave estimation unit AU, or alternatively, generating a secondary signal(s) from the reception signals and inputting the secondary signal(s) to the arriving wave estimation unit AU.

In the example of FIG. 38, a selection circuit 596 which receives the signal being output from the signal processing circuit 560 and the signal being output from the image processing circuit 720 is provided in the object detection apparatus 570. The selection circuit 596 allows one or both of the signal being output from the signal processing circuit 560 and the signal being output from the image processing circuit 720 to be fed to the travel assistance electronic control apparatus 520.

Figure 39:
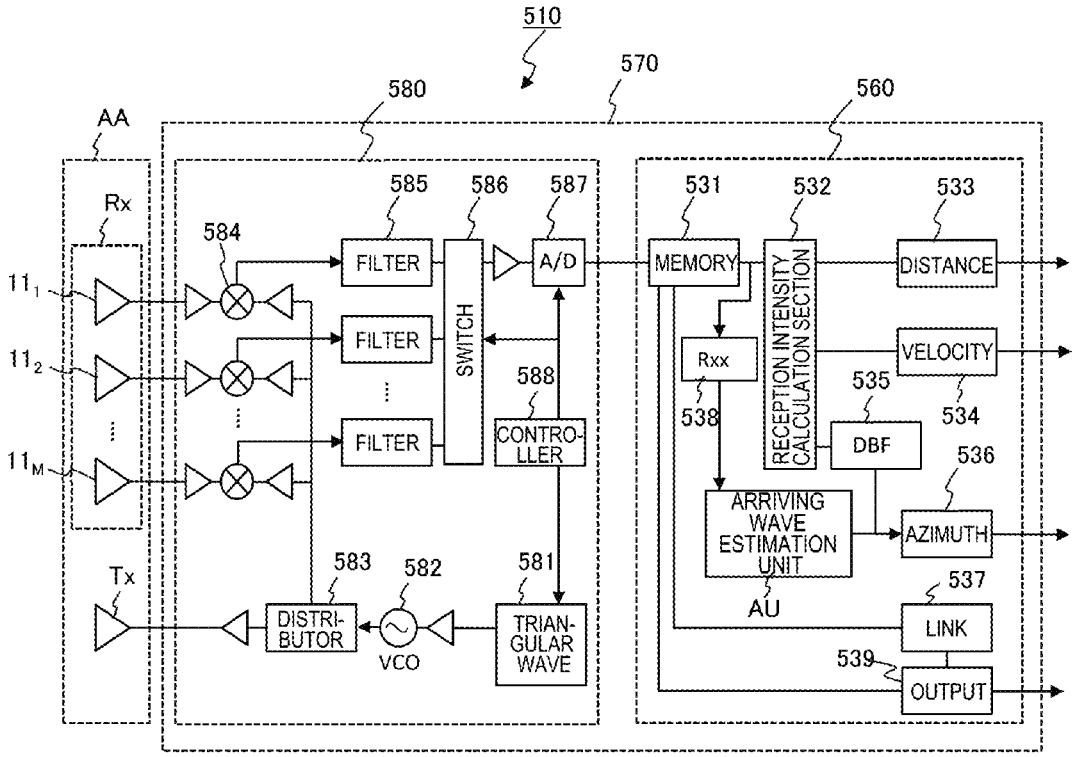
FIG. 39 is a block diagram showing a more detailed exemplary construction of the radar system 510 according to this Application Example.

FIG. 39 is a block diagram showing a more detailed exemplary construction of the radar system 510 according to this Application Example.

As shown in FIG. 39, the array antenna AA includes a transmission antenna Tx which transmits a millimeter wave and reception antennas Rx which receive arriving waves reflected from targets. Although only one transmission antenna Tx is illustrated in the figure, two or more kinds of transmission antennas with different characteristics may be provided. The array antenna AA includes M antenna elements $\mathbf{11}_1$, $\mathbf{11}_2$, . . . , $\mathbf{11}_m$ (where M is an integer of 3 or more). In response to the arriving waves, the plurality of antenna elements $\mathbf{11}_1$, $\mathbf{11}_2$, . . . , $\mathbf{11}_m$ respectively output reception signals $s_1$, $s_2$, . . . , $s_m$ (FIG. 35B).

In the array antenna AA, the antenna elements $\mathbf{11}_1$ to $\mathbf{11}_m$ are arranged in a linear array or a two-dimensional array at fixed intervals, for example. Each arriving wave will impinge on the array antenna AA from a direction at an angle θ with respect to the normal of the plane in which the antenna elements $\mathbf{11}_1$ to $\mathbf{11}_m$ are arrayed. Thus, the direction of arrival of an arriving wave is defined by this angle θ.

When an arriving wave from one target impinges on the array antenna AA, this approximates to a plane wave impinging on the antenna elements $\mathbf{11}_1$ to $\mathbf{11}_m$ from azimuths of the same angle θ. When K arriving waves impinge on the array antenna AA from K targets with different azimuths, the individual arriving waves can be identified in terms of respectively different angles $\theta_1$ to $\theta_K$.

As shown in FIG. 39, the object detection apparatus 570 includes the transmission/reception circuit 580 and the signal processing circuit 560.

The transmission/reception circuit 580 includes a triangular wave generation circuit 581, a VCO (voltage controlled oscillator) 582, a distributor 583, mixers 584, filters 585, a switch 586, an A/D converter 587, and a controller 588. Although the radar system in this Application Example is configured to perform transmission and reception of millimeter waves by the FMCW method, the radar system of the present disclosure is not limited to this method. The transmission/reception circuit 580 is configured to generate a beat signal based on a reception signal from the array antenna AA and a transmission signal from the transmission antenna Tx.

The signal processing circuit 560 includes a distance detection section 533, a velocity detection section 534, and an azimuth detection section 536. The signal processing circuit 560 is configured to process a signal from the A/D converter 587 in the transmission/reception circuit 580, and output signals respectively indicating the detected distance to the target, the relative velocity of the target, and the azimuth of the target.

First, the construction and operation of the transmission/reception circuit 580 will be described in detail.

Figure 40:
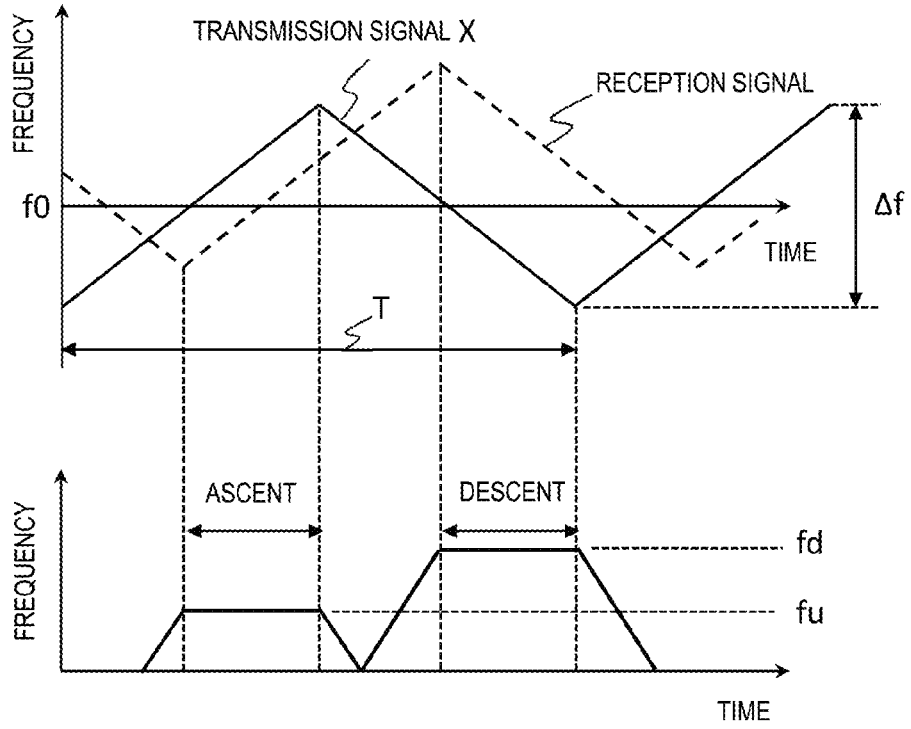
FIG. 40 is a diagram showing change in frequency of a transmission signal which is modulated based on the signal that is generated by a triangular wave generation circuit 581.

The triangular wave generation circuit 581 generates a triangular wave signal, and supplies it to the VCO 582. The VCO 582 outputs a transmission signal having a frequency as modulated based on the triangular wave signal. FIG. 40 is a diagram showing change in frequency of a transmission signal which is modulated based on the signal that is generated by the triangular wave generation circuit 581. This waveform has a modulation width $\Delta f$ and a center frequency of f0. The transmission signal having a thus modulated frequency is supplied to the distributor 583. The distributor 583 allows the transmission signal obtained from the VCO 582 to be distributed among the mixers 584 and the transmission antenna Tx. Thus, the transmission antenna radiates a millimeter wave having a frequency which is modulated in triangular waves, as shown in FIG. 40.

In addition to the transmission signal, FIG. 40 also shows an example of a reception signal from an arriving wave which is reflected from a single preceding vehicle. The reception signal is delayed from the transmission signal. This delay is in proportion to the distance between the driver's vehicle and the preceding vehicle. Moreover, the frequency of the reception signal increases or decreases in accordance with the relative velocity of the preceding vehicle, due to the Doppler effect.

When the reception signal and the transmission signal are mixed, a beat signal is generated based on their frequency difference. The frequency of this beat signal (beat frequency) differs between a period in which the transmission signal increases in frequency (ascent) and a period in which the transmission signal decreases in frequency (descent). Once a beat frequency for each period is determined, based on such beat frequencies, the distance to the target and the relative velocity of the target are calculated.

Figure 41:
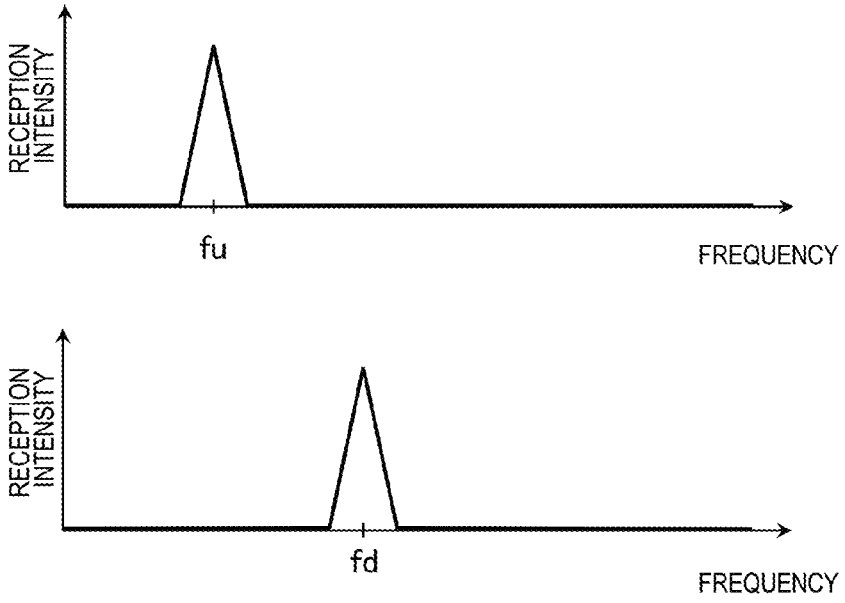
FIG. 41 is a diagram showing a beat frequency fu in an "ascent" period and a beat frequency fd in a "descent" period.

FIG. 41 shows a beat frequency fu in an "ascent" period and a beat frequency fd in a "descent" period. In the graph of FIG. 41, the horizontal axis represents frequency, and the vertical axis represents signal intensity. This graph is obtained by subjecting the beat signal to time-frequency conversion. Once the beat frequencies fu and fd are obtained, based on a known equation, the distance to the target and the relative velocity of the target are calculated. In this Application Example, with the construction and operation described below, beat frequencies corresponding to each antenna element of the array antenna AA are obtained, thus enabling estimation of the position information of a target.

In the example shown in FIG. 39, reception signals from channels $Ch_1$ to $Ch_M$ corresponding to the respective antenna elements $\mathbf{11}_1$ to $\mathbf{11}_m$ are each amplified by an amplifier, and input to the corresponding mixers 584. Each mixer 584 mixes the transmission signal into the amplified reception signal. Through this mixing, a beat signal is generated corresponding to the frequency difference between the reception signal and the transmission signal. The generated beat signal is fed to the corresponding filter 585. The filters 585 apply bandwidth control to the beat signals on the channels $Ch_1$ to $Ch_M$, and supply bandwidth-controlled beat signals to the switch 586.

The switch 586 performs switching in response to a sampling signal which is input from the controller 588. The controller 588 may be composed of a microcomputer, for example. Based on a computer program which is stored in a memory such as a ROM, the controller 588 controls the entire transmission/reception circuit 580. The controller 588 does not need to be provided inside the transmission/reception circuit 580, but may be provided inside the signal processing circuit 560. In other words, the transmission/reception circuit 580 may operate in accordance with a control signal from the signal processing circuit 560. Alternatively, some or all of the functions of the controller 588 may be realized by a central processing unit which controls the entire transmission/reception circuit 580 and signal processing circuit 560.

The beat signals on the channels $Ch_1$ to $Ch_M$ having passed through the respective filters 585 are consecutively supplied to the A/D converter 587 via the switch 586. In synchronization with the sampling signal, the A/D converter 587 converts the beat signals on the channels $Ch_1$ to $Ch_M$, which are input from the switch 586, into digital signals.

Hereinafter, the construction and operation of the signal processing circuit 560 will be described in detail. In this Application Example, the distance to the target and the relative velocity of the target are estimated by the FMCW method. Without being limited to the FMCW method as described below, the radar system can also be implemented by using other methods, e.g., 2 frequency CW and spread spectrum methods.

In the example shown in FIG. 39, the signal processing circuit 560 includes a memory 531, a reception intensity calculation section 532, a distance detection section 533, a velocity detection section 534, a DBF (digital beam forming) processing section 535, an azimuth detection section 536, a target link processing section 537, a matrix generation section 538, a target output processing section 539, and an arriving wave estimation unit AU. As mentioned earlier, a part or a whole of the signal processing circuit 560 may be implemented by FPGA, or by a set of a general-purpose processor(s) and a main memory device(s). The memory 531, the reception intensity calculation section 532, the DBF processing section 535, the distance detection section 533, the velocity detection section 534, the azimuth detection section 536, the target link processing section 537, and the arriving wave estimation unit AU may be individual parts that are implemented in distinct pieces of hardware, or functional blocks of a single signal processing circuit.

Figure 42:
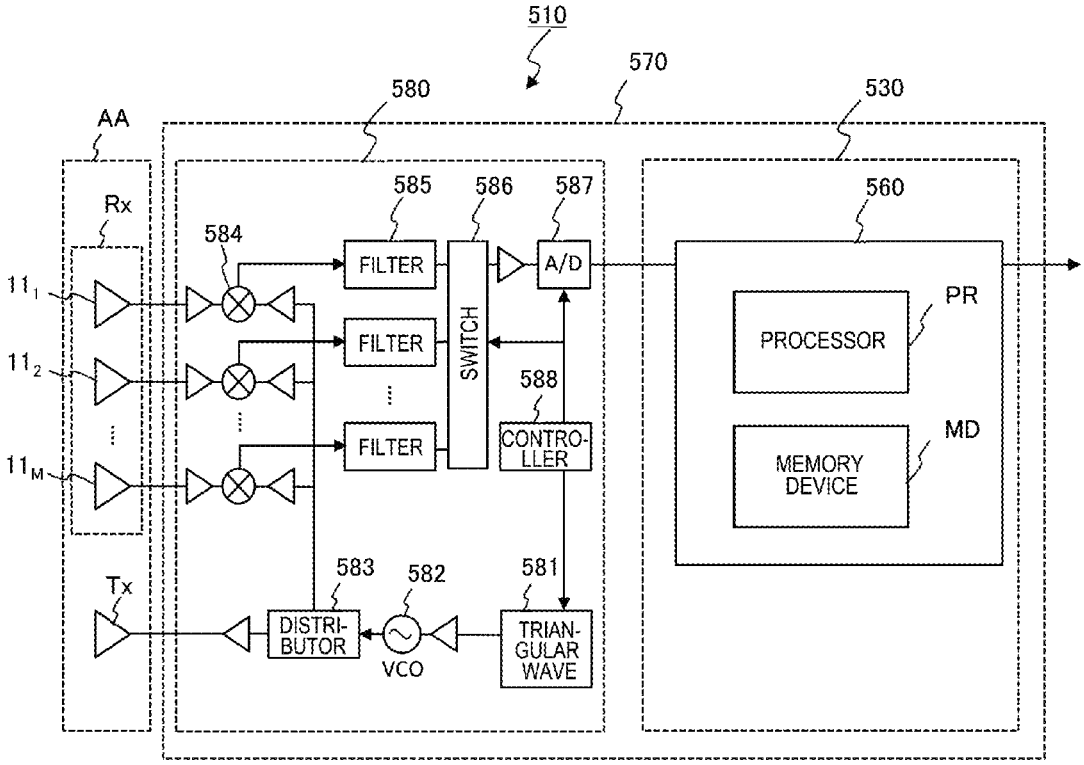
FIG. 42 is a diagram showing an exemplary implementation in which a signal processing circuit 560 is implemented in hardware including a processor PR and a memory device MD.

FIG. 42 shows an exemplary implementation in which the signal processing circuit 560 is implemented in hardware including a processor PR and a memory device MD. In the signal processing circuit 560 with this construction, too, a computer program that is stored in the memory device MD may fulfill the functions of the reception intensity calculation section 532, the DBF processing section 535, the distance detection section 533, the velocity detection section 534, the azimuth detection section 536, the target link processing section 537, the matrix generation section 538, and the arriving wave estimation unit AU shown in FIG. 39.

The signal processing circuit 560 in this Application Example is configured to estimate the position information of a preceding vehicle by using each beat signal converted into a digital signal as a secondary signal of the reception signal, and output a signal indicating the estimation result. Hereinafter, the construction and operation of the signal processing circuit 560 in this Application Example will be described in detail.

For each of the channels $Ch_1$ to $Ch_M$, the memory 531 in the signal processing circuit 560 stores a digital signal which is output from the A/D converter 587. The memory 531 may be composed of a generic storage medium such as a semiconductor memory or a hard disk and/or an optical disk.

The reception intensity calculation section 532 applies Fourier transform to the respective beat signals for the channels $Ch_1$ to $Ch_M$ (shown in the lower graph of FIG. 40) that are stored in the memory 531. In the present specification, the amplitude of a piece of complex number data after the Fourier transform is referred to as "signal intensity". The reception intensity calculation section 532 converts the complex number data of a reception signal from one of the plurality of antenna elements, or a sum of the complex number data of all reception signals from the plurality of antenna elements, into a frequency spectrum. In the resultant spectrum, beat frequencies corresponding to respective peak values, which are indicative of presence and distance of targets (preceding vehicles), can be detected. Taking a sum of the complex number data of the reception signals from all antenna elements will allow the noise components to average out, whereby the S/N ratio is improved.

In the case where there is one target, i.e., one preceding vehicle, as shown in FIG. 41, the Fourier transform will produce a spectrum having one peak value in a period of increasing frequency (the "ascent" period) and one peak value in a period of decreasing frequency ("the descent" period). The beat frequency of the peak value in the "ascent" period is denoted by "fu", whereas the beat frequency of the peak value in the "descent" period is denoted by "fd".

From the signal intensities of beat frequencies, the reception intensity calculation section 532 detects any signal intensity that exceeds a predefined value (threshold value), thus determining the presence of a target. Upon detecting a signal intensity peak, the reception intensity calculation section 532 outputs the beat frequencies (fu, fd) of the peak values to the distance detection section 533 and the velocity detection section 534 as the frequencies of the object of interest. The reception intensity calculation section 532 outputs information indicating the frequency modulation width Δf to the distance detection section 533, and outputs information indicating the center frequency f0 to the velocity detection section 534.

In the case where signal intensity peaks corresponding to plural targets are detected, the reception intensity calculation section 532 find associations between the ascents peak values and the descent peak values based on predefined conditions. Peaks which are determined as belonging to signals from the same target are given the same number, and thus are fed to the distance detection section 533 and the velocity detection section 534.

When there are plural targets, after the Fourier transform, as many peaks as there are targets will appear in the ascent portions and the descent portions of the beat signal. In proportion to the distance between the radar and a target, the reception signal will become more delayed and the reception signal in FIG. 40 will shift more toward the right. Therefore, a beat signal will have a greater frequency as the distant between the target and the radar increases.

Based on the beat frequencies fu and fd which are input from the reception intensity calculation section 532, the distance detection section 533 calculates a distance R through the equation below, and supplies it to the target link processing section 537.

$$R=\{C\cdot T/(2\cdot\Delta f)\}\cdot\{(fu+fd)/2\}$$

Moreover, based on the beat frequencies fu and fd being input from the reception intensity calculation section 532, the velocity detection section 534 calculates a relative velocity V through the equation below, and supplies it to the target link processing section 537.

$$V=\{C/(2\cdot f0)\}\cdot\{(fu-fd)/2\}$$

In the equation which calculates the distance R and the relative velocity V, C is velocity of light, and T is the modulation period.

Note that the lower limit resolution of distance R is expressed as C/(2 Δf). Therefore, as Δf increases, the resolution of distance R increases. In the case where the frequency f0 is in the 76 GHz band, when Δf is set on the order of 660 megahertz (MHz), the resolution of distance R will be on the order of 0.23 meters (m), for example. Therefore, if two preceding vehicles are traveling abreast of each other, it may be difficult with the FMCW method to identify whether there is one vehicle or two vehicles. In such a case, it might be possible to run an algorithm for direction-of-arrival estimation that has an extremely high angular resolution to separate between the azimuths of the two preceding vehicles and enable detection.

By utilizing phase differences between signals from the antenna elements $\mathbf{11}_1$, $\mathbf{11}_2$, . . . , $\mathbf{11}_m$, the DBF processing section 535 allows the incoming complex data corresponding to the respective antenna elements, which has been Fourier transformed with respect to the time axis, to be Fourier transformed with respect to the direction in which the antenna elements are arrayed. Then, the DBF processing section 535 calculates spatial complex number data indicating the spectrum intensity for each angular channel as determined by the angular resolution, and outputs it to the azimuth detection section 536 for the respective beat frequencies.

The azimuth detection section 536 is provided for the purpose of estimating the azimuth of a preceding vehicle. Among the values of spatial complex number data that has been calculated for the respective beat frequencies, the azimuth detection section 536 chooses an angle θ that takes the largest value, and outputs it to the target link processing section 537 as the azimuth at which an object of interest exists.

Note that the method of estimating the angle θ indicating the direction of arrival of an arriving wave is not limited to this example. Various algorithms for direction-of-arrival estimation that have been mentioned earlier can be employed.

The target link processing section 537 calculates absolute values of the differences between the respective values of distance, relative velocity, and azimuth of the object of interest as calculated in the current cycle and the respective values of distance, relative velocity, and azimuth of the object of interest as calculated 1 cycle before, which are read from the memory 531. Then, if the absolute value of each difference is smaller than a value which is defined for the respective value, the target link processing section 537 determines that the target that was detected 1 cycle before and the target detected in the current cycle are an identical target. In that case, the target link processing section 537 increments the count of target link processes, which is read from the memory 531, by one.

If the absolute value of a difference is greater than predetermined, the target link processing section 537 determines that a new object of interest has been detected. The target link processing section 537 stores the respective values of distance, relative velocity, and azimuth of the object of interest as calculated in the current cycle and also the count of target link processes for that object of interest to the memory 531.

In the signal processing circuit 560, the distance to the object of interest and its relative velocity can be detected by using a spectrum which is obtained through a frequency analysis of beat signals, which are signals generated based on received reflected waves.

The matrix generation section 538 generates a spatial covariance matrix by using the respective beat signals for the channels $Ch_1$ to $Ch_M$ (lower graph in FIG. 40) stored in the memory 531. In the spatial covariance matrix of Math. 4, each component is the value of a beat signal which is expressed in terms of real and imaginary parts. The matrix generation section 538 further determines eigenvalues of the spatial covariance matrix Rxx, and inputs the resultant eigenvalue information to the arriving wave estimation unit AU.

When a plurality of signal intensity peaks corresponding to plural objects of interest have been detected, the reception intensity calculation section 532 numbers the peak values respectively in the ascent portion and in the descent portion, beginning from those with smaller frequencies first, and output them to the target output processing section 539. In the ascent and descent portions, peaks of any identical number correspond to the same object of interest. The identification numbers are to be regarded as the numbers assigned to the objects of interest. For simplicity of illustration, a leader line from the reception intensity calculation section 532 to the target output processing section 539 is conveniently omitted from FIG. 39.

When the object of interest is a structure ahead, the target output processing section 539 outputs the identification number of that object of interest as indicating a target. When receiving results of determination concerning plural objects of interest, such that all of them are structures ahead, the target output processing section 539 outputs the identification number of an object of interest that is in the lane of the driver's vehicle as the object position information indicating where a target is. Moreover, When receiving results of determination concerning plural objects of interest, such that all of them are structures ahead and that two or more objects of interest are in the lane of the driver's vehicle, the target output processing section 539 outputs the identification number of an object of interest that is associated with the largest count of target being read from the link processes memory 531 as the object position information indicating where a target is.

Referring back to FIG. 38, an example where the onboard radar system 510 is incorporated in the exemplary construction shown in FIG. 38 will be described. The image processing circuit 720 acquires information of an object from the video, and detects target position information from the object information. For example, the image processing circuit 720 is configured to estimate distance information of an object by detecting the depth value of an object within an acquired video, or detect size information and the like of an object from characteristic amounts in the video, thus detecting position information of the object.

The selection circuit 596 selectively feeds position information which is received from the signal processing circuit 560 or the image processing circuit 720 to the travel assistance electronic control apparatus 520. For example, the selection circuit 596 compares a first distance, i.e., the distance from the driver's vehicle to a detected object as contained in the object position information from the signal processing circuit 560, against a second distance, i.e., the distance from the driver's vehicle to the detected object as contained in the object position information from the image processing circuit 720, and determines which is closer to the driver's vehicle. For example, based on the result of determination, the selection circuit 596 may select the object position information which indicates a closer distance to the driver's vehicle, and output it to the travel assistance electronic control apparatus 520. If the result of determination indicates the first distance and the second distance to be of the same value, the selection circuit 596 may output either one, or both of them, to the travel assistance electronic control apparatus 520.

If information indicating that there is no prospective target is input from the reception intensity calculation section 532, the target output processing section 539 (FIG. 39) outputs zero, indicating that there is no target, as the object position information. Then, on the basis of the object position information from the target output processing section 539, through comparison against a predefined threshold value, the selection circuit 596 chooses either the object position information from the signal processing circuit 560 or the object position information from the image processing circuit 720 to be used.

Based on predefined conditions, the travel assistance electronic control apparatus 520 having received the position information of a preceding object from the object detection apparatus 570 performs control to make the operation safer or easier for the driver who is driving the driver's vehicle, in accordance with the distance and size indicated by the object position information, the velocity of the driver's vehicle, road surface conditions such as rainfall, snowfall or clear weather, or other conditions. For example, if the object position information indicates that no object has been detected, the travel assistance electronic control apparatus 520 may send a control signal to an accelerator control circuit 526 to increase speed up to a predefined velocity, thereby controlling the accelerator control circuit 526 to make an operation that is equivalent to stepping on the accelerator pedal.

In the case where the object position information indicates that an object has been detected, if it is found to be at a predetermined distance from the driver's vehicle, the travel assistance electronic control apparatus 520 controls the brakes via a brake control circuit 524 through a brake-by-wire construction or the like. In other words, it makes an operation of decreasing the velocity to maintain a constant vehicular gap. Upon receiving the object position information, the travel assistance electronic control apparatus 520 sends a control signal to an alarm control circuit 522 so as to control lamp illumination or control audio through a loudspeaker which is provided within the vehicle, so that the driver is informed of the nearing of a preceding object. Upon receiving object position information including a spatial distribution of preceding vehicles, the travel assistance electronic control apparatus 520 may, if the traveling velocity is within a predefined range, automatically make the steering wheel easier to operate to the right or left, or control the hydraulic pressure on the steering wheel side so as to force a change in the direction of the wheels, thereby providing assistance in collision avoidance with respect to the preceding object.

The object detection apparatus 570 may be arranged so that, if a piece of object position information which was being continuously detected by the selection circuit 596 for a while in the previous detection cycle but which is not detected in the current detection cycle becomes associated with a piece of object position information from a camera-detected video indicating a preceding object, then continued tracking is chosen, and object position information from the signal processing circuit 560 is output with priority.

An exemplary specific construction and an exemplary operation for the selection circuit 596 to make a selection between the outputs from the signal processing circuit 560 and the image processing circuit 720 are disclosed in the specification of U.S. Pat. No. 8,446,312, the specification of U.S. Pat. No. 8,730,096, and the specification of U.S. Pat. No. 8,730,099. The entire disclosure thereof is incorporated herein by reference.

[First Variant]

In the radar system for onboard use of the above Application Example, the (sweep) condition for a single instance of FMCW (Frequency Modulated Continuous Wave) frequency modulation, i.e., a time span required for such a modulation (sweep time), is e.g. 1 millisecond, although the sweep time could be shortened to about 100 microseconds.

However, in order to realize such a rapid sweep condition, not only the constituent elements involved in the radiation of a transmission wave, but also the constituent elements involved in the reception under that sweep condition must also be able to rapidly operate. For example, an A/D converter 587 (FIG. 39) which rapidly operates under that sweep condition will be needed. The sampling frequency of the A/D converter 587 may be 10 MHz, for example. The sampling frequency may be faster than 10 MHz.

In the present variant, a relative velocity with respect to a target is calculated without utilizing any Doppler shift-based frequency component. In the present embodiment, the sweep time is Tm=100 microseconds, which is very short. The lowest frequency of a detectable beat signal, which is 1/Tm, equals 10 kHz in this case. This would correspond to a Doppler shift of a reflected wave from a target which has a relative velocity of approximately 20 m/second. In other words, so long as one relies on a Doppler shift, it would be impossible to detect relative velocities that are equal to or smaller than this. Thus, a method of calculation which is different from a Doppler shift-based method of calculation is preferably adopted.

As an example, this variant illustrates a process that utilizes a signal (upbeat signal) representing a difference between a transmission wave and a reception wave which is obtained in an upbeat (ascent) portion where the transmission wave increases in frequency. A single sweep time of FMCW is 100 microseconds, and its waveform is a sawtooth shape which is composed only of an upbeat portion. In other words, in the present embodiment, the signal wave which is generated by the triangular wave/CW wave generation circuit 581 has a sawtooth shape. The sweep width in frequency is 500 MHz. Since no peaks are to be utilized that are associated with Doppler shifts, the process is not one that generates an upbeat signal and a downbeat signal to utilize the peaks of both, but will rely on only one of such signals. Although a case of utilizing an upbeat signal will be illustrated herein, a similar process can also be performed by using a downbeat signal.

The A/D converter 587 (FIG. 39) samples each upbeat signal at a sampling frequency of 10 MHz, and outputs several hundred pieces of digital data (hereinafter referred to as "sampling data"). The sampling data is generated based on upbeat signals after a point in time where a reception wave is obtained and until a point in time at which a transmission wave completes transmission, for example. Note that the process may be ended as soon as a certain number of pieces of sampling data are obtained.

In this variant, 128 upbeat signals are transmitted/received in series, for each of which some several hundred pieces of sampling data are obtained. The number of upbeat signals is not limited to 128. It may be 256, or 8. An arbitrary number may be selected depending on the purpose.

The resultant sampling data is stored to the memory 531. The reception intensity calculation section 532 applies a two-dimensional fast Fourier transform (FFT) to the sampling data. Specifically, first, for each of the sampling data pieces that have been obtained through a single sweep, a first FFT process (frequency analysis process) is performed to generate a power spectrum. Next, the velocity detection section 534 performs a second FFT process for the processing results that have been collected from all sweeps.

When the reflected waves are from the same target, peak components in the power spectrum to be detected in each sweep period will be of the same frequency. On the other hand, for different targets, the peak components will differ in frequency. Through the first FFT process, plural targets that are located at different distances can be separated.

In the case where a relative velocity with respect to a target is non-zero, the phase of the upbeat signal changes slightly from sweep to sweep. In other words, through the second FFT process, a power spectrum whose elements are the data of frequency components that are associated with such phase changes will be obtained for the respective results of the first FFT process.

The reception intensity calculation section 532 extracts peak values in the second power spectrum above, and sends them to the velocity detection section 534.

The velocity detection section 534 determines a relative velocity from the phase changes. For example, suppose that a series of obtained upbeat signals undergo phase changes by every phase θ [RXd]. Assuming that the transmission wave has an average wavelength A, this means there is a $\lambda/(4\pi/\theta)$ change in distance every time an upbeat signal is obtained. Since this change has occurred over an interval of upbeat signal transmission Tm (=100 microseconds), the relative velocity is determined to be $\{\lambda/(4\pi/\theta)\}/Tm$.

Through the above processes, a relative velocity with respect to a target as well as a distance from the target can be obtained.

[Second Variant]

The radar system 510 is able to detect a target by using a continuous wave(s) CW of one or plural frequencies. This method is especially useful in an environment where a multitude of reflected waves impinge on the radar system 510 from still objects in the surroundings, e.g., when the vehicle is in a tunnel.

The radar system 510 has an antenna array for reception purposes, including five channels of independent reception elements. In such a radar system, the azimuth-of-arrival estimation for incident reflected waves is only possible if there are four or fewer reflected waves that are simultaneously incident. In an FMCW-type radar, the number of reflected waves to be simultaneously subjected to an azimuth-of-arrival estimation can be reduced by exclusively selecting reflected waves from a specific distance. However, in an environment where a large number of still objects exist in the surroundings, e.g., in a tunnel, it is as if there were a continuum of objects to reflect radio waves; therefore, even if one narrows down on the reflected waves based on distance, the number of reflected waves may still not be equal to or smaller than four. However, any such still object in the surroundings will have an identical relative velocity with respect to the driver's vehicle, and the relative velocity will be greater than that associated with any other vehicle that is traveling ahead. On this basis, such still objects can be distinguished from any other vehicle based on the magnitudes of Doppler shifts.

Therefore, the radar system 510 performs a process of: radiating continuous waves CW of plural frequencies; and, while ignoring Doppler shift peaks that correspond to still objects in the reception signals, detecting a distance by using a Doppler shift peak(s) of any smaller shift amount(s). Unlike in the FMCW method, in the CW method, a frequency difference between a transmission wave and a reception wave is ascribable only to a Doppler shift. In other words, any peak frequency that appears in a beat signal is ascribable only to a Doppler shift.

In the description of this variant, too, a continuous wave to be used in the CW method will be referred to as a "continuous wave CW". As described above, a continuous wave CW has a constant frequency; that is, it is unmodulated.

Suppose that the radar system 510 has radiated a continuous wave CW of a frequency fp, and detected a reflected wave of a frequency fq that has been reflected off a target. The difference between the transmission frequency fp and the reception frequency fq is called a Doppler frequency, which approximates to $fp-fq=2\cdot Vr\cdot fp/c$. Herein, Vr is a relative velocity between the radar system and the target, and c is the velocity of light. The transmission frequency fp, the Doppler frequency (fp−fq), and the velocity of light c are known. Therefore, from this equation, the relative velocity $Vr=(fp-fq)\cdot c/2fp$ can be determined. The distance to the target is calculated by utilizing phase information as will be described later.

In order to detect a distance to a target by using continuous waves CW, a 2 frequency CW method is adopted. In the 2 frequency CW method, continuous waves CW of two frequencies which are slightly apart are radiated each for a certain period, and their respective reflected waves are acquired. For example, in the case of using frequencies in the 76 GHz band, the difference between the two frequencies would be several hundred kHz. As will be described later, it is more preferable to determine the difference between the two frequencies while taking into account the minimum distance at which the radar used is able to detect a target.

Suppose that the radar system 510 has sequentially radiated continuous waves CW of frequencies fp1 and fp2 ($fp1<fp2$), and that the two continuous waves CW have been reflected off a single target, resulting in reflected waves of frequencies fq1 and fq2 being received by the radar system 510.

Based on the continuous wave CW of the frequency fp1 and the reflected wave (frequency fq1) thereof, a first Doppler frequency is obtained. Based on the continuous wave CW of the frequency fp2 and the reflected wave (frequency fq2) thereof, a second Doppler frequency is obtained. The two Doppler frequencies have substantially the same value. However, due to the difference between the frequencies fp1 and fp2, the complex signals of the respective reception waves differ in phase. By utilizing this phase information, a distance (range) to the target can be calculated.

Specifically, the radar system 10 is able to determine the distance R as $R=c\cdot\Delta\phi/4\pi(fp2-fp1)$. Herein, $\Delta\phi$ denotes the phase difference between two beat signals, i.e., a beat signal fb1 which is obtained as a difference between the continuous wave CW of the frequency fp1 and the reflected wave (frequency fq1) thereof and a beat signal fb2 which is obtained as a difference between the continuous wave CW of the frequency fp2 and the reflected wave (frequency fq2) thereof. The method of identifying the frequencies fb1 and fb2 of the respective beat signals is identical to that in the aforementioned instance of a beat signal from a continuous wave CW of a single frequency.

Note that a relative velocity Vr under the 2 frequency CW method is determined as follows.

$$Vr=fb1\cdot c/2\cdot fp1 \text{ or } Vr=fb2\cdot c/2\cdot fp2$$

Moreover, the range in which a distance to a target can be uniquely identified is limited to the range defined by $Rmax<c/2(fp2-fp1)$. The reason is that beat signals resulting from a reflected wave from any farther target would produce a $\Delta\phi$ which is greater than $2\pi$, such that they are indistinguishable from beat signals associated with targets at closer positions. Therefore, it is more preferable to adjust the difference between the frequencies of the two continuous waves CW so that Rmax becomes greater than the minimum detectable distance of the radar. In the case of a radar whose minimum detectable distance is 100 m, fp2−fp1 may be made e.g. 1.0 MHz. In this case, Rmax=150 m, so that a signal from any target from a position beyond Rmax is not detected. In the case of mounting a radar which is capable of detection up to 250 m, fp2−fp1 may be made e.g. 500 kHz. In this case, Rmax=300 m, so that a signal from any target from a position beyond Rmax is not detected, either. In the case where the radar has both of an operation mode in which the minimum detectable distance is 100 m and the horizontal viewing angle is 120 degrees and an operation mode in which the minimum detectable distance is 250 m and the horizontal viewing angle is 5 degrees, it is preferable to switch the fp2−fp1 value be 1.0 MHz and 500 kHz for operation in the respective operation modes.

A detection approach is known which, by transmitting continuous waves CW at N different frequencies (where N is an integer of 3 or more), and utilizing phase information of the respective reflected waves, detects a distance to each target. Under this detection approach, distance can be properly recognized up to N−1 targets. As the processing to enable this, a fast Fourier transform (FFT) is used, for example. Given N=64 or 128, an FFT is performed for sampling data of a beat signal as a difference between a transmission signal and a reception signal for each frequency, thus obtaining a frequency spectrum (relative velocity). Thereafter, at the frequency of the CW wave, a further FFT is performed for peaks of the same frequency, thus to derive distance information.

Hereinafter, this will be described more specifically.

Figure 43:
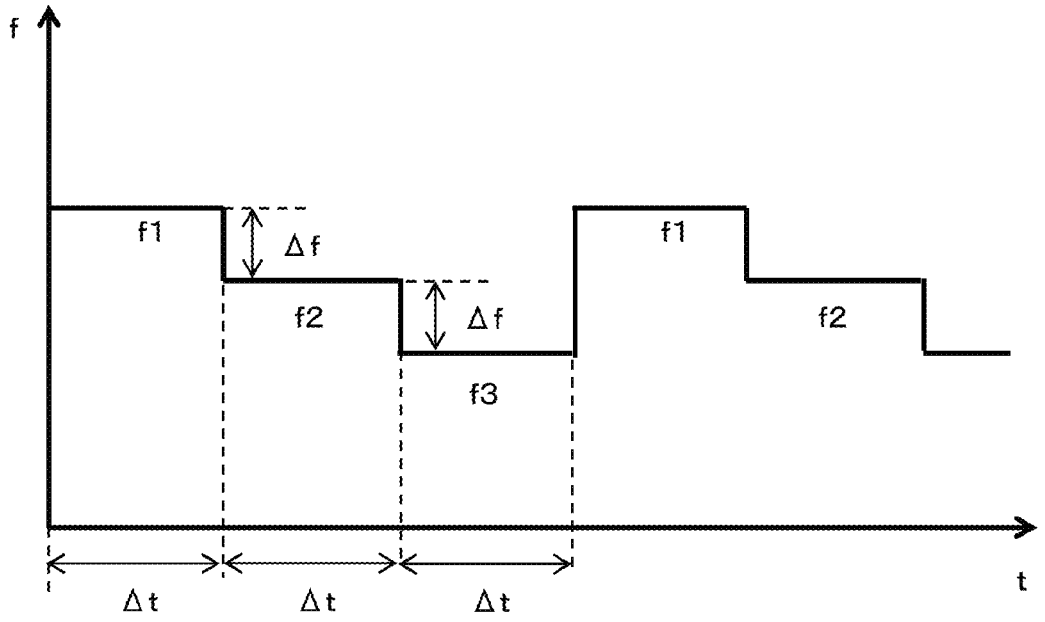
FIG. 43 is a diagram showing a relationship between three frequencies f1, f2 and f3.

For ease of explanation, first, an instance will be described where signals of three frequencies f1, f2 and f3 are transmitted while being switched over time. It is assumed that f1>f2>f3, and f1−f2=f2−f3=Δf. A transmission time Δt is assumed for the signal wave for each frequency. FIG. 43 shows a relationship between three frequencies f1, f2 and f3.

Via the transmission antenna Tx, the triangular wave/CW wave generation circuit 581 (FIG. 39) transmits continuous waves CW of frequencies f1, f2 and f3, each lasting for the time Δt. The reception antennas Rx receive reflected waves resulting by the respective continuous waves CW being reflected off one or plural targets.

Each mixer 584 mixes a transmission wave and a reception wave to generate a beat signal. The A/D converter 587 converts the beat signal, which is an analog signal, into several hundred pieces of digital data (sampling data), for example.

Using the sampling data, the reception intensity calculation section 532 performs FFT computation. Through the FFT computation, frequency spectrum information of reception signals is obtained for the respective transmission frequencies f1, f2 and f3.

Thereafter, the reception intensity calculation section 532 separates peak values from the frequency spectrum information of the reception signals. The frequency of any peak value which is predetermined or greater is in proportion to a relative velocity with respect to a target. Separating a peak value(s) from the frequency spectrum information of reception signals is synonymous with separating one or plural targets with different relative velocities.

Next, with respect to each of the transmission frequencies f1 to f3, the reception intensity calculation section 532 measures spectrum information of peak values of the same relative velocity or relative velocities within a predefined range.

Now, consider a scenario where two targets A and B exist which have about the same relative velocity but are at respectively different distances. A transmission signal of the frequency f1 will be reflected from both of targets A and B to result in reception signals being obtained. The reflected waves from targets A and B will result in substantially the same beat signal frequency. Therefore, the power spectra at the Doppler frequencies of the reception signals, corresponding to their relative velocities, are obtained as a synthetic spectrum F1 into which the power spectra of two targets A and B have been merged.

Similarly, for each of the frequencies f2 and f3, the power spectra at the Doppler frequencies of the reception signals, corresponding to their relative velocities, are obtained as a synthetic spectrum F1 into which the power spectra of two targets A and B have been merged.

Figure 44:
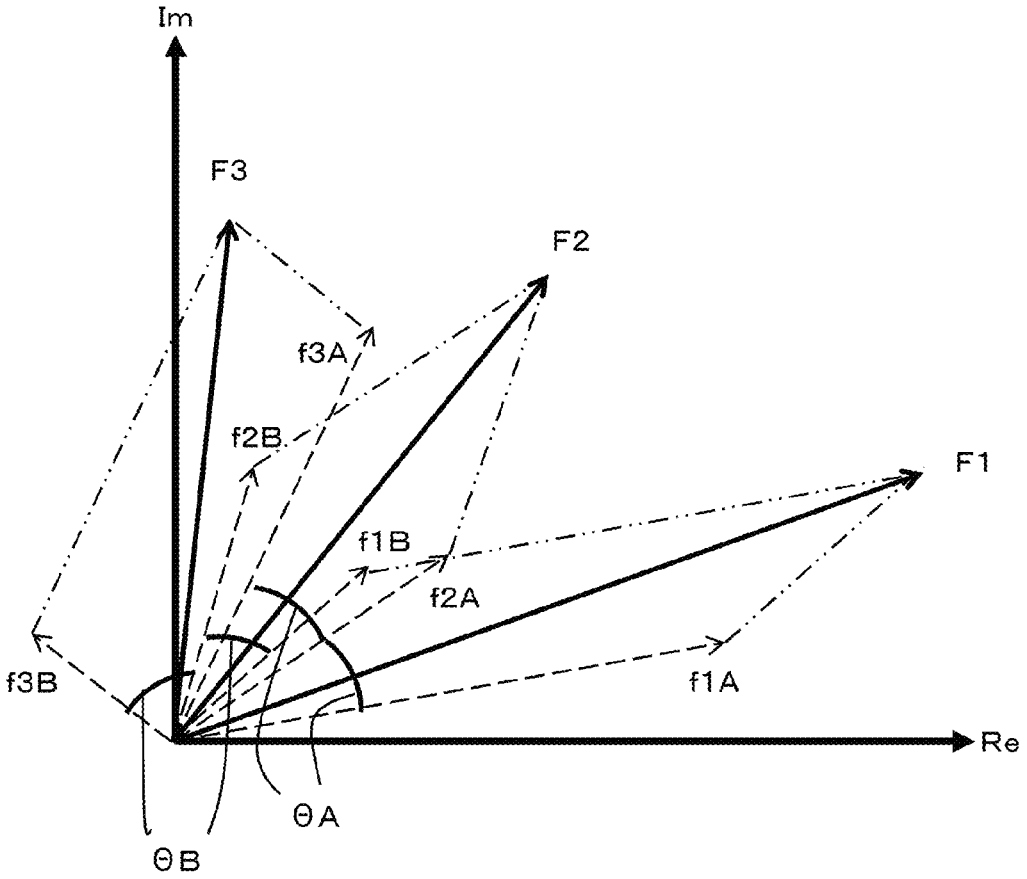
FIG. 44 is a diagram showing a relationship between synthetic spectra F1 to F3 on a complex plane.

FIG. 44 shows a relationship between synthetic spectra F1 to F3 on a complex plane. In the directions of the two vectors composing each of the synthetic spectra F1 to F3, the right vector corresponds to the power spectrum of a reflected wave from target A; i.e., vectors f1A, f2A and f3A, in FIG. 44. On the other hand, in the directions of the two vectors composing each of the synthetic spectra F1 to F3, the left vector corresponds to the power spectrum of a reflected wave from target B; i.e., vectors f1B, f2B and f3B in FIG. 44. Under a constant difference Δf between the transmission frequencies, the phase difference between the reception signals corresponding to the respective transmission signals of the frequencies f1 and f2 is in proportion to the distance to a target. Therefore, the phase difference between the vectors f1A and f2A and the phase difference between the vectors f2A and f3A are of the same value θA, this phase difference θA being in proportion to the distance to target A. Similarly, the phase difference between the vectors f1B and f2B and the phase difference between the vectors f2B and f3B are of the same value θB, this phase difference θB being in proportion to the distance to target B.

By using a well-known method, the respective distances to targets A and B can be determined from the synthetic spectra F1 to F3 and the difference Δf between the transmission frequencies. This technique is disclosed in U.S. Pat. No. 6,703,967, for example. The entire disclosure of this publication is incorporated herein by reference.

Similar processing is also applicable when the transmitted signals have four or more frequencies.

Note that, before transmitting continuous wave CWs at N different frequencies, a process of determining the distance to and relative velocity of each target may be performed by the 2 frequency CW method. Then, under predetermined conditions, this process may be switched to a process of transmitting continuous waves CW at N different frequencies. For example, FFT computation may be performed by using the respective beat signals at the two frequencies, and if the power spectrum of each transmission frequency undergoes a change over time of 30% or more, the process may be switched. The amplitude of a reflected wave from each target undergoes a large change over time due to multipath influences and the like. When there exists a change of a predetermined magnitude or greater, it may be considered that plural targets may exist.

Moreover, the CW method is known to be unable to detect a target when the relative velocity between the radar system and the target is zero, i.e., when the Doppler frequency is zero. However, when a pseudo Doppler signal is determined by the following methods, for example, it is possible to detect a target by using that frequency.

(Method 1) A mixer that causes a certain frequency shift in the output of a receiving antenna is added. By using a transmission signal and a reception signal with a shifted frequency, a pseudo Doppler signal can be obtained.

(Method 2) A variable phase shifter to introduce phase changes continuously over time is inserted between the output of a receiving antenna and a mixer, thus adding a pseudo phase difference to the reception signal. By using a transmission signal and a reception signal with an added phase difference, a pseudo Doppler signal can be obtained.

An example of specific construction and operation of inserting a variable phase shifter to generate a pseudo Doppler signal under Method 2 is disclosed in Japanese Laid-Open Patent Publication No. 2004-257848. The entire disclosure of this publication is incorporated herein by reference.

When targets with zero or very little relative velocity need to be detected, the aforementioned processes of generating a pseudo Doppler signal may be adopted, or the process may be switched to a target detection process under the FMCW method.

Next, with reference to FIG. 45, a procedure of processing to be performed by the object detection apparatus 570 of the onboard radar system 510 will be described.

The example below will illustrate a case where continuous waves CW are transmitted at two different frequencies fp1 and fp2 (fp1<fp2), and the phase information of each reflected wave is utilized to respectively detect a distance with respect to a target.

Figure 45:
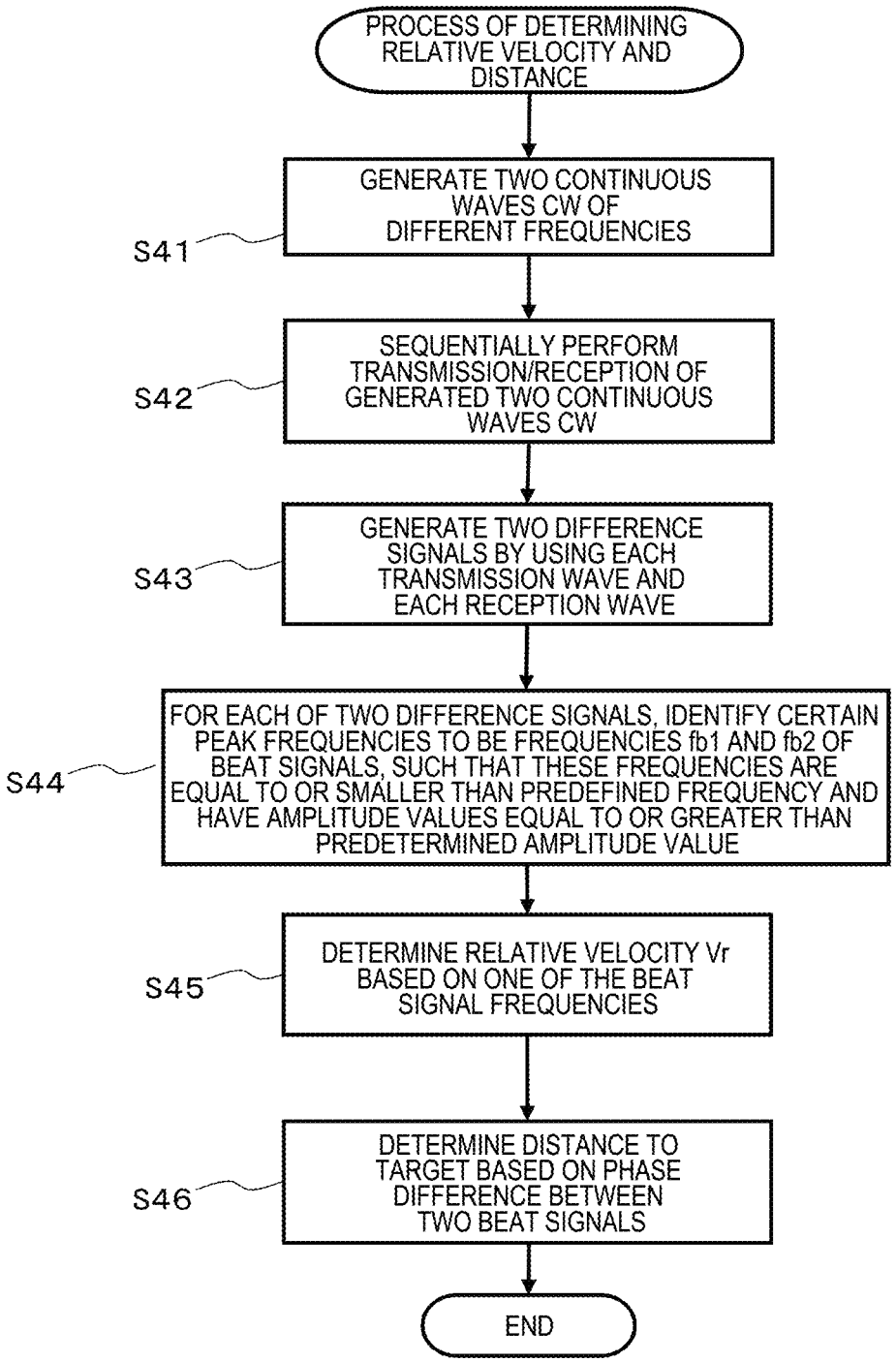
FIG. 45 is a flowchart showing the procedure of a process of determining relative velocity and distance according to a variant.

FIG. 45 is a flowchart showing the procedure of a process of determining relative velocity and distance according to this variant.

At step S41, the triangular wave/CW wave generation circuit 581 generates two continuous waves CW of frequencies which are slightly apart, i.e., frequencies fp1 and fp2.

At step S42, the transmission antenna Tx and the reception antennas Rx perform transmission/reception of the generated series of continuous waves CW. Note that the process of step S41 and the process of step S42 are to be performed in parallel fashion by the triangular wave/CW wave generation circuit 581 and the antenna elements Tx/Rx, rather than step S42 following only after completion of step S41.

At step S43, each mixer 584 generates a difference signal by utilizing each transmission wave and each reception wave, whereby two difference signals are obtained. Each reception wave is inclusive of a reception wave emanating from a still object and a reception wave emanating from a target. Therefore, next, a process of identifying frequencies to be utilized as the beat signals is performed. Note that the process of step S41, the process of step S42, and the process of step 43 are to be performed in parallel fashion by the triangular wave/CW wave generation circuit 581, the antenna elements Tx/Rx, and the mixers 584, rather than step S42 following only after completion of step S41, or step 43 following only after completion of step 42.

At step S44, for each of the two difference signals, the object detection apparatus 570 identifies certain peak frequencies to be frequencies fb1 and fb2 of beat signals, such that these frequencies are equal to or smaller than a frequency which is predefined as a threshold value and yet they have amplitude values which are equal to or greater than a predetermined amplitude value, and that the difference between the two frequencies is equal to or smaller than a predetermined value.

At step S45, based on one of the two beat signal frequencies identified, the reception intensity calculation section 532 detects a relative velocity. The reception intensity calculation section 532 calculates the relative velocity according to $Vr=fb1\cdot c/2\cdot fp1$, for example. Note that a relative velocity may be calculated by utilizing each of the two beat signal frequencies, which will allow the reception intensity calculation section 532 to verify whether they match or not, thus enhancing the precision of relative velocity calculation.

At step S46, the reception intensity calculation section 532 determines a phase difference $\Delta\phi$ between the two beat signals fb1 and fb2, and determines a distance $R=c\cdot\Delta\phi/4\pi(fp2-fp1)$ to the target.

Through the above processes, the relative velocity and distance to a target can be detected.

Note that continuous waves CW may be transmitted at N different frequencies (where N is 3 or more), and by utilizing phase information of the respective reflected wave, distances to plural targets which are of the same relative velocity but at different positions may be detected.

In addition to the radar system 510, the vehicle 500 described above may further include another radar system. For example, the vehicle 500 may further include a radar system having a detection range toward the rear or the sides of the vehicle body. In the case of incorporating a radar system having a detection range toward the rear of the vehicle body, the radar system may monitor the rear, and if there is any danger of having another vehicle bump into the rear, make a response by issuing an alarm, for example. In the case of incorporating a radar system having a detection range toward the sides of the vehicle body, the radar system may monitor an adjacent lane when the driver's vehicle changes its lane, etc., and make a response by issuing an alarm or the like as necessary.

The applications of the above-described radar system 510 are not limited to onboard use only. Rather, the radar system 510 may be used as sensors for various purposes. For example, it may be used as a radar for monitoring the surroundings of a house or any other building. Alternatively, it may be used as a sensor for detecting the presence or absence of a person at a specific indoor place, or whether or not such a person is undergoing any motion, etc., without utilizing any optical images.

[Supplementary Details of Processing]

Other embodiments will be described in connection with the 2 frequency CW or FMCW techniques for array antennas as described above. As described earlier, in the example of FIG. 39, the reception intensity calculation section 532 applies a Fourier transform to the respective beat signals for the channels $Ch_1$ to $Ch_M$ (lower graph in FIG. 40) stored in the memory 531. These beat signals are complex signals, in order that the phase of the signal of computational interest be identified. This allows the direction of an arriving wave to be accurately identified. In this case, however, the computational load for Fourier transform increases, thus calling for a larger-scaled circuit.

In order to solve this problem, a scalar signal may be generated as a beat signal. For each of a plurality of beat signals that have been generated, two complex Fourier transforms may be performed with respect to the spatial axis direction, which conforms to the antenna array, and to the time axis direction, which conforms to the lapse of time, thus to obtain results of frequency analysis. As a result, with only a small amount of computation, beam formation can eventually be achieved so that directions of arrival of reflected waves can be identified, whereby results of frequency analysis can be obtained for the respective beams. As a patent document related to the present disclosure, the entire disclosure of the specification of U.S. Pat. No. 6,339,395 is incorporated herein by reference.

[Optical Sensor, e.g., Camera, and Millimeter Wave Radar]

Next, a comparison between the above-described array antenna and conventional antennas, as well as an exemplary application in which both of the array antenna according to the present disclosure and an optical sensor (e.g., a camera) are utilized, will be described. Note that LIDAR or the like may be employed as the optical sensor.

A millimeter wave radar is able to directly detect a distance (range) to a target and a relative velocity thereof. Another characteristic is that its detection performance is not much deteriorated in the nighttime (including dusk), or in bad weather, e.g., rainfall, fog, or snowfall. On the other hand, it is believed that it is not just as easy for a millimeter wave radar to take a two-dimensional grasp of a target as it is for a camera. On the other hand, it is relatively easy for a camera to take a two-dimensional grasp of a target and recognize its shape. However, a camera may not be able to image a target in nighttime or bad weather, which presents a considerable problem. This problem is particularly outstanding when droplets of water have adhered to the portion through which to ensure lighting, or the eyesight is narrowed by a fog. This problem similarly exists for LIDAR or the like, which also pertains to the realm of optical sensors.

In these years, in answer to increasing demand for safer vehicle operation, driver assist systems for preventing collisions or the like are being developed. A driver assist system acquires an image in the direction of vehicle travel with a sensor such as a camera or a millimeter wave radar, and when any obstacle is recognized that is predicted to hinder vehicle travel, brakes or the like are automatically applied to prevent collisions or the like. Such a function of collision avoidance is expected to operate normally, even in nighttime or bad weather.

Hence, driver assist systems of a so-called fusion construction are gaining prevalence, where, in addition to a conventional optical sensor such as a camera, a millimeter wave radar is mounted as a sensor, thus realizing a recognition process that takes advantage of both. Such a driver assist system will be discussed later.

On the other hand, higher and higher functions are being required of the millimeter wave radar itself. A millimeter wave radar for onboard use mainly uses electromagnetic waves of the 76 GHz band. The antenna power of its antenna is restricted to below a certain level under each country's law or the like. For example, it is restricted to 0.01 W or below in Japan. Under such restrictions, a millimeter wave radar for onboard use is expected to satisfy the required performance that, for example, its detection range is 200 m or more; the antenna size is 60 mm×60 mm or less; its horizontal detection angle is 90 degrees or more; its range resolution is 20 cm or less; it is capable of short-range detection within 10 m; and so on. Conventional millimeter wave radars have used microstrip lines as waveguides, and patch antennas as antennas (hereinafter, these will both be referred to as "patch antennas"). However, with a patch antenna, it has been difficult to attain the aforementioned performance.

By using a slot array antenna to which the technique of the present disclosure is applied, the inventors have successfully achieved the aforementioned performance. As a result, a millimeter wave radar has been realized which is smaller in size, more efficient, and higher-performance than are conventional patch antennas and the like. In addition, by combining this millimeter wave radar and an optical sensor such as a camera, a small-sized, highly efficient, and high-performance fusion apparatus has been realized which has existed never before. This will be described in detail below.

Figure 46:
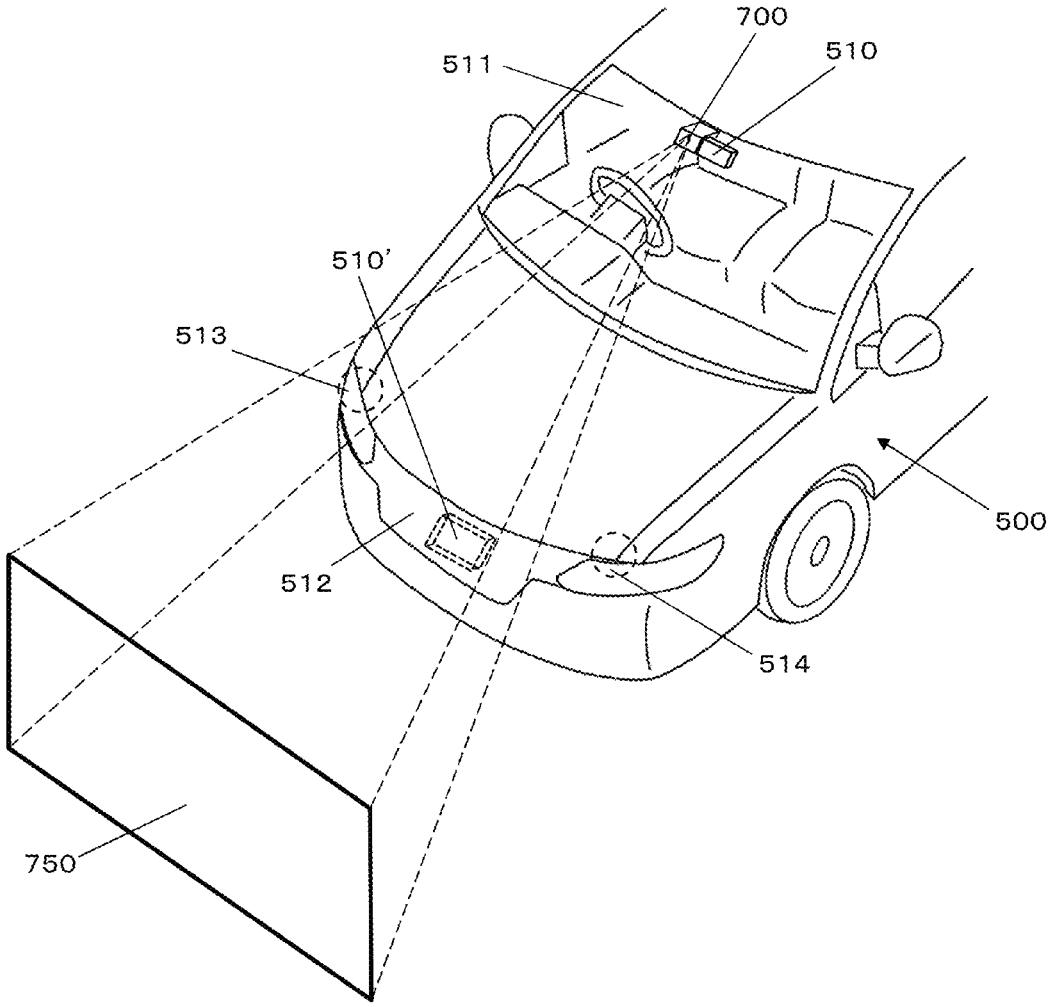
FIG. 46 is a diagram concerning a fusion apparatus in which a radar system 510 having a slot array antenna and a camera 700 are included.

FIG. 46 is a diagram concerning a fusion apparatus in a vehicle 500, the fusion apparatus including a camera 700 and a radar system 510 (hereinafter referred to also as the millimeter wave radar 510) having a slot array antenna to which the technique of the present disclosure is applied. With reference to this figure, various embodiments will be described below.

[Installment of Millimeter Wave Radar within Vehicle Room]

A conventional patch antenna-based millimeter wave radar 510' is placed behind and inward of a grill 512 which is at the front nose of a vehicle. An electromagnetic wave that is radiated from an antenna goes through the apertures in the grill 512, and is radiated ahead of the vehicle 500. In this case, no dielectric layer, e.g., glass, exists that decays or reflects electromagnetic wave energy, in the region through which the electromagnetic wave passes. As a result, an electromagnetic wave that is radiated from the patch antenna-based millimeter wave radar 510' reaches over a long range, e.g., to a target which is 150 m or farther away. By receiving with the antenna the electromagnetic wave reflected therefrom, the millimeter wave radar 510' is able to detect a target. In this case, however, since the antenna is placed behind and inward of the grill 512 of the vehicle, the radar may be broken when the vehicle collides into an obstacle. Moreover, it may be soiled with mud or the like in rain, etc., and the soil that has adhered to the antenna may hinder radiation and reception of electromagnetic waves.

Similarly to the conventional manner, the millimeter wave radar 510 incorporating a slot array antenna according to an embodiment of the present disclosure may be placed behind the grill 512, which is located at the front nose of the vehicle (not shown). This allows the energy of the electromagnetic wave to be radiated from the antenna to be utilized by 100%, thus enabling long-range detection beyond the conventional level, e.g., detection of a target which is at a distance of 250 m or more.

Furthermore, the millimeter wave radar 510 according to an embodiment of the present disclosure can also be placed within the vehicle room, i.e., inside the vehicle. In that case, the millimeter wave radar 510 is placed inward of the windshield 511 of the vehicle, to fit in a space between the windshield 511 and a face of the rearview mirror (not shown) that is opposite to its specular surface. On the other hand, the conventional patch antenna-based millimeter wave radar 510' cannot be placed inside the vehicle room mainly for the two following reasons. A first reason is its large size, which prevents itself from being accommodated within the space between the windshield 511 and the rearview mirror. A second reason is that an electromagnetic wave that is radiated ahead reflects off the windshield 511 and decays due to dielectric loss, thus becoming unable to travel the desired distance. As a result, if a conventional patch antenna-based millimeter wave radar is placed within the vehicle room, only targets which are 100 m ahead or less can be detected, for example. On the other hand, a millimeter wave radar according to an embodiment of the present disclosure is able to detect a target which is at a distance of 200 m or more, despite reflection or decay at the windshield 511. This performance is equivalent to, or even greater than, the case where a conventional patch antenna-based millimeter wave radar is placed outside the vehicle room.

[Fusion Construction Based on Millimeter Wave Radar and Camera, Etc., being Placed within Vehicle Room]

Currently, an optical imaging device such as a CCD camera is used as the main sensor in many a driver assist system (Driver Assist System). Usually, a camera or the like is placed within the vehicle room, inward of the windshield 511, in order to account for unfavorable influences of the external environment, etc. In this context, in order to minimize the optical effect of raindrops and the like, the camera or the like is placed in a region which is swept by the wipers (not shown) but is inward of the windshield 511.

In recent years, due to needs for improved performance of a vehicle in terms of e.g. automatic braking, there has been a desire for automatic braking or the like that is guaranteed to work regardless of whatever external environment may exist. In this case, if the only sensor in the driver assist system is an optical device such as a camera, a problem exists in that reliable operation is not guaranteed in nighttime or bad weather. This has led to the need for a driver assist system that incorporates not only an optical sensor (such as a camera) but also a millimeter wave radar, these being used for cooperative processing, so that reliable operation is achieved even in nighttime or bad weather.

As described earlier, a millimeter wave radar incorporating the slot array antenna according to the present disclosure permits itself to be placed within the vehicle room, due to downsizing and remarkable enhancement in the efficiency of the radiated electromagnetic wave over that of a conventional patch antenna. By taking advantage of these properties, as shown in FIG. 46, the millimeter wave radar 510, which incorporates not only an optical sensor 700 such as a camera but also a slot array antenna according to the present disclosure, allows both to be placed inward of the windshield 511 of the vehicle 500. This has created the following novel effects.

(1) It is easier to install the driver assist system on the vehicle 500. The conventional patch antenna 510' has required a space behind the grill 512, which is at the front nose, in order to accommodate the radar. Since this space may include some sites that affect the structural design of the vehicle, if the size of the radar device is changed, it may have been necessary to reconsider the structural design. This inconvenience is avoided by placing the millimeter wave radar within the vehicle room.

Figure 47:
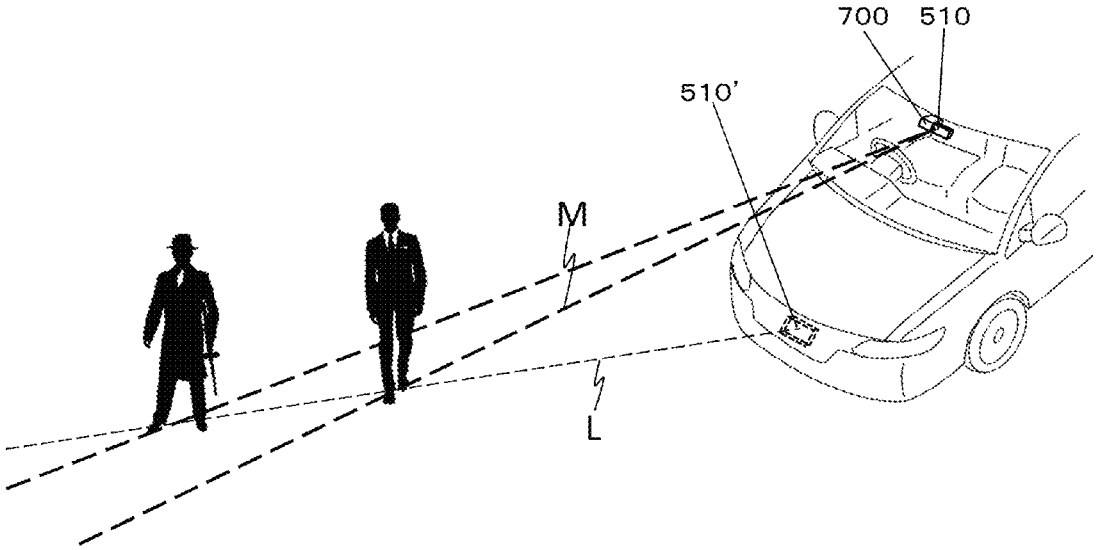
FIG. 47 is a diagram illustrating how placing a millimeter wave radar 510 and a camera 700 at substantially the same position within the vehicle room may allow them to acquire an identical field of view and line of sight, thus facilitating a matching process.

(2) Free from the influences of rain, nighttime, or other external environment factors to the vehicle, more reliable operation can be achieved. Especially, as shown in FIG. 47, by placing the millimeter wave radar 510 and the camera 700 at substantially the same position within the vehicle room, they can attain an identical field of view and line of sight, thus facilitating the "matching process" which will be described later, i.e., a process through which to establish that respective pieces of target information captured by them actually come from an identical object. On the other hand, if the millimeter wave radar 510' were placed behind the grill 512, which is at the front nose outside the vehicle room, its radar line of sight L would differ from a radar line of sight M of the case where it was placed within the vehicle room, thus resulting in a large offset with the image to be acquired by the camera 700.

(3) Reliability of the millimeter wave radar device is improved. As described above, since the conventional patch antenna 510' is placed behind the grill 512, which is at the front nose, it is likely to gather soil, and may be broken even in a minor collision accident or the like. For these reasons, cleaning and functionality checks are always needed. Moreover, as will be described below, if the position or direction of attachment of the millimeter wave radar becomes shifted due to an accident or the like, it is necessary to reestablish alignment with respect to the camera. The chances of such occurrences are reduced by placing the millimeter wave radar within the vehicle room, whereby the aforementioned inconveniences are avoided.

In a driver assist system of such fusion construction, the optical sensor 700, e.g., a camera, and the millimeter wave radar 510 incorporating the slot array antenna according to the present disclosure may have an integrated construction, i.e., being in fixed position with respect to each other. In that case, certain relative positioning should be kept between the optical axis of the optical sensor such as a camera and the directivity of the antenna of the millimeter wave radar, as will be described later. When this driver assist system having an integrated construction is fixed within the vehicle room of the vehicle 500, the optical axis of the camera, etc., should be adjusted so as to be oriented in a certain direction ahead of the vehicle. For these matters, see U.S. Patent Application Publication No. 2015/0264230, U.S. Patent Application Publication No. 2016/0264065, U.S. patent application Ser. No. 15/248,141, U.S. patent application Ser. No. 15/248,149, and U.S. patent application Ser. No. 15/248,156, which are incorporated herein by reference. Related techniques concerning the camera are described in the specification of U.S. Pat. No. 7,355,524, and the specification of U.S. Pat. No. 7,420,159, the entire disclosure of each which is incorporated herein by reference.

Regarding placement of an optical sensor such as a camera and a millimeter wave radar within the vehicle room, see, for example, the specification of U.S. Pat. No. 8,604,968, the specification of U.S. Pat. No. 8,614,640, and the specification of U.S. Pat. No. 7,978,122, the entire disclosure of each which is incorporated herein by reference. However, at the time when these patents were filed for, only conventional antennas with patch antennas were the known millimeter wave radars, and thus observation was not possible over sufficient distances. For example, the distance that is observable with a conventional millimeter wave radar is considered to be at most 100 m to 150 m. Moreover, when a millimeter wave radar is placed inward of the windshield, the large radar size inconveniently blocks the driver's field of view, thus hindering safe driving. On the other hand, a millimeter wave radar incorporating a slot array antenna according to an embodiment of the present disclosure is capable of being placed within the vehicle room because of its small size and remarkable enhancement in the efficiency of the radiated electromagnetic wave over that of a conventional patch antenna. This enables a long-range observation over 200 m, while not blocking the driver's field of view.

[Adjustment of Position of Attachment Between Millimeter Wave Radar and Camera, Etc.,]

In the processing under fusion construction (which hereinafter may be referred to as a "fusion process"), it is desired that an image which is obtained with a camera or the like and the radar information which is obtained with the millimeter wave radar map onto the same coordinate system because, if they differ as to position and target size, cooperative processing between both will be hindered.

This involves adjustment from the following three standpoints.

(1) The optical axis of the camera or the like and the antenna directivity of the millimeter wave radar must have a certain fixed relationship.

It is required that the optical axis of the camera or the like and the antenna directivity of the millimeter wave radar are matched. Alternatively, a millimeter wave antenna may include two or more transmission antennas and two or more reception antennas, the directivities of these antennas being intentionally made different. Therefore, it is necessary to guarantee that at least a certain known relationship exists between the optical axis of the camera or the like and the directivities of these antennas.

In the case where the camera or the like and the millimeter wave radar have the aforementioned integrated construction, i.e., being in fixed position to each other, the relative positioning between the camera or the like and the millimeter wave radar stays fixed. Therefore, the aforementioned requirements are satisfied with respect to such an integrated construction. On the other hand, in a conventional patch antenna or the like, where the millimeter wave antenna is placed behind the grill 512 of the vehicle 500, the relative positioning between them is usually to be adjusted according to (2) below.

(2) A certain fixed relationship exists between an image acquired with the camera or the like and radar information of the millimeter wave radar in an initial state (e.g., upon shipment) of having been attached to the vehicle.

The positions of attachment of the optical sensor 700 such as a camera and the millimeter wave radar 510 or 510' on the vehicle 500 will finally be determined in the following manner. At a predetermined position ahead of the vehicle 500, a chart to serve as a reference or a target which is subject to observation by the radar (which will hereinafter be referred to as, respectively, a "reference chart" and a "reference target", and collectively as the "benchmark") is accurately positioned. This is observed with the optical sensor 700 such as a camera or with the millimeter wave radar 510. The observation information regarding the observed benchmark is compared against previously-stored shape information or the like of the benchmark, and the current offset information is quantitated. Based on this offset information, by at least one of the following means, the positions of attachment of the optical sensor 700 such as a camera and the millimeter wave radar 510 or 510' are adjusted or corrected. Any other means may also be employed that can provide similar results.

(i) Adjust the positions of attachment of the camera and the radar device so that the benchmark will come at a midpoint between the camera and the radar. This adjustment may be done by using a jig or tool, etc., which is separately provided.

(ii) Determine an offset amounts of the camera and the radar relative to the benchmark, and through image processing of the camera image and radar processing, correct for these offset amounts.

What is to be noted is that, in the case where the optical sensor 700 such as a camera and the millimeter wave radar 510 incorporating a slot array antenna according to an embodiment of the present disclosure have an integrated construction, i.e., being in fixed position to each other, adjusting an offset of either the camera or the radar with respect to the benchmark will make the offset amount known for the other as well, thus making it unnecessary to check for the other's offset with respect to the benchmark.

Specifically, with respect to the camera 700, a reference chart may be placed at a predetermined position 750, and an image taken by the camera 700 is compared against advance information indicating where in the field of view of the camera 700 the reference chart image is supposed to be located, thereby detecting an offset amount. Based on this, the camera 700 is adjusted by at least one of the above means (i) and (ii). Next, the offset amount which has been ascertained for the camera is translated into an offset amount of the millimeter wave radar. Thereafter, an offset amount adjustment is made with respect to the radar information, by at least one of the above means (i) and (ii).

Alternatively, this may be performed on the basis of the millimeter wave radar 510. In other words, with respect to the millimeter wave radar 510, a reference target may be placed at a predetermined position, and the radar information thereof is compared against advance information indicating where in the field of view of the millimeter wave radar 510 the reference target is supposed to be located, thereby detecting an offset amount. Based on this, the millimeter wave radar 510 is adjusted by at least one of the above means (i) and (ii). Next, the offset amount which has been ascertained for the millimeter wave radar is translated into an offset amount of the camera. Thereafter, an offset amount adjustment is made with respect to the image information obtained by the camera 700, by at least one of the above means (i) and (ii).

(3) Even after an initial state of the vehicle, a certain relationship is maintained between an image acquired with the camera or the like and radar information of the millimeter wave radar.

Usually, an image acquired with the camera or the like and radar information of the millimeter wave radar are supposed to be fixed in the initial state, and hardly vary unless in an accident of the vehicle or the like. However, if an offset in fact occurs between these, an adjustment is possible by the following means.

The camera 700 is attached in such a manner that portions 513 and 514 (characteristic points) that are characteristic of the driver's vehicle fit within its field of view, for example. The positions at which these characteristic points are actually imaged by the camera 700 are compared against the information of the positions to be assumed by these characteristic points when the camera 700 is attached accurately in place, and an offset amount(s) is detected therebetween. Based on this detected offset amount(s), the position of any image that is taken thereafter may be corrected, whereby an offset of the physical position of attachment of the camera 700 can be corrected for. If this correction sufficiently embodies the performance that is required of the vehicle, then the adjustment per the above (2) may not be needed. By regularly performing this adjustment during startup or operation of the vehicle 500, even if an offset of the camera or the like occurs anew, it is possible to correct for the offset amount, thus helping safe travel.

However, this means is generally considered to result in poorer accuracy of adjustment than with the above means (2). Supposedly, a reference object(s) that will provide sufficient accuracy is placed at a predetermined position(s) moderately distant from the vehicle before the adjustment, thus enabling adjustment with a predetermined accuracy. However, this means (3) involves an adjustment that is based on parts of the vehicle body, which can only provide a poorer accuracy than that will be provided by a benchmark, and thus the resultant accuracy of adjustment will be somewhat inferior. However, it may still be effective as a means of correction when the position of attachment of the camera or the like is considerably altered for reasons such as an accident or a large external force being applied to the camera or the like within the vehicle room, etc.

[Mapping of Target as Detected by Millimeter Wave Radar and Camera or the Like: Matching Process]

In a fusion process, for a given target, it needs to be established that an image thereof which is acquired with a camera or the like and radar information which is acquired with the millimeter wave radar pertain to "the same target". For example, suppose that two obstacles (first and second obstacles), e.g., two bicycles, have appeared ahead of the vehicle 500. These two obstacles will be captured as camera images, and detected as radar information of the millimeter wave radar. At this time, the camera image and the radar information with respect to the first obstacle need to be mapped to each other so that they are both directed to the same target. Similarly, the camera image and the radar information with respect to the second obstacle need to be mapped to each other so that they are both directed to the same target. If the camera image of the first obstacle and the radar information of the second obstacle are mistakenly recognized to pertain to an identical object, a considerable accident may occur. Hereinafter, in the present specification, such a process of determining whether a camera image and a radar target pertain to the same target may be referred to as a "matching process".

This matching process may be implemented by various detection devices (or methods) described below. Hereinafter, these will be specifically described. Note that the each of the following detection devices is to be installed in the vehicle, and at least includes a millimeter wave radar detection section, an image detection section (e.g., a camera) which is oriented in a direction overlapping the direction of detection by the millimeter wave radar detection section, and a matching section. Herein, the millimeter wave radar detection section includes a slot array antenna according to any of the embodiments of the present disclosure, and at least acquires radar information in its own field of view. The image acquisition section at least acquires image information in its own field of view. The matching section includes a processing circuit which matches a result of detection by the millimeter wave radar detection section against a result of detection by the image detection section to determine whether or not the same target is being detected by the two detection sections. Herein, the image detection section may be composed of a selected one of, or selected two or more of, an optical camera, LIDAR, an infrared radar, and an ultrasonic radar. The following detection devices differ from one another in terms of the detection process at their respective matching section.

In a first detection device, the matching section performs two matches as follows. A first match involves, for a target of interest that has been detected by the millimeter wave radar detection section, obtaining distance information and lateral position information thereof, and also finding a target that is the closest to the target of interest among a target or two or more targets detected by the image detection section, and detecting a combination(s) thereof. A second match involves, for a target of interest that has been detected by the image detection section, obtaining distance information and lateral position information thereof, and also finding a target that is the closest to the target of interest among a target or two or more targets detected by the millimeter wave radar detection section, and detecting a combination(s) thereof. Furthermore, this matching section determines whether there is any matching combination between the combination(s) of such targets as detected by the millimeter wave radar detection section and the combination(s) of such targets as detected by the image detection section. Then, if there is any matching combination, it is determined that the same object is being detected by the two detection sections. In this manner, a match is attained between the respective targets that have been detected by the millimeter wave radar detection section and the image detection section.

A related technique is described in the specification of U.S. Pat. No. 7,358,889, the entire disclosure of which is incorporated herein by reference. In this publication, the image detection section is illustrated by way of a so-called stereo camera that includes two cameras. However, this technique is not limited thereto. In the case where the image detection section includes a single camera, detected targets may be subjected to an image recognition process or the like as appropriate, in order to obtain distance information and lateral position information of the targets. Similarly, a laser sensor such as a laser scanner may be used as the image detection section.

In a second detection device, the matching section matches a result of detection by the millimeter wave radar detection section and a result of detection by the image detection section every predetermined period of time. If the matching section determines that the same target was being detected by the two detection sections in the previous result of matching, it performs a match by using this previous result of matching. Specifically, the matching section matches a target which is currently detected by the millimeter wave radar detection section and a target which is currently detected by the image detection section, against the target which was determined in the previous result of matching to be being detected by the two detection sections. Then, based on the result of matching for the target which is currently detected by the millimeter wave radar detection section and the result of matching for the target which is currently detected by the image detection section, the matching section determines whether or not the same target is being detected by the two detection sections. Thus, rather than directly matching the results of detection by the two detection sections, this detection device performs a chronological match between the two results of detection and a previous result of matching. Therefore, the accuracy of detection is improved over the case of only performing a momentary match, whereby stable matching is realized. In particular, even if the accuracy of the detection section drops momentarily, matching is still possible because of utilizing past results of matching. Moreover, by utilizing the previous result of matching, this detection device is able to easily perform a match between the two detection sections.

In the current match which utilizes the previous result of matching, if the matching section of this detection device determines that the same object is being detected by the two detection sections, then the matching section of this detection device excludes this determined object in performing matching between objects which are currently detected by the millimeter wave radar detection section and objects which are currently detected by the image detection section. Then, this matching section determines whether there exists any identical object that is currently detected by the two detection sections. Thus, while taking into account the result of chronological matching, the detection device also makes a momentary match based on two results of detection that are obtained from moment to moment. As a result, the detection device is able to surely perform a match for any object that is detected during the current detection.

A related technique is described in the specification of U.S. Pat. No. 7,417,580, the entire disclosure of which is incorporated herein by reference. In this publication, the image detection section is illustrated by way of a so-called stereo camera that includes two cameras. However, this technique is not limited thereto. In the case where the image detection section includes a single camera, detected targets may be subjected to an image recognition process or the like as appropriate, in order to obtain distance information and lateral position information of the targets. Similarly, a laser sensor such as a laser scanner may be used as the image detection section.

In a third detection device, the two detection sections and matching section perform detection of targets and performs matches therebetween at predetermined time intervals, and the results of such detection and the results of such matching are chronologically stored to a storage medium, e.g., memory. Then, based on a rate of change in the size of a target in the image as detected by the image detection section, and on a distance to a target from the driver's vehicle and its rate of change (relative velocity with respect to the driver's vehicle) as detected by the millimeter wave radar detection section, the matching section determines whether the target which has been detected by the image detection section and the target which has been detected by the millimeter wave radar detection section are an identical object.

When determining that these targets are an identical object, based on the position of the target in the image as detected by the image detection section, and on the distance to the target from the driver's vehicle and/or its rate of change as detected by the millimeter wave radar detection section, the matching section predicts a possibility of collision with the vehicle.

A related technique is described in the specification of U.S. Pat. No. 6,903,677, the entire disclosure of which is incorporated herein by reference.

As described above, in a fusion process of a millimeter wave radar and an imaging device such as a camera, an image which is obtained with the camera or the like and radar information which is obtained with the millimeter wave radar are matched against each other. A millimeter wave radar incorporating the aforementioned array antenna according to an embodiment of the present disclosure can be constructed so as to have a small size and high performance. Therefore, high performance and downsizing, etc., can be achieved for the entire fusion process including the aforementioned matching process. This improves the accuracy of target recognition, and enables safer travel control for the vehicle.

[Other Fusion Processes]

In a fusion process, various functions are realized based on a matching process between an image which is obtained with a camera or the like and radar information which is obtained with the millimeter wave radar detection section. Examples of processing apparatuses that realize representative functions of a fusion process will be described below.

Each of the following processing apparatuses is to be installed in a vehicle, and at least includes: a millimeter wave radar detection section to transmit or receive electromagnetic waves in a predetermined direction; an image acquisition section, such as a monocular camera, that has a field of view overlapping the field of view of the millimeter wave radar detection section; and a processing section which obtains information therefrom to perform target detection and the like. The millimeter wave radar detection section acquires radar information in its own field of view. The image acquisition section acquires image information in its own field of view. A selected one, or selected two or more of, an optical camera, LIDAR, an infrared radar, and an ultrasonic radar may be used as the image acquisition section. The processing section can be implemented by a processing circuit which is connected to the millimeter wave radar detection section and the image acquisition section. The following processing apparatuses differ from one another with respect to the content of processing by this processing section.

In a first processing apparatus, the processing section extracts, from an image which is captured by the image acquisition section, a target which is recognized to be the same as the target which is detected by the millimeter wave radar detection section. In other words, a matching process according to the aforementioned detection device is performed. Then, it acquires information of a right edge and a left edge of the extracted target image, and derives locus approximation lines, which are straight lines or predetermined curved lines for approximating loci of the acquired right edge and the left edge, are derived for both edges. The edge which has a larger number of edges existing on the locus approximation line is selected as a true edge of the target. The lateral position of the target is derived on the basis of the position of the edge that has been selected as a true edge. This permits a further improvement on the accuracy of detection of a lateral position of the target.

A related technique is described in the specification of U.S. Pat. No. 8,610,620, the entire disclosure of which is incorporated herein by reference.

In a second processing apparatus, in determining the presence of a target, the processing section alters a determination threshold to be used in checking for a target presence in radar information, on the basis of image information. Thus, if a target image that may be an obstacle to vehicle travel has been confirmed with a camera or the like, or if the presence of a target has been estimated, etc., for example, the determination threshold for the target detection by the millimeter wave radar detection section can be optimized so that more accurate target information can be obtained. In other words, if the possibility of the presence of an obstacle is high, the determination threshold is altered so that this processing apparatus will surely be activated. On the other hand, if the possibility of the presence of an obstacle is low, the determination threshold is altered so that unwanted activation of this processing apparatus is prevented. This permits appropriate activation of the system.

Furthermore in this case, based on radar information, the processing section may designate a region of detection for the image information, and estimate a possibility of the presence of an obstacle on the basis of image information within this region. This makes for a more efficient detection process.

A related technique is described in the specification of U.S. Pat. No. 7,570,198, the entire disclosure of which is incorporated herein by reference.

In a third processing apparatus, the processing section performs combined displaying where images obtained from a plurality of different imaging devices and a millimeter wave radar detection section and an image signal based on radar information are displayed on at least one display device. In this displaying process, horizontal and vertical synchronizing signals are synchronized between the plurality of imaging devices and the millimeter wave radar detection section, and among the image signals from these devices, selective switching to a desired image signal is possible within one horizontal scanning period or one vertical scanning period. This allows, on the basis of the horizontal and vertical synchronizing signals, images of a plurality of selected image signals to be displayed side by side; and, from the display device, a control signal for setting a control operation in the desired imaging device and the millimeter wave radar detection section is sent.

When a plurality of different display devices display respective images or the like, it is difficult to compare the respective images against one another. Moreover, when display devices are provided separately from the third processing apparatus itself, there is poor operability for the device. The third processing apparatus would overcome such shortcomings.

A related technique is described in the specification of U.S. Pat. No. 6,628,299 and the specification of U.S. Pat. No. 7,161,561, the entire disclosure of each of which is incorporated herein by reference.

In a fourth processing apparatus, with respect to a target which is ahead of a vehicle, the processing section instructs an image acquisition section and a millimeter wave radar detection section to acquire an image and radar information containing that target. From within such image information, the processing section determines a region in which the target is contained. Furthermore, the processing section extracts radar information within this region, and detects a distance from the vehicle to the target and a relative velocity between the vehicle and the target. Based on such information, the processing section determines a possibility that the target will collide against the vehicle. This enables an early detection of a possible collision with a target.

A related technique is described in the specification of U.S. Pat. No. 8,068,134, the entire disclosure of which is incorporated herein by reference.

In a fifth processing apparatus, based on radar information or through a fusion process which is based on radar information and image information, the processing section recognizes a target or two or more targets ahead of the vehicle. The "target" encompasses any moving entity such as other vehicles or pedestrians, traveling lanes indicated by white lines on the road, road shoulders and any still objects (including gutters, obstacles, etc.), traffic lights, pedestrian crossings, and the like that may be there. The processing section may encompass a GPS (Global Positioning System) antenna. By using a GPS antenna, the position of the driver's vehicle may be detected, and based on this position, a storage device (referred to as a map information database device) that stores road map information may be searched in order to ascertain a current position on the map. This current position on the map may be compared against a target or two or more targets that have been recognized based on radar information or the like, whereby the traveling environment may be recognized. On this basis, the processing section may extract any target that is estimated to hinder vehicle travel, find safer traveling information, and display it on a display device, as necessary, to inform the driver.

A related technique is described in the specification of U.S. Pat. No. 6,191,704, the entire disclosure of which is incorporated herein by reference.

The fifth processing apparatus may further include a data communication device (having communication circuitry) that communicates with a map information database device which is external to the vehicle. The data communication device may access the map information database device, with a period of e.g. once a week or once a month, to download the latest map information therefrom. This allows the aforementioned processing to be performed with the latest map information.

Furthermore, the fifth processing apparatus may compare between the latest map information that was acquired during the aforementioned vehicle travel and information that is recognized of a target or two or more targets based on radar information, etc., in order to extract target information (hereinafter referred to as "map update information") that is not included in the map information. Then, this map update information may be transmitted to the map information database device via the data communication device. The map information database device may store this map update information in association with the map information that is within the database, and update the current map information itself, if necessary. In performing the update, respective pieces of map update information that are obtained from a plurality of vehicles may be compared against one another to check certainty of the update.

Note that this map update information may contain more detailed information than the map information which is carried by any currently available map information database device. For example, schematic shapes of roads may be known from commonly-available map information, but it typically does not contain information such as the width of the road shoulder, the width of the gutter that may be there, any newly occurring bumps or dents, shapes of buildings, and so on. Neither does it contain heights of the roadway and the sidewalk, how a slope may connect to the sidewalk, etc. Based on conditions which are separately set, the map information database device may store such detailed information (hereinafter referred to as "map update details information") in association with the map information. Such map update details information provides a vehicle (including the driver's vehicle) with information which is more detailed than the original map information, thereby rending itself available for not only the purpose of ensuring safe vehicle travel but also some other purposes. As used herein, a "vehicle (including the driver's vehicle)" may be e.g. an automobile, a motorcycle, a bicycle, or any autonomous vehicle to become available in the future, e.g., an electric wheelchair. The map update details information is to be used when any such vehicle may travel.

(Recognition Via Neural Network)

Each of the first to fifth processing apparatuses may further include a sophisticated apparatus of recognition. The sophisticated apparatus of recognition may be provided external to the vehicle. In that case, the vehicle may include a high-speed data communication device that communicates with the sophisticated apparatus of recognition. The sophisticated apparatus of recognition may be constructed from a neural network, which may encompass so-called deep learning and the like. This neural network may include a convolutional neural network (hereinafter referred to as "CNN"), for example. A CNN, a neural network that has proven successful in image recognition, is characterized by possessing one or more sets of two layers, namely, a convolutional layer and a pooling layer.

There exists at least three kinds of information as follows, any of which may be input to a convolutional layer in the processing apparatus:

(1) information that is based on radar information which is acquired by the millimeter wave radar detection section;

(2) information that is based on specific image information which is acquired, based on radar information, by the image acquisition section; or (3) fusion information that is based on radar information and image information which is acquired by the image acquisition section, or information that is obtained based on such fusion information.

Based on information of any of the above kinds, or information based on a combination thereof, product-sum operations corresponding to a convolutional layer are performed. The results are input to the subsequent pooling layer, where data is selected according to a predetermined rule. In the case of max pooling where a maximum value among pixel values is chosen, for example, the rule may dictate that a maximum value be chosen for each split region in the convolutional layer, this maximum value being regarded as the value of the corresponding position in the pooling layer.

A sophisticated apparatus of recognition that is composed of a CNN may include a single set of a convolutional layer and a pooling layer, or a plurality of such sets which are cascaded in series. This enables accurate recognition of a target, which is contained in the radar information and the image information, that may be around a vehicle.

Related techniques are described in the U.S. Pat. No. 8,861,842, the specification of U.S. Pat. No. 9,286,524, and the specification of US Patent Application Publication No. 2016/0140424, the entire disclosure of each of which is incorporated herein by reference.

In a sixth processing apparatus, the processing section performs processing that is related to headlamp control of a vehicle. When a vehicle travels in nighttime, the driver may check whether another vehicle or a pedestrian exists ahead of the driver's vehicle, and control a beam(s) from the headlamp(s) of the driver's vehicle to prevent the driver of the other vehicle or the pedestrian from being dazzled by the headlamp(s) of the driver's vehicle. This sixth processing apparatus automatically controls the headlamp(s) of the driver's vehicle by using radar information, or a combination of radar information and an image taken by a camera or the like.

Based on radar information, or through a fusion process based on radar information and image information, the processing section detects a target that corresponds to a vehicle or pedestrian ahead of the vehicle. In this case, a vehicle ahead of a vehicle may encompass a preceding vehicle that is ahead, a vehicle or a motorcycle in the oncoming lane, and so on. When detecting any such target, the processing section issues a command to lower the beam(s) of the headlamp(s). Upon receiving this command, the control section (control circuit) which is internal to the vehicle may control the headlamp(s) to lower the beam(s) therefrom.

Related techniques are described in the specification of U.S. Pat. No. 6,403,942, the specification of U.S. Pat. No. 6,611,610, the specification of U.S. Pat. No. 8,543,277, the specification of U.S. Pat. No. 8,593,521, and the specification of U.S. Pat. No. 8,636,393, the entire disclosure of each of which is incorporated herein by reference.

According to the above-described processing by the millimeter wave radar detection section, and the above-described fusion process by the millimeter wave radar detection section and an imaging device such as a camera, the millimeter wave radar can be constructed so as to have a small size and high performance, whereby high performance and downsizing, etc., can be achieved for the radar processing or the entire fusion process. This improves the accuracy of target recognition, and enables safer travel control for the vehicle.

Application Example 2: Various Monitoring Systems (Natural Elements, Buildings, Roads, Watch, Security)

A millimeter wave radar (radar system) incorporating an array antenna according to an embodiment of the present disclosure also has a wide range of applications in the fields of monitoring, which may encompass natural elements, weather, buildings, security, nursing care, and the like. In a monitoring system in this context, a monitoring apparatus that includes the millimeter wave radar may be installed e.g. at a fixed position, in order to perpetually monitor a subject(s) of monitoring. Regarding the given subject(s) of monitoring, the millimeter wave radar has its resolution of detection adjusted and set to an optimum value.

A millimeter wave radar incorporating an array antenna according to an embodiment of the present disclosure is capable of detection with a radio frequency electromagnetic wave exceeding e.g. 100 GHz. As for the modulation band in those schemes which are used in radar recognition, e.g., the FMCW method, the millimeter wave radar currently achieves a wide band exceeding 4 GHz, which supports the aforementioned Ultra Wide Band (UWB). Note that the modulation band is related to the range resolution. In a conventional patch antenna, the modulation band was up to about 600 MHz, thus resulting in a range resolution of 25 cm. On the other hand, a millimeter wave radar associated with the array antenna according to the present disclosure has a range resolution of 3.75 cm, indicative of a performance which rivals the range resolution of conventional LIDAR. Whereas an optical sensor such as LIDAR is unable to detect a target in nighttime or bad weather as mentioned above, a millimeter wave radar is always capable of detection, regardless of daytime or nighttime and irrespective of weather. As a result, a millimeter wave radar associated with the array antenna according to the present disclosure is available for a variety of applications which were not possible with a millimeter wave radar incorporating any conventional patch antenna.

Figure 48:
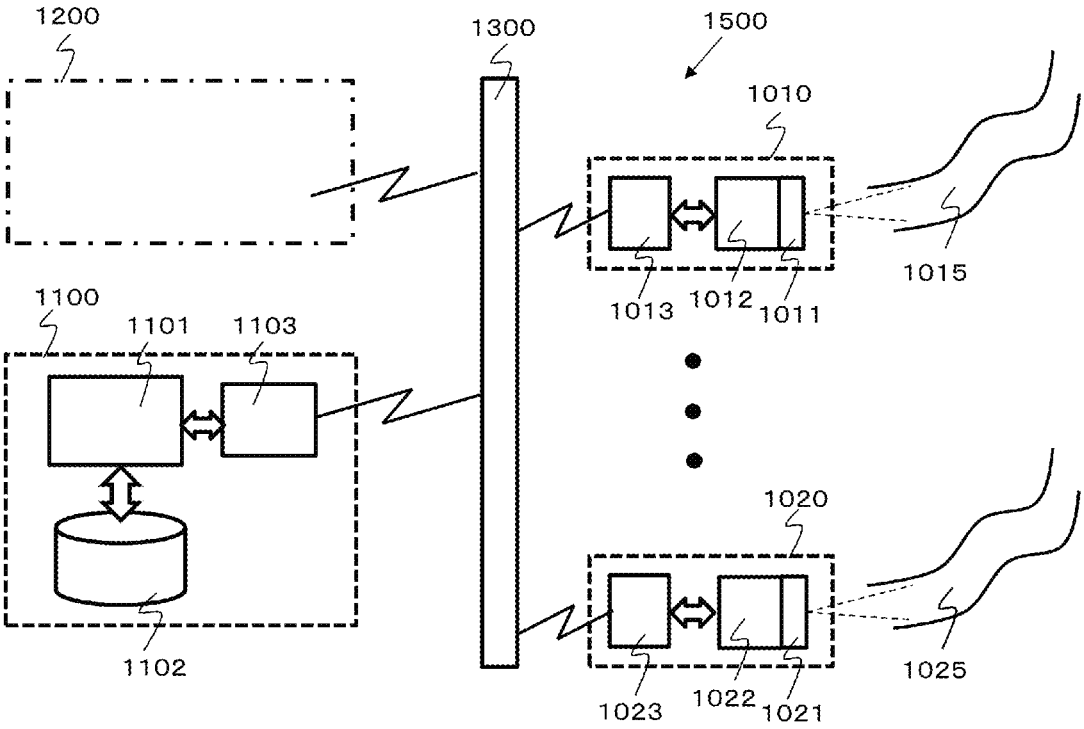
FIG. 48 is a diagram showing an exemplary construction for a monitoring system 1500 based on millimeter wave radar.

FIG. 48 is a diagram showing an exemplary construction for a monitoring system 1500 based on millimeter wave radar. The monitoring system 1500 based on millimeter wave radar at least includes a sensor section 1010 and a main section 1100. The sensor section 1010 at least includes an antenna 1011 which is aimed at the subject of monitoring 1015, a millimeter wave radar detection section 1012 which detects a target based on a transmitted or received electromagnetic wave, and a communication section (communication circuit) 1013 which transmits detected radar information. The main section 1100 at least includes a communication section (communication circuit) 1103 which receives radar information, a processing section (processing circuit) 1101 which performs predetermined processing based on the received radar information, and a data storage section (storage medium) 1102 in which past radar information and other information that is needed for the predetermined processing, etc., are stored. Telecommunication lines 1300 exist between the sensor section 1010 and the main section 1100, via which transmission and reception of information and commands occur between them. As used herein, the telecommunication lines may encompass any of a general-purpose communications network such as the Internet, a mobile communications network, dedicated telecommunication lines, and so on, for example. Note that the present monitoring system 1500 may be arranged so that the sensor section 1010 and the main section 1100 are directly connected, rather than via telecommunication lines. In addition to the millimeter wave radar, the sensor section 1010 may also include an optical sensor such as a camera. This will permit target recognition through a fusion process which is based on radar information and image information from the camera or the like, thus enabling a more sophisticated detection of the subject of monitoring 1015 or the like.

Hereinafter, examples of monitoring systems embodying these applications will be specifically described.

[Natural Element Monitoring System]

A first monitoring system is a system that monitors natural elements (hereinafter referred to as a "natural element monitoring system"). With reference to FIG. 48, this natural element monitoring system will be described. Subjects of monitoring 1015 of the natural element monitoring system 1500 may be, for example, a river, the sea surface, a mountain, a volcano, the ground surface, or the like. For example, when a river is the subject of monitoring 1015, the sensor section 1010 being secured to a fixed position perpetually monitors the water surface of the river 1015. This water surface information is perpetually transmitted to a processing section 1101 in the main section 1100. Then, if the water surface reaches a certain height or above, the processing section 1101 informs a distinct system 1200 which separately exists from the monitoring system (e.g., a weather observation monitoring system), via the telecommunication lines 1300. Alternatively, the processing section 1101 may send information to a system (not shown) which manages the water gate, whereby the system if instructed to automatically close a water gate, etc. (not shown) which is provided at the river 1015.

The natural element monitoring system 1500 is able to monitor a plurality of sensor sections 1010, 1020, etc., with the single main section 1100. When the plurality of sensor sections are distributed over a certain area, the water levels of rivers in that area can be grasped simultaneously. This allows to make an assessment as to how the rainfall in this area may affect the water levels of the rivers, possibly leading to disasters such as floods. Information concerning this can be conveyed to the distinct system 1200 (e.g., a weather observation monitoring system) via the telecommunication lines 1300. Thus, the distinct system 1200 (e.g., a weather observation monitoring system) is able to utilize the conveyed information for weather observation or disaster prediction in a wider area.

The natural element monitoring system 1500 is also similarly applicable to any natural element other than a river. For example, the subject of monitoring of a monitoring system that monitors tsunamis or storm surges is the sea surface level. It is also possible to automatically open or close the water gate of a seawall in response to a rise in the sea surface level. Alternatively, the subject of monitoring of a monitoring system that monitors landslides to be caused by rainfall, earthquakes, or the like may be the ground surface of a mountainous area, etc.

[Traffic Monitoring System]

A second monitoring system is a system that monitors traffic (hereinafter referred to as a "traffic monitoring system"). The subject of monitoring of this traffic monitoring system may be, for example, a railroad crossing, a specific railroad, an airport runway, a road intersection, a specific road, a parking lot, etc.

For example, when the subject of monitoring is a railroad crossing, the sensor section 1010 is placed at a position where the inside of the crossing can be monitored. In this case, in addition to the millimeter wave radar, the sensor section 1010 may also include an optical sensor such as a camera, which will allow a target (subject of monitoring) to be detected from more perspectives, through a fusion process based on radar information and image information. The target information which is obtained with the sensor section 1010 is sent to the main section 1100 via the telecommunication lines 1300. The main section 1100 collects other information (e.g., train schedule information) that may be needed in a more sophisticated recognition process or control, and issues necessary control instructions or the like based thereon. As used herein, a necessary control instruction may be, for example, an instruction to stop a train when a person, a vehicle, etc. is found inside the crossing when it is closed.

If the subject of monitoring is a runway at an airport, for example, a plurality of sensor sections 1010, 1020, etc., may be placed along the runway so as to set the runway to a predetermined resolution, e.g., a resolution that allows any foreign object that is 5 cm by 5 cm or larger to be detected. The monitoring system 1500 perpetually monitors the runway, regardless of daytime or nighttime and irrespective of weather. This function is enabled by the very ability of the millimeter wave radar according to an embodiment of the present disclosure to support UWB. Moreover, since the present millimeter wave radar device can be embodied with a small size, a high resolution, and a low cost, it provides a realistic solution for covering the entire runway surface from end to end. In this case, the main section 1100 keeps the plurality of sensor sections 1010, 1020, etc., under integrated management. If a foreign object is found on the runway, the main section 1100 transmits information concerning the position and size of the foreign object to an air-traffic control system (not shown). Upon receiving this, the air-traffic control system temporarily prohibits takeoff and landing on that runway. In the meantime, the main section 1100 transmits information concerning the position and size of the foreign object to a separately-provided vehicle, which automatically cleans the runway surface, etc., for example. Upon receive this, the cleaning vehicle may autonomously move to the position where the foreign object exists, and automatically remove the foreign object. Once removal of the foreign object is completed, the cleaning vehicle transmits information of the completion to the main section 1100. Then, the main section 1100 again confirms that the sensor section 1010 or the like which has detected the foreign object now reports that "no foreign object exists" and that it is safe now, and informs the air-traffic control system of this. Upon receiving this, the air-traffic control system may lift the prohibition of takeoff and landing from the runway.

Furthermore, in the case where the subject of monitoring is a parking lot, for example, it may be possible to automatically recognize which position in the parking lot is currently vacant. A related technique is described in the specification of U.S. Pat. No. 6,943,726, the entire disclosure of which is incorporated herein by reference.

[Security Monitoring System]

A third monitoring system is a system that monitors a trespasser into a piece of private land or a house (hereinafter referred to as a "security monitoring system"). The subject of monitoring of this security monitoring system may be, for example, a specific region within a piece of private land or a house, etc.

For example, if the subject of monitoring is a piece of private land, the sensor section(s) 1010 may be placed at one position, or two or more positions where the sensor section(s) 1010 is able to monitor it. In this case, in addition to the millimeter wave radar, the sensor section(s) 1010 may also include an optical sensor such as a camera, which will allow a target (subject of monitoring) to be detected from more perspectives, through a fusion process based on radar information and image information. The target information which was obtained by the sensor section 1010(s) is sent to the main section 1100 via the telecommunication lines 1300. The main section 1100 collects other information (e.g., reference data or the like needed to accurately recognize whether the trespasser is a person or an animal such as a dog or a bird) that may be needed in a more sophisticated recognition process or control, and issues necessary control instructions or the like based thereon. As used herein, a necessary control instruction may be, for example, an instruction to sound an alarm or activate lighting that is installed in the premises, and also an instruction to directly report to a person in charge of the premises via mobile telecommunication lines or the like, etc. The processing section 1101 in the main section 1100 may allow an internalized, sophisticated apparatus of recognition (that adopts deep learning or a like technique) to recognize the detected target. Alternatively, such a sophisticated apparatus of recognition may be provided externally, in which case the sophisticated apparatus of recognition may be connected via the telecommunication lines 1300.

A related technique is described in the specification of U.S. Pat. No. 7,425,983, the entire disclosure of which is incorporated herein by reference.

Another embodiment of such a security monitoring system may be a human monitoring system to be installed at a boarding gate at an airport, a station wicket, an entrance of a building, or the like. The subject of monitoring of such a human monitoring system may be, for example, a boarding gate at an airport, a station wicket, an entrance of a building, or the like.

If the subject of monitoring is a boarding gate at an airport, the sensor section(s) 1010 may be installed in a machine for checking personal belongings at the boarding gate, for example. In this case, there may be two checking methods as follows. In a first method, the millimeter wave radar transmits an electromagnetic wave, and receives the electromagnetic wave as it reflects off a passenger (which is the subject of monitoring), thereby checking personal belongings or the like of the passenger. In a second method, a weak millimeter wave which is radiated from the passenger's own body is received by the antenna, thus checking for any foreign object that the passenger may be hiding. In the latter method, the millimeter wave radar preferably has a function of scanning the received millimeter wave. This scanning function may be implemented by using digital beam forming, or through a mechanical scanning operation. Note that the processing by the main section 1100 may utilize a communication process and a recognition process similar to those in the above-described examples.

[Building Inspection System (Non-Destructive Inspection)]

A fourth monitoring system is a system that monitors or checks the concrete material of a road, a railroad overpass, a building, etc., or the interior of a road or the ground, etc., (hereinafter referred to as a "building inspection system"). The subject of monitoring of this building inspection system may be, for example, the interior of the concrete material of an overpass or a building, etc., or the interior of a road or the ground, etc.

For example, if the subject of monitoring is the interior of a concrete building, the sensor section 1010 is structured so that the antenna 1011 can make scan motions along the surface of a concrete building. As used herein, "scan motions" may be implemented manually, or a stationary rail for the scan motion may be separately provided, upon which to cause the movement by using driving power from an electric motor or the like. In the case where the subject of monitoring is a road or the ground, the antenna 1011 may be installed face-down on a vehicle or the like, and the vehicle may be allowed to travel at a constant velocity, thus creating a "scan motion". The electromagnetic wave to be used by the sensor section 1010 may be a millimeter wave in e.g. the so-called terahertz region, exceeding 100 GHz. As described earlier, even with an electromagnetic wave over e.g. 100 GHz, an array antenna according to an embodiment of the present disclosure can be adapted to have smaller losses than do conventional patch antennas or the like. An electromagnetic wave of a higher frequency is able to permeate deeper into the subject of checking, such as concrete, thereby realizing a more accurate non-destructive inspection. Note that the processing by the main section 1100 may also utilize a communication process and a recognition process similar to those in the other monitoring systems described above.

A related technique is described in the specification of U.S. Pat. No. 6,661,367, the entire disclosure of which is incorporated herein by reference.

[Human Monitoring System]

A fifth monitoring system is a system that watches over a person who is subject to nursing care (hereinafter referred to as a "human watch system"). The subject of monitoring of this human watch system may be, for example, a person under nursing care or a patient in a hospital, etc.

For example, if the subject of monitoring is a person under nursing care within a room of a nursing care facility, the sensor section(s) 1010 is placed at one position, or two or more positions inside the room where the sensor section(s) 1010 is able to monitor the entirety of the inside of the room. In this case, in addition to the millimeter wave radar, the sensor section 1010 may also include an optical sensor such as a camera. In this case, the subject of monitoring can be monitored from more perspectives, through a fusion process based on radar information and image information. On the other hand, when the subject of monitoring is a person, from the standpoint of privacy protection, monitoring with a camera or the like may not be appropriate. Therefore, sensor selections must be made while taking this aspect into consideration. Note that target detection by the millimeter wave radar will allow a person, who is the subject of monitoring, to be captured not by his or her image, but by a signal (which is, as it were, a shadow of the person). Therefore, the millimeter wave radar may be considered as a desirable sensor from the standpoint of privacy protection.

Information of the person under nursing care which has been obtained by the sensor section(s) 1010 is sent to the main section 1100 via the telecommunication lines 1300. The main section 1100 collects other information (e.g., reference data or the like needed to accurately recognize target information of the person under nursing care) that may be needed in a more sophisticated recognition process or control, and issues necessary control instructions or the like based thereon. As used herein, a necessary control instruction may be, for example, an instruction to directly report a person in charge based on the result of detection, etc. The processing section 1101 in the main section 1100 may allow an internalized, sophisticated apparatus of recognition (that adopts deep learning or a like technique) to recognize the detected target. Alternatively, such a sophisticated apparatus of recognition may be provided externally, in which case the sophisticated apparatus of recognition may be connected via the telecommunication lines 1300.

In the case where a person is the subject of monitoring of the millimeter wave radar, at least the two following functions may be added.

A first function is a function of monitoring the heart rate and/or the respiratory rate. In the case of a millimeter wave radar, an electromagnetic wave is able to see through the clothes to detect the position and motions of the skin surface of a person's body. First, the processing section 1101 detects a person who is the subject of monitoring and an outer shape thereof. Next, in the case of detecting a heart rate, for example, a position on the body surface where the heartbeat motions are easy to detect may be identified, and the motions there may be chronologically detected. This allows a heart rate per minute to be detected, for example. The same is also true when detecting a respiratory rate. By using this function, the health status of a person under nursing care can be perpetually checked, thus enabling a higher-quality watch over a person under nursing care.

A second function is a function of fall detection. A person under nursing care such as an elderly person may fall from time to time, due to weakened legs and feet. When a person falls, the velocity or acceleration of a specification site of the person's body, e.g., the head, will reach a certain level or greater. When the subject of monitoring of the millimeter wave radar is a person, the relative velocity or acceleration of the target of interest can be perpetually detected. Therefore, by identifying the head as the subject of monitoring, for example, and chronologically detecting its relative velocity or acceleration, a fall can be recognized when a velocity of a certain value or greater is detected. When recognizing a fall, the processing section 1101 can issue an instruction or the like corresponding to pertinent nursing care assistance, for example.

Note that the sensor section(s) 1010 is secured to a fixed position(s) in the above-described monitoring system or the like. However, the sensor section(s) 1010 can also be installed on a moving entity, e.g., a robot, a vehicle, a flying object such as a drone. As used herein, the vehicle or the like may encompass not only an automobile, but also a smaller sized moving entity such as an electric wheelchair, for example. In this case, this moving entity may include an internal GPS unit which allows its own current position to be always confirmed. In addition, this moving entity may also have a function of further improving the accuracy of its own current position by using map information and the map update information which has been described with respect to the aforementioned fifth processing apparatus.

Furthermore, in any device or system that is similar to the above-described first to third detection devices, first to sixth processing apparatuses, first to fifth monitoring systems, etc., a like construction may be adopted to utilize an array antenna or a millimeter wave radar according to an embodiment of the present disclosure.

Application Example 3: Communication System

[First Example of Communication System]

The waveguide device and antenna device (array antenna) according to the present disclosure can be used for the transmitter and/or receiver with which a communication system (telecommunication system) is constructed. The waveguide device and antenna device according to the present disclosure are composed of layered conductive members, and therefore are able to keep the transmitter and/or receiver size smaller than in the case of using a hollow waveguide. Moreover, there is no need for dielectric, and thus the dielectric loss of electromagnetic waves can be kept smaller than in the case of using a microstrip line. Therefore, a communication system including a small and highly efficient transmitter and/or receiver can be constructed.

Such a communication system may be an analog type communication system which transmits or receives an analog signal that is directly modulated. However, a digital communication system may be adopted in order to construct a more flexible and higher-performance communication system.

Hereinafter, with reference to FIG. 49, a digital communication system 800A in which a waveguide device and an antenna device according to an embodiment of the present disclosure are used will be described.

Figure 49:
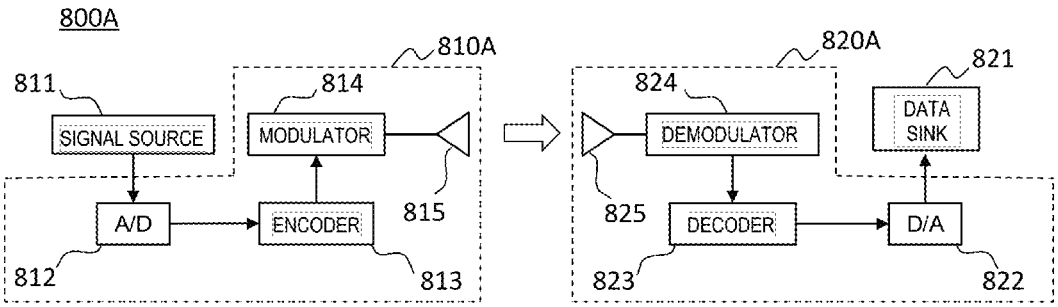
FIG. 49 is a block diagram showing a construction for a digital communication system 800A.

FIG. 49 is a block diagram showing a construction for the digital communication system 800A. The communication system 800A includes a transmitter 810A and a receiver 820A. The transmitter 810A includes an analog to digital (A/D) converter 812, an encoder 813, a modulator 814, and a transmission antenna 815. The receiver 820A includes a reception antenna 825, a demodulator 824, a decoder 823, and a digital to analog (D/A) converter 822. The at least one of the transmission antenna 815 and the reception antenna 825 may be implemented by using an array antenna according to an embodiment of the present disclosure. In this exemplary application, the circuitry including the modulator 814, the encoder 813, the A/D converter 812, and so on, which are connected to the transmission antenna 815, is referred to as the transmission circuit. The circuitry including the demodulator 824, the decoder 823, the D/A converter 822, and so on, which are connected to the reception antenna 825, is referred to as the reception circuit. The transmission circuit and the reception circuit may be collectively referred to as the communication circuit.

With the analog to digital (A/D) converter 812, the transmitter 810A converts an analog signal which is received from the signal source 811 to a digital signal. Next, the digital signal is encoded by the encoder 813. As used herein, "encoding" means altering the digital signal to be transmitted into a format which is suitable for communication. Examples of such encoding include CDM (Code-Division Multiplexing) and the like. Moreover, any conversion for effecting TDM (Time-Division Multiplexing) or FDM (Frequency Division Multiplexing), or OFDM (Orthogonal Frequency Division Multiplexing) is also an example of encoding. The encoded signal is converted by the modulator 814 into a radio frequency signal, so as to be transmitted from the transmission antenna 815.

In the field of communications, a wave representing a signal to be superposed on a carrier wave may be referred to as a "signal wave"; however, the term "signal wave" as used in the present specification does not carry that definition. A "signal wave" as referred to in the present specification is broadly meant to be any electromagnetic wave to propagate in a waveguide, or any electromagnetic wave for transmission/reception via an antenna element.

The receiver 820A restores the radio frequency signal that has been received by the reception antenna 825 to a low-frequency signal at the demodulator 824, and to a digital signal at the decoder 823. The decoded digital signal is restored to an analog signal by the digital to analog (D/A) converter 822, and is sent to a data sink (data receiver) 821. Through the above processes, a sequence of transmission and reception processes is completed.

When the communicating agent is a digital appliance such as a computer, analog to digital conversion of the transmission signal and digital to analog conversion of the reception signal are not needed in the aforementioned processes. Thus, the analog to digital converter 812 and the digital to analog converter 822 in FIG. 49 may be omitted. A system of such construction is also encompassed within a digital communication system.

In a digital communication system, in order to ensure signal intensity or expand channel capacity, various methods may be adopted. Many such methods are also effective in a communication system which utilizes radio waves of the millimeter wave band or the terahertz band.

Radio waves in the millimeter wave band or the terahertz band have higher straightness than do radio waves of lower frequencies, and undergoes less diffraction, i.e., bending around into the shadow side of an obstacle. Therefore, it is not uncommon for a receiver to fail to directly receive a radio wave that has been transmitted from a transmitter. Even in such situations, reflected waves may often be received, but a reflected wave of a radio wave signal is often poorer in quality than is the direct wave, thus making stable reception more difficult. Furthermore, a plurality of reflected waves may arrive through different paths. In that case, the reception waves with different path lengths might differ in phase from one another, thus causing multi-path fading.

As a technique for improving such situations, a so-called antenna diversity technique may be used. In this technique, at least one of the transmitter and the receiver includes a plurality of antennas. If the plurality of antennas are parted by distances which differ from one another by at least about the wavelength, the resulting states of the reception waves will be different. Accordingly, the antenna that is capable of transmission/reception with the highest quality among all is selectively used, thereby enhancing the reliability of communication. Alternatively, signals which are obtained from more than one antenna may be merged for an improved signal quality.

In the communication system 800A shown in FIG. 49, for example, the receiver 820A may include a plurality of reception antennas 825. In this case, a switcher exists between the plurality of reception antennas 825 and the demodulator 824. Through the switcher, the receiver 820A connects the antenna that provides the highest-quality signal among the plurality of reception antennas 825 to the demodulator 824. In this case, the transmitter 810A may also include a plurality of transmission antennas 815.

[Second Example of Communication System]

Figure 50:
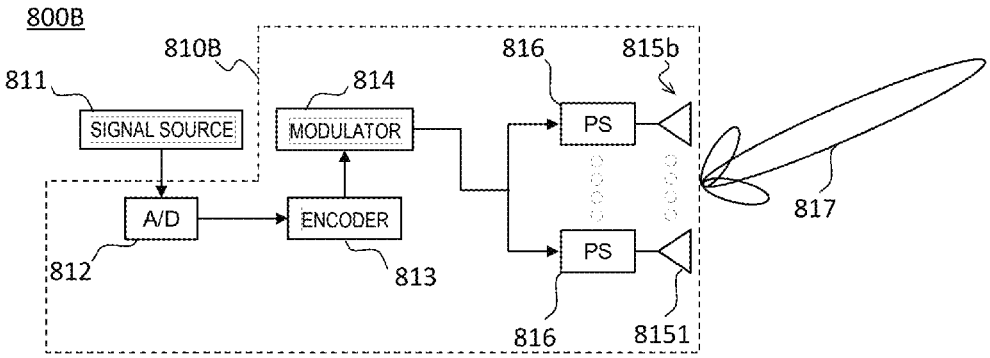
FIG. 50 is a block diagram showing an exemplary communication system 800B including a transmitter 810B which is capable of changing its radio wave radiation pattern.

FIG. 50 is a block diagram showing an example of a communication system 800B including a transmitter 810B which is capable of varying the radiation pattern of radio waves. In this exemplary application, the receiver is identical to the receiver 820A shown in FIG. 49; for this reason, the receiver is omitted from illustration in FIG. 50. In addition to the construction of the transmitter 810A, the transmitter 810B also includes an antenna array 815*b*, which includes a plurality of antenna elements 8151. The antenna array 815*b* may be an array antenna according to an embodiment of the present disclosure. The transmitter 810B further includes a plurality of phase shifters (PS) 816 which are respectively connected between the modulator 814 and the plurality of antenna elements 8151. In the transmitter 810B, an output of the modulator 814 is sent to the plurality of phase shifters 816, where phase differences are imparted and the resultant signals are led to the plurality of antenna elements 8151. In the case where the plurality of antenna elements 8151 are disposed at equal intervals, if a radio frequency signal whose phase differs by a certain amount with respect to an adjacent antenna element is fed to each antenna element 8151, a main lobe 817 of the antenna array 815*b* will be oriented in an azimuth which is inclined from the front, this inclination being in accordance with the phase difference. This method may be referred to as beam forming.

The azimuth of the main lobe 817 may be altered by allowing the respective phase shifters 816 to impart varying phase differences. This method may be referred to as beam steering. By finding phase differences that are conducive to the best transmission/reception state, the reliability of communication can be enhanced. Although the example here illustrates a case where the phase difference to be imparted by the phase shifters 816 is constant between any adjacent antenna elements 8151, this is not limiting. Moreover, phase differences may be imparted so that the radio wave will be radiated in an azimuth which allows not only the direct wave but also reflected waves to reach the receiver.

A method called null steering can also be used in the transmitter 810B. This is a method where phase differences are adjusted to create a state where the radio wave is radiated in no specific direction. By performing null steering, it becomes possible to restrain radio waves from being radiated toward any other receiver to which transmission of the radio wave is not intended. This can avoid interference. Although a very broad frequency band is available to digital communication utilizing millimeter waves or terahertz waves, it is nonetheless preferable to make as efficient a use of the bandwidth as possible. By using null steering, plural instances of transmission/reception can be performed within the same band, whereby efficiency of utility of the bandwidth can be enhanced. A method which enhances the efficiency of utility of the bandwidth by using techniques such as beam forming, beam steering, and null steering may sometimes be referred to as SDMA (Spatial Division Multiple Access).

[Third Example of Communication System]

In order to increase the channel capacity in a specific frequency band, a method called MIMO (Multiple-Input and Multiple-Output) may be adopted. Under MIMO, a plurality of transmission antennas and a plurality of reception antennas are used. A radio wave is radiated from each of the plurality of transmission antennas. In one example, respectively different signals may be superposed on the radio waves to be radiated. Each of the plurality of reception antennas receives all of the transmitted plurality of radio waves. However, since different reception antennas will receive radio waves that arrive through different paths, differences will occur among the phases of the received radio waves. By utilizing these differences, it is possible to, at the receiver side, separate the plurality of signals which were contained in the plurality of radio waves.

The waveguide device and antenna device according to the present disclosure can also be used in a communication system which utilizes MIMO. Hereinafter, an example such a communication system will be described.

Figure 51:
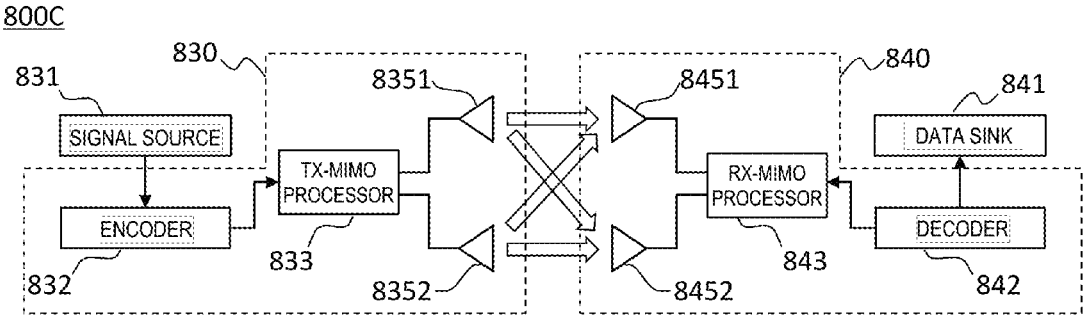
FIG. 51 is a block diagram showing an exemplary communication system 800C implementing a MIMO function.

FIG. 51 is a block diagram showing an example of a communication system 800C implementing a MIMO function. In the communication system 800C, a transmitter 830 includes an encoder 832, a TX-MIMO processor 833, and two transmission antennas 8351 and 8352. A receiver 840 includes two reception antennas 8451 and 8452, an RX-MIMO processor 843, and a decoder 842. Note that the number of transmission antennas and the number of reception antennas may each be greater than two. Herein, for ease of explanation, an example where there are two antennas of each kind will be illustrated. In general, the channel capacity of an MIMO communication system will increase in proportion to the number of whichever is the fewer between the transmission antennas and the reception antennas.

Having received a signal from the data signal source 831, the transmitter 830 encodes the signal at the encoder 832 so that the signal is ready for transmission. The encoded signal is distributed by the TX-MIMO processor 833 between the two transmission antennas 8351 and 8352.

In a processing method according to one example of the MIMO method, the TX-MIMO processor 833 splits a sequence of encoded signals into two, i.e., as many as there are transmission antennas 8352, and sends them in parallel to the transmission antennas 8351 and 8352. The transmission antennas 8351 and 8352 respectively radiate radio waves containing information of the split signal sequences. When there are N transmission antennas, the signal sequence is split into N. The radiated radio waves are simultaneously received by the two reception antennas 8451 and 8452. In other words, in the radio waves which are received by each of the reception antennas 8451 and 8452, the two signals which were split at the time of transmission are mixedly contained. Separation between these mixed signals is achieved by the RX-MIMO processor 843.

The two mixed signals can be separated by paying attention to the phase differences between the radio waves, for example. A phase difference between two radio waves of the case where the radio waves which have arrived from the transmission antenna 8351 are received by the reception antennas 8451 and 8452 is different from a phase difference between two radio waves of the case where the radio waves which have arrived from the transmission antenna 8352 are received by the reception antennas 8451 and 8452. That is, the phase difference between reception antennas differs depending on the path of transmission/reception. Moreover, unless the spatial relationship between a transmission antenna and a reception antenna is changed, the phase difference therebetween remains unchanged. Therefore, based on correlation between reception signals received by the two reception antennas, as shifted by a phase difference which is determined by the path of transmission/reception, it is possible to extract any signal that is received through that path of transmission/reception. The RX-MIMO processor 843 may separate the two signal sequences from the reception signal e.g. by this method, thus restoring the signal sequence before the split. The restored signal sequence still remains encoded, and therefore is sent to the decoder 842 so as to be restored to the original signal there. The restored signal is sent to the data sink 841.

Although the MIMO communication system 800C in this example transmits or receives a digital signal, an MIMO communication system which transmits or receives an analog signal can also be realized. In that case, in addition to the construction of FIG. 51, an analog to digital converter and a digital to analog converter as have been described with reference to FIG. 49 are provided. Note that the information to be used in distinguishing between signals from different transmission antennas is not limited to phase difference information. Generally speaking, for a different combination of a transmission antenna and a reception antenna, the received radio wave may differ not only in terms of phase, but also in scatter, fading, and other conditions. These are collectively referred to as CSI (Channel State Information). CSI may be utilized in distinguishing between different paths of transmission/reception in a system utilizing MIMO.

Note that it is not an essential requirement that the plurality of transmission antennas radiate transmission waves containing respectively independent signals. So long as separation is possible at the reception antenna side, each transmission antenna may radiate a radio wave containing a plurality of signals. Moreover, beam forming may be performed at the transmission antenna side, while a transmission wave containing a single signal, as a synthetic wave of the radio waves from the respective transmission antennas, may be formed at the reception antenna. In this case, too, each transmission antenna is adapted so as to radiate a radio wave containing a plurality of signals.

In this third example, too, as in the first and second examples, various methods such as CDM, FDM, TDM, and OFDM may be used as a method of signal encoding.

In a communication system, a circuit board that implements an integrated circuit (referred to as a signal processing circuit or a communication circuit) for processing signals may be stacked as a layer on the waveguide device and antenna device according to an embodiment of the present disclosure. Since the waveguide device and antenna device according to an embodiment of the present disclosure is structured so that plate-like conductive members are layered therein, it is easy to further stack a circuit board thereupon. By adopting such an arrangement, a transmitter and a receiver which are smaller in volume than in the case where a hollow waveguide or the like is employed can be realized.

In the first to third examples of the communication system as described above, each element of a transmitter or a receiver, e.g., an analog to digital converter, a digital to analog converter, an encoder, a decoder, a modulator, a demodulator, a TX-MIMO processor, or an RX-MIMO processor, is illustrated as one independent element in FIGS. 49, 50, and 51; however, these do not need to be discrete. For example, all of these elements may be realized by a single integrated circuit. Alternatively, some of these elements may be combined so as to be realized by a single integrated circuit. Either case qualifies as an embodiment of the present invention so long as the functions which have been described in the present disclosure are realized thereby.

As described above, the present disclosure encompasses slot array antennas, radar devices, radar systems, and wireless communication systems as recited in the following Items.

[Item 1] A slot array antenna comprising:

an electrically conductive member having an electrically conductive surface and a plurality of slots therein, the plurality of slots being arrayed in a first direction which extends along the electrically conductive surface;

a waveguide member having an electrically conductive waveguide face which opposes the plurality of slots and extends along the first direction; and an artificial magnetic conductor extending on both sides of the waveguide member, wherein, at least one of the electrically conductive member and the waveguide member includes a plurality of dents on the electrically conductive surface and/or the waveguide face, the plurality of dents each serving to broaden a spacing between the electrically conductive surface and the waveguide face relative to any adjacent site;

the plurality of dents include a first dent, a second dent, and a third dent which are adjacent to one another and consecutively follow along the first direction; and a distance between centers of the first dent and the second dent is different from a distance between centers of the second dent and the third dent.

[Item 2] The slot array antenna of item 1, wherein the first to third dents are on the electrically conductive surface of the electrically conductive member.

[Item 3] The slot array antenna of item 1, wherein the first to third dents are on the waveguide face of the waveguide member.

[Item 4] The slot array antenna of any of items 1 to 3, wherein, the plurality of slots include a first slot and a second slot which are adjacent to each other; and as viewed from a normal direction of the electrically conductive surface, at least two of the first to third dents are located between the first and second slots.

[Item 5] The slot array antenna of item 4, wherein, as viewed from the normal direction of the electrically conductive surface, the first and second dents are located between the first and second slots; and the third dent is located outside of the first and second slots.

[Item 6] The slot array antenna of item 4 or 5, wherein, as viewed from the normal direction of the electrically conductive surface, a midpoint between the first and second slots is located between the first and second dents.

[Item 7] The slot array antenna of any of items 1 to 6, further comprising another electrically conductive member having another electrically conductive surface opposing the electrically conductive surface of the electrically conductive member, wherein the waveguide member is a ridge on the other electrically conductive member.

[Item 8] The slot array antenna of any of items 1 to 7, wherein, the slot array antenna is used for at least one of transmission and reception of an electromagnetic wave of a band having a central wavelength $\lambda o$ in free space; and at least one of a distance between centers of the first dent and the second dent and a distance between centers of the second dent and the third dent is greater than $1.15\lambda o/8$.

[Item 9] A slot array antenna comprising:

an electrically conductive member having an electrically conductive surface and a plurality of slots therein, the plurality of slots being arrayed in a first direction which extends along the electrically conductive surface;

a waveguide member having an electrically conductive waveguide face which opposes the plurality of slots and extends along the first direction; and an artificial magnetic conductor extending on both sides of the waveguide member, wherein, at least one of the electrically conductive member and the waveguide member includes a plurality of bumps on the electrically conductive surface and/or the waveguide face, the plurality of bumps each serving to narrow a spacing between the electrically conductive surface and the waveguide face relative to any adjacent site;

the plurality of bumps include a first bump, a second bump, and a third bump which are adjacent to one another and consecutively follow along the first direction; and a distance between centers of the first bump and the second bump is different from a distance between centers of the second bump and the third bump.

[Item 10] The slot array antenna of item 9, wherein the first to third bumps are on the electrically conductive surface of the electrically conductive member.

[Item 11] The slot array antenna of item 9, wherein the first to third bumps are on the waveguide face of the waveguide member.

[Item 12] The slot array antenna of any of items 9 to 11, wherein, the plurality of slots include a first slot and a second slot which are adjacent to each other; and as viewed from a normal direction of the electrically conductive surface, at least two of the first to third bumps are located between the first and second slots.

[Item 13] The slot array antenna of item 12, wherein, as viewed from the normal direction of the electrically conductive surface, the first and second bumps are located between the first and second slots; and the third bump is located outside of the first and second slots.

[Item 14] The slot array antenna of item 4, 12 or 13, wherein, as viewed from the normal direction of the electrically conductive surface, a midpoint between the first and second slots is located between the first and second bumps.

[Item 15] The slot array antenna of any of items 9 to 14, further comprising another electrically conductive member having another electrically conductive surface opposing the electrically conductive surface of the electrically conductive member, wherein the waveguide member is a ridge on the other electrically conductive member.

[Item 16] The slot array antenna of any of items 9 to 15, wherein, the slot array antenna is used for at least one of transmission and reception of an electromagnetic wave of a band having a central wavelength $\lambda o$ in free space; and at least one of a distance between centers of the first bump and the second bump and a distance between centers of the second bump and the third bump is greater than $1.15\lambda o/8$.

[Item 17] A slot array antenna comprising:

an electrically conductive member having an electrically conductive surface and a plurality of slots therein, the plurality of slots being arrayed in a first direction which extends along the electrically conductive surface;

a waveguide member having an electrically conductive waveguide face which opposes the plurality of slots and extends along the first direction; and an artificial magnetic conductor extending on both sides of the waveguide member, wherein, the waveguide member includes a plurality of broad portions on the waveguide face, the plurality of broad portions each serving to broaden width of the waveguide face relative to any adjacent site;

the plurality of broad portions include a first broad portion, a second broad portion, and a third broad portion which are adjacent to one another and consecutively follow along the first direction; and a distance between centers of the first broad portion and the second broad portion is different from a distance between centers of the second broad portion and the third broad portion.

[Item 18] The slot array antenna of item 17, wherein the first to third broad portions are on the electrically conductive surface of the electrically conductive member.

[Item 19] The slot array antenna of item 17, wherein the first to third broad portions are on the waveguide face of the waveguide member.

[Item 20] The slot array antenna of any of items 17 to 19, wherein, the plurality of slots include a first slot and a second slot which are adjacent to each other; and as viewed from a normal direction of the electrically conductive surface, at least two of the first to third broad portions are located between the first and second slots.

[Item 21] The slot array antenna of item 20, wherein, as viewed from the normal direction of the electrically conductive surface, the first and second broad portions are located between the first and second slots; and the third broad portion is located outside of the first and second slots.

[Item 22] The slot array antenna of item 4, 20 or 21, wherein, as viewed from the normal direction of the electrically conductive surface, a midpoint between the first and second slots is located between the first and second broad portions.

[Item 23] The slot array antenna of any of items 17 to 22, further comprising another electrically conductive member having another electrically conductive surface opposing the electrically conductive surface of the electrically conductive member, wherein the waveguide member is a ridge on the other electrically conductive member.

[Item 24] The slot array antenna of any of items 17 to 23, wherein, the slot array antenna is used for at least one of transmission and reception of an electromagnetic wave of a band having a central wavelength $\lambda o$ in free space; and at least one of a distance between centers of the first broad portion and the second broad portion and a distance between centers of the second broad portion and the third broad portion is greater than $1.15\lambda o/8$.

[Item 25] A slot array antenna comprising:

an electrically conductive member having an electrically conductive surface and a plurality of slots therein, the plurality of slots being arrayed in a first direction which extends along the electrically conductive surface;

a waveguide member having an electrically conductive waveguide face which opposes the plurality of slots and extends along the first direction; and an artificial magnetic conductor extending on both sides of the waveguide member, wherein, the waveguide member includes a plurality of narrow portions on the waveguide face, the plurality of narrow portions each serving to narrow width of the waveguide face relative to any adjacent site;

the plurality of narrow portions include a first narrow portion, a second narrow portion, and a third narrow portion which are adjacent to one another and consecutively follow along the first direction; and a distance between centers of the first narrow portion and the second narrow portion is different from a distance between centers of the second narrow portion and the third narrow portion.

[Item 26] The slot array antenna of item 25, wherein the first to third narrow portions are on the electrically conductive surface of the electrically conductive member.

[Item 27] The slot array antenna of item 25, wherein the first to third narrow portions are on the waveguide face of the waveguide member.

[Item 28] The slot array antenna of any of items 25 to 27, wherein, the plurality of slots include a first slot and a second slot which are adjacent to each other; and as viewed from a normal direction of the electrically conductive surface, at least two of the first to third narrow portions are located between the first and second slots.

[Item 29] The slot array antenna of item 28, wherein, as viewed from the normal direction of the electrically conductive surface, the first and second narrow portions are located between the first and second slots; and the third narrow portion is located outside of the first and second slots.

[Item 30] The slot array antenna of item 4, 28 or 29, wherein, as viewed from the normal direction of the electrically conductive surface, a midpoint between the first and second slots is located between the first and second narrow portions.

[Item 31] The slot array antenna of any of items 25 to 30, further comprising another electrically conductive member having another electrically conductive surface opposing the electrically conductive surface of the electrically conductive member, wherein the waveguide member is a ridge on the other electrically conductive member.

[Item 32] The slot array antenna of any of items 25 to 31, wherein, the slot array antenna is used for at least one of transmission and reception of an electromagnetic wave of a band having a central wavelength $\lambda o$ in free space; and at least one of a distance between centers of the first narrow portion and the second narrow portion and a distance between centers of the second narrow portion and the third narrow portion is greater than $1.15\lambda o/8$.

[Item 33] A slot array antenna comprising:

an electrically conductive member having an electrically conductive surface and a plurality of slots therein, the plurality of slots being arrayed in a first direction which extends along the electrically conductive surface;

a waveguide member having an electrically conductive waveguide face which opposes the plurality of slots and extends along the first direction; and an artificial magnetic conductor extending on both sides of the waveguide member, wherein, a waveguide extending between the electrically conductive surface and the waveguide face includes a plurality of positions at which capacitance of the waveguide exhibits a local maximum or a local minimum;

the plurality of positions include a first position, a second position, and a third position which are adjacent to one another and consecutively follow along the first direction; and a distance between centers of the first position and the second position is different from a distance between centers of the second position and the third position.

[Item 34] The slot array antenna of item 33, wherein the first to third positions are on the electrically conductive surface of the electrically conductive member.

[Item 35] The slot array antenna of item 33, wherein the first to third positions are on the waveguide face of the waveguide member.

[Item 36] The slot array antenna of any of items 33 to 35, wherein, the plurality of slots include a first slot and a second slot which are adjacent to each other; and as viewed from a normal direction of the electrically conductive surface, at least two of the first to third positions are located between the first and second slots.

[Item 37] The slot array antenna of item 36, wherein, as viewed from the normal direction of the electrically conductive surface, the first and second positions are located between the first and second slots; and the third position is located outside of the first and second slots.

[Item 38] The slot array antenna of item 4, 36 or 37, wherein, as viewed from the normal direction of the electrically conductive surface, a midpoint between the first and second slots is located between the first and second positions.

[Item 39] The slot array antenna of any of items 33 to 38, further comprising another electrically conductive member having another electrically conductive surface opposing the electrically conductive surface of the electrically conductive member, wherein the waveguide member is a ridge on the other electrically conductive member.

[Item 40] The slot array antenna of any of items 33 to 39, wherein, the slot array antenna is used for at least one of transmission and reception of an electromagnetic wave of a band having a central wavelength $\lambda o$ in free space; and at least one of a distance between centers of the first position and the second position and a distance between centers of the second position and the third position is greater than $1.15\lambda o/8$.

[Item 41] A slot array antenna comprising:

an electrically conductive member having an electrically conductive surface and a plurality of slots therein, the plurality of slots being arrayed in a first direction which extends along the electrically conductive surface;

a waveguide member having an electrically conductive waveguide face which opposes the plurality of slots and extends along the first direction; and an artificial magnetic conductor extending on both sides of the waveguide member, wherein, a waveguide extending between the electrically conductive surface and the waveguide face includes a plurality of positions at which inductance of the waveguide exhibits a local maximum or a local minimum, the plurality of positions include a first position, a second position, and a third position which are adjacent to one another and consecutively follow along the first direction; and a distance between centers of the first position and the second position is different from a distance between centers of the second position and the third position.

[Item 42] The slot array antenna of item 41, wherein the first to third positions are on the electrically conductive surface of the electrically conductive member.

[Item 43] The slot array antenna of item 41, wherein the first to third positions are on the waveguide face of the waveguide member.

[Item 44] The slot array antenna of any of items 41 to 43, wherein, the plurality of slots include a first slot and a second slot which are adjacent to each other; and as viewed from a normal direction of the electrically conductive surface, at least two of the first to third positions are located between the first and second slots.

[Item 45] The slot array antenna of item 44, wherein, as viewed from the normal direction of the electrically conductive surface, the first and second positions are located between the first and second slots; and the third position is located outside of the first and second slots.

[Item 46] The slot array antenna of item 4, 44 or 45, wherein, as viewed from the normal direction of the electrically conductive surface, a midpoint between the first and second slots is located between the first and second positions.

[Item 47] The slot array antenna of any of items 41 to 46, further comprising another electrically conductive member having another electrically conductive surface opposing the electrically conductive surface of the electrically conductive member, wherein the waveguide member is a ridge on the other electrically conductive member.

[Item 48] The slot array antenna of any of items 41 to 47, wherein, the slot array antenna is used for at least one of transmission and reception of an electromagnetic wave of a band having a central wavelength $\lambda o$ in free space; and at least one of a distance between centers of the first position and the second position and a distance between centers of the second position and the third position is greater than $1.15\lambda o/8$.

[Item 49] A slot array antenna for use in at least one of transmission and reception of an electromagnetic wave of a band having a central wavelength $\lambda o$ in free space, comprising:

an electrically conductive member having an electrically conductive surface and a slot row including a plurality of slots, the plurality of slots being arrayed in a first direction which extends along the electrically conductive surface;

a waveguide member having an electrically conductive waveguide face which opposes the plurality of slots and extends along the first direction; and an artificial magnetic conductor extending on both sides of the waveguide member, wherein, a width of the waveguide face is less than $\lambda o/2$;

a waveguide extending between the electrically conductive surface and the waveguide face includes at least one minimal position at which at least one of inductance and capacitance of the waveguide exhibits a local minimum and at least one maximal position at which at least one of inductance and capacitance of the waveguide exhibits a local maximum, the at least one minimal position and the at least one maximal position being arrayed along the first direction; and the at least one minimal position includes a first type of minimal position which is adjacent to the maximal position while being more distant therefrom than $1.15\lambda o/8$.

[Item 50] The slot array antenna of item 49, wherein, the at least one maximal position comprises a plurality of maximal positions;

the at least one minimal position comprises a plurality of minimal positions; and the minimal positions further include a minimal position which is adjacent to the at least one maximal position while being less distant therefrom than $1.15\lambda o/8$.

[Item 51] The slot array antenna of item 49 or 50, wherein, at least one of the electrically conductive member and the waveguide member includes additional elements on at least one of the electrically conductive surface and the waveguide face, the additional elements changing at least one of inductance and capacitance of the waveguide extending between the electrically conductive surface and the waveguide face; and a position of each additional element along the first direction overlaps at least one of the minimal positions or at least one of the maximal positions.

[Item 52] The slot array antenna of item 51, wherein, at least one of the additional elements includes a plurality of minute additional elements each having a length along the first direction which is less than $1.15\lambda o/8$;

the plurality of minute additional elements are arrayed so as to be adjacent along the first direction;

at least one of the minimal positions and the maximal positions has adjacent ones of the plurality of minute additional elements arrayed therein; and a distance between centers of adjacent ones of the plurality of minute additional elements is less than $1.15\lambda o/8$.

[Item 53] The slot array antenna of item 51, wherein, each additional element comprises one of a dent, a bump, a broad portion, and a narrow portion.

[Item 54] The slot array antenna of any of items 51 or 53, wherein, each additional element is a dent or a bump on the waveguide face; and the waveguide face includes a flat portion between two adjacent dents or between two adjacent bumps, the flat portion having a length which is greater than $1.15\lambda o/4$.

[Item 55] A slot array antenna for use in at least one of transmission and reception of an electromagnetic wave of a band having a central wavelength $\lambda o$ in free space, comprising:

an electrically conductive member having an electrically conductive surface and a slot row including a plurality of slots, the plurality of slots being arrayed in a first direction which extends along the electrically conductive surface;

a waveguide member having an electrically conductive waveguide face which opposes the plurality of slots and extends along the first direction; and an artificial magnetic conductor extending on both sides of the waveguide member, wherein, a width of the waveguide face is less than $\lambda o/2$;

at least one of the electrically conductive member and the waveguide member includes a plurality of additional elements on at least one of the electrically conductive surface and the waveguide face;

the plurality of additional elements include at least one first type of additional element and/or at least one second type of additional element;

the at least one first type of additional element is a bump being provided on either the electrically conductive surface or the waveguide face and serving to narrow a spacing between the electrically conductive surface and the waveguide face relative to any adjacent site, or a broad portion serving to broaden the width of the waveguide face relative to any adjacent site; and the at least one second type of additional element is a dent being provided on either the electrically conductive surface or the waveguide face and serving to broaden the spacing between the electrically conductive surface and the waveguide face relative to any adjacent site, or a narrow portion serving to narrow the width of the waveguide face relative to any adjacent site, wherein, (a) the at least one first type of additional element is adjacent along the first direction to the at least one second type of additional element or at least one neutral portion lacking the at least one additional element, and a central position of the at least one first type of additional element is more distant than 1.15λo/8 along the first direction from a central position of the at least one second type of additional element or the at least one neutral portion; or (b) the at least one second type of additional element is adjacent along the first direction to the at least one first type of additional element or at least one neutral portion lacking the at least one additional element, and a central position of the at least one first type of additional element is more distant than 1.15λo/8 along the first direction from a central position of the at least one second type of additional element or the at least one neutral portion.

[Item 56] A slot array antenna for use in at least one of transmission and reception of an electromagnetic wave of a band having a central wavelength λo in free space, comprising:

an electrically conductive member having an electrically conductive surface and a slot row including a plurality of slots, the plurality of slots being arrayed in a first direction which extends along the electrically conductive surface;

a waveguide member having an electrically conductive waveguide face which opposes the plurality of slots and extends along the first direction; and an artificial magnetic conductor extending on both sides of the waveguide member, wherein, a width of the waveguide face is less than λo/2;

at least one of the electrically conductive member and the waveguide member includes a plurality of additional elements on at least one of the electrically conductive surface and the waveguide face;

the plurality of additional elements include at least one third type of additional element and/or at least one fourth type of additional element;

the at least one third type of additional element is a bump being provided on either the electrically conductive surface or the waveguide face and serving to narrow a spacing between the electrically conductive surface and the waveguide face relative to any adjacent site, the width of the waveguide being narrowed at the bump relative to any adjacent site; and the at least one fourth type of additional element is a dent being provided on either the electrically conductive surface or the waveguide face and serving to broaden the spacing between the electrically conductive surface and the waveguide face relative to any adjacent site, the width of the waveguide being broadened at the bump relative to any adjacent site, wherein, (c) the at least one third type of additional element is adjacent along the first direction to the at least one fourth type of additional element or at least one neutral portion lacking the at least one additional element, and a central position of the at least one third type of additional element is more distant than 1.15λo/8 along the first direction from a central position of the at least one fourth type of additional element or the at least one neutral portion; or (d) the at least one fourth type of additional element is adjacent along the first direction to the at least one third type of additional element or at least one neutral portion lacking the at least one additional element, and a central position of the at least one fourth type of additional element is more distant than 1.15λo/8 along the first direction from a central position of the at least one third type of additional element or the at least one neutral portion.

[Item 57] The slot array antenna of item 55 or 56, wherein the plurality of additional elements further include an additional element which is adjacent to another additional element while being less distant therefrom than 1.15λo/8.

[Item 58] The slot array antenna of any of item 51 to 57, wherein the plurality of additional elements include additional elements which are symmetrically distributed with respect to a midpoint position between two adjacent slots among the plurality of slots, or to a position on the waveguide face opposing the midpoint position.

[Item 59] A slot array antenna comprising:

an electrically conductive member having an electrically conductive surface and a plurality of slots therein, the plurality of slots being arrayed in a first direction which extends along the electrically conductive surface;

a waveguide member having an electrically conductive waveguide face which opposes the plurality of slots and extends along the first direction; and an artificial magnetic conductor extending on both sides of the waveguide member, wherein, at least one of a spacing between the electrically conductive surface and the waveguide face and a width of the waveguide face fluctuates along the first direction with a period which is equal to or greater than ½ of a distance between centers of two adjacent slots among the plurality of slots.

[Item 60] A slot array antenna for use in at least one of transmission and reception of an electromagnetic wave of a band having a central wavelength λo in free space, the slot array antenna comprising:

an electrically conductive member having an electrically conductive surface and a plurality of slots therein, the plurality of slots being arrayed in a first direction which extends along the electrically conductive surface;

a waveguide member having an electrically conductive waveguide face which opposes the plurality of slots and extends along the first direction; and an artificial magnetic conductor extending on both sides of the waveguide member, wherein, a width of the waveguide face is less than λo; and at least one of a spacing between the electrically conductive surface and the waveguide face and the width of the waveguide face fluctuates along the first direction with a period which is longer than 1.15λo/4.

[Item 61] A slot array antenna for use in at least one of transmission and reception of an electromagnetic wave of a band having a central wavelength λo in free space, the slot array antenna comprising:

an electrically conductive member having an electrically conductive surface and a plurality of slots therein, the plurality of slots being arrayed in a first direction which extends along the electrically conductive surface;

a waveguide member having an electrically conductive waveguide face which opposes the plurality of slots and extends along the first direction; and an artificial magnetic conductor extending on both sides of the waveguide member, wherein, a width of the waveguide face is less than λo;

at least one of the electrically conductive member and the waveguide member includes a plurality of additional elements on the waveguide face or the electrically conductive surface, the plurality of additional elements changing at least one of a spacing between the electrically conductive surface and the waveguide face and the width of the waveguide face relative to any adjacent site; and at least one of the spacing between the electrically conductive surface and the waveguide face and the width of the waveguide face fluctuates along the first directions with a period which is longer than λR/4, where λR is a wavelength of an electromagnetic wave of the wavelength λo when propagating in a waveguide lacking the plurality of additional elements, the waveguide extending between the electrically conductive member and the waveguide member.

[Item 62] A slot array antenna comprising:

an electrically conductive member having an electrically conductive surface and a plurality of slots therein, the plurality of slots being arrayed in a first direction which extends along the electrically conductive surface;

a waveguide member having an electrically conductive waveguide face which opposes the plurality of slots and extends along the first direction; and an artificial magnetic conductor extending on both sides of the waveguide member, wherein, at least one of capacitance and inductance of a waveguide extending between the electrically conductive surface and the waveguide face fluctuates along the first direction with a period which is equal to or greater than ½ of a distance between centers of two adjacent slots among the plurality of slots.

[Item 63] A slot array antenna comprising:

an electrically conductive member having an electrically conductive surface and a plurality of slots therein, the plurality of slots being arrayed in a first direction which extends along the electrically conductive surface;

a waveguide member having an electrically conductive waveguide face which opposes the plurality of slots and extends along the first direction; and an artificial magnetic conductor extending on both sides of the waveguide member, wherein, a spacing between the electrically conductive surface and the waveguide face fluctuates along the first direction; and a waveguide extending between the electrically conductive member and the waveguide member has at least three places with mutually varying spacing between the electrically conductive surface and the waveguide face.

[Item 64] The slot array antenna of item 63, wherein a waveguide extending between the electrically conductive member and the waveguide member has at least three places with mutually varying spacing between the electrically conductive surface and the waveguide face between two adjacent slots among the plurality of slots.

[Item 65] A slot array antenna comprising:

an electrically conductive member having an electrically conductive surface and a plurality of slots therein, the plurality of slots being arrayed in a first direction which extends along the electrically conductive surface;

a waveguide member having an electrically conductive waveguide face which opposes the plurality of slots and extends along the first direction; and an artificial magnetic conductor extending on both sides of the waveguide member, wherein, a width of the waveguide face fluctuates along the first direction; and the waveguide face has at least three places with mutually varying width of the waveguide face.

[Item 66] The slot array antenna of item 65, wherein the waveguide face has at least three places with mutually varying width of the waveguide face between two adjacent slots among the plurality of slots.

[Item 67] The slot array antenna of any of items 1 to 66, wherein the waveguide face includes a flat portion opposing the plurality of slots.

[Item 68] The slot array antenna of any of items 1 to 67, comprising a plurality of waveguide members, including the waveguide member, wherein, the electrically conductive member has a plurality of slot rows, including the slot row comprising the plurality of slots;

each of the plurality of slot rows includes a plurality of slots arrayed along the first direction;

the waveguide faces of the plurality of waveguide members respectively oppose the plurality of slot rows; and the plurality of slot rows and the plurality of waveguide members are arrayed along a second direction which intersects the first direction.

[Item 69] The slot array antenna of any of items 1 to 68, further comprising another electrically conductive member having another electrically conductive surface opposing the electrically conductive surface of the electrically conductive member, wherein, the artificial magnetic conductor includes a plurality of electrically conductive rods each having a leading end opposing the electrically conductive surface and a root connected to the other electrically conductive surface.

[Item 70] The slot array antenna of item 69, wherein, the slot array antenna is used for at least one of transmission and reception of an electromagnetic wave of a band having a central wavelength λo in free space; and along a direction that is perpendicular to both of the first direction and a direction from the root to the leading end of each of the plurality of electrically conductive rods, a width of the waveguide member, a width of each electrically conductive rod, a width of any space between two adjacent electrically conductive rods, and a distance from the root of each of the plurality of electrically conductive rods to the electrically conductive surface are each less than λo/2.

[Item 71] The slot array antenna of any of items 1 to 70, wherein, the slot array antenna is used for at least one of transmission and reception of an electromagnetic wave of a band having a central wavelength λo in free space; and a distance between centers of two adjacent slots among the plurality of slots is less than λo.

[Item 72] A radar device comprising:

the slot array antenna of any of items 1 to 71; and a microwave integrated circuit connected to the slot array antenna.

[Item 73] A radar system comprising:

the radar device of item 72; and a signal processing circuit connected to the microwave integrated circuit of the radar device.

[Item 74] A wireless communication system comprising:

the slot array antenna of any of items 1 to 71; and a communication circuit connected to the slot array antenna.

A slot array antenna according to the present disclosure is applicable to any technological field where antennas are used. For example, it is available to various applications where transmission/reception of electromagnetic waves of the gigahertz band or the terahertz band is performed. In particular, it is suitably used in onboard radar systems, various types of monitoring systems, indoor positioning systems, wireless communication systems, and the like where downsizing and gain enhancement are desired.

While the present invention has been described with respect to exemplary embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

What is claimed is:

1. A slot array antenna comprising:

an electrically conductive member having an electrically conductive surface and a plurality of slots therein, the plurality of slots being arrayed in a first direction which extends along the electrically conductive surface;

a waveguide member having an electrically conductive waveguide face which opposes the plurality of slots and extends along the first direction; and an artificial magnetic conductor extending on both sides of the waveguide member, wherein, at least one of the electrically conductive member and the waveguide member includes a plurality of dents on the electrically conductive surface and/or the waveguide face, the plurality of dents each serving to broaden a spacing between the electrically conductive surface and the waveguide face relative to any adjacent site;

the plurality of dents include a first dent, a second dent, and a third dent which are adjacent to one another and consecutively follow along the first direction; and a distance between centers of the first dent and the second dent is different from a distance between centers of the second dent and the third dent.

2. The slot array antenna of claim 1, wherein the first to third dents are on the electrically conductive surface of the electrically conductive member.

3. The slot array antenna of claim 1, wherein the first to third dents are on the waveguide face of the waveguide member.

4. The slot array antenna of claim 1, wherein, the plurality of slots include a first slot and a second slot which are adjacent to each other; and as viewed from a normal direction of the electrically conductive surface, at least two of the first to third dents are located between the first and second slots.

5. The slot array antenna of claim 4, wherein, as viewed from the normal direction of the electrically conductive surface, the first and second dents are located between the first and second slots; and the third dent is located outside of the first and second slots.

6. The slot array antenna of claim 4, wherein, as viewed from the normal direction of the electrically conductive surface, a midpoint between the first and second slots is located between the first and second dents.

7. The slot array antenna of claim 1, further comprising another electrically conductive member having another electrically conductive surface opposing the electrically conductive surface of the electrically conductive member, wherein the waveguide member is a ridge on the other electrically conductive member.

8. The slot array antenna of claim 1, wherein, the slot array antenna is used for at least one of transmission and reception of an electromagnetic wave of a band having a central wavelength $\lambda o$ in free space; and at least one of a distance between centers of the first dent and the second dent and a distance between centers of the second dent and the third dent is greater than $1.15\lambda o/8$.

9. A slot array antenna comprising:

an electrically conductive member having an electrically conductive surface and a plurality of slots therein, the plurality of slots being arrayed in a first direction which extends along the electrically conductive surface;

a waveguide member having an electrically conductive waveguide face which opposes the plurality of slots and extends along the first direction; and an artificial magnetic conductor extending on both sides of the waveguide member, wherein, at least one of the electrically conductive member and the waveguide member includes a plurality of bumps on the electrically conductive surface and/or the waveguide face, the plurality of bumps each serving to narrow a spacing between the electrically conductive surface and the waveguide face relative to any adjacent site;

the plurality of bumps include a first bump, a second bump, and a third bump which are adjacent to one another and consecutively follow along the first direction; and a distance between centers of the first bump and the second bump is different from a distance between centers of the second bump and the third bump.

10. A slot array antenna comprising:

an electrically conductive member having an electrically conductive surface and a plurality of slots therein, the plurality of slots being arrayed in a first direction which extends along the electrically conductive surface;

a waveguide member having an electrically conductive waveguide face which opposes the plurality of slots and extends along the first direction; and an artificial magnetic conductor extending on both sides of the waveguide member, wherein, the waveguide member includes a plurality of broad portions on the waveguide face, the plurality of broad portions each serving to broaden width of the waveguide face relative to any adjacent site;

the plurality of broad portions include a first broad portion, a second broad portion, and a third broad portion which are adjacent to one another and consecutively follow along the first direction; and a distance between centers of the first broad portion and the second broad portion is different from a distance between centers of the second broad portion and the third broad portion.

11. A slot array antenna comprising:

an electrically conductive member having an electrically conductive surface and a plurality of slots therein, the plurality of slots being arrayed in a first direction which extends along the electrically conductive surface;

a waveguide member having an electrically conductive waveguide face which opposes the plurality of slots and extends along the first direction; and an artificial magnetic conductor extending on both sides of the waveguide member, wherein, the waveguide member includes a plurality of narrow portions on the waveguide face, the plurality of narrow portions each serving to narrow width of the waveguide face relative to any adjacent site;

the plurality of narrow portions include a first narrow portion, a second narrow portion, and a third narrow portion which are adjacent to one another and consecutively follow along the first direction; and a distance between centers of the first narrow portion and the second narrow portion is different from a distance between centers of the second narrow portion and the third narrow portion.

12. A slot array antenna comprising:

an electrically conductive member having an electrically conductive surface and a plurality of slots therein, the plurality of slots being arrayed in a first direction which extends along the electrically conductive surface;

a waveguide member having an electrically conductive waveguide face which opposes the plurality of slots and extends along the first direction; and an artificial magnetic conductor extending on both sides of the waveguide member, wherein, a waveguide extending between the electrically conductive surface and the waveguide face includes a plurality of positions at which capacitance of the waveguide exhibits a local maximum or a local minimum;

the plurality of positions include a first position, a second position, and a third position which are adjacent to one another and consecutively follow along the first direction; and a distance between centers of the first position and the second position is different from a distance between centers of the second position and the third position.

13. A slot array antenna comprising:

an electrically conductive member having an electrically conductive surface and a plurality of slots therein, the plurality of slots being arrayed in a first direction which extends along the electrically conductive surface;

a waveguide member having an electrically conductive waveguide face which opposes the plurality of slots and extends along the first direction; and an artificial magnetic conductor extending on both sides of the waveguide member, wherein, a waveguide extending between the electrically conductive surface and the waveguide face includes a plurality of positions at which inductance of the waveguide exhibits a local maximum or a local minimum, the plurality of positions include a first position, a second position, and a third position which are adjacent to one another and consecutively follow along the first direction; and a distance between centers of the first position and the second position is different from a distance between centers of the second position and the third position.

14. The slot array antenna of claim 1, wherein the waveguide face includes a flat portion opposing the plurality of slots.

15. The slot array antenna of claim 1, comprising a plurality of waveguide members, including the waveguide member, wherein, the electrically conductive member has a plurality of slot rows, including the slot row comprising the plurality of slots;

each of the plurality of slot rows includes a plurality of slots arrayed along the first direction;

the waveguide faces of the plurality of waveguide members respectively oppose the plurality of slot rows; and the plurality of slot rows and the plurality of waveguide members are arrayed along a second direction which intersects the first direction.

16. The slot array antenna of claim 1, further comprising another electrically conductive member having another electrically conductive surface opposing the electrically conductive surface of the electrically conductive member, wherein, the artificial magnetic conductor includes a plurality of electrically conductive rods each having a leading end opposing the electrically conductive surface and a root connected to the other electrically conductive surface.

17. The slot array antenna of claim 16, wherein, the slot array antenna is used for at least one of transmission and reception of an electromagnetic wave of a band having a central wavelength $\lambda o$ in free space; and along a direction that is perpendicular to both of the first direction and a direction from the root to the leading end of each of the plurality of electrically conductive rods, a width of the waveguide member, a width of each electrically conductive rod, a width of any space between two adjacent electrically conductive rods, and a distance from the root of each of the plurality of electrically conductive rods to the electrically conductive surface are each less than $\lambda o/2$.

18. The slot array antenna of claim 1, wherein, the slot array antenna is used for at least one of transmission and reception of an electromagnetic wave of a band having a central wavelength $\lambda o$ in free space; and a distance between centers of two adjacent slots among the plurality of slots is less than $\lambda o$.

19. A radar device comprising:

the slot array antenna of claim 1; and a microwave integrated circuit connected to the slot array antenna.

* * * * *